US007764906B2

(12) United States Patent
Niimi

(10) Patent No.: US 7,764,906 B2
(45) Date of Patent: Jul. 27, 2010

(54) IMAGE FORMING APPARATUS AND IMAGE FORMING METHOD

(75) Inventor: Tatsuya Niimi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 573 days.

(21) Appl. No.: 11/474,258

(22) Filed: Jun. 26, 2006

(65) Prior Publication Data

US 2006/0292480 A1 Dec. 28, 2006

(30) Foreign Application Priority Data

Jun. 24, 2005 (JP) ..... 2005-184380
Jun. 28, 2005 (JP) ..... 2005-188047
Jul. 26, 2005 (JP) ..... 2005-215640

(51) Int. Cl.
*G03G 15/00* (2006.01)

(52) U.S. Cl. ..... 399/159; 430/58.65; 430/58.75; 430/58.8; 430/58.5; 430/59.5; 430/58.7; 430/66

(58) Field of Classification Search ..... 399/159; 430/58.65, 58.75, 58.8, 58.5, 59.2, 59.5, 430/66, 58.7
See application file for complete search history.

(56) References Cited

U.S. PATENT DOCUMENTS 5,576,131 A * 11/1996 Takai et al. ..... 430/59.2
5,871,876 A 2/1999 Ikuno et al.
6,558,863 B2 5/2003 Rokutanzono et al.
2002/0028400 A1* 3/2002 Shimada et al. ..... 430/58.05
2003/0186144 A1* 10/2003 Kunieda et al. ..... 430/58.8
2004/0033428 A1 2/2004 Niimi
2004/0053149 A1 3/2004 Toda et al.
2004/0234875 A1 11/2004 Toda et al.
2004/0253527 A1* 12/2004 Suzuki et al. ..... 430/66

(Continued)

FOREIGN PATENT DOCUMENTS

JP 60-88981 5/1985

(Continued)

OTHER PUBLICATIONS

Owen, David. Copies in Seconds. New York: Simon and Schuster Paperbacks. (2004) pp. 166-175.*

(Continued)

*Primary Examiner*—Christopher RoDee
(74) *Attorney, Agent, or Firm*—Oblon, Spivak, McClelland, Maier & Neustadt, L.L.P.

(57) ABSTRACT

An image forming apparatus, including an electrostatic latent image bearer bearing an electrostatic latent image; an electrostatic latent image former forming the electrostatic latent image on a surface of the latent image bearer; an image developer developing the electrostatic latent image with a developer including a toner to form a toner image on the surface of the image bearer; a transferer transferring the toner image onto a receiving material; a fixer fixing the toner image to the receiving material; and a discharger discharging charges remaining on the image bearer by irradiating the image bearer with discharging light having a wavelength of less than 500 nm, wherein the latent image bearer includes a substrate; and a photosensitive layer overlying the substrate, including a charge generation layer containing an organic charge generation material, and a charge transport layer containing at least one of charge transport materials having the formulae (I) to (IV).

18 Claims, 10 Drawing Sheets

$S_0$ : GROUND STATE
$S_1$ : LOWEST SINGLET EXCITED STATE
$S^*$ : SINGLET EXCITED STATE

U.S. PATENT DOCUMENTS

| | | | | |
|---|---|---|---|---|
| 2005/0069797 | A1* | 3/2005 | Niimi et al. | 430/78 |
| 2005/0111880 | A1* | 5/2005 | Fujii et al. | 399/159 |
| 2005/0175911 | A1 | 8/2005 | Tamoto et al. | |
| 2006/0008719 | A1 | 1/2006 | Niimi | |
| 2006/0057479 | A1 | 3/2006 | Niimi et al. | |

FOREIGN PATENT DOCUMENTS

| | | |
|---|---|---|
| JP | 61-036784 | 2/1986 |
| JP | 62-038491 | 2/1987 |
| JP | 62-087981 | 4/1987 |
| JP | 01-217490 | 8/1989 |
| JP | 01-274186 | 11/1989 |
| JP | 04-174489 | 6/1992 |
| JP | 07-199759 | 8/1995 |
| JP | 2002-287382 | 10/2002 |
| JP | 2004-045996 | 2/2004 |
| JP | 2004-045997 | 2/2004 |
| JP | 2005-031110 | 2/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 164-168.*

"Half-width", IUPAC Compendium of Chemical Technology, 2nd edition. (1997).*

U.S. Appl. No. 11/749,292, filed May 16, 2007, Inaba, et al.

U.S. Appl. No. 11/855,553, filed Sep. 14, 2007, Inaba, et al.

U.S. Appl. No.09/566,958, filed May 8, 2000, Niimi, et al.

U.S. Appl. No.11/364,325, filed Mar. 1, 2006, Niimi.

* cited by examiner $S_0$ : GROUND STATE
$S_1$ : LOWEST SINGLET EXCITED STATE
$S^*$ : SINGLET EXCITED STATE

IMAGE FORMING APPARATUS AND IMAGE FORMING METHOD

BACKGROUND OF THE INVENTION

1. Field of the Invention

The present invention relates to an image forming apparatus and an image forming method, and more particularly to an electrophotographic image forming apparatus and an electrophotographic image forming method using a photoreceptor having a photosensitive layer including a charge generation layer and a charge transport layer as an electrostatic latent image bearer (hereinafter referred to as an "electrophotographic photoreceptor" and a "photoconductive insulator" as well).

2. Discussion of the Background

Recently, development of information processing systems utilizing electrophotography is remarkable. In particular, optical printers in which information converted to digital signals is recorded using light have been dramatically improved in print qualities and reliability. This digital recording technique is applied not only to printers but also to copiers, and so-called digital copiers have been developed and used. Copiers utilizing both the conventional analogue recording technique and this digital recording technique have various information processing functions, and therefore it is expected that demand for such copiers will be escalating. In addition, with popularization and improvement of personal computers, the performance of digital color printers which can produce documents including color images has been rapidly improved.

Conventionally analogue image forming methods have been used for electrophotographic image formation. Analogue image forming methods typically use a posi-posi developing method. However, currently digital image forming methods are typically used and almost all of these image forming apparatuses use a nega-posi developing method. This is because almost all images to be produced by these image forming apparatuses are character images, which typically have a relatively low image area proportion of from 5 to 10%.

Conventional analogue image forming methods typically use a posi-posi developing method in which a charged photoreceptor is exposed to a light image which is prepared by irradiating an original image, and a non-lighted portion, which is an image portion and has a relatively high potential, is developed with a toner, resulting in formation of a toner image. In contrast, digital image forming methods typically use a nega-posi developing method in which a charged photoreceptor is exposed to a light image, and a lighted portion, which is an image portion and has a relatively low potential, is reversely developed with a toner, resulting in formation of a toner image. The image forming methods using a nega-posi developing method have an advantage in that the output time of a light source (such as laser diodes) of a light irradiating device can be dramatically reduced (to about one-tenth).

In the nega-posi developing method, a non-image portion (i.e., a non-lighted portion) of a photoreceptor has a high potential even after a developing process. Therefore, the photoreceptor is subjected to a discharge process after the transfer process. Specific examples of the discharging methods include optical discharging methods in which light irradiates the photoreceptor to cancel the residual charge by the photocarriers generated by light irradiation; mechanical discharging methods in which an electroconductive member such as brushes is contacted with the photoreceptor to leak the residual charge; electrical discharging methods in which a reverse bias is applied to the photoreceptor to cancel the residual charge; etc.

Recently, electrophotographic image forming apparatuses can produce high definition images and color images. Therefore, information (i.e., original images) input to such image forming apparatuses to be produced is slightly changed from character images to photograph images, color pictures and graphs, etc. When such images are produced, a problem in that the resultant images have a ghost image of a previously formed image occurs unless the charge remaining on the photoreceptor is discharged. A ghost image is typically formed as follows. When a residual charge is insufficiently discharged, the photoreceptor has an uneven potential after being charged. When light irradiates such a photoreceptor to form an image (particularly a half tone image), the resultant electrostatic latent image has an uneven potential. When such a latent image is developed, a ghost image of the image formed in the last image forming operation is formed in the resultant toner image.

There are two causes for formation of a ghost image. One of the causes is that since image formation is performed at a high speed, there is a case where the capacity of the charger used is insufficient for evenly charging a photoreceptor having a residual charge. In this case, a ghost image is caused. The other of the causes is that a charging roller is used as a charger of an image forming apparatus to miniaturize the image forming apparatus (particularly tandem type image forming apparatus). Charging rollers, which cause discharging between the surface thereof and the surface of a photoreceptor, cause a ghost image relatively easily compared with conventional charging device such as corotrons and scorotrons.

In any event it is important to maintain uniformity of the residual potential of a photoreceptor (i.e., the potential of a photoreceptor just before charging). Therefore, in order to produce high quality images, the discharging process is very important now.

Among the various discharging methods mentioned above, the methods except for the optical discharging methods have the following drawbacks. Specifically, since the discharging methods using a brush or the like contacts the member with a photoreceptor, the photoreceptor and the member are easily abraded, and thereby the lives of the photoreceptor and the member are shortened. In addition, the methods cause a problem in that when the surface of the photoreceptor or the member is contaminated with a toner or the like, the discharging effect is deteriorated. Further, the methods cannot perform discharging at a high speed, and therefore the methods are not suitable for high-speed image forming apparatuses.

The electrical discharging methods applying a reverse bias to a photoreceptor have a drawback in that when the bias is too low, even discharging cannot be performed, and when the bias is too high, the photoreceptor is reversely charged (i.e., the photoreceptor has positive charges). Since general photoreceptors can transport only positive charges, positive charges formed on the photoreceptors cannot be cancelled. When the thus positively charged photoreceptor is negatively charged in the following charging process for forming an image, the photoreceptor is charged so as to have a predetermined negative potential after the positive charges thereon are cancelled by the negative charging. Therefore, the negatively charging tends to be insufficiently performed, resulting in formation of an uneven residual potential on the photoreceptor. In addition, when positive charges are formed, traps are formed in the photosensitive layer, and thereby a residual potential is easily formed on the photoreceptor. In this case, the life of the photoreceptor is shortened.

Thus, the optical discharging methods are preferable for electrophotographic image forming methods and apparatuses at the present time. As mentioned above, images to be produced by an image forming apparatus typically have an image area proportion of 10% at the highest. Therefore, 90% or more of the surface of a photoreceptor is discharged (i.e., photo-carriers are generated in 90% or more of the photosensitive layer to discharge the residual charges) when the nega-posi developing method is used whereas 10% or less of the surface of a photoreceptor is discharged when conventional image forming methods using a posi-posi developing method are used. Therefore, the discharging process has been hardly studied until now.

Japanese Laid-Open Patent Publication No. 60-88981 or 60-88982 discloses an image forming apparatus which uses a photoreceptor including an inorganic photosensitive material (such as selenium alloys and amorphous silicon) and which uses a discharging device emitting light having a relatively short wavelength to reduce fatigue of the photoreceptor caused by the light irradiation and charging. However, the photoreceptor disclosed therein is an inorganic photoreceptor and therefore the technique cannot be applied to organic photoreceptors as it is. This is because the photo-carrier generation mechanism of inorganic photoreceptors is different from that of organic photoreceptors. In addition, the image forming apparatus uses a posi-posi developing method, and therefore the technique cannot be used for nega-posi developing methods as it is because the influence of the discharging on residual charges in nega-posi developing methods is different from that in posi-posi developing methods. Further, as a result of the present inventor's experiment, it is found that the discharging device, which emits light including a component with a wavelength of not less than 500 nm, cannot produce good discharging effects.

Japanese Laid-Open Patent Publication No. 61-36784 discloses a discharging technique in that light used for discharging a photoreceptor including a photosensitive material whose photosensitivity is improved by a dye has a wavelength which is substantially identical to the specific wavelength at which the non-sensitized photosensitive material has a photosensitivity (i.e., which is not the wavelength at which the dye has absorption). For example, when a photoreceptor using polyvinyl carbazole which has absorption in the ultraviolet region and whose sensitivity to visible light is improved by adding a dye (which has absorption in the visible region) thereto is used, a discharging device emitting light having a wavelength in the ultraviolet region is used. In this case, when discharging is performed using ultraviolet light, the photo-carrier generation efficiency is low and thereby discharging cannot be efficiently performed. In addition, the photosensitive material (i.e., polyvinyl carbazole) is easily deteriorated by the ultraviolet light. Therefore, the technique is not effective. Further, this technique is used for posi-posi developing methods, and therefore the technique cannot be effectively used for nega-posi developing methods.

Japanese Laid-Open Patent Publication No. 62-38491 discloses a discharging technique in that light having a relatively short wavelength range irradiates a photoreceptor having a photosensitivity in a relatively long wavelength region and having lower or little photosensitivity in the relative short wavelength range to prevent fatigue of the photoreceptor caused by the light irradiation. However, when the technique is used for high speed image forming apparatuses, the discharging effect is poor, resulting in formation of a ghost image. Namely, the technique cannot be applied to current image forming apparatuses. In addition, Japanese Laid-Open Patent Publication No. 62-38491 does not specify the wavelength range of the discharging light.

Japanese Laid-Open Patent Publications Nos. 01-217490 and 01-274186 disclose discharging techniques in that light with a wavelength of not greater than 620 nm irradiates a positive-chargeable photoreceptor having a layered photosensitive layer in which a charge generation layer is formed on a charge transport layer. The light used for discharging includes light with a wavelength of not less than 500 nm. As a result of the present inventor's experiment using these techniques, the residual charge decreasing effect is insufficient.

Japanese Laid-Open Patent Publication No. 04-174489 discloses a discharging technique in that two kinds of light emitting diodes irradiate a photoreceptor to prevent increase of residual potential of the photoreceptor under high temperature and high humidity conditions. The light used for discharging includes light with a wavelength of not less than 500 nm. As a result of the present inventor's experiment using this technique, the residual charge decreasing effect is insufficient.

Japanese patent No. 3460285 discloses a discharging technique of using discharging light having light intensity, which exceeds the half value of the maximum absorption peak of the photosensitive layer of the photoreceptor used, at a wavelength within the wavelength range between the lower and upper half values of the maximum absorption peak, wherein the photosensitive layer is a single-layered photosensitive layer including an organic pigment. In general, organic pigments used as photosensitive materials have absorption in the visible region, and thereby light with a wavelength of not less than 500 nm has to be used for the discharging light. As a result of the present inventor's experiment using the technique, the residual charge decreasing effect is insufficient.

Japanese Laid-Open Patent Publication No. 2002-287382 discloses a discharging technique in that discharging is performed using light to which the photoreceptor used has a higher sensitivity than that to the image writing light. It is described therein that by using this technique, the residual potential can be reduced and thereby formation of a ghost image can be prevented. In Japanese Laid-Open Patent Publication No. 2002-287382, the wavelength of the discharging light changes depending on the photosensitive material used for the photoreceptor and therefore the wavelength is not specified therein. In general, organic pigments have absorption in the visible region. Therefore there is a case where light with a wavelength not less than 500 nm is used for discharging. In this case, the residual charge decreasing effect is insufficient.

Japanese Laid-Open Patent Publication No. 2005-31110 discloses a discharging technique in that light, against which the photoreceptor used has relatively low absorption, irradiates the photoreceptor to discharge residual charge thereon, wherein the photoreceptor has a single-layered photosensitive layer in which a charge generation material is dispersed. This light irradiation is performed to remove charges generated within the photosensitive layer. Specifically, in a case of single-layered photosensitive layer, a charge generation material is uniformly dispersed in the entire photosensitive layer. Imagewise light, against which the photosensitive layer has relatively high absorption, is absorbed by the surface portion of the photosensitive layer, and therefore photo-carriers are formed in the surface portion. However, the charges formed in the inner portions of the photosensitive layer far from the surface portion remain therein while being trapped.

The thus trapped charges cannot be cancelled by the discharging. In attempting to solve the problem, light which has such a relatively long wavelength as to be able to enter into the bottom portions of the layer is used as discharging light to generate photo-carriers therein, and cancel the trapped charges with the photo-carriers. However, in general the photosensitive layer of a photoreceptor having a layered photosensitive layer is relatively thin compared to single-layered photosensitive layers. In addition, the image writing light is absorbed by the layered photosensitive layers at a rate of not greater than 90% (i.e., 10% or more of the image writing light passes through the photosensitive layers. Therefore, charge generation is performed in the entire photosensitive layers unlike the single-layered photosensitive layers even when the wavelength of the image writing light is changed. Therefore, the effect described in Japanese Laid-Open Patent Publication No. 2005-31110 is not produced for photoreceptors having a layered photosensitive layer.

Japanese Laid-Open Patent Publication No. 2004-45996 discloses a discharging technique of using discharging light having a wavelength corresponding to the soret band of a phthalocyanine compound used for the photosensitive layer. It is described therein to use a fluorescent lamp as a discharging light source.

It is also described in Japanese Laid-Open Patent Publication No. 2004-45997 to use a fluorescent lamp as a discharging light source for a photoreceptor including a phthalocyanine compound as a photosensitive material.

FIG. 1 illustrates the emission spectrum of a fluorescent lamp. The spectrum includes several emission lines, and a high emission line is observed at a wavelength of from 500 to 650 nm. Since the quantities of components of the fluorescent light are proportional to the areas of the peaks, the components of the light having a wavelength of from 500 to 650 nm mainly irradiate the photoreceptor. In Japanese Laid-Open Patent Publications Nos. 2004-45996 and 2004-45997, discharging using a LED emitting red light with a wavelength of 680 nm is compared with discharging using a fluorescent lamp. Since a fluorescent lamp mainly irradiates light having a wavelength of from 500 to 650 nm, discharging using light having a wavelength of from 500 to 650 nm is compared with discharging using light with a wavelength of 680 nm. Although each light includes a component corresponding to the soret band of a phthalocyanine compound, the light quantity of the component is small. Therefore, the discharging method hardly produces a good effect.

In addition, image forming apparatuses are required to produce high quality color images and to have high durability. In order to produce high quality images in digital image forming apparatuses, one of the key points is to form a clear and small one-dot electrostatic latent image and the other of the key points is to prevent formation of abnormal images. In addition, it is important to prolong the life of the photoreceptors used for the image forming apparatuses. In order to develop the key technologies, it is important to reduce fatigue of a photoreceptor, specifically it is important to prevent increase of residual potential of lighted portions of a photoreceptor.

In order to prevent increase of residual potential of lighted portions of a photoreceptor, the materials used for the photoreceptor and the formulation of the layers of the photoreceptors have been studied. However, the fatigue of photoreceptor largely depends not only on the formulation of the layers of photoreceptors but also on the image forming conditions of image forming apparatuses. Therefore, it is the conventional way of researchers and developers that materials and formulations are studied to develop a photoreceptor suitable for the target image forming apparatus. In other words, it has not been performed to study fatigue of photoreceptors from the viewpoint of image forming conditions.

Because of these reasons, a need exists for an image forming apparatus and method which can produce high quality images while preventing increase of residual potential of the photoreceptor used for the apparatus even after long repeated use.

SUMMARY OF THE INVENTION

Accordingly, an object of the present invention is to provide an image forming apparatus and method which can produce high quality images while preventing increase of residual potential of the photoreceptor used for the apparatus even after long repeated use.

This object and other objects of the present invention, either individually or collectively, have been satisfied by the discovery of an image forming apparatus, comprising:

an electrostatic latent image bearer bearing an electrostatic latent image;

an electrostatic latent image former forming the electrostatic latent image on a surface of the electrostatic latent image bearer;

an image developer developing the electrostatic latent image with a developer including a toner to form a toner image on the surface of the image bearer;

a transferer transferring the toner image onto a receiving material;

a fixer fixing the toner image to the receiving material; and a discharger discharging charges remaining on the image bearer after the toner image is transferred by irradiating the electrostatic latent image bearer with discharging light having a wavelength of less than 500 nm, wherein the electrostatic latent image bearer comprises:

a substrate; and a photosensitive layer located overlying the substrate, including a charge generation layer containing an organic charge generation material, and a charge transport layer containing at least one of charge transport materials having the following formulae (I) to (IV):

(I)

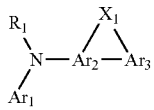

wherein each of $Ar_1$, $Ar_2$ and $Ar_3$ represents an aromatic ring group optionally having a substituent; $R_1$ represents an alkyl group optionally having a substituent, an aralkyl group optionally having a substituent, a vinyl group optionally having a substituent or an aromatic ring group optionally having a substituent; $X_1$ represents a bivalent organic group; and $Ar_1$ and $R_1$ optionally form a ring in combination, (II)

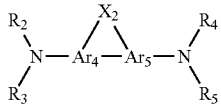

wherein each of $Ar_4$ and $Ar_5$ represents an aromatic ring group optionally having a substituent; each of $R_2$, $R_3$, $R_4$ and $R_5$ represents an alkyl group optionally having a substituent, an aralkyl group optionally having a substituent, a vinyl group optionally having a substituent or an aromatic ring group optionally having a substituent, provided that at least two of them are aromatic ring groups each optionally having a substituent; $X_2$ represents a bivalent organic group; and $R_2$ and $R_3$, and $R_4$ and $R_5$ optionally form a ring in combination, (III)

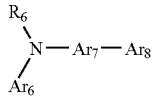

wherein each of $Ar_6$, $Ar_7$ and $Ar_8$ represents an aromatic ring group optionally having a substituent; $R_6$ represents an alkyl group optionally having a substituent, an aralkyl group optionally having a substituent, a vinyl group optionally having a substituent or an aromatic ring group optionally having a substituent; $X_1$ represents a bivalent organic group; and $Ar_6$ and $R_6$ optionally form a ring in combination, and (IV)

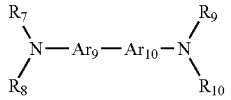

wherein each of $Ar_9$ and $Ar_{10}$ represents an aromatic ring group optionally having a substituent; each of $R_7$, $R_8$, $R_9$ and $R_{10}$ represents an alkyl group optionally having a substituent, an aralkyl group optionally having a substituent, a vinyl group optionally having a substituent or an aromatic ring group optionally having a substituent, provided that at least two of them are aromatic ring groups each optionally having a substituent; and $R_7$ and $R_8$, and $R_9$ and $R_{10}$ optionally form a ring in combination.

As another aspect of the present invention, an image forming method is provided, comprising:

forming an electrostatic latent image on the surface of an electrostatic latent image bearer;

developing the electrostatic latent image with a developer including a toner to form a toner image on the surface of the image bearer;

transferring the toner image onto a receiving material;

fixing the toner image to the receiving material; and discharging charges remaining on the image bearer after the toner image is transferred by irradiating the electrostatic latent image bearer with discharging light having a wavelength of less than 500 nm, wherein the electrostatic latent image bearer comprises:

a substrate; and a photosensitive layer located overlying the substrate, including a charge generation layer containing an organic charge generation material, and a charge transport layer containing at least one of charge transport materials having the formulae (I) to (IV).

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
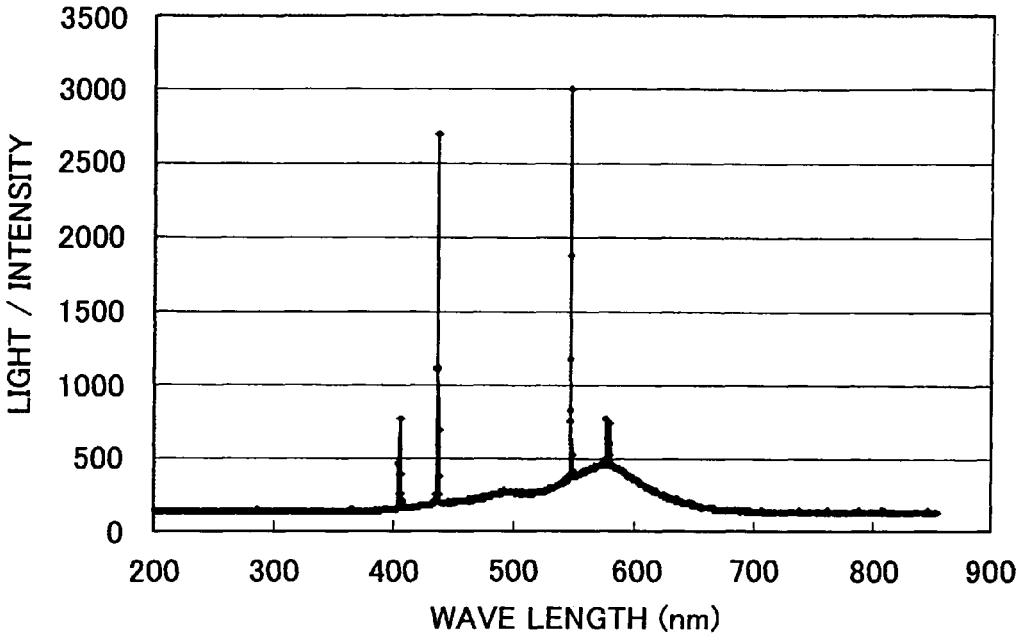
FIG. 1 illustrates the emission spectrum of a fluorescent lamp.

The present invention provides an image forming apparatus and method which can produce high quality images while preventing increase of residual potential of the photoreceptor used for the apparatus even after long repeated use.

The present inventor has studied how the electrostatic fatigue (particularly increase of residual potential) of a photoreceptor is influenced by image forming conditions of the image forming apparatus for which the photoreceptor is used. The procedure for the study is as follows.

A running test which was performed is that a photoreceptor is repeatedly subjected to a charging process, an imagewise light irradiating process and a discharging process in an image forming apparatus from which the developing device, transferring device and cleaning device are removed to avoid influence of the devices on the electrostatic fatigue of the photoreceptor. In this running test, (1) the image area proportion of the images to be produced was changed while the quantity of charges passing through the photoreceptor and the residual potential of the photoreceptor were measured, and (2) the charges of the charged photoreceptor were removed only by discharging light (without performing image writing) while the quantity of charges passing through the photoreceptor and the residual potential of the photoreceptor were measured.

As a result of the running test, the following knowledge can be obtained.

(1) The increase of residual potential of the photoreceptor depends on the quantity of charges passing through the photoreceptor. This is true even when the image area proportion of the images to be produced is changed.

(2) The quantity of charges passing through the photoreceptor depends on the quantity of light irradiating the photoreceptor (i.e., the total quantities of image writing light and discharging light, namely the quantity of light absorbed by the photoreceptor) in one image forming cycle.

(3) In a nega-posi developing method, the quantity of discharging light constitutes the majority of the total light quantity.

In addition, the procedure for the running test was repeated except that the transfer device was attached to the image forming apparatus so that a reverse bias could be applied to the photoreceptor. In this case, the conditions of the bias were adjusted so that the residual potential of the photoreceptor just before the discharging process (i.e., just after the transfer process) was substantially the same as that of the photoreceptor just after the discharge process in the above running test. As a result of this running test, it was found that the increase of residual potential of the photoreceptor can be dramatically reduced; and the increase of residual potential depends on the image area proportion of the produced images. Namely, it was found that the discharging process does not influence on the increase of residual potential in this case.

As a result of the running test, the following knowledge can be obtained.

(4) When the residual potential of a photoreceptor before a discharging process is decreased, the residual potential increasing problem can be avoided. In other words, when the potential of a photoreceptor just before a discharging process is low, the residual potential increasing problem is not caused by discharging light irradiation.

(5) Even when residual potential of a photoreceptor is decreased by applying a reverse bias, the degree of increase in residual potential of the photoreceptor is proportional to the charges passing through the photoreceptor, which is the same as the result mentioned above in paragraph (1).

It is clear from the knowledge (1) to (5) that the increase of residual potential of a photoreceptor depends on the charges passing through the photoreceptor and almost all the charges passing through the photoreceptor are generated in the discharging process. Therefore, in order to control the increase of residual potential of a photoreceptor, it is important to control the discharging process for the photoreceptor.

The quantity of charges passing through a photoreceptor are defined as the quantity of charges passing through a portion of the photoreceptor having a unit area in one image forming cycle, and changes depending on the quantity of photo-carriers generated. Therefore, the charge quantity changes depending on the following factors:

(A) the potential of the charged photoreceptor (i.e., the intensity of the electric field formed on the photoreceptor);

(B) the quantity of light irradiating the photoreceptor;

(C) the area of the lighted portion of the photoreceptor;

(D) the capacitance (thickness) of the photoreceptor (photosensitive layer);

(E) the photo-carrier generating efficiency of the photoreceptor; etc.

However, these conditions cannot be widely changed in image forming apparatuses. For example, when the potential of a charged photoreceptor is largely increased, the photoreceptor is easily damaged. In contrast, when the potential is largely decreased, the potential of a background area of an image (i.e., difference between the potential of a non-lighted portion of the photoreceptor and the developing bias) is decreased or the developing potential (i.e., difference between the developing bias and the potential of a lighted portion of the photoreceptor) is decreased. Therefore, high quality images cannot be stably produced because there is little margin for image forming conditions.

When the quantity of light irradiating the photoreceptor is largely decreased, images with low image density and low contrast are produced. In contrast, when the light quantity is largely increased, clear dot images cannot be produced because each dot of the dot images is widened.

The capacitance and carrier generation efficiency of a photoreceptor cannot be largely changed unless the materials constituting the photoreceptor are changed. In this regard, the main materials used for photoreceptors (such as charge generation materials and charge transport materials) for use in high speed, and highly durable and stable image forming apparatuses are limited. Therefore, it is difficult to largely change the capacitance and carrier generation efficiency of a photoreceptor.

Accordingly, the quantity of charges passing through a photoreceptor is changed mainly depending on the quantity of light irradiating the photoreceptor.

As mentioned above, one image forming cycle typically includes charging, imagewise light irradiating, developing, transferring, fixing, cleaning and discharging processes. Among these processes, only imagewise light irradiating and discharging processes are related to the light irradiation.

In general, current digital image forming apparatuses use a nega-posi developing method. This is because since the image area proportion of images to be produced is about 10% at the highest, the stress on the imagewise light irradiating device can be decreased by using the method. However, the charges remaining on a photoreceptor affect the following charging process to be performed on the photoreceptor. Therefore, residual charges have to be decreased as much as possible before the following charging process.

Since the image area proportion of images is about 10%, 90% or more of the surface of a photoreceptor has a relatively high potential just before the discharging process. By irradiating the surface of the photoreceptor with discharging light, photo-carriers are generated in the photoreceptor and thereby the residual charges can be cancelled. Namely, in one image forming cycle 90% of the charges passing through the photoreceptor are generated in the discharging process.

As mentioned above, analysis of electrostatic fatigue of a photoreceptor from the viewpoint of image forming conditions has been hardly performed.

Japanese Laid-Open Patent Publication No. 2000-105476 discloses a photoreceptor including a charge transport material having the formula (I) or (II) for use in an image forming apparatus using a short-wavelength writing light source. However, as mentioned above, the influence of the writing light source upon the electrostatic fatigue of a photoreceptor is at most 10% (5% in general) and the influence of the discharging light thereon is much larger. Japanese Laid-Open Patent Publication No. 2000-105476 does not specify the wavelength of the discharging light as the present invention to reduce the electrostatic fatigue.

When a charge transport layer absorbs a part of writing light, the photosensitivity of a photoreceptor deteriorates. When the writing light is changed to fluorescent light or phosphorescent light, a charge generation layer absorbs this light to generate a carrier. In such a case, although deterioration of the photosensitivity is rather prevented, the resultant image fatally blurs.

The discharge light mainly uniforms the surface potential of a photoreceptor to be newly charged. The discharge light can be irradiated longer than the writing light, and therefore deterioration of the photosensitivity for the discharge light is negligible. Even when fluorescent light or phosphorescent light is generated, the discharge light completes its main purpose by uniforming the surface potential of a photoreceptor.

As a result of the present inventor's investigations, it is found that the discharging process largely influences thereon. Further, the present inventor has studied the conditions of discharging light (particularly the wavelength of discharging light).

In general, light which can be absorbed by the photoreceptor (i.e., the charge generation layer) can be used as the discharging light. In order to uniformly irradiate a photoreceptor in the longitudinal direction thereof, light sources such as LED arrays and fluorescent lamps are typically used for discharging. In the past, fluorescent lamps were mainly used. However, fluorescent lamps have the following drawbacks.

(1) Since a part of the light emitted thereby is absorbed by a charge transport layer, a sufficient quantity of light cannot reach a charge generation layer, and thereby the quantity of the light has to be increased; and (2) Since a part of the light emitted thereby is absorbed by a charge transport layer, the charge transport material therein is deteriorated, resulting in deterioration of the charging properties of the photoreceptor.

In order to avoid such problems, LEDs emitting red light (with a wavelength on the order of 600 nm) have been used because such light is not absorbed by typical charge transport materials and is well absorbed by typical charge generation materials. Therefore, the above-mentioned problems specific to fluorescent lamps can be solved, and discharging can be well performed. In addition, such red LEDs have low costs.

The present inventor has a question as to whether such long wavelength light is suitable for discharging, and has studied the dependence of discharging (i.e., residual potential) on the wavelength of the light used for the discharging. Specifically, residual potentials of photoreceptors after a running test were measured by changing the wavelength of discharging light.

As a result of the experiment, it was found that the residual potential after discharging using red light is relatively high compared with that in the cases where light having a relatively short wavelength is used for discharging. In addition, it was found that when light having a wavelength of less than 500 nm is used, the residual potential is hardly increased. This experiment was performed while controlling the quantity of charges passing through the photoreceptors per a unit time in the discharging process to be constant. Therefore, the quantity of discharging light irradiating a photoreceptor is changed depending on the wavelength of the discharging light, but the quantity of light absorbed by the photoreceptor is not changed. Accordingly, it was found from the experiment that the increase of residual potential of a photoreceptor is influenced by the wavelength of discharging light.

As a result of the present inventor's study, it is found that the degree of increase in residual potential can be decreased when the discharging light has a short wavelength of less than 500 nm. It is found that when the discharging light include not only light having a wavelength of less than 500 nm and light having a wavelength of not less than 500 nm, the effect of the light having a wavelength of less than 500 nm can be reduced. Therefore, the residual potential increasing problem cannot be well solved by the discharging method described in Japanese Laid-Open Patent Publication No. 60-88981.

In the present application, light having a wavelength of less than 500 nm for use in the discharging process does not include light having a wavelength of not less than 500 nm.

The reason why increase in residual potential can be suppressed by performing discharging using light having a wavelength less than 500 nm is not yet determined but is considered as follows.

Figure 2:
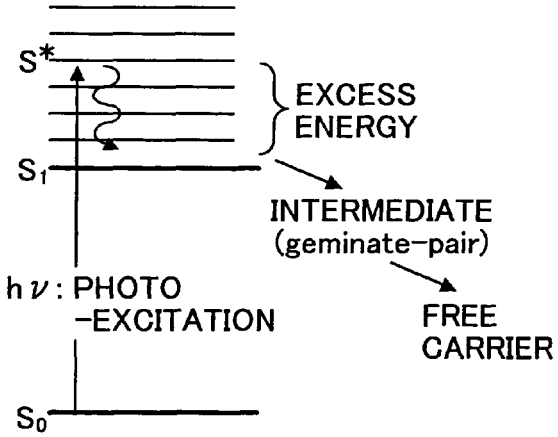
FIG. 2 is a schematic view for explaining how an organic material generates a photo-carrier.

FIG. 2 is a schematic view for explaining how photo-carriers are generated from an organic material. As illustrated in FIG. 2, an organic material (i.e., a charge generation material) typically generates photo-carriers with two steps (i.e., photo-excitation→formation of intermediate→formation of free carriers). Specifically, when a charge generation material absorbs light, the material is photo-excited from a ground state (S0) to an excited state. When the energy level of the excited state is higher than that of a lowest singlet excited state (S1), photo-carriers are generated. In other words, when light having a relatively long wavelength is used for discharging, photo-carriers are hardly generated because light having a relatively long wavelength has relatively low energy compared to light having a short wavelength.

The charge generation material excited to a singlet excited state (S*) rapidly achieves the lowest singlet excited state (S1), resulting in formation of an intermediate (geminate-pair). In this regard, the energy corresponding to the difference in energy between the singlet excited state (S*) and the lowest singlet excited state (S1) (i.e., excess energy in FIG. 2) is thermally relaxed.

Residual potential increases as follows. Specifically, the positive and negative photo-carriers thus produced are transported to the sites having opposite polarities (namely, if a negative charge type photoreceptor is used, the negative charges are formed on the surface of the photoreceptor and therefore positive holes are transported to the surface of the photoreceptor and negative electrons are transported to the substrate). In this case, the photo-carriers are often trapped in the transportation process, resulting in formation of residual charges. The trapped carriers cannot escape therefrom because the energy is greater than the activation energy at room temperature, and the charges are accumulated. However, when light having a wavelength of less than 500 nm is used, large excess energy is generated and the excess energy releases the trapped carriers from the traps. Therefore, increase of residual potential can be prevented.

Figure 3:
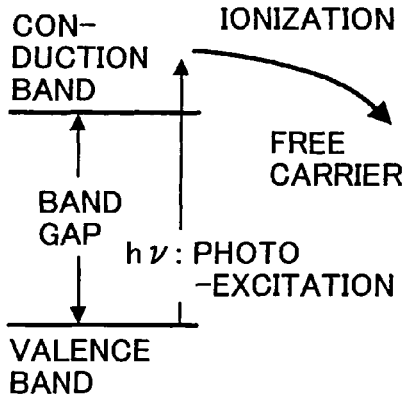
FIG. 3 is a schematic view for explaining how an inorganic material generates a photo-carrier.

FIG. 3 is a schematic view for explaining how photo-carriers are generated from an inorganic material. In general, a band model including a valence band and a conduction band applies to an inorganic material.

An electron obtaining energy which is caused by photo-excitation and which corresponds to the band gap can freely move in the valence band. In addition, in the conduction band the electron is directly ionized, and thereby free carriers are formed. Namely when an electron obtains energy greater than the band gap, the carrier generation efficiency (i.e., ion dissociation efficiency) is increased but excess energy is not generated unlike the above-mentioned organic material case. This model is supported by the fact in that the carrier generation efficiency of an inorganic photoreceptor depends on the wavelength of the exciting light.

When considering the difference in carrier generation mechanism between inorganic materials and organic materials, the effect of discharging light having a specific wavelength can be well understood.

Specifically, in the case of organic photoreceptors, the number of carriers generated is not changed when the wavelength of the discharging light is changed (i.e., there is no dependence of the quantum efficiency on the wavelength of the discharging light), but the quantity of the excess energy generated depends on the wavelength of the discharging light. Namely, as the discharging light irradiating a photoreceptor has a shorter wavelength, the quantity of the excess energy generated in the photoreceptor becomes larger.

In contrast, in the case of inorganic photoreceptors, the quantum efficiency depends on the wavelength of the discharging light. Therefore, when the discharging light has a short wavelength, the number of generated carriers increases but excess energy is not generated. Namely, the energy corresponding to the excess energy is used for increasing the carrier generation efficiency.

In the present invention, light having a wavelength of less than 500 nm is used as the discharging light. By irradiating an organic photoreceptor with discharging light having a wavelength of less than 500 nm, the excess energy can be relatively increased compared to the case where visible light is used as the discharging light. The thus generated excess energy can be used as the activation energy for releasing charges trapped in the photosensitive layer.

In contrast, since excess energy is not generated in inorganic photoreceptors, the charges trapped in the photosensitive layer cannot be released. Therefore, even when discharging is performed on an inorganic photoreceptor using light having such a wavelength as mentioned above, the effect of the present invention cannot be produced.

In the present invention, the discharging light needs to fully reach a charge generation layer of a photoreceptor. Therefore, a charge transport layer located thereon needs to fully transmit the discharging light having a wavelength of less than 500 nm. Some of the conventional charge transport materials absorb light having a wavelength of less than 500 nm. Therefore, when such materials are used, the present invention does not fully work. Even charge transport materials fully transmitting light having a wavelength of less than 500 nm cannot stabilize the electrostatic properties of a photoreceptor when not having sufficient charge transportability.

The charge transport material for use in the present invention preferably (1) transmits the discharging light having a wavelength of less than 500 nm, specifically 30% or more thereof when forming a charge transport layer, (2) has good suitability to an organic charge generation material, specifically good energy suitability to smoothly accept photo-carrier generated in the charge generation layer, (3) has stability against repeated use of a photoreceptor, specifically resistance to an oxidizing gas made by a charger and stability against energization for a long period.

From this standpoint, at least one of charge transport materials having the formulae (I) to (IV) satisfies the above-mentioned conditions.

The image forming apparatus of the present invention includes at least an electrostatic image bearer (hereinafter referred to as a photoreceptor) which includes a layered photosensitive layer including a charge generation layer (hereinafter referred to as a CGL), which includes an organic charge generation material (a charge generation material is hereinafter referred to as a CGM), and a charge transport layer (hereinafter referred to as a CTL), which is located overlying the CGL and includes at least one of charge transport materials having the formulae (I) to (IV); an electrostatic latent image former; an image developer; a transferer; a fixer; and a discharger irradiating the photoreceptor with light having a wavelength of less than 500 nm. The image forming apparatus optionally includes other means such as a cleaner, a toner recycler and a controller.

The image forming method of the present invention includes at least an electrostatic latent image forming step for forming an electrostatic latent image on such a photoreceptor as mentioned above, a developing step, a transferring step, a discharging step for irradiating the photoreceptor with light having a wavelength of less than 500 nm, and a fixing step. The image forming method optionally includes other steps such as a cleaning step, a toner recycling step and a controlling step.

The image forming method of the present invention can be well performed using the image forming apparatus of the present invention. Specifically, the electrostatic latent image forming step, developing step, transferring step, discharging step and fixing step are performed with the electrostatic latent image forming device, developing device, transferring device, discharging device and fixing device, respectively. The other optional steps can be performed with the corresponding devices mentioned above.

Electrostatic Latent Image Bearer (i.e., Photoreceptor)

The photoreceptor for use in the image forming apparatus of the present invention includes at least an organic CGM in the CGL, and at least one of charge transport materials having the formulae (I) to (IV) in the CTL. The materials, shape, structure, dimension, etc. of the photoreceptor are not particularly limited. The photoreceptor preferably includes an electroconductive substrate.

FIGS. 4-7 illustrate examples of the photoreceptor for use in the image forming apparatus of the present invention.

Figure 4:
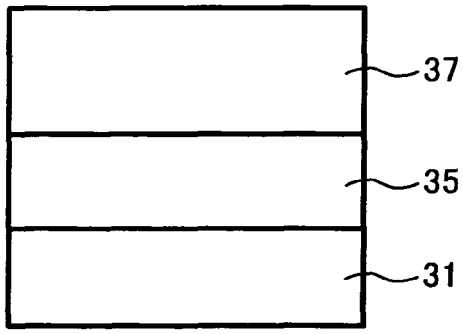
FIG. 4 is a cross-sectional view illustrating an embodiment of layer composition of the electrostatic latent image bearer of the present invention.

The photoreceptor illustrated in FIG. 4 has an electroconductive substrate 31, a CGL 35 including an organic CGM as a main component and located on the substrate, and a CTL 37 including a CTM as a main component and located on the CGL.

Figure 5:
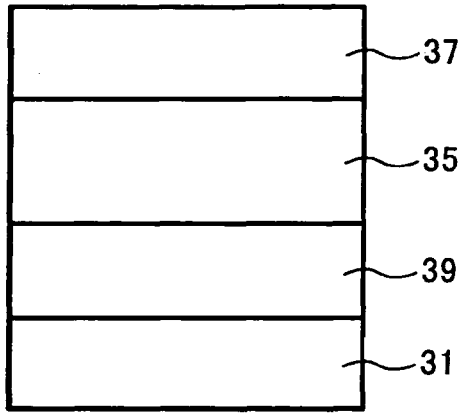
FIG. 5 is a cross-sectional view illustrating another embodiment of layer composition of the electrostatic latent image bearer of the present invention.

The photoreceptor illustrated in FIG. 5 has a structure similar to the photoreceptor illustrated in FIG. 4 except that an intermediate layer 39 is located between the substrate 31 and the CGL 35.

Figure 6:
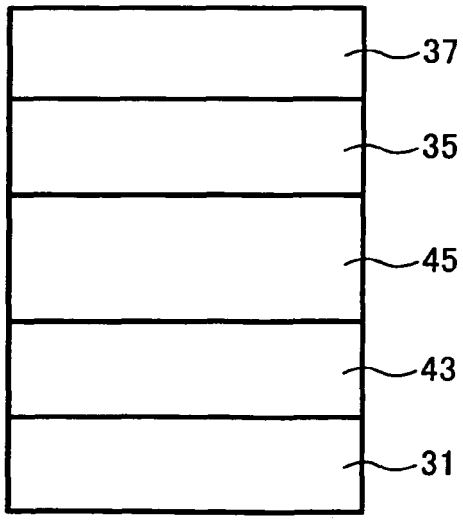
FIG. 6 is a cross-sectional view illustrating a further embodiment of layer composition of the electrostatic latent image bearer of the present invention.

The photoreceptor illustrated in FIG. 6 has a structure similar to the photoreceptor illustrated in FIG. 5 except that the intermediate layer 39 includes a charge blocking layer 43 and a moiré preventing layer 45.

Figure 7:
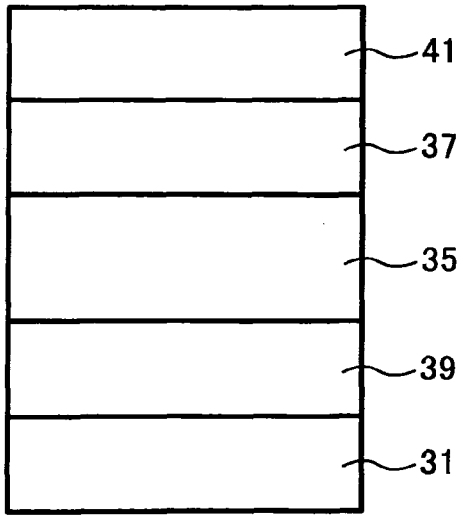
FIG. 7 is a cross-sectional view illustrating another embodiment of layer composition of the electrostatic latent image bearer of the present invention.

The photoreceptor illustrated in FIG. 7 has a structure similar to the photoreceptor illustrated in FIG. 5 except that a protective layer 41 is located on the CTL.

Suitable materials for use as the electroconductive substrate 31 include materials having a volume resistivity not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 1, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like can also be used as the substrate 31.

Furthermore, substrates, in which a coating liquid including a binder resin and an electroconductive powder is coated on the supports mentioned above, can be used as the substrate 31. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like.

Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the substrate 31.

Among these materials, cylinders made of aluminum or an aluminum alloy are preferable because aluminum can be easily anodized. Suitable aluminum materials for use as the substrate include aluminum and aluminum alloys such as JIS 1000 series, 3000 series and 6000 series. Anodic oxide films can be formed by anodizing metals or metal alloys in an electrolyte solution. Among the anodic oxide films, alumite films which can be prepared by anodizing aluminum or an aluminum alloy are preferably used for the photoreceptor of the present invention. This is because the resultant photoreceptor hardly causes undesired images such as black spots and background fouling when used for reverse development (i.e., nega-posi development).

The anodizing treatment is performed in an acidic solution including an acid such as chromic acid, sulfuric acid, oxalic acid, phosphoric acid, boric acid, and sulfamic acid. Among these acids, sulfuric acid is preferably used for the anodizing treatment in the present invention. It is preferable to perform an anodizing treatment on a substrate under the following conditions:

(1) concentration of sulfuric acid: 10 to 20%

(2) temperature of treatment liquid: 5 to 25° C.

(3) current density: 1 to 4 A/dm$^2$ (4) electrolyzation voltage: 5 to 30 V (5) treatment time: 5 to 60 minutes.

However, the treatment conditions are not limited thereto.

The thus prepared anodic oxide film is porous and highly insulative. Therefore, the surface of the substrate is very unstable, and the physical properties of the anodic oxide film change with time. In order to avoid such a problem, the anodic oxide film is preferably subjected to a sealing treatment. The sealing treatment can be performed by, for example, the following methods:

(1) the anodic oxide film is dipped in an aqueous solution of nickel fluoride or nickel acetate;

(2) the anodic oxide film is dipped in a boiling water; and (3) the anodic oxide film is subjected to steam sealing.

After the sealing treatment, the anodic oxide film is subjected to a washing treatment to remove foreign materials such as metal salts adhered to the surface of the anodic oxide film during the sealing treatment. Such foreign materials present on the surface of the substrate not only affect the coating quality of a layer formed thereon but also produce images having background fouling because of typically having a low electric resistance. The washing treatment is performed by washing the substrate having an anodic oxide film thereon with pure water one or more times. It is preferable that the washing treatment is performed until the washing water is as clean (i.e., deinonized) as possible. In addition, it is also preferable to rub the substrate with a washing member such as brushes in the washing treatment.

The thickness of the thus prepared anodic oxide film is preferably from 5 to 15 μm. When the anodic oxide film is less than 5 μm, the barrier effect thereof is not satisfactory. In contrast, when the anodic oxide film is greater than 15 μm, the time constant of the electrode (i.e., the substrate) becomes excessively large, resulting in increase of residual potential of the resultant photoreceptor and deterioration of response thereof.

The photoreceptor of the present invention can include an intermediate layer 39 between the electroconductive substrate 31 and the CGL 35. The intermediate layer 39 includes a resin as a main component. Since a CGL is formed on the intermediate layer typically by coating a liquid including an organic solvent, the resin in the intermediate layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The intermediate layer may include a fine powder of metal oxides such as titanium oxide, silica, alumina, zirconium oxide, tin oxide and indium oxide to prevent occurrence of moiré in the resultant images and to decrease residual potential of the resultant photoreceptor.

Among these metal oxides, titanium oxide is preferably included in the intermediate layer to enhance the effect of the present invention. In this regard, it is more preferable that the titanium oxide included in the intermediate layer is contacted with the CGL 35.

The intermediate layer can be formed by coating a coating liquid using a proper solvent and a proper coating method. The intermediate layer may be formed using a silane coupling agent, titanium coupling agent or a chromium coupling agent. In addition, a layer of aluminum oxide which is formed by an anodic oxidation method and a layer of an organic compound such as polyparaxylylene or an inorganic compound such as SiO, SnO2, TiO2, ITO or CeO2 which is formed by a vacuum evaporation method is also preferably used as the intermediate layer. In addition, the intermediate layer can also be formed by any known methods. The thickness of the intermediate layer is preferably 0 to 5 μm.

The intermediate layer 39 has both a function of preventing the charges, which are induced at the electroconductive substrate side of the layer in the charging process, from being injected into the photosensitive layer, and a function of preventing occurrence of moiré fringe caused by using coherent light such as laser light as image writing light. In the present invention it is preferable to use a functionally separated intermediate layer (i.e., a combination of the charge blocking layer 43 and the moiré preventing layer 45). Next, the functionally separated intermediate layer will be explained.

The function of the charge blocking layer 43 is to prevent the charges, which are induced in the electrode (i.e., the electroconductive substrate 31) and have a polarity opposite to that of the voltage applied to the photoreceptor by a charger, from being injected to the photosensitive layer. Specifically, when negative charging is performed, the charge blocking layer 43 prevents injection of positive holes to the photosensitive layer. In contrast, when positive charging is performed, the charge blocking layer 43 prevents injection of electrons to the photosensitive layer. Specific examples of the charge blocking layer include the following:

(1) a layer prepared by anodic oxidation such as aluminum oxide layer;

(2) an insulating layer of an inorganic material such as SiO;

(3) a layer made of a network of a glassy metal oxide;

(4) a layer made of polyphosphazene;

(5) a layer made of a reaction product of aminosilane;

(6) a layer made of an insulating resin; and (7) a crosslinked resin layer.

Among these layers, an insulating resin layer and a crosslinked resin layer, which can be formed by a wet coating method, are preferably used. Since the moiré preventing layer and the photosensitive layer are typically formed on the charge blocking layer by a wet coating method, the charge blocking layer preferably has good resistance to the solvents included in the coating liquids of the moiré preventing layer and the photosensitive layer.

Suitable resins for use in the charge blocking layer include thermoplastic resins such as polyamide resins, polyester resins, and vinyl chloride/vinyl acetate copolymers; and thermosetting resins which can be prepared by thermally polymerizing a compound having a plurality of active hydrogen atoms (such as hydrogen atoms of —OH, —NH2, and —NH) with a compound having a plurality of isocyanate groups and/or a compound having a plurality of epoxy groups. Specific examples of the compounds having a plurality of active hydrogen atoms include polyvinyl butyral, phenoxy resins, phenolic resins, polyamide resins, phenolic resins, polyamide resins, polyester resins, polyethylene glycol resins, polypropylene glycol resins, polybutylene glycol resins, and acrylic resins (such as hydroxyethyl methacrylate resins). Specific examples of the compounds having a plurality of isocyanate groups include tolylene diisocyanate, hexamethylene diisocyanate, diphenylmethane diisocyanate, and prepolymers of these compounds. Specific examples of the compounds having a plurality of epoxy groups include bisphenol A based epoxy resins, etc.

Among these resins, polyamide resins are preferably used in view of film formability, environmental stability and resistance to solvents.

In addition, oil-free alkyd resins; amino resins such as thermosetting amino resins prepared by thermally polymerizing a butylated melamine resin; and photo-crosslinking resins prepared by reacting an unsaturated resin, such as unsaturated polyurethane resins unsaturated polyester resins, with a photo-polymerization initiator such as thioxanthone compounds and methylbenzyl formate, can also be used.

In addition, electroconductive polymers having a rectification property, and layers including a resin or a compound having an electron accepting or donating property which is determined depending on the polarity of the charges formed on the surface of the photoreceptor can also be used.

The charge blocking layer 43 preferably has a thickness not less than 0.1 μm and less than 2.0 μm, and more preferably from 0.3 μm to 1.0 μm. When the charge blocking layer is greater than 2.0 μm, the residual potential of the photoreceptor increases after imagewise light irradiation is repeatedly performed particularly under low temperature and low humidity conditions. In contrast, the charge blocking layer is less than 0.1 μm, the charge blocking effect is hardly produced. The charge blocking layer 43 can include one or more materials such as crosslinking agents, solvents, additives and crosslinking promoters. The charge blocking layer 43 can be prepared by coating a coating liquid by a coating method such as blade coating, dip coating, spray coating, bead coating and nozzle coating, followed by drying and crosslinking using heat or light.

The function of the moiré preventing layer 45 is to prevent occurrence of moiré fringe in the resultant images due to interference of light, which is caused when coherent light (such as laser light) is used for optical writing. Namely, the moiré preventing layer scatters the light-used for optical writing. In order to carry out this function, the layer preferably includes a material having a high refractive index. The moiré preventing layer typically includes a binder resin and an inorganic pigment. Suitable inorganic pigments include white inorganic pigments. Specific examples of the white inorganic pigments include titanium oxide, calcium fluoride, calcium oxide, silica, magnesium oxide and aluminum oxide. Among these pigments, titanium oxide is preferably used because of having high hiding power.

Since the injection of charges from the substrate 31 is blocked by the charge blocking layer 43, the moiré preventing layer 45 preferably has an ability to transport charges having the same polarity as that of the charges formed on the surface of the photoreceptor, to prevent increase of residual potential. For example, in a negative charge type photoreceptor, the moiré preventing layer 45 preferably has an electron conducting ability. Therefore it is preferable to use an electroconductive inorganic pigment or a conductive inorganic pigment for the moiré preventing layer 45. Alternatively, an electroconductive material (such as acceptors) may be added to the moiré preventing layer 45.

Specific examples of the binder resin for use in the moiré preventing layer 45 include the resins mentioned above for use in the charge blocking layer 43. Since the photosensitive layer (CGL 35 and CTL 37) is formed on the moiré preventing layer 45 by coating a coating liquid, the binder resin preferably has a good resistance to the solvent included in the photosensitive layer coating liquid. Among the resins, thermosetting resins, and more preferably mixtures of alkyd and melamine resins, are preferably used as the binder resin of the moiré preventing layer 45. The mixing ratio of an alkyd resin to a melamine resin is an important factor influencing the structure and properties of the moiré preventing layer 45, and the weight ratio thereof is preferably from 5/5 to 8/2 (i.e., from 1 to 4). When the mixing ratio of an alkyd resin to a melamine resin is less than 1, the coated film is shrunk in the thermosetting process, and thereby coating defects are formed in the resultant film. In addition, the residual potential increasing problem occurs. In contrast, when the mixing ratio of an alkyd resin to a melamine resin is greater than 4, the electric resistance of the layer seriously decreases, and thereby the resultant images have background fouling, although residual potential of the photoreceptor is reduced.

The mixing ratio of the inorganic pigment to the binder resin in the moiré preventing layer 45 is also an important factor, and the volume ratio thereof is preferably from 1/1 to 3/1 (i.e., from 1 to 3). When the ratio is less than 1 (i.e., the content of the inorganic pigment is too low), not only the moiré preventing effect deteriorates but also the residual potential increases after repeated use. In contrast, when the ratio is greater than 3, the film formability of the layer deteriorates, resulting in deterioration of surface conditions of the resultant layer. In addition, a problem in that the upper layer (e.g., the photosensitive layer) cannot form a good film thereon because the coating liquid penetrates into the moiré preventing layer occurs. This problem is fatal to the photoreceptor having a layered photosensitive layer including a thin charge generation layer as a lower layer because such a thin CGL cannot be formed on such a moiré preventing layer. In addition, when the ratio is greater than 3, a problem in that the surface of the inorganic pigment cannot be covered with the binder resin. In this case, the CGM is directly contacted with the inorganic pigment and thereby the possibility of occurrence of a problem in that carriers are thermally produced increases, resulting in occurrence of the background development problem.

By using two kinds of titanium oxides having different average particle diameters for the moiré preventing layer, the substrate 31 is effectively hidden by the moiré preventing layer and thereby occurrence of moiré fringes can be well prevented and formation of pinholes in the layer can also be prevented. In this regard, the average particle diameters (D1 and D2) of the two kinds of titanium oxides preferably satisfy the following relationship:

$$0.2 < D2/D1 \leqq 0.5.$$

When the ratio D2/D1 is less than 0.2, the surface of the titanium oxide becomes more active, and thereby stability of the electrostatic properties of the resultant photoreceptor seriously deteriorates. In contrast, when the D2/D1 ratio is greater than 0.5, the electroconductive substrate 31 cannot be well hidden by the moiré preventing layer and thereby the moiré preventing effect deteriorates and abnormal images such as moiré fringes are produced. In this regard, the average particle diameter of the pigment means the average particle diameter of the pigment in a dispersion prepared by dispersing the pigment in water while applying a strong shear force thereto.

Further, the average particle diameter (D2) of the titanium oxide (T2) having a smaller average particle diameter is also an important factor, and is preferably greater than 0.05 μm and less than 0.20 μm. When D2 is less than 0.05 μm, hiding power of the layer deteriorates. Therefore, moiré fringes tend to be caused. In contrast, when D2 is greater than 0.2 μm, the filling factor of the titanium oxide in the layer is small, and thereby background development preventing effect cannot be well produced.

The mixing ratio of the two kinds of titanium oxides in the moiré preventing layer 45 is also an important factor, and is preferably determined such that the following relationship is satisfied:

$$0.2 \leqq T2/(T1+T2) \leqq 0.8,$$

wherein T1 represents the weight of the titanium oxide having a larger average particle diameter, and T2 represents the weight of the titanium oxide having a smaller average particle diameter.

When the mixing ratio (T2/T1+T2) is less than 0.2, the filling factor of the titanium oxide in the layer is small, and thereby background development preventing effect cannot be well produced. In contrast, when the mixing ratio (T2/(T1+T2) is greater than 0.8, the hiding power of the layer deteriorates, and thereby the moiré preventing effect cannot be well produced.

The moiré preventing layer preferably has a thickness of from 1 to 10 μm, and more preferably from 2 to 5 μm. When the layer is less than 1 μm, the moiré preventing effect cannot be well produced. In contrast, when the moiré preventing layer is greater than 10 μm, the residual potential increases after repeated use.

The moiré preventing layer is typically prepared as follows. An inorganic pigment is dispersed in a solvent together with a binder resin using a dispersion machine such as ball mills, sand mills, and attritors. In this case, crosslinking agents, other solvents, additives, crosslinking promoters, etc., can be added thereto if desired. The thus prepared coating liquid is coated on the charge blocking layer by a method such as blade coating, dip coating, spray coating, bead coating and nozzle coating, followed by drying and crosslinking using light or heat.

Next, the photosensitive layer will be explained. The photosensitive layer includes the CGL 35 including an organic CGM and the CTL 37 located overlying the CGL 35 and including at least at least one of charge transport materials having the formulae (I) to (IV).

The CGL 35 includes an organic CGM as a main component, and is typically prepared by coating a coating liquid, which is prepared by dispersing an organic CGM in a solvent optionally together with a binder resin using a dispersing machine such as ball mills, attritors, sand mills and supersonic dispersing machines, on an electroconductive substrate, followed by drying.

Specific examples of the binder resins, which are optionally included in the CGL coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. Among the binder resins, polyvinyl acetal represented by polyvinyl butyral is preferably used. The content of the binder resin in the CGL is preferably from 0 to 500 parts by weight, and preferably from 10 to 300 parts by weight, per 100 parts by weight of the CGM included in the layer.

Specific examples of the solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. Among these solvents, ketones, esters and ethers are preferably used. The CGL preferably has a thickness of from 0.01 to 5 μm, and more preferably from 0.1 to 2 μm.

Specific examples of the organic CGMs include phthalocyanine pigments such as metal phthalocyanine, metal-free phthalocyanine, azulenium salt pigments, squaric acid methine pigments, azo pigments having a carbazole skeleton, azo pigments having a triphenyl amine skeleton, azo pigments having a diphenyl amine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, bisbenzimidazole pigments, and the like organic pigments. These CGMs can be used alone or in combination.

Among the pigments, an asymmetric azo pigment having the following formula (V) can effectively be used:

(V)

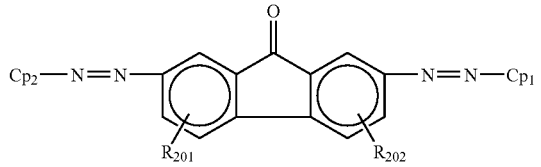

wherein $Cp_1$ and $Cp_2$ independently and differently represent a coupler residue, and $R_{201}$ and $R_{202}$ independently represent a hydrogen atom, a halogen atom, an alkyl group, an alkoxy group and a cyano group.

In addition, $Cp_1$ and $Cp_2$ have the following formula (VI):

(VI)

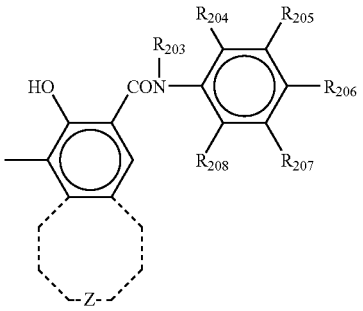

wherein $R_{203}$ represents an alkyl group such as a hydrogen atom, a methyl group and an ethyl group, and an aryl group such as a phenyl group. $R_{204}$, $R_{205}$, $R_{206}$, $R_{207}$ and $R_{208}$ independently represent a halogen atom such as a hydrogen atom, a nitro group, a cyano group, a fluorine atom, a chlorine atom and an iodine atom; an alkyl group such as a trifluoromethyl group, a methyl group and an ethyl group; an alkoxy group such as a methoxy group and an ethoxy group; dialkylamino group; and a hydroxyl group. Z represents atoms which are required to form a substituted or an unsubstituted aromatic carbon ring, or a substituted or an unsubstituted aromatic heterocycle.

Further, titanylphthalocyanine compounds having an X-ray diffraction spectrum such that a maximum peak is observed at a Bragg (2θ) angle (±0.2°) of 27.2°; or an X-ray diffraction spectrum such that a maximum peak is observed at a Bragg (2θ) angle of 27.2±0.2°, a lowest angle peak at an angle of 7.3±0.2°, and a main peak at each of Bragg (2θ) angles (±0.2°) of 9.4°, 9.6°, and 24.0°, wherein no peak is observed between the peaks of 7.3° and 9.4° and at an angle of 26.3 (±0.2°) are also preferably used.

The method for synthesizing the titanylphthalocyanine compounds and for preparing a dispersion including the compounds are described in Japanese Laid-Open Patent Publications Nos. 2001-19871, 2004-78141 and 2004-83859.

The organic CGM having an average particle diameter not greater than 0.25 μm, included in the electrophotographic photoreceptor of the present invention, is preferably removed.

In this regard, the particle diameter means the volume average particle diameter, and can be determined by a centrifugal automatic particle diameter analyzer, CAPA-700 from Horiba Ltd. The volume average particle diameter means the cumulative 50% particle diameter (i.e., Median diameter). However, by using this particle diameter determining method, there is a case where a small amount of coarse particles cannot be detected. Therefore, it is preferable to directly observe the dispersion including a CGM with an electron microscope, to determine the particle diameter of the crystal.

In addition, with respect to minute coating defects included in a layer using a dispersion, the following knowledge can be acquired. Whether coarse particles are present in the dispersion can be detected by a particle diameter measuring instrument if the concentration of coarse particles is on the order of a few percent or more. However, when the concentration is not greater than 1%, the presence of coarse particles cannot be detected by such an instrument. Therefore, even when it is confirmed that the average particle diameter of the crystal in a dispersion falls in the preferable range, a problem in that the resultant charge generation layer has minute coating defects can occur.

Figure 8:
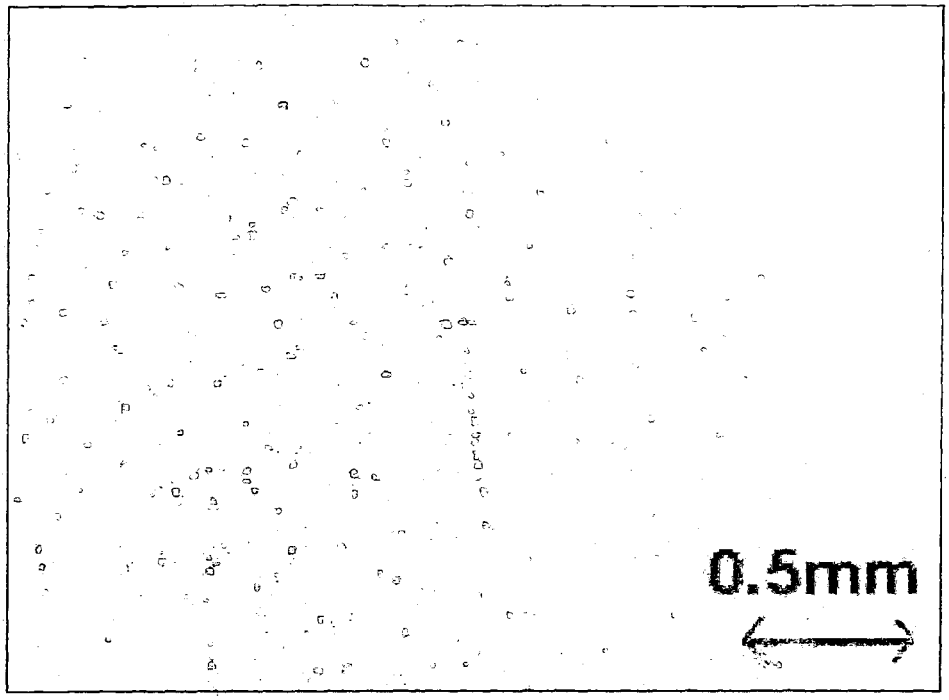
FIG. 8 is a photograph showing the dispersion status of a charge generation material in a dispersion when the dispersion time is short.
Figure 9:
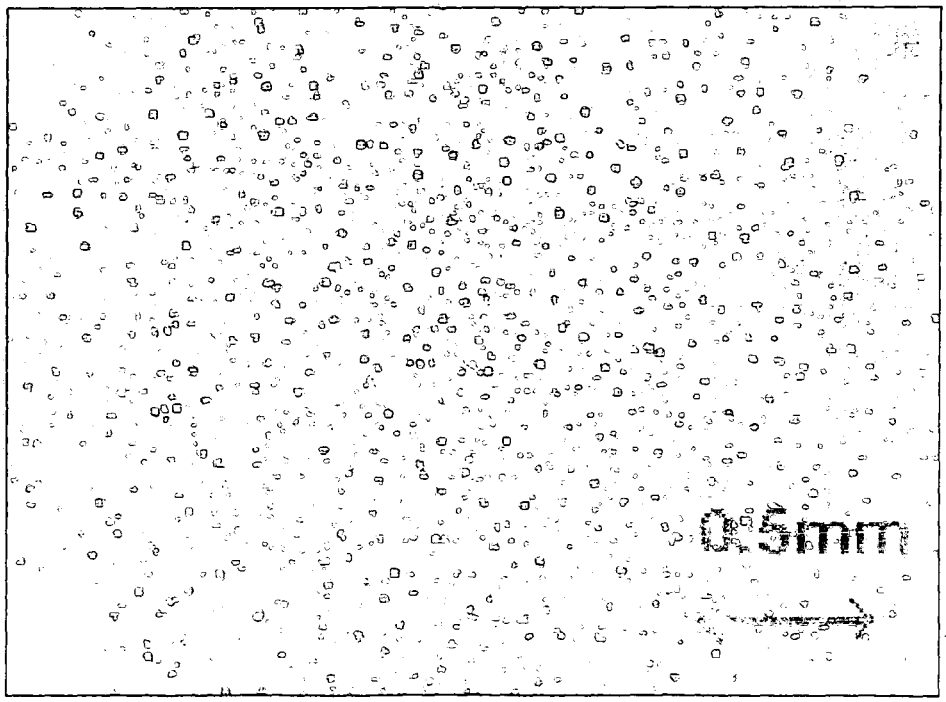
FIG. 9 is a photograph showing the dispersion status of a charge generation material in a dispersion when the dispersion time is long.

FIGS. 8 and 9 are photographs showing the dispersion status in different dispersions A and B which are prepared by the same method except that the dispersion time is changed. The dispersion time for the dispersion A is shorter than that for the dispersion B. It is clear from the comparison of FIG. 8 with FIG. 9 that coarse particles are present in the dispersion A illustrated in FIG. 8. Coarse particles are observed as black spots in FIG. 8.

Figure 10:
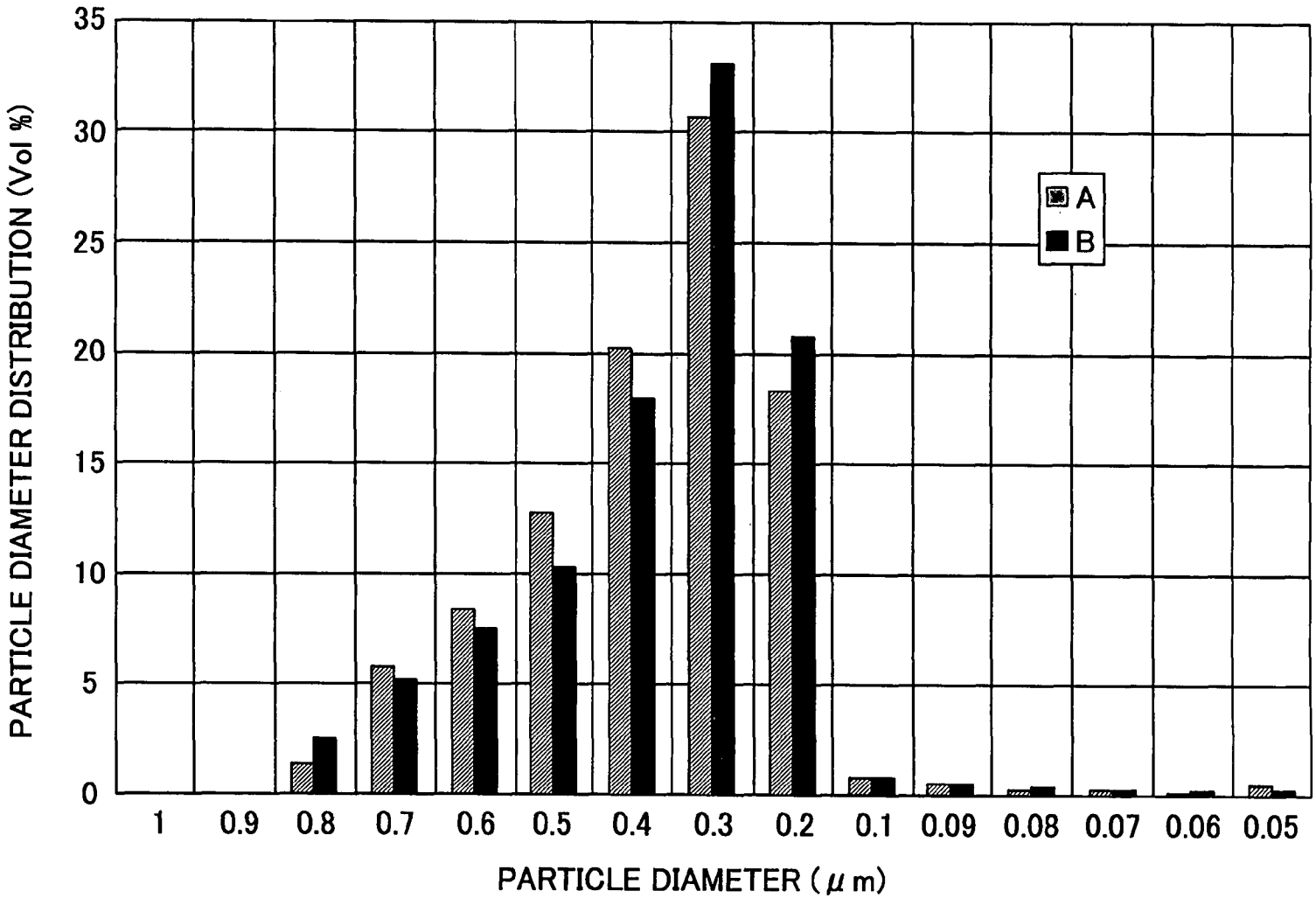
FIG. 10 is a graph showing an average particle diameter and a particle diameter distribution of the dispersions in FIGS. 8 (A) an 9 (B)

The particle diameter distributions of the dispersions A and B, which are measured with a centrifugal automatic particle diameter analyzer, CAPA-700 from Horiba Ltd., are illustrated in FIG. 10. In FIG. 10, characters A and B represent the particle diameter distributions of the dispersions A and B, respectively. As can be understood from the graph, the particle diameter distributions are almost the same. The average particle diameters of the dispersions A and B are 0.29 μm and 0.28 μm, respectively, which are the same when considering the measurement error. Thus, whether or not coarse particles are present cannot be determined using such a particle diameter measuring instrument. As mentioned above, whether coarse particles are present in a dispersion can be detected only by the method in which the dispersion is directly observed using a microscope.

Next, the method for removing coarse particles from an organic CGM dispersion will be explained.

A dispersion is prepared by dispersing the organic CGM in a solvent, optionally together with a binder resin, using a ball mill, an attritor, a sand mill, a bead mill, an ultrasonic dispersing machine or the like. In this case, it is preferable that a proper binder resin is chosen in consideration of the electrostatic properties of the resultant photoreceptor and a proper solvent is chosen while considering its abilities to wet and disperse the pigment.

Specifically, after a dispersion wherein the particles are refined as much as possible is prepared, the dispersion is then filtered using a filter with a proper pore size. By using this method, a small amount of coarse particles (which cannot be visually observed or cannot be detected by a particle diameter measuring instrument) can be removed from the dispersion. In addition, the particle diameter distribution of the particles in the dispersion can be properly controlled. Specifically, it is preferable to use a filter with an effective pore diameter not greater than 5 μm, and more preferably not greater than 3 μm. By using such a filter, a dispersion in which the CGM is dispersed while having an average particle diameter not greater than 0.25 μm (or not greater than 0.20 μm) can be prepared. By using this dispersion, a CGL can be formed without causing coating defects. Therefore, the effects of the present invention can be fully produced.

When a dispersion including a large amount of coarse particles is filtered, the amount of particles removed by filtering increases, and thereby a problem in that the solid content of the resultant dispersion is seriously decreased. Therefore, it is preferable that the dispersion to be filtered has a proper particle diameter distribution (i.e., a proper particle diameter and a proper standard deviation of particle diameter). Specifically, in order to efficiently perform the filtering operation without causing the clogging problem of the filter at a little loss of the resultant CGM, it is preferable that the average particle diameter is not greater than 0.3 μm and the standard deviation of the particle diameter is not greater than 0.2 μm.

The CGMs for use in the present invention have a high intermolecular hydrogen bond force. Therefore, the dispersed pigment particles have a high interaction. As a result thereof, the dispersed CGM particles tend to aggregate. By performing the above-mentioned filtering using a filter having the specific pore diameter, such aggregates can be removed. In this regard, the dispersion has a thixotropic property, and thereby particles having a particle diameter less than the pore diameter of the filter used can be removed. Alternatively, a liquid having a structural viscosity can be changed to a Newtonian liquid by filtering. By removing coarse particles from a CGL coating liquid, a good CGL can be prepared and the effect of the present invention can be produced.

It is preferable that a proper filter is chosen depending on the size of coarse particles to be removed. As a result of the present inventor's investigation, it is found that coarse particles having a particle diameter not less than 3 μm affect the image qualities of images with a resolution of 600 dpi (600 dots/inch (25.4 mm)). Therefore, it is preferable to use a filter with a pore diameter not greater than 5 μm, and more preferably not greater than 3 μm. Filters with too small a pore diameter filter out TiOPc particles, which can be used for the CGL, as well as coarse particles to be removed. In addition, such filters cause problems in that filtering takes a long time, the filters are clogged with particles, and an excessive stress is applied to the pump used. Therefore, a filter with a proper pore diameter is preferably used. Needless to say, the filter preferably has good resistance to the solvent used for the dispersion.

The CTL is typically prepared by coating a coating liquid, which is prepared by dissolving or dispersing at least one of charge transport materials having the formulae (I) to (IV) in a solvent optionally together with a binder resin, followed by drying. If desired, additives such as plasticizers, leveling agents and antioxidants can be added to the coating liquid.

Preferred embodiments of the charge transport materials having the formulae (I) to (IV) are as follows.

(I)

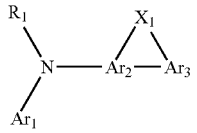

(II)

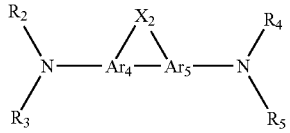

wherein each of $Ar_1$, $Ar_2$, $Ar_3$, $Ar_4$ and $Ar_5$ represents an aromatic ring group optionally having a substituent; each of $R_1$, $R_2$, $R_3$, $R_4$ and $R_5$ represents an alkyl group optionally having a substituent, an aralkyl group optionally having a substituent, a vinyl group optionally having a substituent or an aromatic ring group optionally having a substituent, provided that at least two of $R_2$ to $R_5$ are aromatic ring groups each optionally having a substituent; each of $X_1$ and $X_2$ represents a bivalent organic group, and preferably —O—, —S—, —$SO_2$—, —$NR_6$—, —$CR_7$═$CR_8$— and —$CR_9R_{10}$—, wherein each of $R_6$ to $R_{10}$ represents an alkyl group optionally having a substituent, an aralkyl group optionally having a substituent or an aromatic ring group optionally having a substituent; and $R_1$ and $Ar_1$, $R_2$ and $R_3$, and $R_4$ and $R_5$ optionally form a ring directly or through an organic group such as —$CH_2$—, —$CH_2CH_2$—, —CH═CH—, —O— and —S—.

Specific examples of the aromatic ring group of $R_1$, $Ar_1$ and $R_2$ to $R_{10}$ in the formula (I) and (II) include aromatic hydrocarbon group such as phenyl, naphtyl, anthracenyl and pyrenyl; aromatic heterocyclic groups such as pyridyl, quinolyl, thienyl, furyl, carbazolyl, benzoimidazolyl and benzothiazolyl. Specific examples of the aromatic ring group of $Ar_2$ to $Ar_5$ include aromatic hydro carbons such as benzene, naphthalene, anthracene and pyrene; and bivalent and trivalent aromatic hydrocarbon groups and aromatic heterocyclic groups, wherein 2 or 3 hydrogen atoms are removed from an aromatic heterocyclic ring, such as pyridine, quinoline, thiophene and furan. Specific examples of the alkyl groups include a methyl group, an ethyl group, a propyl group, a butyl group, a hexyl group, etc. Specific examples of the aralkyl group include a benzyl group, a phenetyl group, a naphthylmethyl group, a furfuryl group, etc.

Specific examples of the substituents include alkyl groups such as a methyl group, an ethyl group, a propyl group, a butyl group and a hexyl group; alkoxy groups such as a methoxy group, an ethoxy group and a butoxy group; halogen atoms such as a fluorine tom, a chlorine atom, a bromine atom and an iodine atom; aromatic hydrocarbon groups such as phenyl and naphtyl; heterocyclic groups such as pyridyl, quinolyl, thienyl and furyl; acyl groups such as acetyl and benzyl; haloalkyl groups such as trifluoromethyl; cyano groups; nitro groups; phenylcarbamoyl groups; carboxy groups; hydroxy groups; etc.

(III)

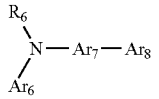

wherein each of $Ar_6$, $Ar_7$ and $Ar_8$ represents an aromatic ring group optionally having a substituent; $R_6$ represents an alkyl group optionally having a substituent, an aralkyl group optionally having a substituent, a vinyl group optionally having a substituent or an aromatic ring group optionally having a substituent; $X_1$ represents a bivalent organic group; and $Ar_6$ and $R_6$ optionally form a ring directly or through an organic group such as —$CH_2$—, —$CH_2CH_2$—, —CH═CH—, —O— and —S—.

Specific examples of the aromatic ring group of $R_6$, $Ar_6$ and $Ar_8$ in the formula (III) include aromatic hydrocarbon group such as phenyl, naphthyl, anthracenyl and pyrenyl; aromatic heterocyclic groups such as pyridyl, quinolyl, thienyl, furyl, carbazolyl, benzoimidazolyl and benzothiazolyl. Specific examples of the aromatic ring group of $Ar_7$ include aromatic hydro carbons such as benzene, naphthalene, anthracene and pyrene; and bivalent and trivalent aromatic hydrocarbon groups and aromatic heterocyclic groups, wherein 2 or 3 hydrogen atoms are removed from an aromatic heterocyclic ring, such as pyridine, quinoline, thiophene and furan. Specific examples of the substituents include alkyl groups such as a methyl group, an ethyl group, a propyl group, a butyl group and a hexyl group; alkoxy groups such as a methoxy group, an ethoxy group and a butoxy group; halogen atoms such as a fluorine tom, a chlorine atom, a bromine atom and an iodine atom; aromatic hydrocarbon groups such as phenyl and naphtyl; heterocyclic groups such as pyridyl, quinolyl, thienyl and furyl; acyl groups such as acetyl and benzyl; haloalkyl groups such as trifluoromethyl; cyano groups; nitro groups; phenylcarbamoyl groups; carboxy groups; hydroxy groups; etc.

(IV)

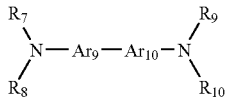

wherein each of $Ar_9$ and $Ar_{10}$ represents an aromatic ring group optionally having a substituent; each of $R_7$, $R_8$, $R_9$ and $R_{10}$ represents an alkyl group optionally having a substituent, an aralkyl group optionally having a substituent, a vinyl group optionally having a substituent or an aromatic ring group optionally having a substituent, provided that at least two of them are aromatic ring groups each optionally having a substituent; and $R_7$ and $R_8$, and $R_9$ and $R_{10}$ optionally form a ring directly or through an organic group such as —$CH_2$—, —$CH_2CH_2$—, —CH═CH—, —O— and —S—.

Specific examples of the aromatic ring group of $R_7$ to $R_{10}$ in the formula (IV) include aromatic hydrocarbon group such as phenyl, naphthyl, anthracenyl and pyrenyl; aromatic heterocyclic groups such as pyridyl, quinolyl, thienyl, furanyl, carbazolyl, benzoimidazolyl and benzothiazolyl. Specific examples of the aromatic ring group of $Ar_9$ and $Ar_{10}$ include aromatic hydrocarbons such as benzene, naphthalene, anthracene and pyrene; and bivalent and trivalent aromatic hydrocarbon groups and aromatic heterocyclic groups, wherein 2 or 3 hydrogen atoms are removed from an aromatic heterocyclic ring, such as pyridine, quinoline, thiophene and furan. Specific examples of the substituents include alkyl groups such as a methyl group, an ethyl group, a propyl group, a butyl group and a hexyl group; alkoxy groups such as a methoxy group, an ethoxy group and a butoxy group; halogen atoms such as a fluorine tom, a chlorine atom, a bromine atom and an iodine atom; aromatic hydrocarbon groups such as phenyl and naphtyl; heterocyclic groups such as pyridyl, quinolyl, thienyl and furanyl; acyl groups such as acetyl and benzyl; haloalkyl groups such as trifluoromethyl; cyano groups; nitro groups; phenylcarbamoyl groups; carboxy groups; hydroxy groups; etc.

Specific examples of the CTMs having the formulae (I) to (IV) include the following CTMs.

TABLE 1

(I)

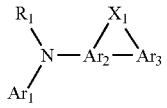

| No. | Formula |
|---|---|
| 1-1 | 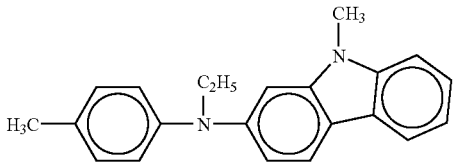 |
| 1-2 | 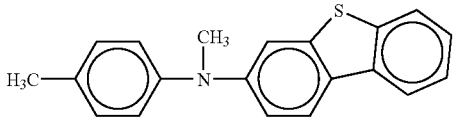 |

TABLE 1-continued
(I)
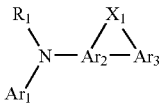
| No. | Formula |
|---|---|
| 1-3 | 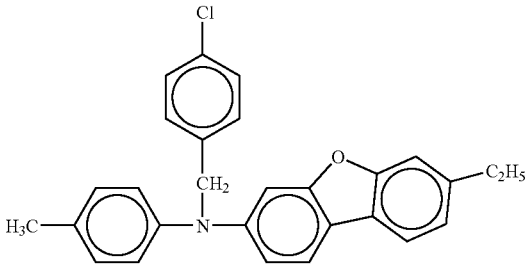 |
| 1-4 | 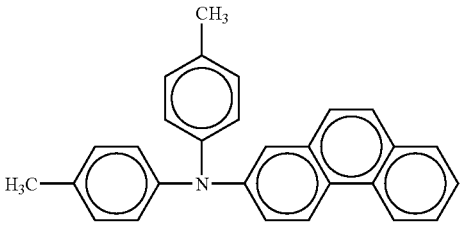 |
| 1-5 | 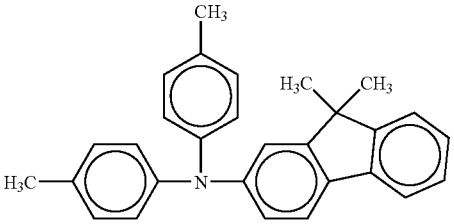 |
| 1-6 | 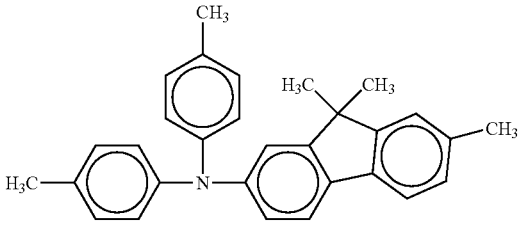 |
| 1-7 | 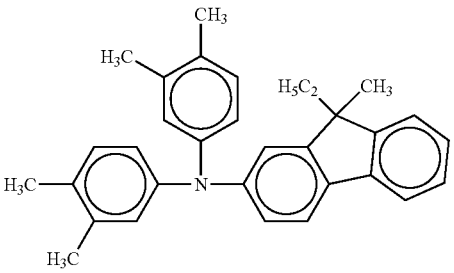 |

TABLE 1-continued
(I)
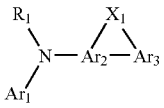
| No. | Formula |
|---|---|
| 1-8 | 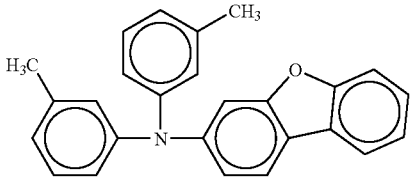 |
| 1-9 | 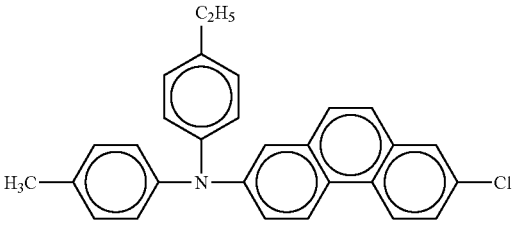 |
| 1-10 | 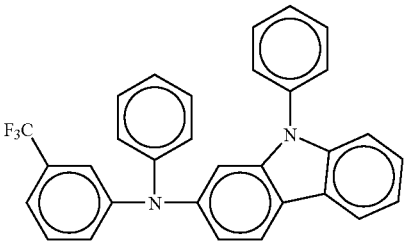 |
| 1-11 | 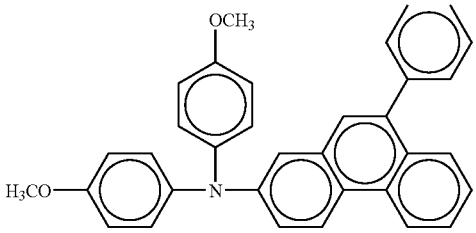 |
| 1-12 | 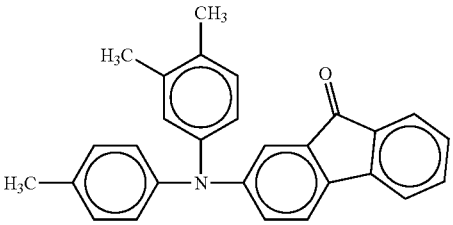 |
| 1-13 | 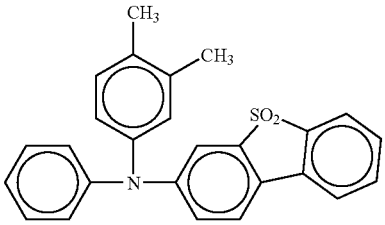 |

TABLE 1-continued
(I)
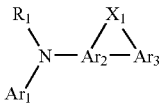
| No. | Formula |
|---|---|
| 1-14 | 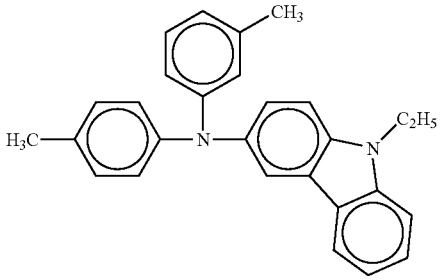 |
| 1-15 | 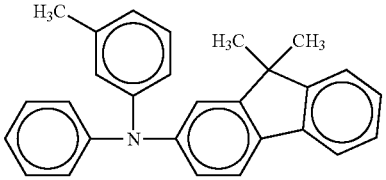 |
| 1-16 | 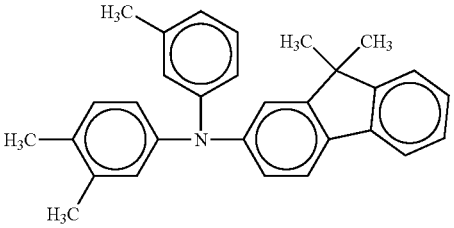 |
| 1-17 | 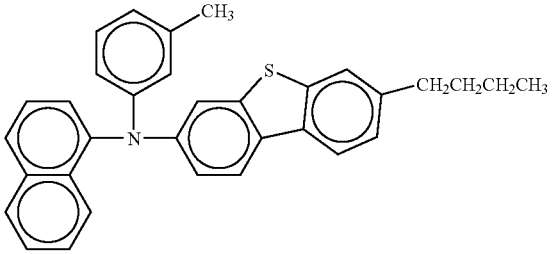 |
| 1-18 | 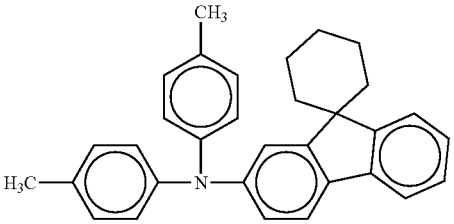 |

TABLE 1-continued
(I)
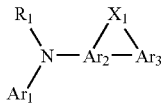
| No. | Formula |
|---|---|
| 1-19 | 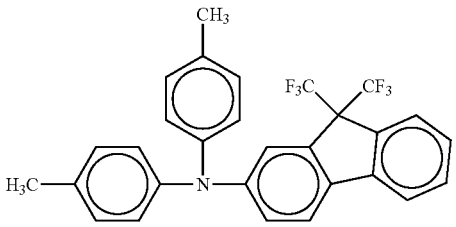 |
| 1-20 | 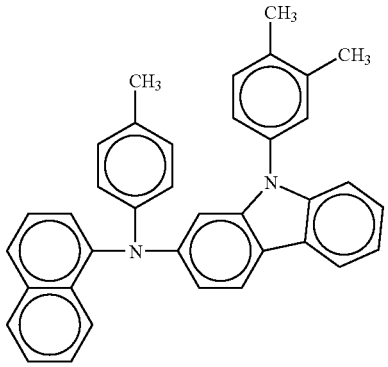 |
| 1-21 | 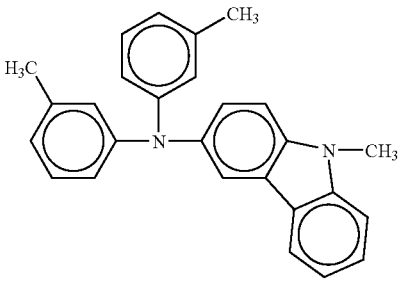 |
| 1-22 | 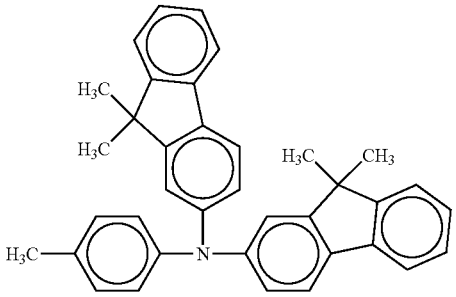 |
| 1-23 | 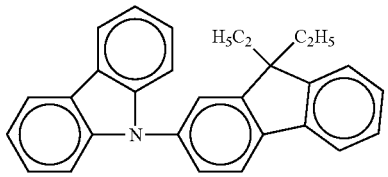 |

TABLE 1-continued
(I)
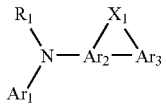
| No. | Formula |
|---|---|
| 1-24 | 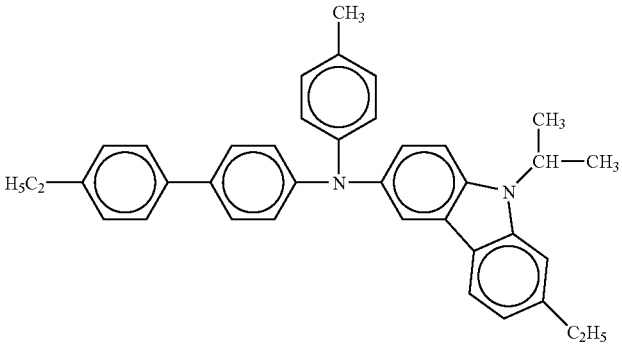 |
| 1-25 | 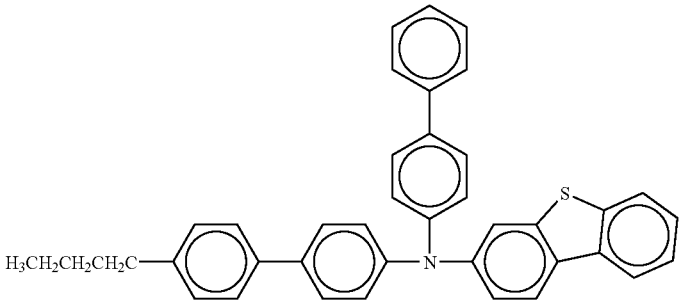 |
| 1-26 | 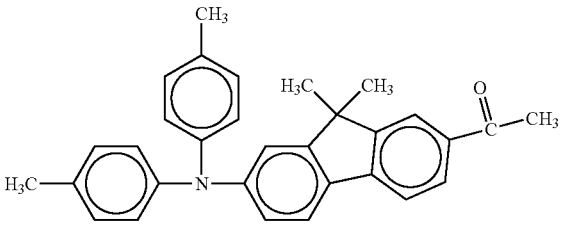 |
| 1-27 | 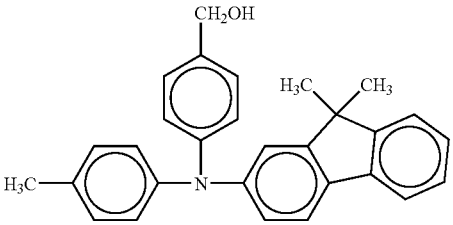 |
| 1-28 | 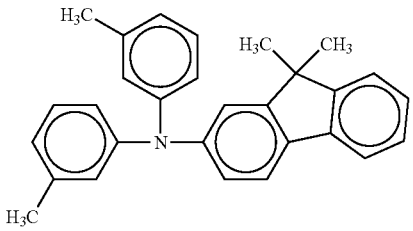 |

TABLE 1-continued
(I)
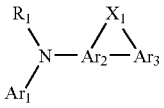
| No. | Formula |
|---|---|
| 1-29 | 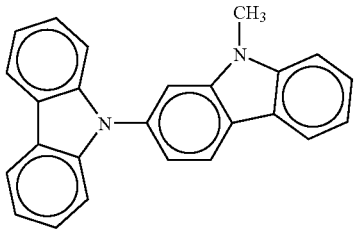 |
TABLE 2
(II)
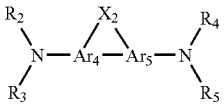
| No. | Formula |
|---|---|
| 2-1 | 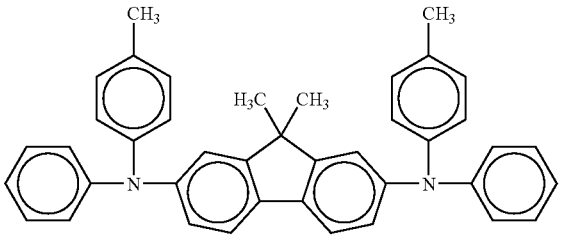 |
| 2-2 | 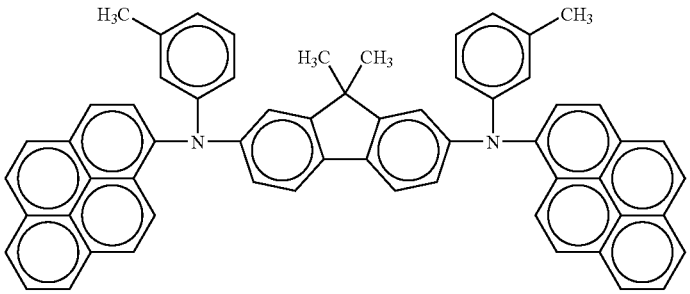 |
| 2-3 | 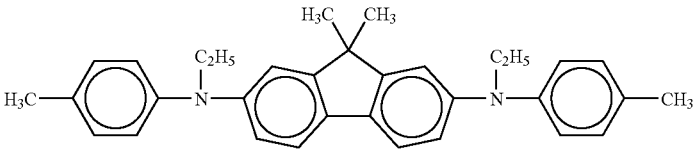 |

TABLE 2-continued
(II)
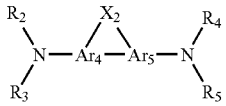
| No. | Formula |
|---|---|
| 2-4 | 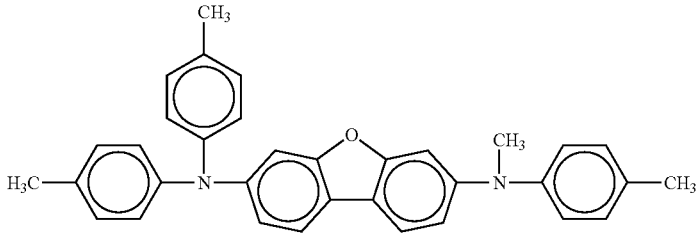 |
| 2-5 | 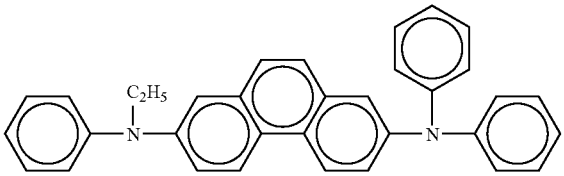 |
| 2-6 | 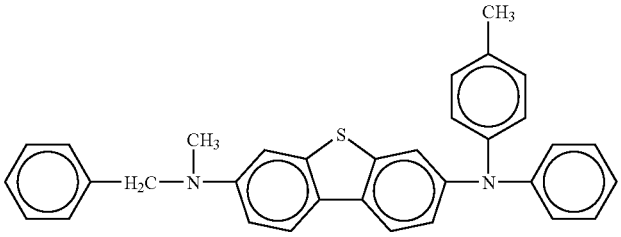 |
| 2-7 | 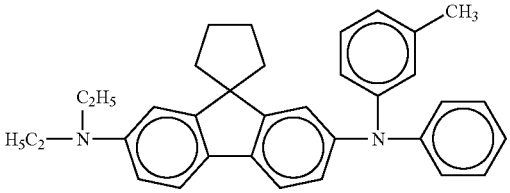 |
| 2-8 | 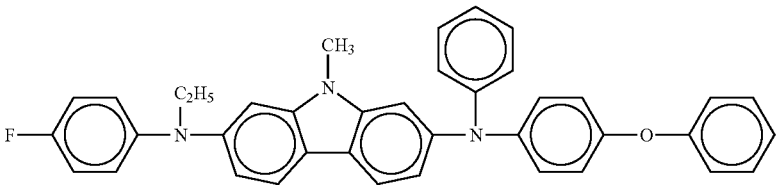 |
| 2-9 | 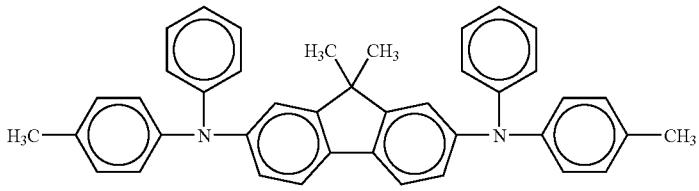 |

TABLE 2-continued
(II)
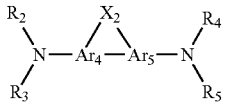
| No. | Formula |
|---|---|
| 2-10 | 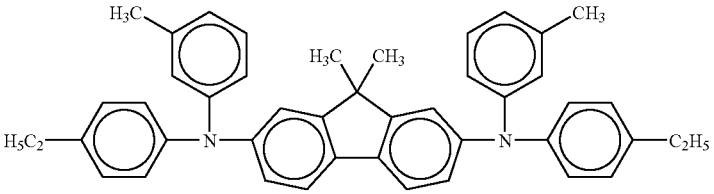 |
| 2-11 | 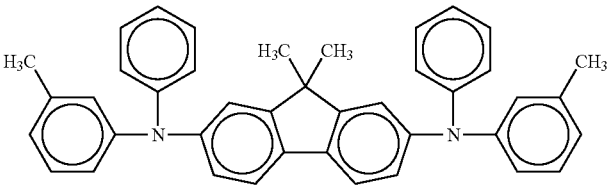 |
| 2-12 | 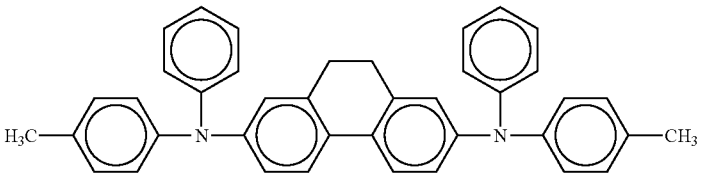 |
| 2-13 | 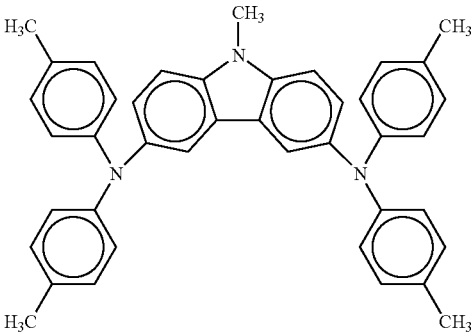 |
| 2-14 | 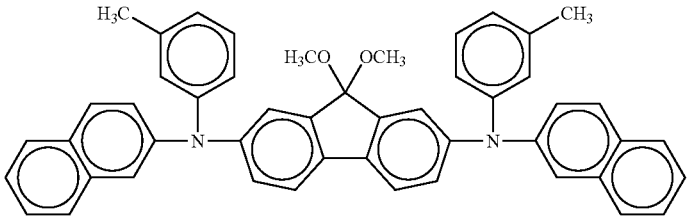 |

TABLE 2-continued
(II)
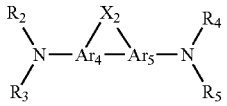
| No. | Formula |
|---|---|
| 2-15 | 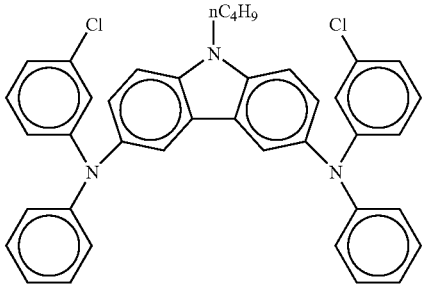 |
| 2-16 | 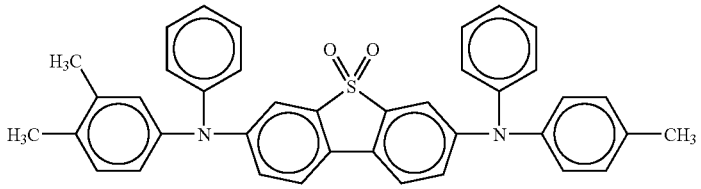 |
| 2-17 | 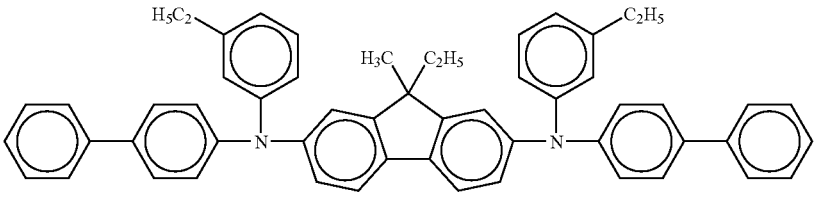 |
| 2-18 | 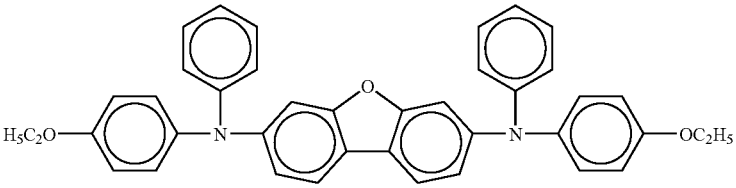 |
| 2-19 | 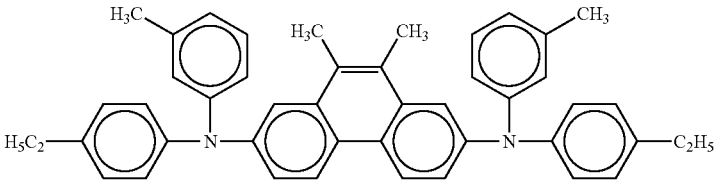 |
| 2-20 | 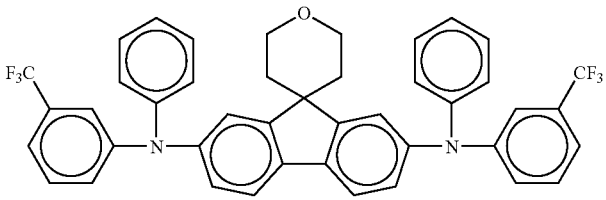 |

TABLE 2-continued
(II)
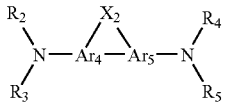
| No. | Formula |
|---|---|
| 2-21 | 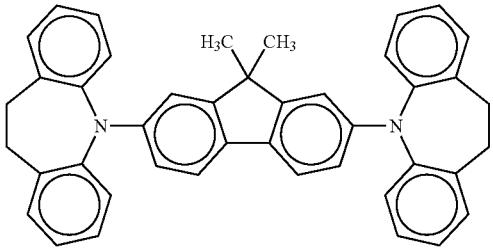 |
| 2-22 | 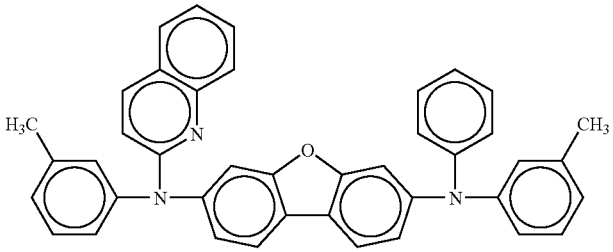 |
| 2-23 | 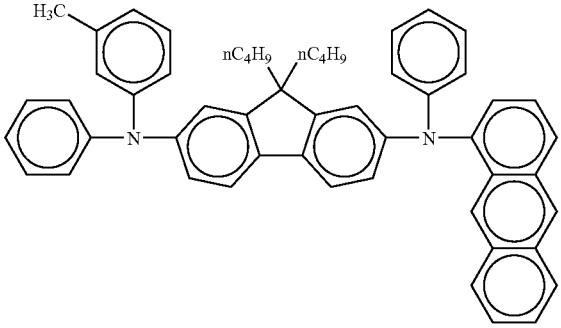 |
| 2-24 | 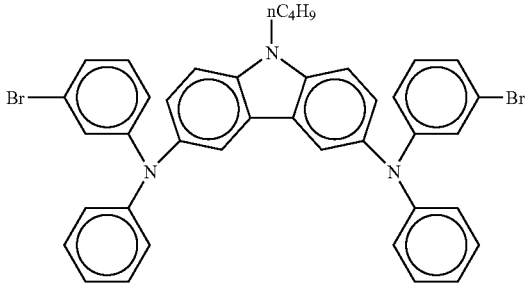 |
| 2-25 | 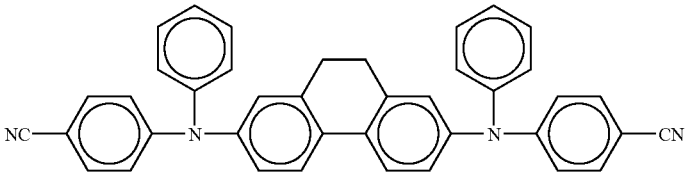 |

TABLE 2-continued
(II)
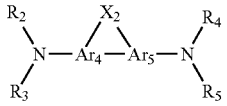
| No. | Formula |
|---|---|
| 2-26 | 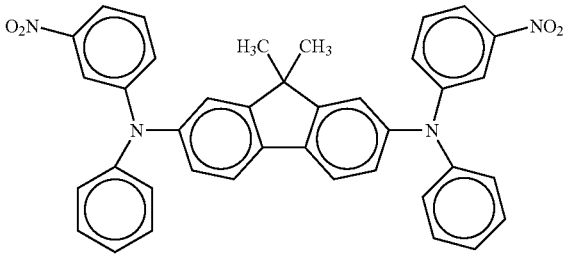 |
TABLE 3
(III)
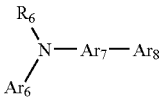
| No. | Formula |
|---|---|
| 3-1 | 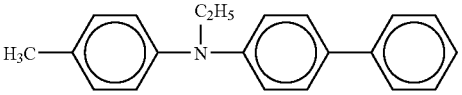 |
| 3-2 | 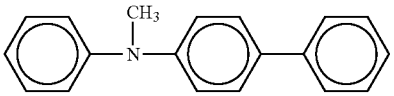 |
| 3-3 | 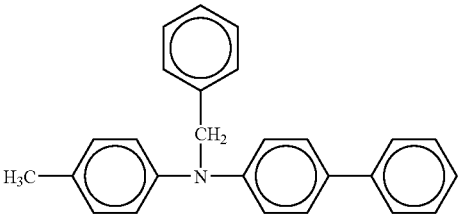 |
| 3-4 | 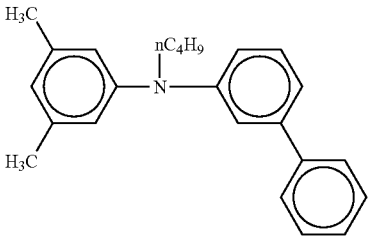 |
| 3-5 | 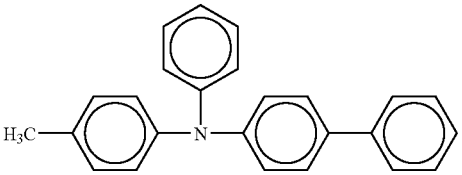 |

TABLE 3-continued
(III)
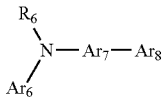
| No. | Formula |
|---|---|
| 3-6 | 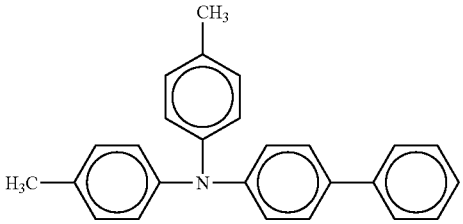 |
| 3-7 | 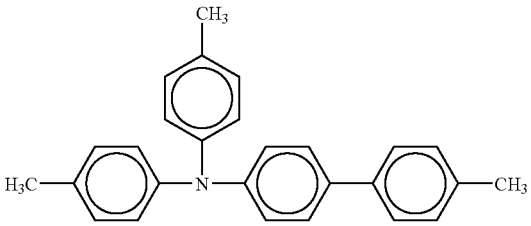 |
| 3-8 | 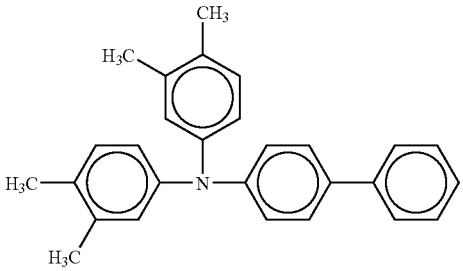 |
| 3-9 | 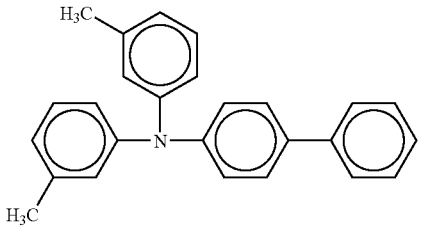 |
| 3-10 | 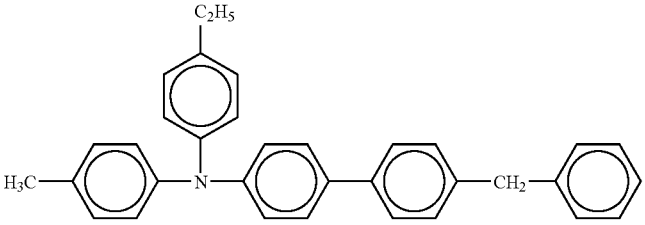 |

TABLE 3-continued
(III)
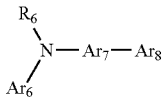
| No. | Formula |
|---|---|
| 3-11 | 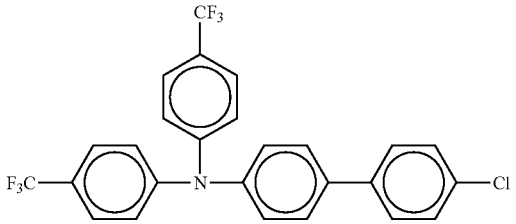 |
| 3-12 | 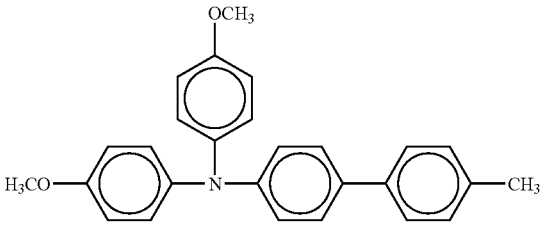 |
| 3-13 | 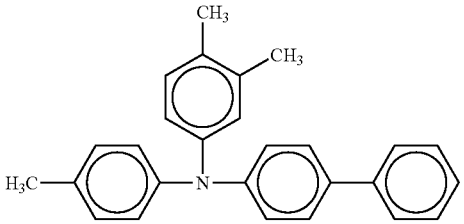 |
| 3-14 | 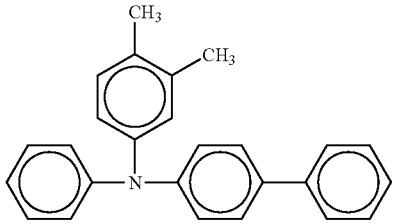 |
| 3-15 | 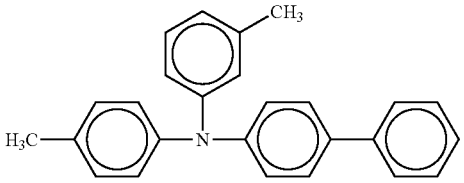 |
| 3-16 | 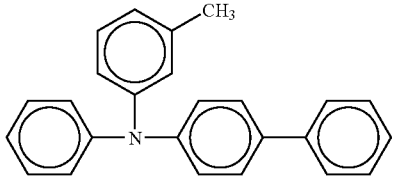 |

TABLE 3-continued
(III)
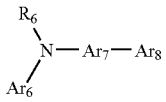
| No. | Formula |
|---|---|
| 3-17 | 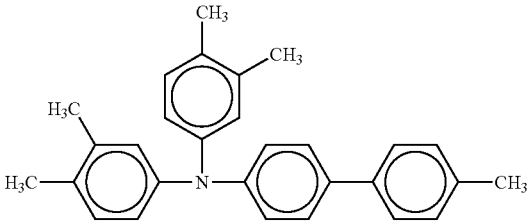 |
| 3-18 | 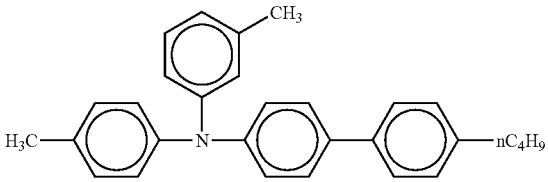 |
| 3-19 | 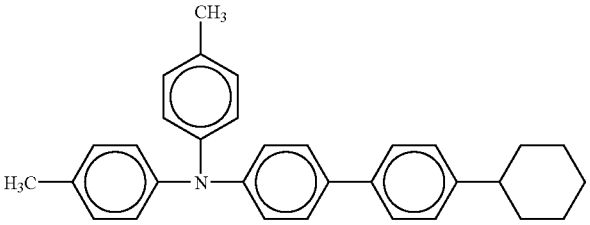 |
| 3-20 | 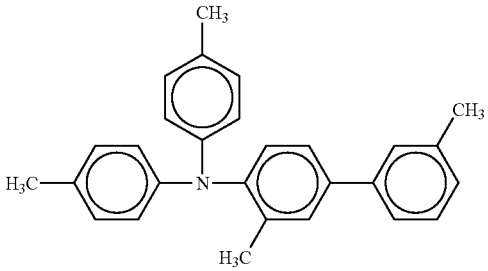 |
| 3-21 | 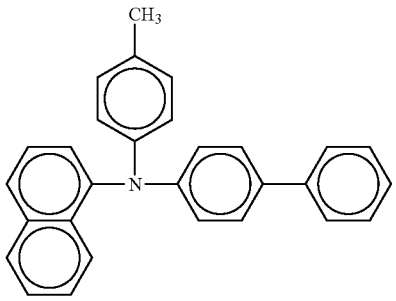 |

TABLE 3-continued
(III)
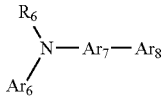
| No. | Formula |
|---|---|
| 3-22 | 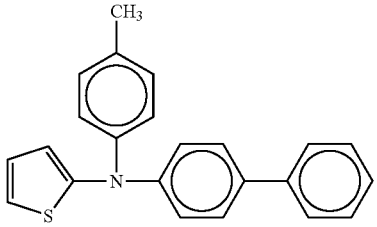 |
| 3-23 | 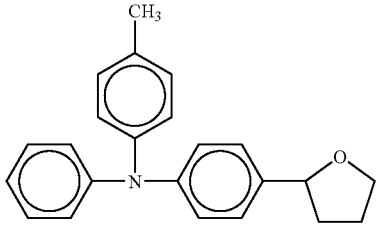 |
| 3-24 | 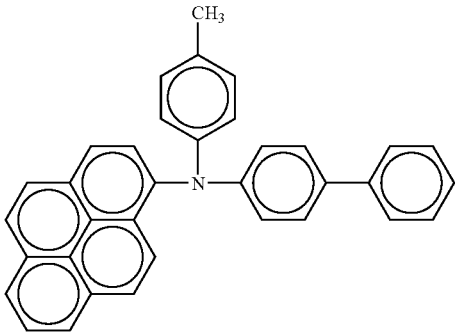 |
| 3-25 | 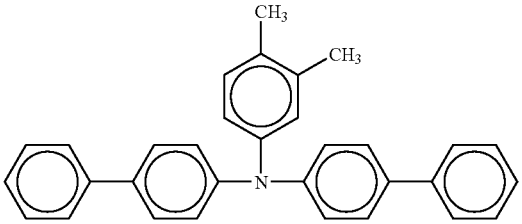 |
| 3-26 | 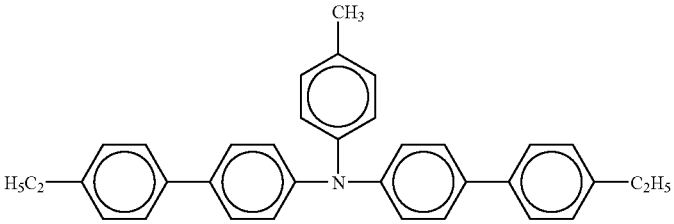 |

TABLE 3-continued
(III)
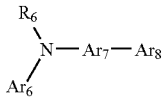
| No. | Formula |
|---|---|
| 3-27 | 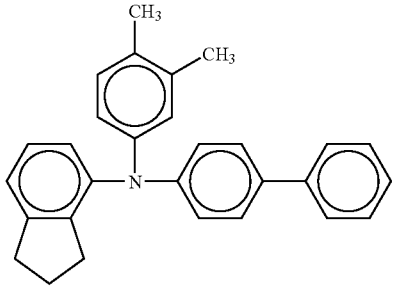 |
| 3-28 | 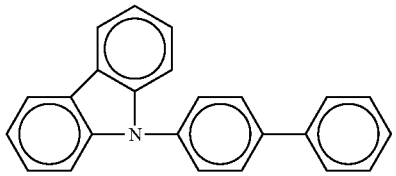 |
| 3-29 | 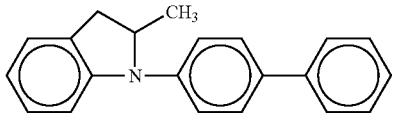 |
| 3-30 | 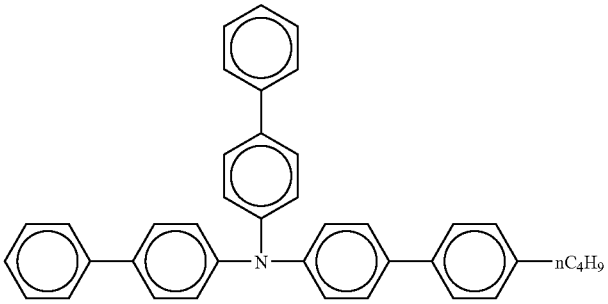 |
| 3-31 | 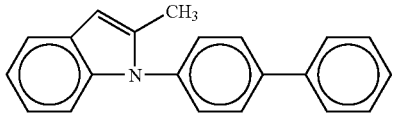 |
| 3-32 | 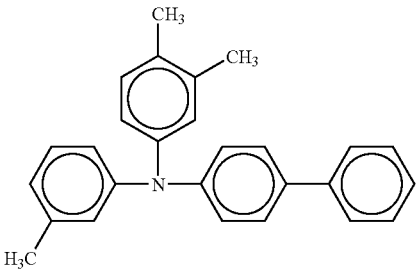 |

TABLE 3-continued
(III)
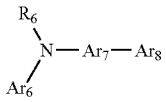
| No. | Formula |
|---|---|
| 3-33 | 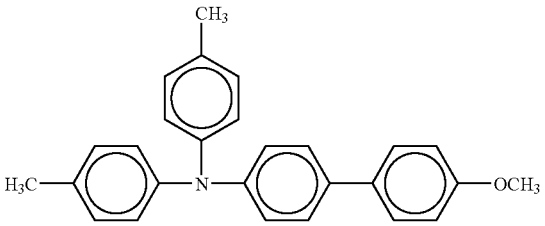 |
TABLE 4
(IV)
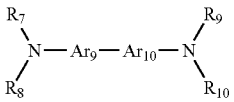
| No. | Formula |
|---|---|
| 4-1 | 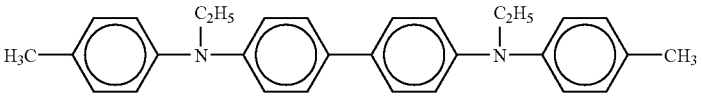 |
| 4-2 | 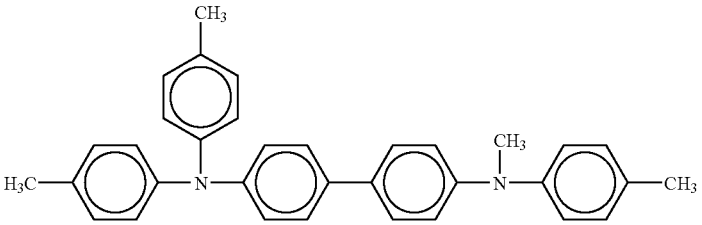 |
| 4-3 | 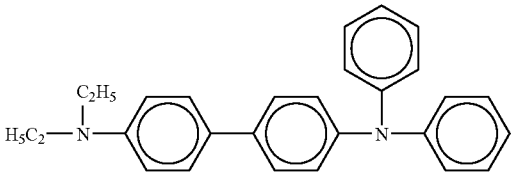 |
| 4-4 | 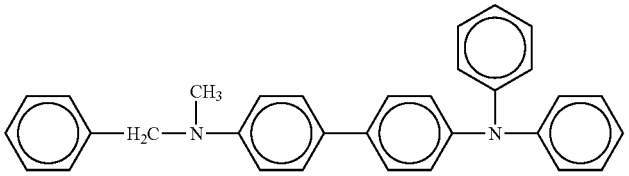 |
| 4-5 | 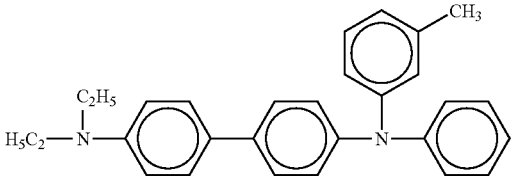 |

TABLE 4-continued
(IV)
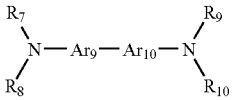
| No. | Formula |
|---|---|
| 4-6 | 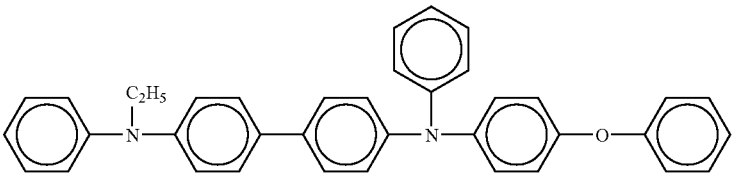 |
| 4-7 | 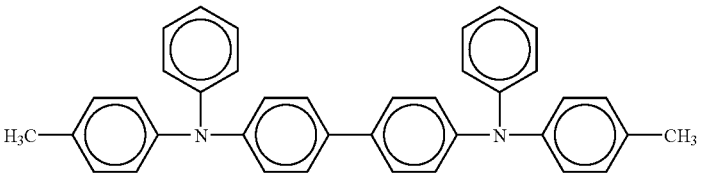 |
| 4-8 | 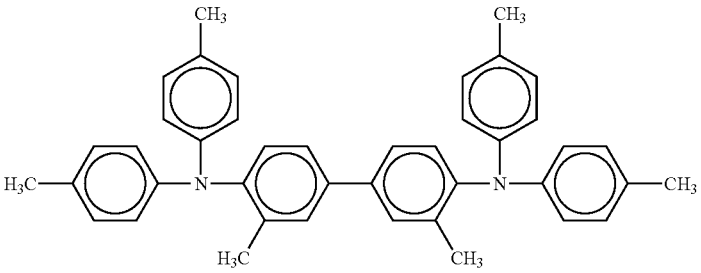 |
| 4-9 | 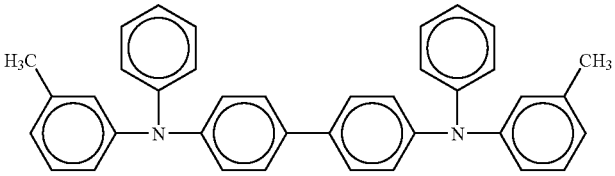 |
| 4-10 | 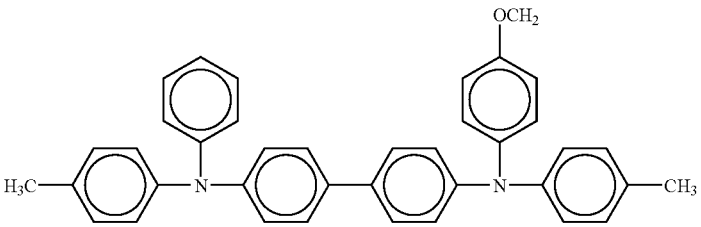 |
| 4-11 | 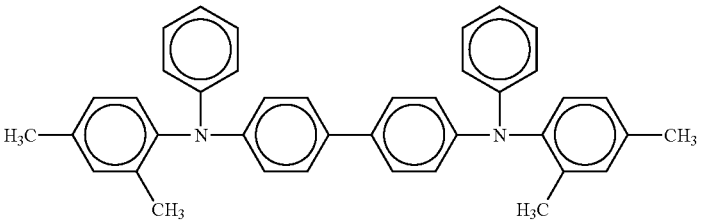 |

TABLE 4-continued
(IV)
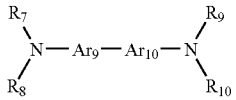
| No. | Formula |
|---|---|
| 4-12 | 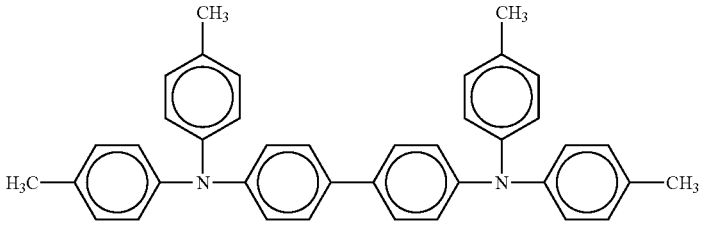 |
| 4-13 | 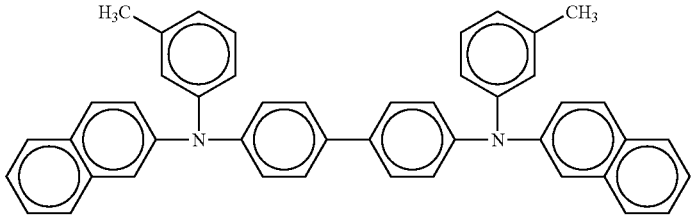 |
| 4-14 | 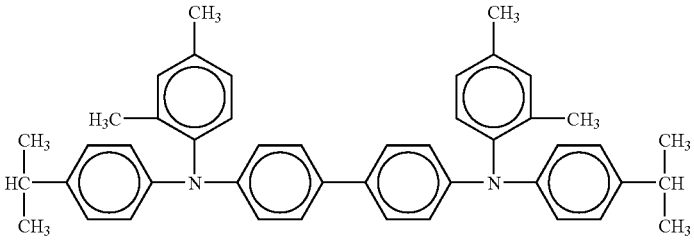 |
| 4-15 | 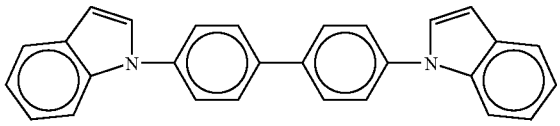 |
| 4-16 | 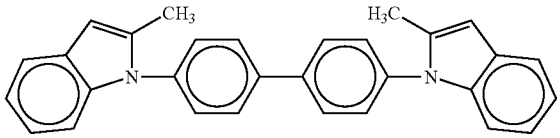 |
| 4-17 | 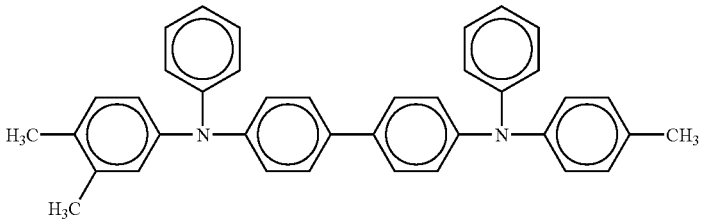 |
| 4-18 | 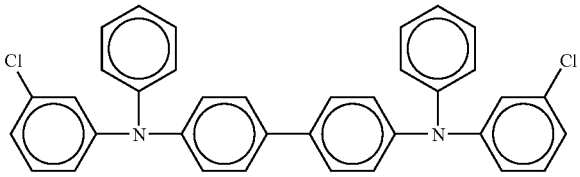 |

TABLE 4-continued
(IV)
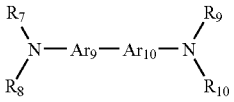
| No. | Formula |
|---|---|
| 4-19 | 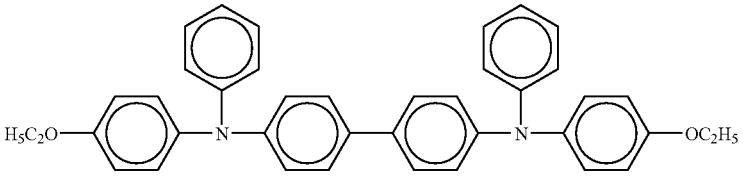 |
| 4-20 | 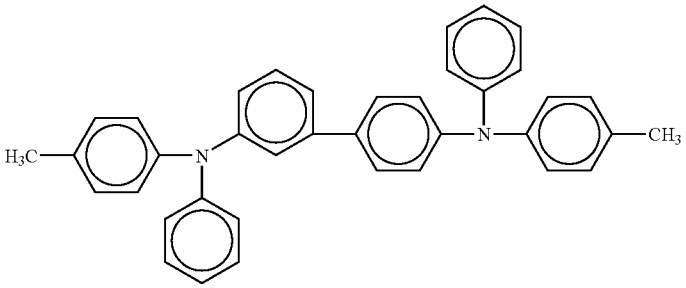 |
| 4-21 | 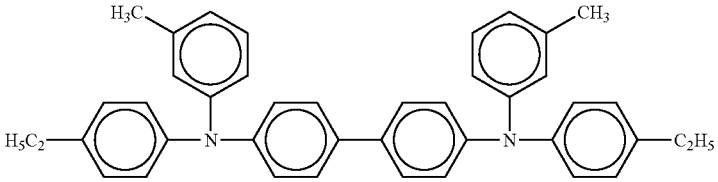 |
| 4-22 | 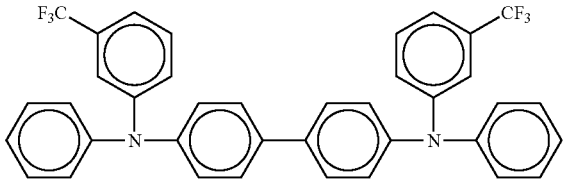 |
| 4-23 | 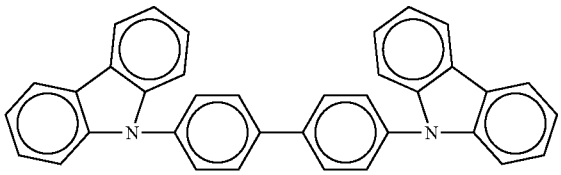 |
| 4-24 | 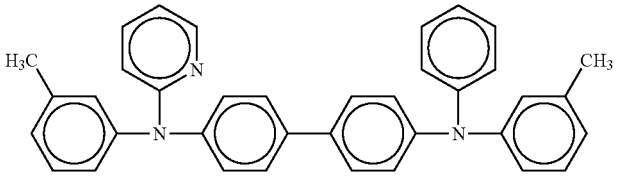 |
| 4-25 | 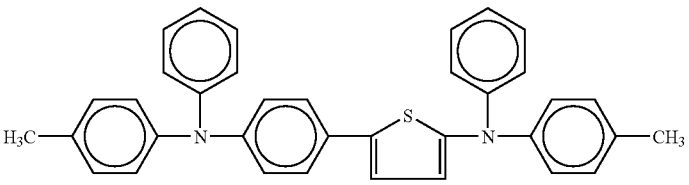 |

TABLE 4-continued
(IV)
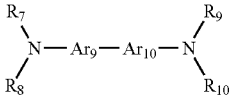
| No. | Formula |
|---|---|
| 4-26 | 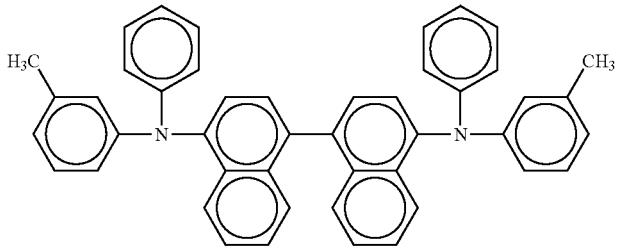 |
| 4-27 | 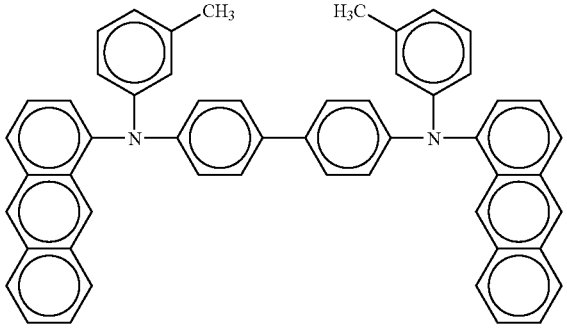 |
| 4-28 | 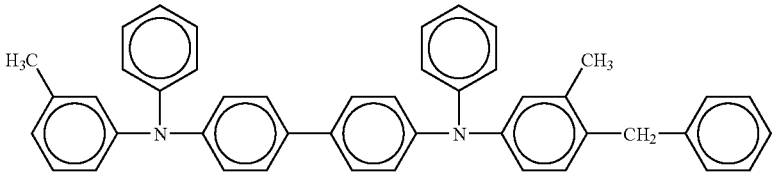 |
| 4-29 | 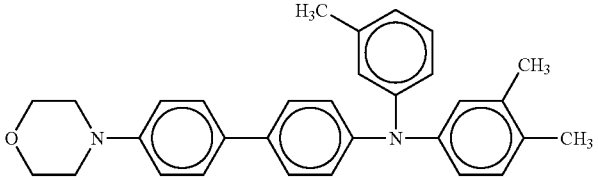 |
| 4-30 | 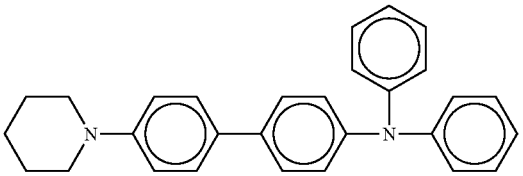 |

Specific examples of the binder resins for use in the CTL include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the CTM in the charge transport layer is preferably from 20 to 300 parts by weight, and more preferably from 40 to 150 parts by weight, per 100 parts by weight of the binder resin included in the CTL. The thickness of the CTL is preferably from 5 to 100 μm.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents. However, in view of environmental protection, non-halogenated solvents are preferably used. Specifically, cyclic ethers such as tetrahydrofuran, dioxolan and dioxane, aromatic hydrocarbons such as toluene and xylene, and their derivatives are preferably used.

A photosensitive layer in which a CTL is formed on a CTL often causes a problem in that discharging light cannot reach the CGL depending on the material constituting the CTL, resulting in insufficient discharging, although a single-layered photosensitive layer or a photosensitive layer in which a CGL is formed on a CTL does not cause this problem. In addition, when a CTM absorbs discharging light, the CTM is easily deteriorated by the light, resulting in occurrence of the residual potential increasing problem. Therefore, the CTL preferably has a transmittance of not less than 30%, more preferably not less than 50% and even more preferably not less than 85%, against the discharging light used.

The CTL may include additives such as plasticizers and leveling agents. Specific examples of the plasticizers include known plasticizers such as dibutyl phthalate and dioctyl phthalate. The content of the plasticizer in the CTL is from 0 to 30% by weight based on the total weight of the binder resin included in the charge transport layer. Specific examples of the leveling agents include silicone oils such as dimethyl silicone oils and methyl phenyl silicone oils, and polymers and oligomers, which include a perfluoroalkyl group in their side chain. The content of the leveling agent in the CTL is from 0 to 1% by weight based on the total weight of the binder resin included in the CTL.

The photoreceptor for use in the present invention optionally includes a protective layer, which is formed on the photosensitive layer to protect the photosensitive layer. Recently, computers are used in daily life, and therefore a need exists for a high-speed and small-sized printer. By forming a protective layer on the photosensitive layer, the resultant photoreceptor has good durability while having a high photosensitivity and producing images without abnormal images.

The protective layers for use in the present invention are classified into two types, one of which is a layer including a binder resin and a filler dispersed in the binder resin and the other of which is a layer including a crosslinked binder resin.

At first, the protective layer of the first type will be explained.

Specific examples of the materials for use in the protective layer include ABS resins, ACS resins, olefin-vinyl monomer copolymers, chlorinated polyether, aryl resins, phenolic resins, polyacetal, polyamide, polyamideimide, polyallylsulfone, polybutylene, polybutyleneterephthalate, polycarbonate, polyarylate, polyethersulfone, polyethylene, polyethyleneterephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Among these resins, polycarbonate and polyarylate are preferably used.

In addition, in order to impart good abrasion resistance to the protective layer, fluorine-containing resins such as polytetrafluoroethylene, and silicone resins can be used therefor. Further, materials in which such resins as mentioned above are mixed with an inorganic filler such as titanium oxide, aluminum oxide, tin oxide, zinc oxide, zirconium oxide, magnesium oxide, potassium titanate and silica or an organic filler can also be used therefor. These inorganic fillers may be subjected to a surface-treatment.

Suitable organic fillers for use in the protective layer include powders of fluorine-containing resins such as polytetrafluoroethylene, silicone resin powders, amorphous carbon powders, etc. Specific examples of the inorganic fillers for use in the protective layer include powders of metals such as copper, tin, aluminum and indium; metal oxides such as alumina, silica, tin oxide, zinc oxide, titanium oxide, alumina, zirconia, indium oxide, antimony oxide, bismuth oxide, calcium oxide, tin oxide doped with antimony, indium oxide doped with tin; potassium titanate, etc. In view of hardness, the inorganic fillers are preferable, and in particular, silica, titanium oxide and alumina are effectively used.

The content of the filler in the protective layer is preferably determined depending on the species of the filler used and the application of the resultant photoreceptor, but the content of a filler in the surface portion of the protective layer is preferably not less than 5% by weight, more preferably from 10 to 50% by weight, and even more preferably from 10 to 30% by weight, based on the total weight of the surface portion of the protective layer. The filler included in the protective layer preferably has a volume average particle diameter of from 0.1 to 2 μm, and more preferably from 0.3 to 1 μm. When the volume average particle diameter is less than 0.1 μm good abrasion resistance cannot be imparted to the resultant photoreceptor. In contrast, when the average particle diameter is greater than 2 μm the surface of the resultant protective layer is seriously roughened or a problem such that a protective layer itself cannot be formed occurs.

In the present application, the average particle diameter of a filler means a volume average particle diameter unless otherwise specified, and is measured using an instrument, CAPA-700 manufactured by Horiba Ltd. In this case, the cumulative 50% particle diameter (i.e., the median particle diameter) is defined as the average particle diameter. In addition, it is preferable that the standard deviation of the particle diameter distribution curve of the filler used in the protective layer is not greater than 1 μm. When the standard deviation is too large (i.e., when the filler has too broad particle diameter distribution), the effect of the present invention cannot be produced.

The pH of the filler used in the protective layer coating liquid largely influences on the dispersibility of the filler therein and the resolution of the images produced by the resultant photoreceptor. The reasons therefor are as follows. Fillers (in particular, metal oxides) typically include hydrochloric acid therein which is used when the fillers are produced. When the amount of residual hydrochloric acid is large, the resultant photoreceptor tends to produce blurred images. In addition, inclusion of too large an amount of hydrochloric acid causes the dispersibility of the filler to deteriorate.

Another reason therefor is that the charge properties of fillers (in particular, metal oxides) are largely influenced by the pH of the fillers. In general, particles dispersed in a liquid are charged positively or negatively. In this case, ions having a charge opposite to the charge of the particles gather around the particles to neutralize the charge of the particles, resulting in formation of an electric double layer, and thereby the particles are stably dispersed in the liquid. The potential (i.e., zeta potential) of a point around one of the particles decreases (i.e., approaches to zero) as the distance between the point and the particle increases. Namely, a point far apart from the particle is electrically neutral, i.e., the zeta potential thereof is zero. In this case, the higher the zeta potential, the better the dispersion of the particles. When the zeta potential is nearly equal to zero, the particles easily aggregate (i.e., the particles are unstably dispersed). The zeta potential of a system largely depends on the pH of the system. When the system has a certain pH, the zeta potential becomes zero. This pH point is called an isoelectric point. It is preferable to increase the zeta potential by setting the pH of the system to be far apart from the isoelectric point, in order to enhance the dispersion stability of the system.

It is preferable for the protective layer to include a filler having an isoelectric point at a pH of 5 or more, in order to prevent formation of blurred images. In other words, fillers having a highly basic property can be preferably used in the photoreceptor of the present invention because the effect of the present invention can be heightened. Fillers having a highly basic property have a high zeta potential (i.e., the fillers are stably dispersed) when the system for which the fillers are used is acidic.

In this application, the pH of a filler means the pH of the filler at the isoelectric point, which is determined by the zeta potential of the filler. Zeta potential can be measured by a laser beam potential meter manufactured by Ootsuka Electric Co., Ltd.

In addition, in order to prevent production of blurred images, fillers having a high electric resistance (i.e., not less than $1\times10^{10}$ Ω·cm in resistivity) are preferably used. Further, fillers having a pH of not less than 5 and fillers having a dielectric constant of not less than 5 can be more preferably used. Fillers having a dielectric constant of not less than 5 and/or a pH of not less than 5 can be used alone or in combination. In addition, combinations of a filler having a pH of not less than 5 and a filler having a pH of less than 5, or combinations of a filler having a dielectric constant of not less than 5 and a filler having a dielectric constant of less than 5, can also be used. Among these fillers, α-alumina having a closest packing structure is preferably used. This is because α-alumina has a high insulating property, a high heat stability and a good abrasion resistance, and thereby formation of blurred images can be prevented and abrasion resistance of the resultant photoreceptor can be improved.

In the present application, the resistivity of a filler is defined as follows. The resistivity of a powder such as fillers largely changes depending on the filling factor of the powder when the resistivity is measured. Therefore, it is necessary to measure the resistivity under a constant condition. In the present application, the resistivity is measured by a device similar to the devices disclosed in FIG. 1 of 5-113688. The surface area of the electrodes of the device is 4.0 $cm^2$. Before the resistivity of a sample powder is measured, a load of 4 kg is applied to one of the electrodes for 1 minute and the amount of the sample powder is adjusted such that the distance between the two electrodes becomes 4 mm. The resistivity of the sample powder is measured by pressing the sample powder only by the weight (i.e., 1 kg) of the upper electrode without applying any other load to the sample. The voltage applied to the sample powder is 100 V. When the resistivity is not less than $10^6$ Ω·cm, HIGH RESISTANCEMETER (from Yokogawa Hewlett-Packard Co.) is used to measure the resistivity. When the resistivity is less than $10^6$ Ω·cm, a digital multimeter (from Fluke Corp.) is used.

The dielectric constant of a filler is measured as follows. A cell similar to that used for measuring the resistivity is also used for measuring the dielectric constant. After a load is applied to a sample powder, the capacity of the sample powder is measured using a dielectric loss measuring instrument (from Ando Electric Co., Ltd.) to determine the dielectric constant of the powder.

The fillers to be included in the protective layer are preferably subjected to a surface treatment using a surface treatment agent in order to improve the dispersion of the fillers in the protective layer. When a filler is poorly dispersed in the protective layer, the following problems occur.

(1) the residual potential of the resultant photoreceptor increases;

(2) the transparency of the resultant protective layer decreases;

(3) coating defects are formed in the resultant protective layer;

(4) the abrasion resistance of the protective layer deteriorates;

(5) the durability of the resultant photoreceptor deteriorates; and (6) the image qualities of the images produced by the resultant photoreceptor deteriorate.

Suitable surface treatment agents include known surface treatment agents. However, surface treatment agents which can maintain the highly insulating property of the fillers used are preferably used.

As for the surface treatment agents, titanate coupling agents, aluminum coupling agents, zircoaluminate coupling agents, higher fatty acids, combinations of these agents with a silane coupling agent, Al2O3, TiO2, ZrO2, silicones, aluminum stearate, and the like, can be preferably used to improve the dispersibility of fillers and to prevent formation of blurred images. These materials can be used alone or in combination. When fillers treated with a silane coupling agent are used, the resultant photoreceptor tends to produce blurred images. However, combinations of a silane coupling agent with one of the surface treatment agents mentioned above can often produce good images without blurring. The coating weight of the surface treatment agents is preferably from 3 to 30% by weight, and more preferably from 5 to 20% by weight, based on the weight of the filler to be treated, although the weight is determined depending on the average primary particle diameter of the filler. When the content of the surface treatment agent is less than 3% by weight, the dispersibility of the filler cannot be improved. In contrast, when the content of the surface treatment agent is greater than 30% by weight, the residual potential of the resultant photoreceptor seriously increases. These fillers can be dispersed using a proper dispersion machine. In this case, the fillers are preferably dispersed such that the aggregated particles are dissociated and primary particles of the fillers are dispersed, to improve the transparency of the resultant protective layer.

In addition, a CTM can be included in the protective layer to enhance the photo response and to reduce the residual potential of the resultant photoreceptor. The CTMs mentioned above for use in the charge transport layer can also be used for the protective layer. When a low molecular weight CTM is used for the protective layer, the concentration of the CTM may be changed in the thickness direction of the protective layer. Specifically, it is preferable to reduce the concentration of the CTM at the surface portion of the protective layer in order to improve the abrasion resistance of the resultant photoreceptor. At this point, the concentration of the CTM means the ratio of the weight of the CTM to the total weight of the protective layer.

It is preferable to use one or more of the charge transport polymers mentioned above for use in the CTL for the protective layer in order to improve the durability and high speed charge transportability of the photoreceptor.

The protective layer can be formed by any known coating methods. The thickness of the protective layer is preferably from 0.1 to 10 μm.

Next, the crosslinked protective layer will be explained. The crosslinked protective layer is preferably prepared by subjecting a reactive monomer having plural crosslinkable functional groups in a molecule to a crosslinking reaction upon application of light or heat thereto. By forming a protective layer having such a three-dimensional network, the photoreceptor has good abrasion resistance.

In order to prepare the above-mentioned protective layer, monomers having a charge transportable moiety in the entire part or a part thereof are preferably used. By using such monomers, the resultant protective layer has the charge transport moiety in the three-dimensional network. Therefore, the CTL can fully exercise a charge transport function. Among the monomers, monomers having a triarylamine structure are preferably used.

The protective layer having such a three-dimensional structure has good abrasion resistance but often forms a crack therein if the layer is too thick. In order to prevent occurrence of such cracking problem, a multi-layered protective layer in which a crosslinked protective layer is formed on a protective layer in which a low molecular CTM is dispersed in a polymer can be used.

The crosslinked protective layer having a charge transport structure is preferably prepared by reacting and crosslinking a radical polymerizable tri- or poly-functional monomer having no charge transport structure and a radical polymerizable monofunctional monomer having a charge transport structure. This protective layer has high hardness and high elasticity because of having a well-developed three dimensional network and a high crosslinking density. In addition, since the surface of the protective layer is uniform and smooth, the protective layer has good abrasion resistance and scratch resistance. Although it is important to increase the crosslinking density of the protective layer, a problem in that the protective layer has a high internal stress due to shrinkage in the crosslinking reaction tends to occur. The internal stress increases as the thickness of the protective layer increases. Therefore, when a thick protective layer is crosslinked, problems in that the protective layer is cracked and peeled occur. Even though these problems are not caused when a photoreceptor is new, the problems are easily caused when the photoreceptor receives various stresses after being repeatedly subjected to charging, developing, transferring and cleaning.

In order to prevent occurrence of the problems, the following techniques can be used.

(1) a polymeric component is added to the crosslinked protective layer;

(2) a large amount of mono- or di-functional monomers are used for forming the crosslinked protective layer; and (3) a polyfunctional monomer having a group capable of imparting softness to the resultant crosslinked protective layer is used for forming the crosslinked protective layer.

However, all the crosslinked protective layers prepared using these techniques have a low crosslinking density. Therefore, a good abrasion resistance cannot be imparted to the resultant protective layers. In contrast, the crosslinked protective layer of the photoreceptor for use in the present invention has a well-developed three-dimensional network, a high crosslinking density and a high charge transporting ability when having a thickness of from 1 to 10 μm. Therefore, the resultant photoreceptor has high abrasion resistance and hardly causes cracking and peeling problems. The thickness of the crosslinked protective layer is preferably from 2 to 8 μm. In this case, the margin for the above-mentioned problems can be improved and flexibility in choosing materials for forming a protective layer having a higher crosslinking density can be enhanced.

The reasons why the photoreceptor for use in the present invention hardly causes the cracking and peeling problems are as follows.

(1) a relatively thin crosslinked protective layer having a charge transport structure is formed and thereby increase of internal stress of the photoreceptor can be prevented; and (2) since a CTL is formed below the crosslinked protective layer having a charge transport structure, the internal stress of the crosslinked protective layer can be relaxed.

Therefore, it is not necessary to increase the amount of polymer components in the protective layer. Accordingly, occurrence of problems in that the protective layer is scratched or a film (such as a toner film) is formed on the protective layer, which is caused by incomplete mixing of polymer components and the crosslinked material formed by reaction of radical polymerizable monomers, can be prevented. In addition, when a protective layer is crosslinked by irradiating light, a problem in that the inner portion of the protective layer is incompletely reacted because the charge transport moieties absorb light occurs if the protective layer is too thick.

However, since the protective layer of the photoreceptor for use in the present invention has a thickness of not greater than 10 μm, the inner portion of the protective layer can be completely crosslinked and thereby a good abrasion resistance can be imparted to the entire protective layer. Further, since the crosslinked protective layer is prepared using a monofunctional monomer having a charge transport structure, the monofunctional monomer is incorporated in the crosslinking bonds formed by one or more tri- or poly-functional monomers. When a crosslinked protective layer is formed using a low molecular weight CTM having no functional group, a problem in that the low molecular weight CTM is separated from the crosslinked resin, resulting in precipitation of the low molecular weight CTM and formation of a clouded protective layer, and thereby the mechanical strength of the protective layer is deteriorated. When a crosslinked protective layer is formed using di- or poly-functional charge transport compounds as main components, the resultant protective layer is seriously distorted, resulting in increase of internal stress, because the charge transfer moieties are bulky, although the protective layer has a high crosslinking density.

Further, the photoreceptor of the present invention has good electric properties, good stability, and high durability. This is because the crosslinked protective layer has a structure in that a unit obtained from a monofunctional monomer having a charge transport structure is connected with the crosslinking bonds like a pendant. In contrast, the protective layer formed using a low molecular weight CTM having no functional group causes the precipitation and clouding problems, and thereby the photosensitivity of the photoreceptor is deteriorated and residual potential of the photoreceptor is increased (i.e., the photoreceptor has poor electric properties). In addition, in the crosslinked protective layer formed using di- or poly-functional charge transport compounds as main components, the charge transport moieties are fixed in the crosslinked network, and thereby charges are trapped, resulting in deterioration of photosensitivity and increase of residual potential. When such electric properties of a photoreceptor are deteriorated, problems in that the resultant images have low image density and character images are narrowed occur. Since a CTL having a high mobility and few charge traps can be formed as the CTL of the photoreceptor of the present invention, production of side effects in electric properties of the photoreceptor can be prevented even when the crosslinked protective layer is formed on the CTL.

Further, a crosslinked protective layer having a charge transport structure is insoluble in organic solvents and typically has an excellent abrasion resistance. The crosslinked protective layer prepared by reacting a tri- or poly-functional polymerizable monomer having no charge transport structure with a monofunctional monomer having a charge transport structure has a well-developed three-dimensional network and a high crosslinking density. However, in a case where materials (such as mono- or di-functional monomers, polymer binders, antioxidants, leveling agents, and plasticizers) other than the above-mentioned polymerizable monomers are added and/or the crosslinking conditions are changed, problems in that the crosslinking density of the resultant protective layer is locally low and the resultant protective layer is constituted of aggregates of minute crosslinked material having a high crosslinking density tend to occur. Such a crosslinked protective layer has poor mechanical strength and poor resistance to organic solvents. Therefore, when the photoreceptor is repeatedly used, a problem in that a portion of the protective layer is seriously abraded or is released from the protective layer occurs. In contrast, the crosslinked protective layer for use in the present photoreceptor has high molecular weight and good solvent resistance because of having a well-developed three dimensional network and a high crosslinking density. Therefore, the resultant photoreceptor has excellent abrasion resistance and does not cause the above-mentioned problems.

Then the constituents of the coating liquid for forming the crosslinked protective layer having a charge transport structure will be explained.

The tri- or poly-functional monomers having no charge transport structure mean monomers which have three or more radical polymerizable groups and which do not have a charge transport structure (such as a positive hole transport structure (e.g., triarylamine, hydrazone, pyrazoline and carbazole structures); and an electron transport structure (e.g., condensed polycyclic quinine structure, diphenoquinone structure, a cyano group and a nitro group)). As the radical polymerizable groups, any radical polymerizable groups having a carbon-carbon double bond can be used. Suitable radical polymerizable groups include 1-substituted ethylene groups having the below-mentioned formula (X) and 1,1-substituted ethylene groups having the below-mentioned formula (XI).

1-Substituted Ethylene Groups $$CH2{=}CH{-}X^1{-} \quad (X)$$

wherein $X^1$ represents an arylene group (such as a phenylene group and a naphthylene group), which optionally has a substituent, a substituted or unsubstituted alkenylene group, a —CO— group, a —COO— group, a —CON($R^{10}$) group (wherein $R^{10}$ represents a hydrogen atom, an alkyl group (e.g., a methyl group, and an ethyl group), an aralkyl group (e.g., a benzyl group, a naphthylmethyl group and a phenetyl group) or an aryl group (e.g., a phenyl group and a naphthyl group)), or a —S— group.

Specific examples of the groups having formula (X) include a vinyl group, a styryl group, 2-methyl-1,3-butadienyl group, a vinylcarbonyl group, acryloyloxy group, acryloylamide, vinyl thioether, etc.

1,1-Substituted Ethylene Groups $$CH2{=}C(Y){-}(X^2)_n{-} \quad (XI)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR^{11}$ group (wherein $R^{11}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR^{12}R^{13}$ group (wherein each of $R^{12}$ and $R^{13}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups))); $X^2$ represents a group selected from the groups mentioned above for use in $X^1$ and an alkylene group, wherein at least one of Y and $X^2$ is an oxycarbonyl group, a cyano group, an alkenylene group or an aromatic group; and n is 0 or 1.

Specific examples of the groups having formula (XI) include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X^1$, $X^2$ and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

Among these radical polymerizable tri- or poly-functional groups, acryloyloxy groups and methacryloyloxy groups having three or more functional groups are preferably used. Compounds having three or more acryloyloxy groups can be prepared by subjecting (meth)acrylic acid (salts), (meth) acrylhalides and (meth)acrylates, which have three or more hydroxyl groups, to an ester reaction or an ester exchange reaction. The three or more radical polymerizable groups included in a radical polymerizable tri- or poly-functional monomer are the same as or different from the others therein.

Specific examples of the radical polymerizable tri- or poly-functional monomers include trimethylolpropane triacrylate (TMPTA), trimethylolpropane trimethacrylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerythritol ethoxytriacrylate, ethyleneoxy-modified triacryl phosphate, 2,2,5,5-tetrahydroxymethylcyclopentanone tetraacrylate, etc. These monomers are used alone or in combination.

In order to form a dense crosslinked network in the crosslinked protective layer, the ratio (Mw/F) of the molecular weight (Mw) of the tri- or poly-functional monomer to the number of functional groups (F) included in a molecule of the monomer is preferably not greater than 250. When the number is too large, the resultant protective becomes soft and thereby the abrasion resistance of the layer slightly deteriorates. In this case, it is not preferable to use only one monomer having a functional group having a long chain group such as ethylene oxide, propylene oxide and caprolactone. The content of the unit obtained from the tri- or poly-functional monomers in the crosslinked protective layer is preferably from 20 to 80% by weight, and more preferably from 30 to 70% by weight based on the total weight of the protective layer. When the content is less than 20% by weight, the three dimensional crosslinking density is low, and thereby good abrasion resistance cannot be imparted to the protective layer. In contrast, when the content is greater than 80% by weight, the content of the charge transport compound decreases, good charge transport property cannot be imparted to the protective layer. In order to balance the abrasion resistance and charge transport property of the crosslinked protective layer, the content of the unit obtained from the tri- or poly-functional monomers in the protective layer is preferably from 30 to 70% by weight.

Suitable radical polymerizable monofunctional monomers having a charge transport structure for use in preparing the crosslinked protective layer include compounds having one radical polymerizable functional group and a charge transport structure such as positive hole transport groups (e.g., triarylamine, hydrazone, pyrazoline and carbazole structures) and electron transport groups (e.g., electron accepting aromatic groups such as condensed polycyclic quinine structure, diphenoquinone structure, and cyano and nitro groups). As the functional group of the radical polymerizable monofunctional monomers, acryloyloxy and methacryloyloxy groups are preferably used. Among the charge transport groups, triarylamine groups are preferably used. Among the compounds having a triarylamine group, compounds having the following formula (VII) or (VIII) are preferably used because of having good electric properties (i.e., high photosensitivity and low residual potential).

(VII)

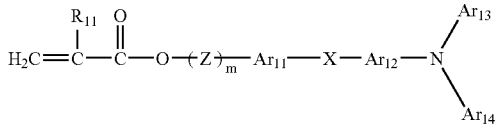

(VIII)

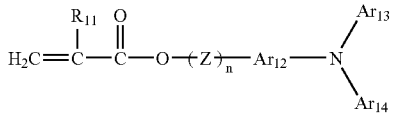

In formulae (VII) and (VIII), $R_{11}$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR_{12}$ group (wherein $R_{12}$ represents a hydrogen atom, a substituted or unsubstituted alkyl group, a substituted or unsubstituted aralkyl group and a substituted or unsubstituted aryl group) a halogenated carbonyl group or a —$CONR_{13}R_{14}$ (wherein each of $R_{13}$ and $R_{14}$ represents a hydrogen atom, a substituted or unsubstituted alkyl group, a substituted or unsubstituted aralkyl group and a substituted or unsubstituted aryl group); each of $Ar_{11}$ and $Ar_{12}$ represents a substituted or unsubstituted arylene group; each of $Ar_{13}$ and $Ar_{14}$ represents a substituted or unsubstituted arylene group; X represents a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxycarbonyl group; each of m and n is 0 or an integer of from 1 to 3; and p is 0 or 1.

In formulae (VII) and (VIII), specific examples of the alkyl, aryl, aralkyl, and alkoxy groups for use in $R_{11}$ include the following.

Alkyl Group

Methyl, ethyl, propyl and butyl groups.

Aryl Group

Phenyl and naphthyl groups, etc.

Aralkyl Group

Benzyl, phenethyl and naphthylmethyl groups.

Alkoxy Group

Methoxy, ethoxy and propoxy groups.

These groups may be substituted with a halogen atom, a nitro group, a cyano group, an alkyl group (such as methyl and ethyl groups), an alkoxy group (such as methoxy and ethoxy groups), an aryloxy group (such as a phenoxy group), an aryl group (such as phenyl and naphthyl groups), an aralkyl group (such as benzyl and phenethyl groups), etc.

Among these groups, a hydrogen atom and a methyl group are preferable as $R_{11}$.

Suitable substituted or unsubstituted aryl groups for use as $Ar_{13}$ and $Ar_{14}$ include condensed polycyclic hydrocarbon groups, non-condensed cyclic hydrocarbon groups, and heterocyclic groups.

Specific examples of the condensed polycyclic hydrocarbon groups include compounds in which 18 or less carbon atoms constitute one or more rings, such as pentanyl, indecenyl, naphthyl, azulenyl, heptalenyl, biphenilenyl, as-indacenyl, s-indacenyl, fluorenyl, acenaphthylenyl, preiadenyl, acenaphthenyl, phenarenyl, phenanthoryl, anthoryl, fluorantenyl, acephenanthorylenyl, aceanthorylenyl, triphenylenyl, pyrenyl, chrysenyl, and naphthasenyl groups.

Specific examples of the non-condensed cyclic hydrocarbon groups include monovalent groups of benzene, diphenyl ether, polyethylene diphenyl ether, diphenyl thioether, and diphenyl sulfone; monovalent groups of non-condensed polycyclic hydrocarbon groups such as biphenyl, polyphenyl, diphenyl alkanes, diphenylalkenes, diphenyl alkyne, triphenyl methane, distyryl benzene, 1,1-diphenylcycloalkanes, polyphenylalkanes, polyphenyl alkenes; and ring aggregation hydrocarbons such as 9,9-diphenyl fluorenone.

Specific examples of the heterocyclic groups include monovalent groups of carbazole, dibenzofuran, dibenzothiophene, oxadiazole, and thiadiazole.

The aryl groups for use as $Ar_{13}$ and $Ar_{14}$ may be substituted with the following groups.

(1) Halogen atoms, and cyano and nitro groups.

(2) Linear or branched alkyl groups which preferably have from 1 to 12 carbon atoms, more preferably from 1 to 8 carbon atoms and even more preferably from 1 to 4 carbon atoms. These alkyl groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkyl groups include methyl, ethyl, n-propyl, iso-propyl, n-butyl, sec-butyl, t-butyl, trifluoromethyl, 2-hydroxyethyl, 2-ethoxyethyl, 2-cyanoethyl, 2-methoxyethyl, benzyl, 4-chlorobenzyl, 4-methylbenzyl and 4-phenylbenzyl groups.

(3) Alkoxy groups (i.e., —OR2). R2 represents one of the alkyl groups defined above in paragraph (2). Specific examples of the alkoxy groups include methoxy, ethoxy, n-propoxy, iso-propoxy, t-butoxy, n-butoxy, s-butoxy, iso-butoxy, 2-hydroxyethoxy, benzyloxy and trifluoromethoxy groups.

(4) Aryloxy groups. Specific examples of the aryl group of the acryloxy groups include phenyl and naphthyl groups. The aryloxy groups may be substituted with an alkoxy group having from 1 to 4 carbon atoms, an alkyl group having from 1 to 4 carbon atoms, or a halogen atom. Specific examples of the groups include phenoxy, 1-naphthyloxy, 2-naphthyloxy, 4-methoxyphenoxy, and 4-methylphenoxy groups.

(5) Alkylmercapto or arylmercapto group. Specific examples of the groups include methylthio, ethylthio, phenylthio, and p-methylphenylthio groups (6) Groups having the following formula.

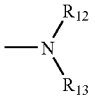

wherein each of R12 and R13 represents a hydrogen atom, one of the alkyl groups defined in paragraph (2) or an aryl group (such as phenyl, biphenyl, and naphthyl groups). These groups may be substituted with another group such as an alkoxy group having from 1 to 4 carbon atoms, an alkyl group having from 1 to 4 carbon atoms, and a halogen atom. In addition, R12 and R13 optionally form a ring in combination.

Specific examples of the groups having the above-mentioned formula include amino, diethylamino, N-methyl-N-phenylamino, N,N-diphenylamino, N,N-di(tolyl)amino, dibenzylamino, piperidino, morpholino, and pyrrolidino groups.

(7) Alkylenedioxy or alkylenedithio groups such as methylenedioxy and methylenedithio groups.

(8) Substituted or unsubstituted styryl groups, substituted or unsubstituted β-phenylstyryl groups, diphenylaminophenyl groups, and ditolylaminophenyl groups.

As the arylene groups for use in $Ar^{11}$ and $Ar^{12}$, divalent groups delivered from the aryl groups mentioned above for use in $Ar_{13}$ and $Ar_{14}$ can be used.

The group X is a substituted or unsubstituted alkylene group, a substituted or unsubstituted cycloalkylene group, a substituted or unsubstituted alkylene ether, an oxygen atom, a sulfur atom, and a vinylene group.

Suitable groups for use as the substituted or unsubstituted alkylene group include linear or branched alkylene groups which preferably have from 1 to 12 carbon atoms, more preferably from 1 to 8 carbon atoms and even more preferably from 1 to 4 carbon atoms. These alkylene groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkylene groups include methylene, ethylene, n-propylene, iso-propylene, n-butylene, sec-butylene, t-butylene, trifluoromethylene, 2-hydroxyethylene, 2-ethoxyethylene, 2-cyanoethylene, 2-methoxyethylene, benzylidene, phenylethylene, 4-chlorophenylethylene, 4-methylphenylethylene and 4-biphenylethylene groups.

Suitable groups for use in the substituted or unsubstituted cycloalkylene groups include cyclic alkylene groups having from 5 to 7 carbon atoms, which may be substituted with a fluorine atom or another group such as a hydroxyl group, alkyl groups having from 1 to 4 carbon atoms, and alkoxy groups having 1 to 4 carbon atoms. Specific examples of the substituted or unsubstituted cycloalkylene groups include cyclohexylidene, cyclohexylene, and 3,3-dimethylcyclohexylidene groups.

Specific examples of the substituted or unsubstituted alkylene ether groups include ethyleneoxy, propyleneoxy, ethylene glycol, propylene glycol, diethylene glycol, tetraethylene glycol, and tripropylene glycol groups. The alkylene group of the alkylene ether groups may be substituted with another group such as hydroxyl, methyl and ethyl groups.

As the vinylene group, groups having one of the following formulae can be preferably used.

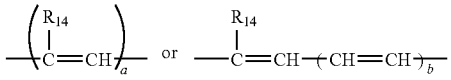

In the above-mentioned formulae, R14 represents a hydrogen atom, one of the alkyl groups mentioned above for use in paragraph (2), or one of the aryl groups mentioned above for use in $Ar_{13}$ and $Ar_{14}$, wherein a is 1 or 2, and b is 1, 2 or 3.

In formulae (VII) and (VIII), Z represents a substituted or unsubstituted alkylene group, a substituted or unsubstituted divalent alkylene ether group, a divalent alkyleneoxycarbonyl group. Specific examples of the substituted or unsubstituted alkylene group include the alkylene groups mentioned above for use as X. Specific examples of the substituted or unsubstituted alkylene ether group include the divalent alkylene ether groups mentioned above for use as X. Specific examples of the divalent alkyleneoxycarbonyl group include divalent groups modified by caprolactone.

More preferably, monomers having the following formula (IX) are used as the radical polymerizable monofunctional monomer having a charge transport structure.

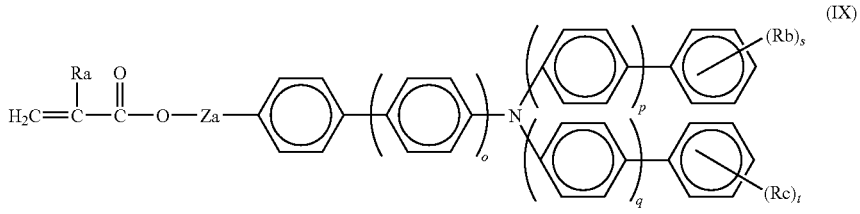

(IX)

In formula (IX), each of o, p and q is 0 or 1; Ra represents a hydrogen atom, or a methyl group; each of Rb and Rc represents an alkyl group having from 1 to 6 carbon atoms, wherein each of Rb and Rc can include plural groups which are the same as or different from each other; each of and t is 0, 1, 2 or 3; r is 0 or 1; Za represents a methylene group, an ethylene group or a group having one of the following formulae.

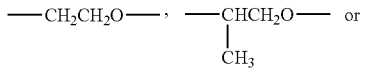

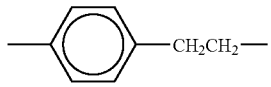

In formula (IX), each of Rb and Rc is preferably a methyl group or an ethyl group.

The radical polymerizable monofunctional monomers having formula (VII) or (VIII) (preferably formula (IX)), have the following property. Namely, a monofunctional monomer is polymerized while the double bond of a molecule is connected with the double bonds of other molecules. Therefore, the monomer is incorporated in a polymer chain, i.e., in a main chain or a side chain of the crosslinked polymer chain which is formed by the monomer and a radical polymerizable tri- or poly-functional monomer. The side chain of the unit obtained from the monofunctional monomer is present between two main polymer chains which are connected by crosslinking chains. In this regard, the crosslinking chains are classified into intermolecular crosslinking chains and intramolecular crosslinking chains.

In any of these case, the triarylamine group which is a pendant of the main chain of the unit obtained from the monofunctional monomer is bulky and is connected with the main chain with a carbonyl group therebetween while not being fixed (i.e., while being fairly free three-dimensionally). Therefore, the crosslinked polymer has little strain, and in addition the crosslinked protective layer has good charge transport property.

Specific examples of the radical polymerizable monofunctional monomers include the following compounds Nos. 1-160, but are not limited thereto.

No. 1

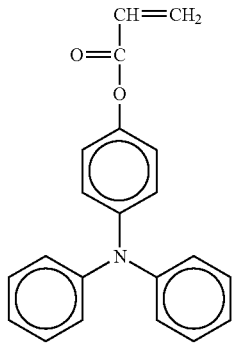

No. 2

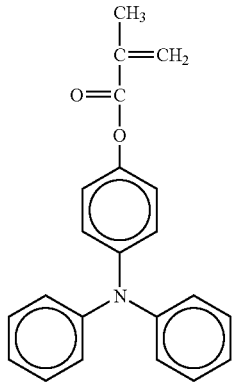

No. 3

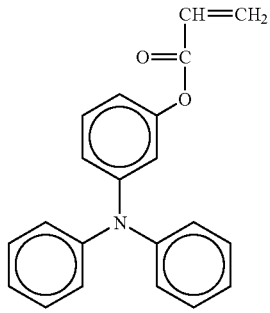

-continued
No. 4
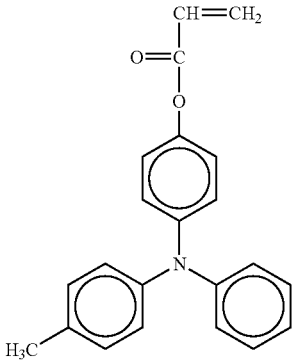
No. 5
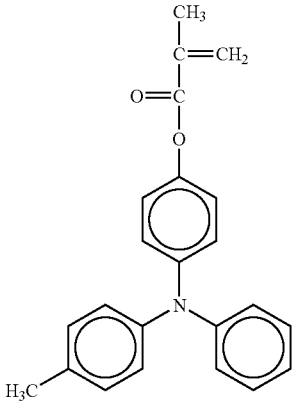
No. 6
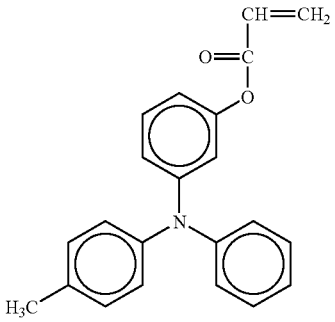
No. 7
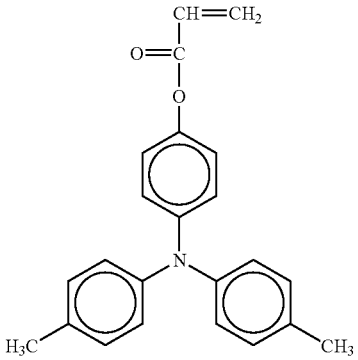
-continued
No. 8
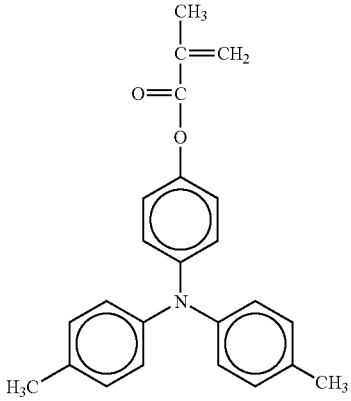
No. 9
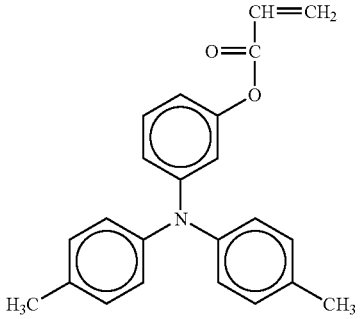
No. 10
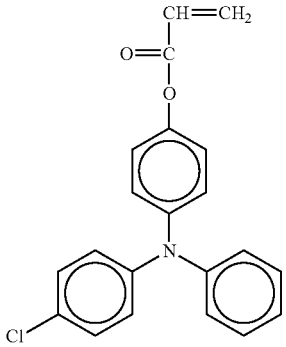
No. 11
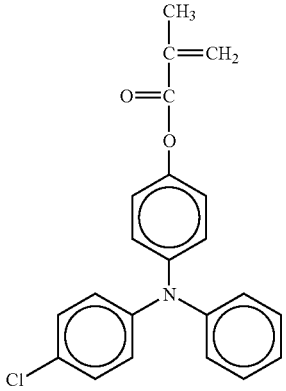

-continued
No. 12
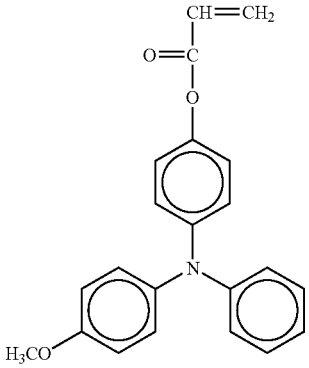
No. 13
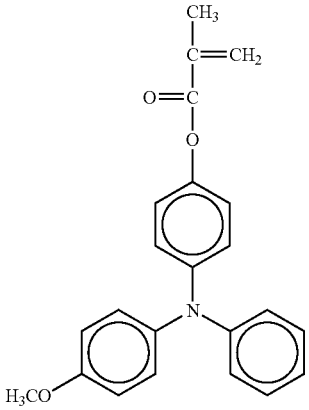
No. 14
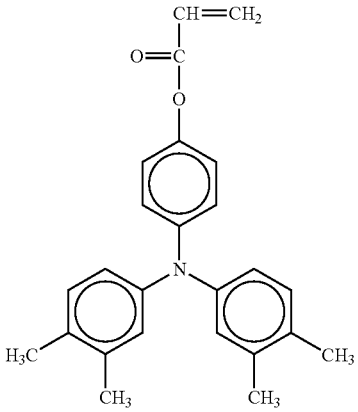
-continued
No. 15
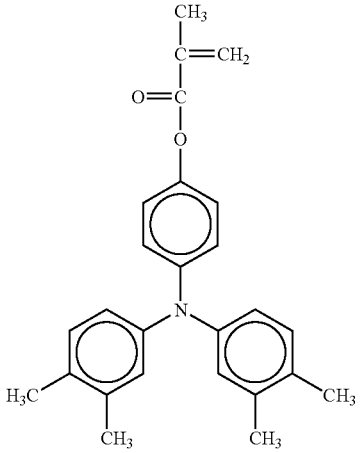
No. 16
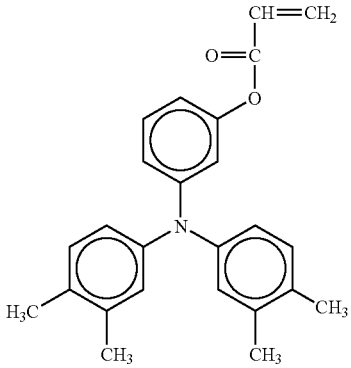
No. 17
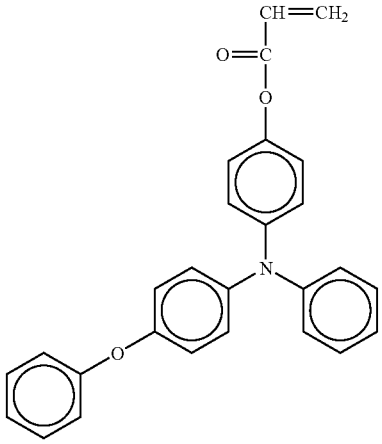

-continued
No. 18
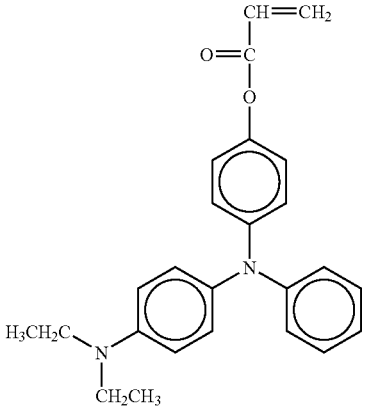
No. 19
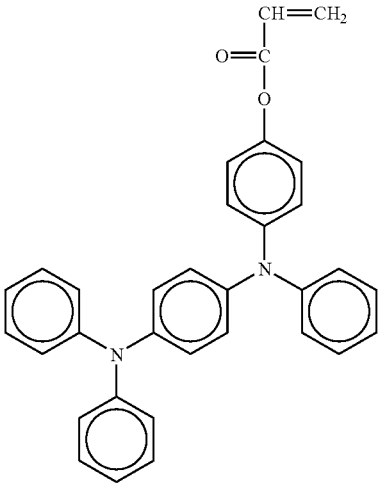
No. 20
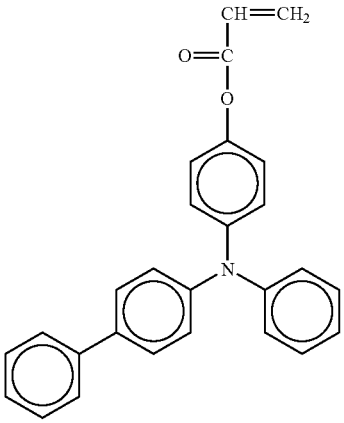
-continued
No. 21
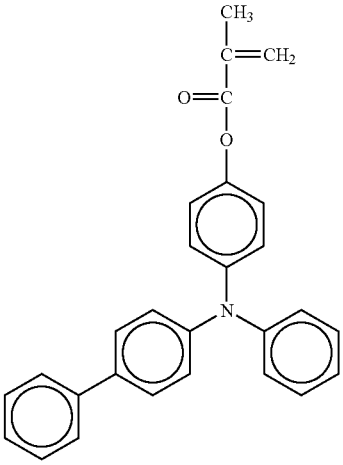
No. 22
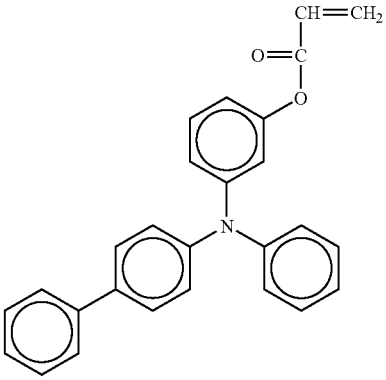
No. 23
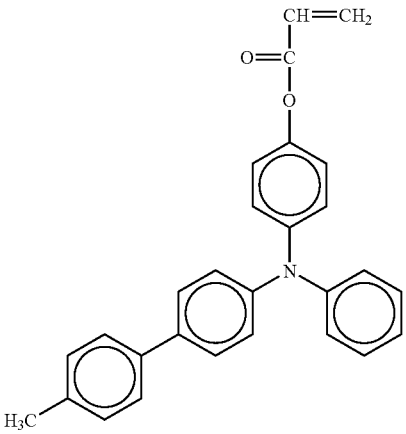

-continued
No. 24
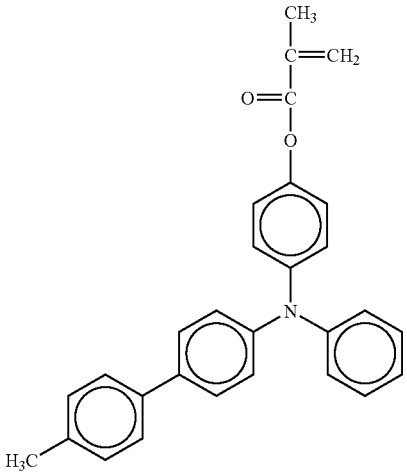
No. 25
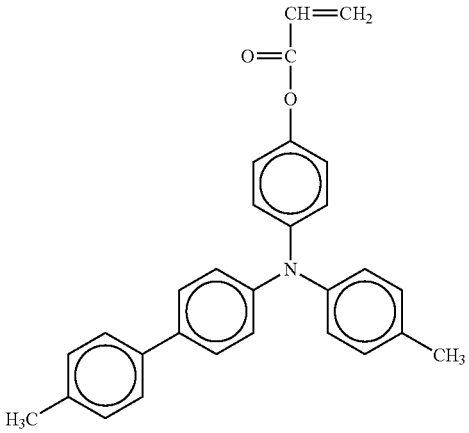
No. 26
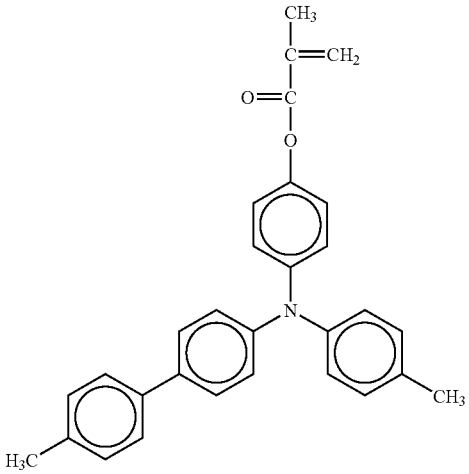
-continued
No. 27
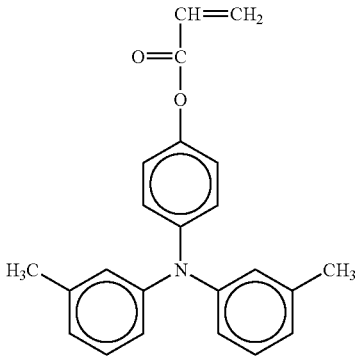
No. 28
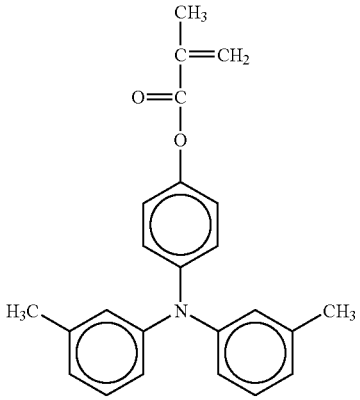
No. 29
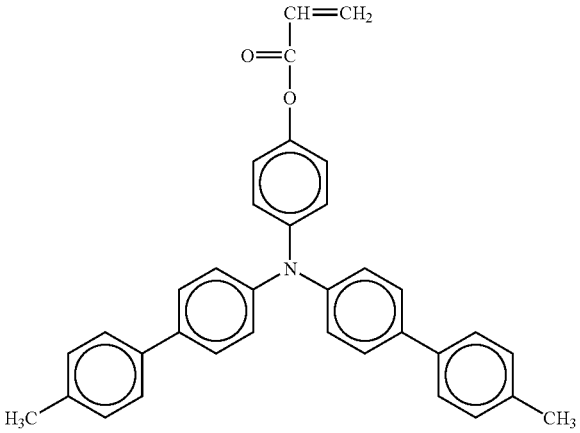
No. 30
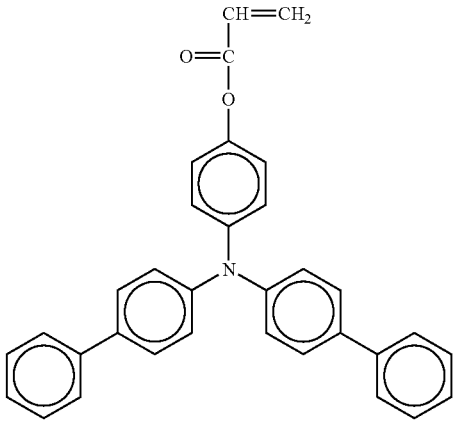

-continued
No. 31
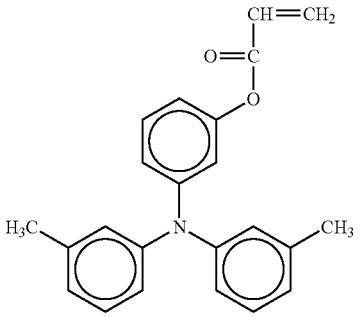
No. 32
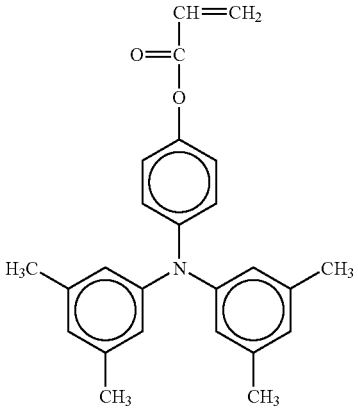
No. 33
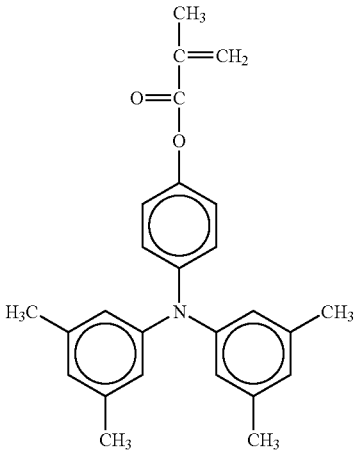
No. 34
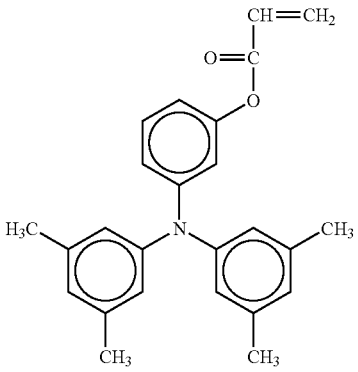
-continued
No. 35
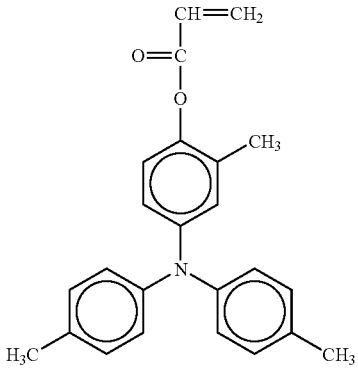
No. 36
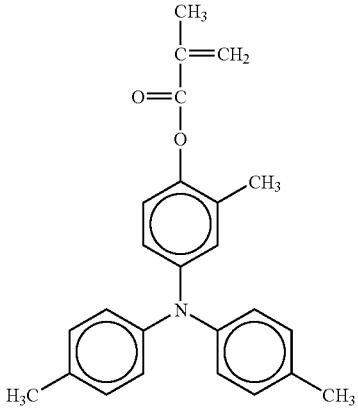
No. 37
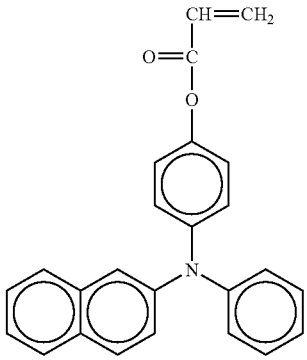
No. 38
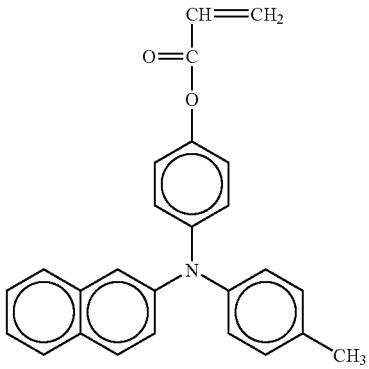

-continued
No. 39
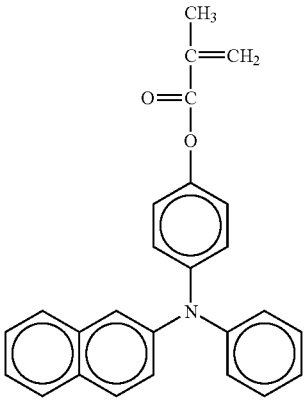
No. 40
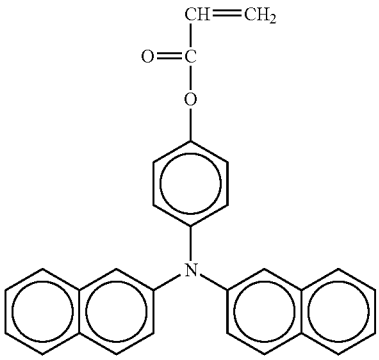
No. 41
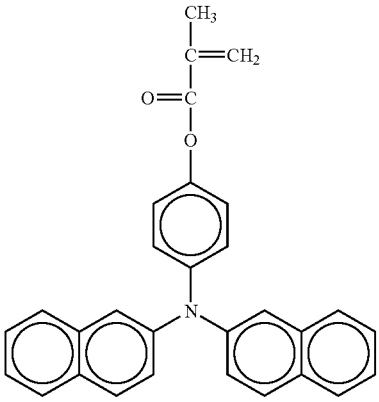
-continued
No. 42
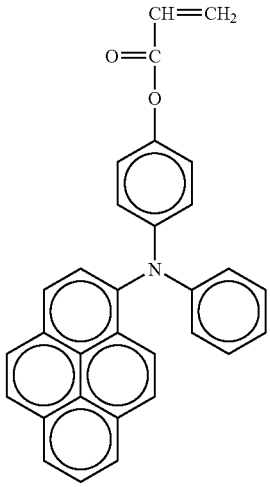
No. 43
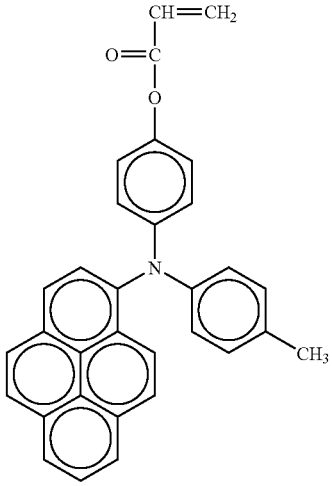
No. 44
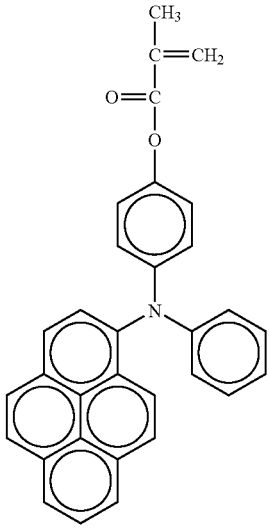

-continued
No. 45
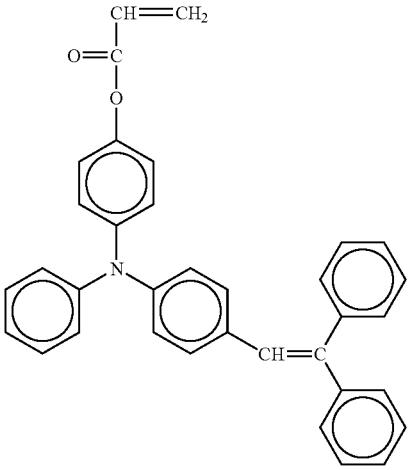
No. 46
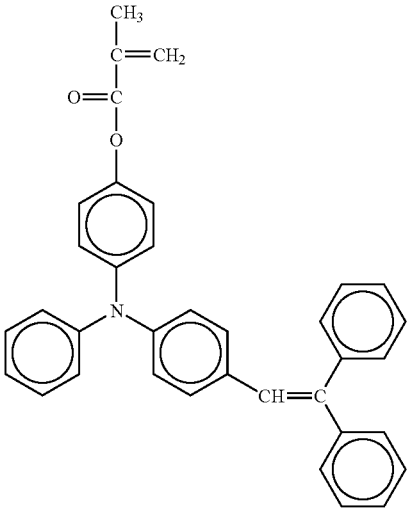
No. 47
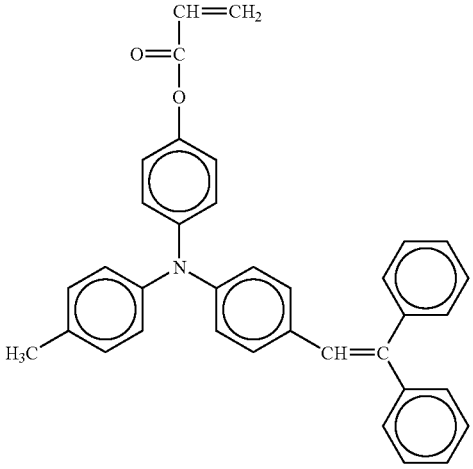
-continued
No. 48
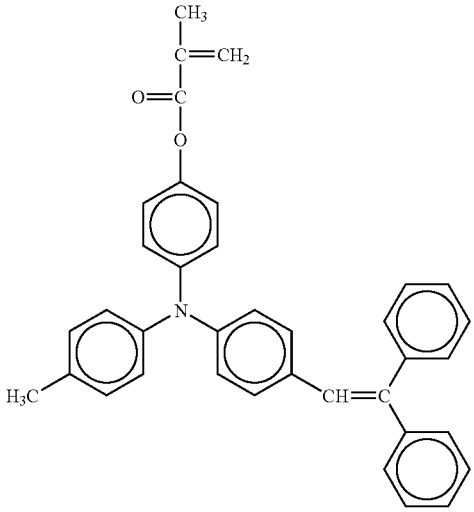
No. 49
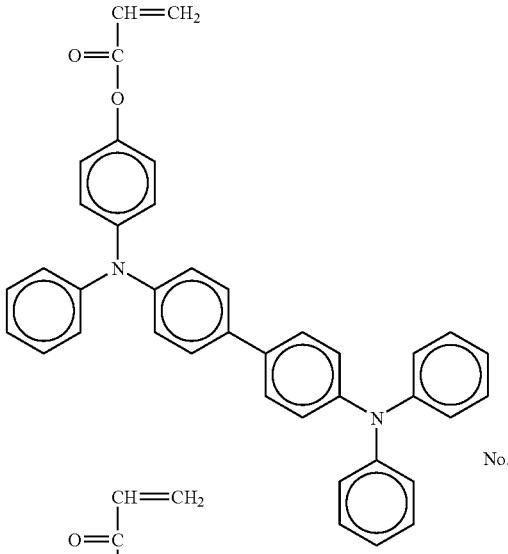
No. 50
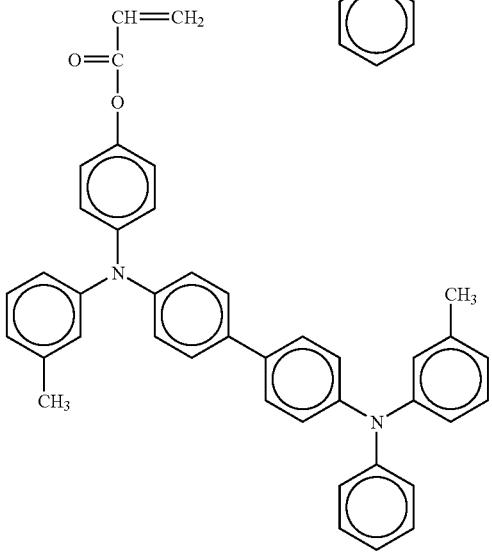

-continued
No. 51
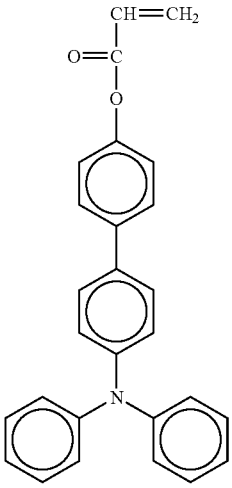
No. 52
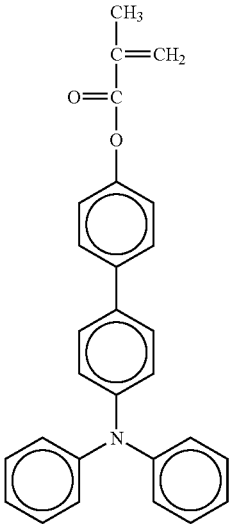
No. 53
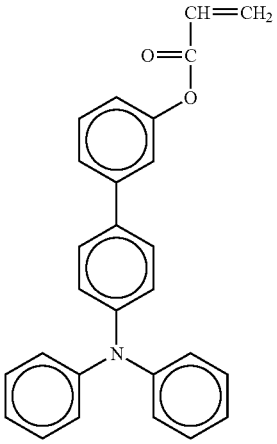
-continued
No. 54
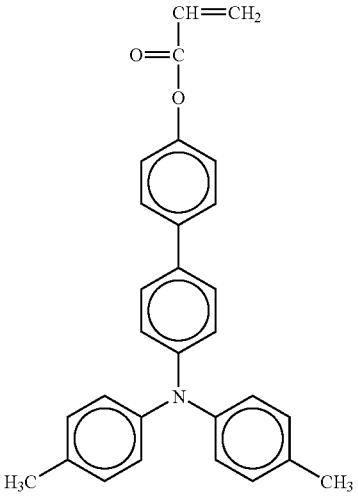
No. 55
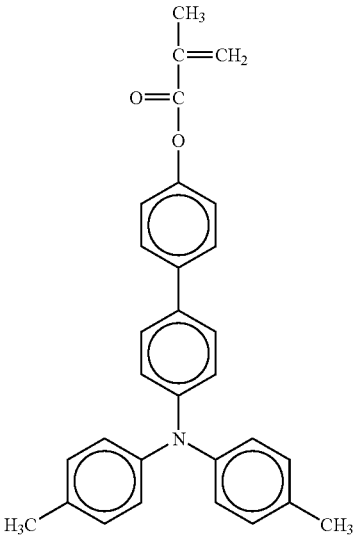
No. 56
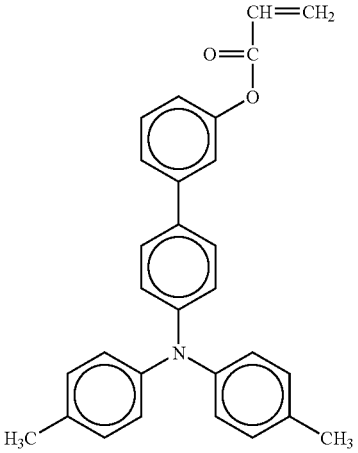

-continued
No. 57
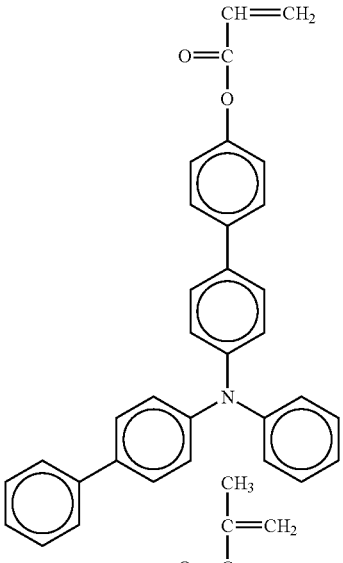
No. 58
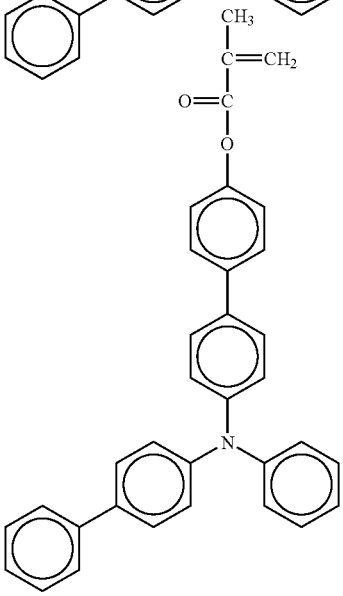
No. 59
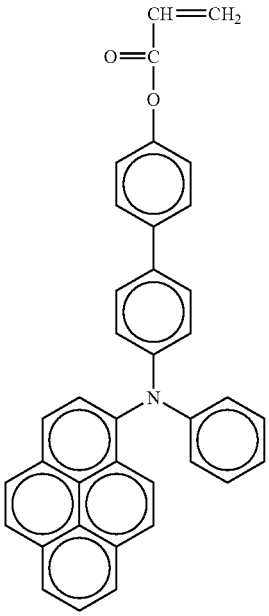
-continued
No. 60
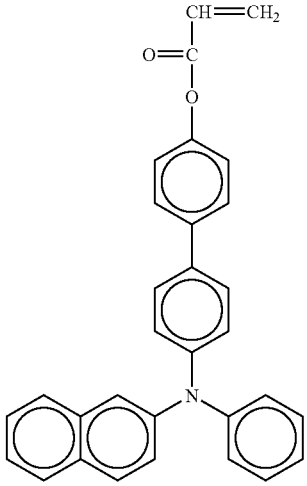
No. 61
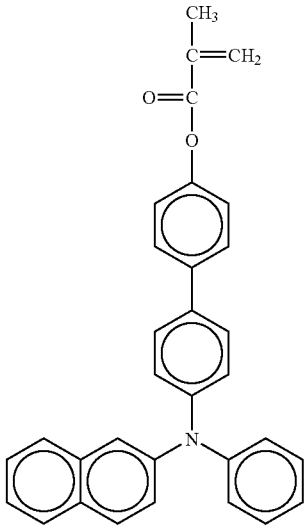
No. 62
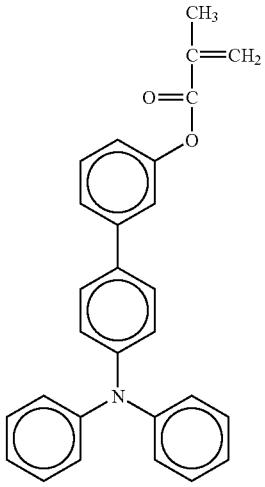

-continued
No. 63
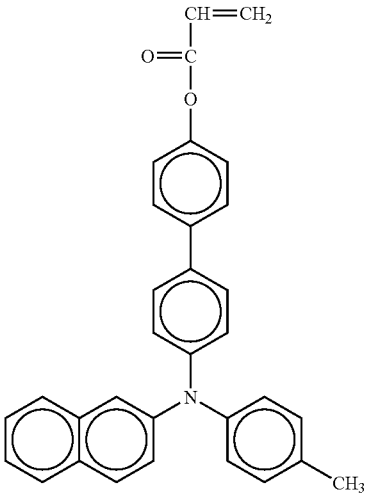
No. 64
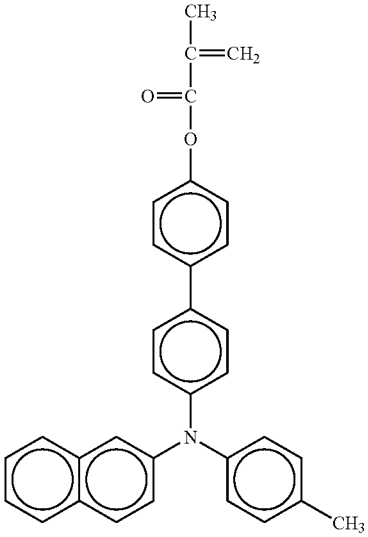
No. 65
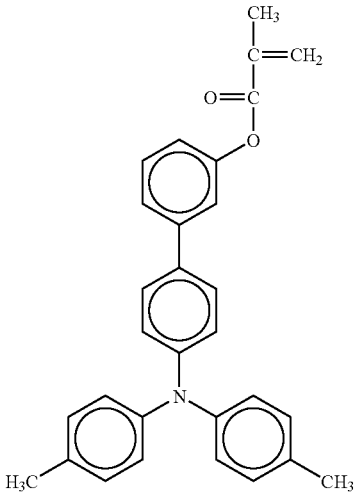
-continued
No. 66
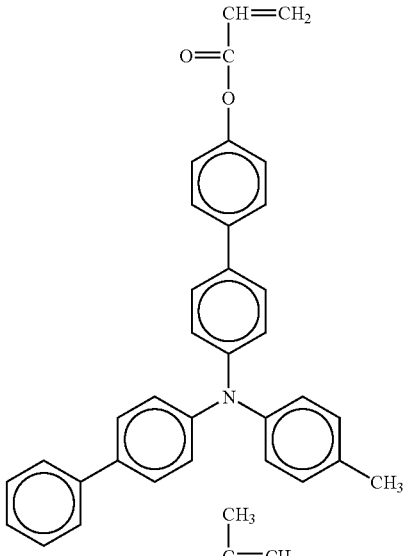
No. 67
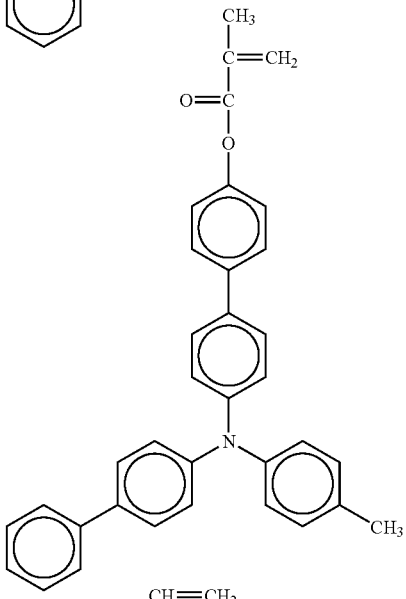
No. 68
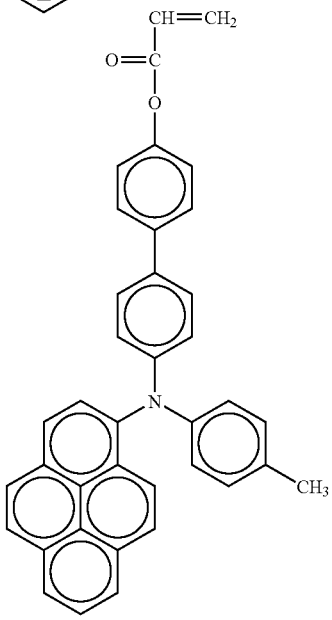

-continued
No. 69
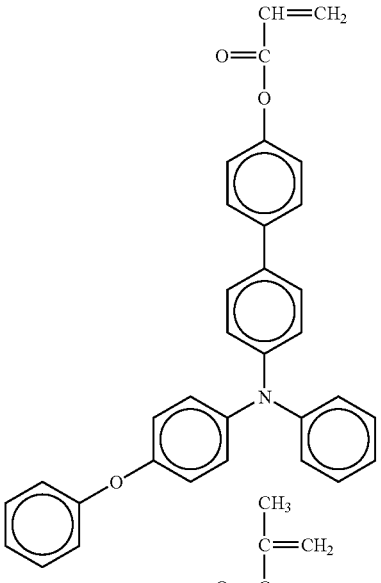
No. 70
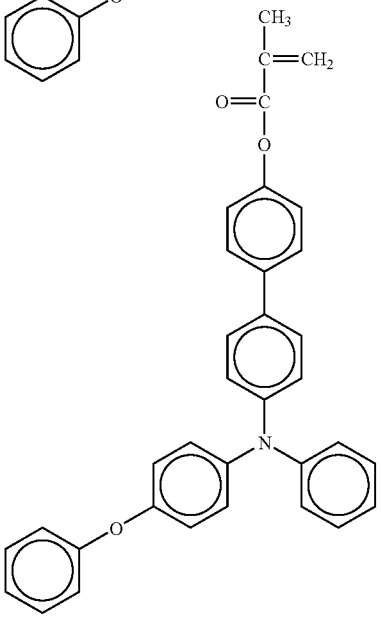
No. 71
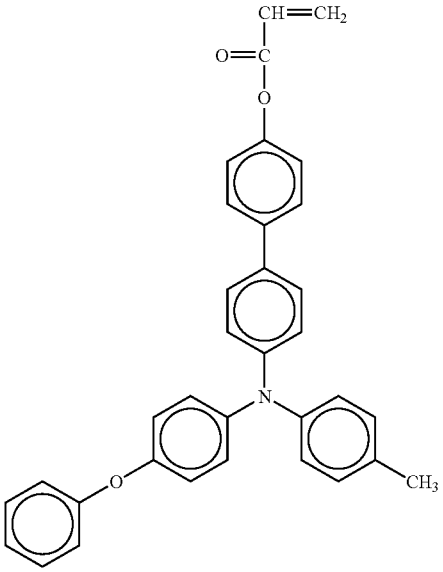
-continued
No. 72
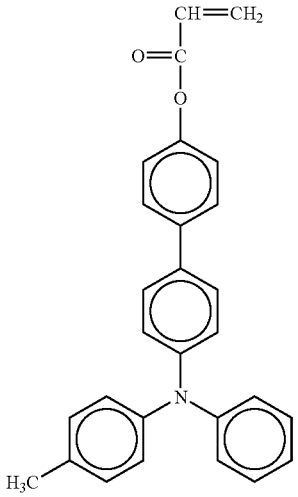
No. 73
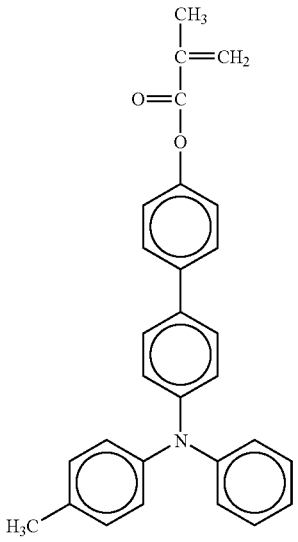
No. 74
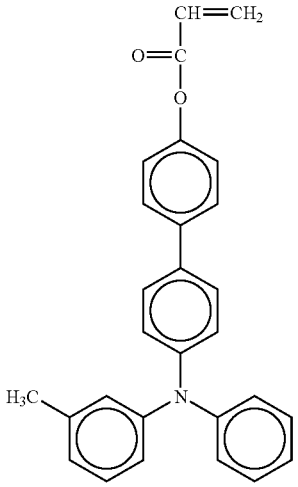

-continued
No. 75
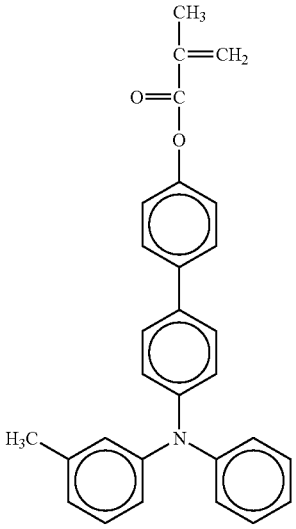
No. 76
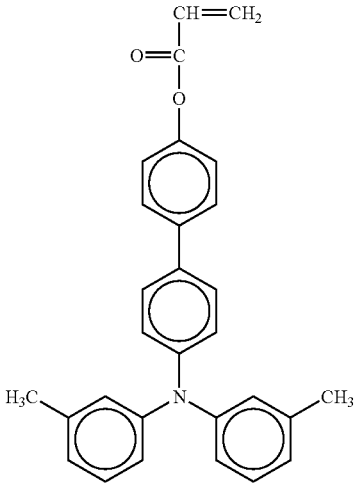
No. 77
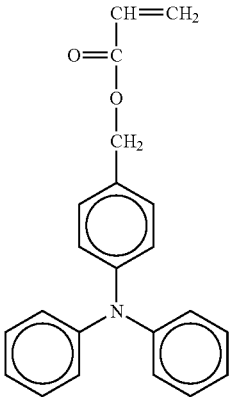
-continued
No. 78
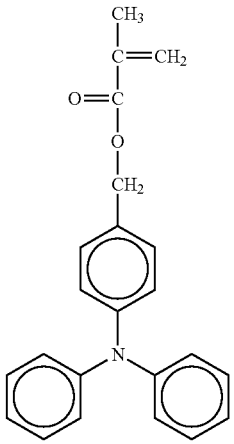
No. 79
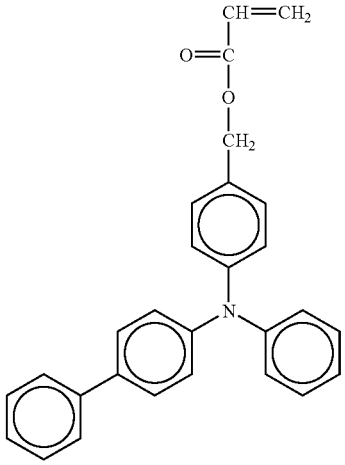
No. 80
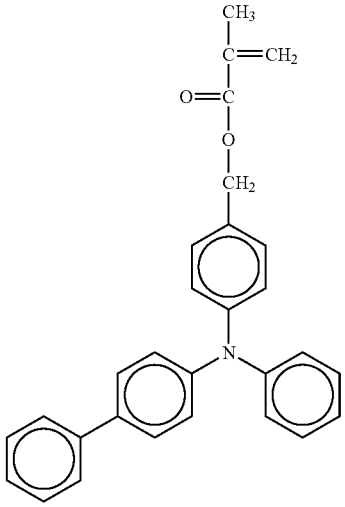

-continued
No. 81
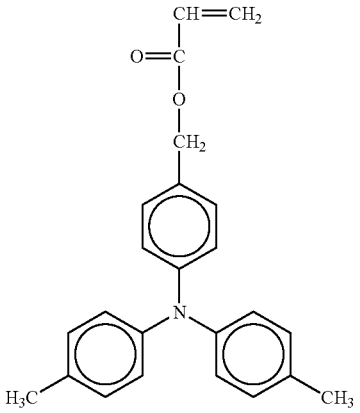
No. 82
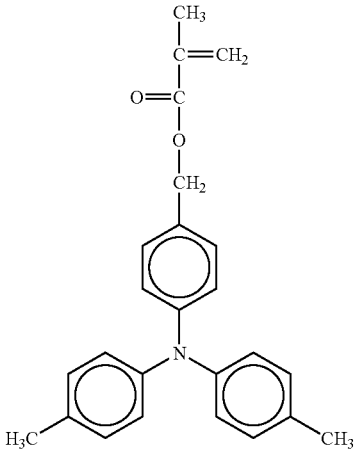
No. 83
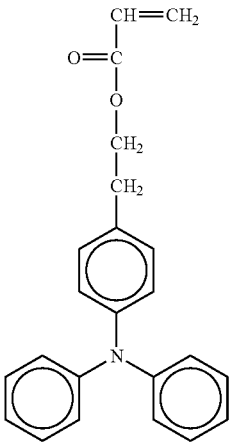
-continued
No. 84
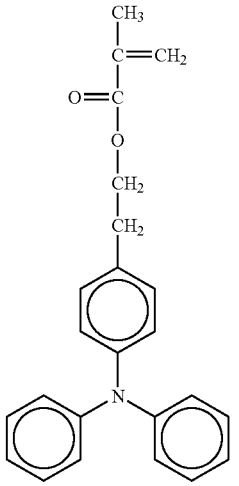
No. 85
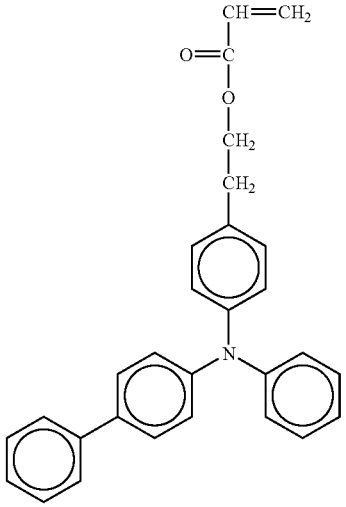
No. 86
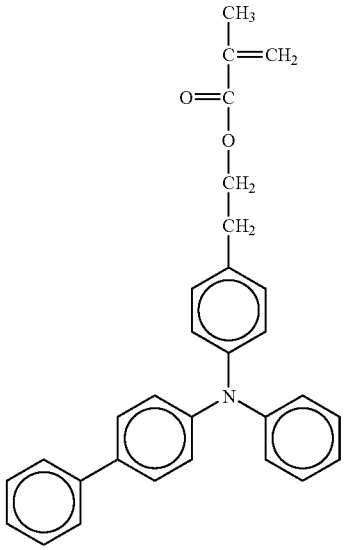

-continued
No. 87
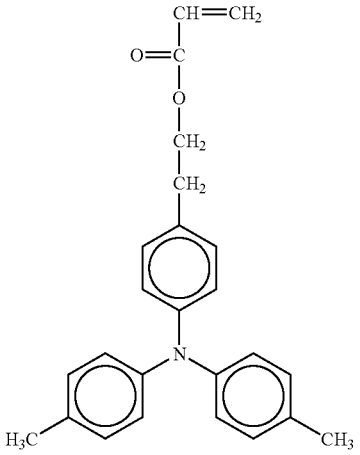
No. 88
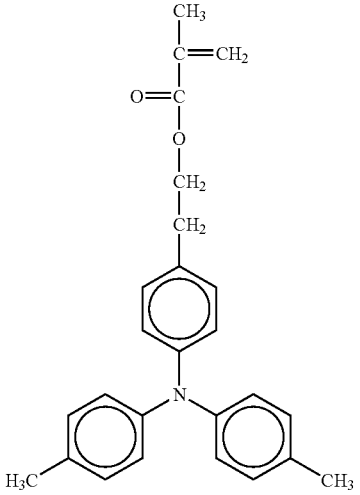
No. 89
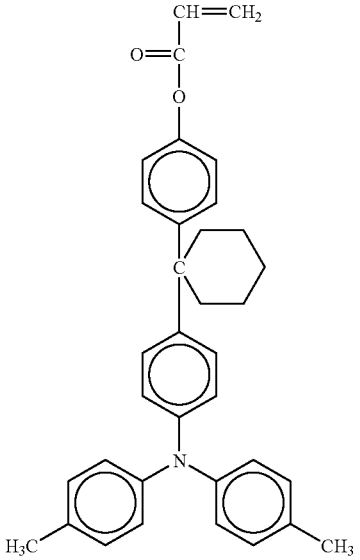
-continued
No. 90
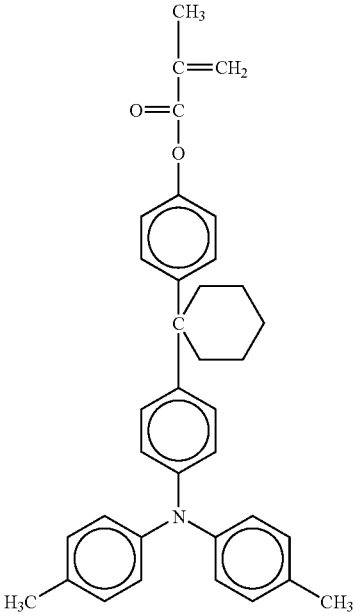
No. 91
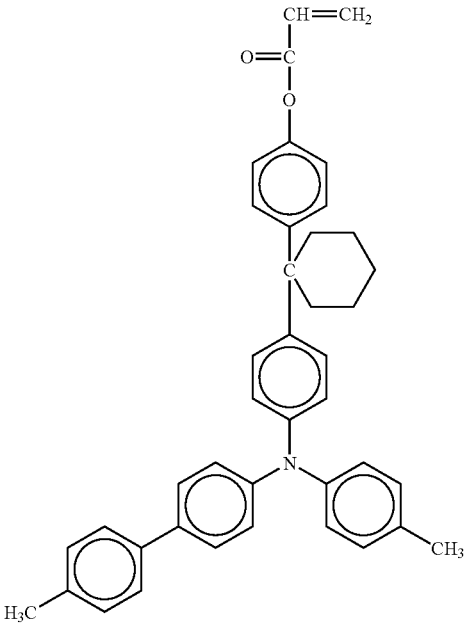

-continued
No. 92
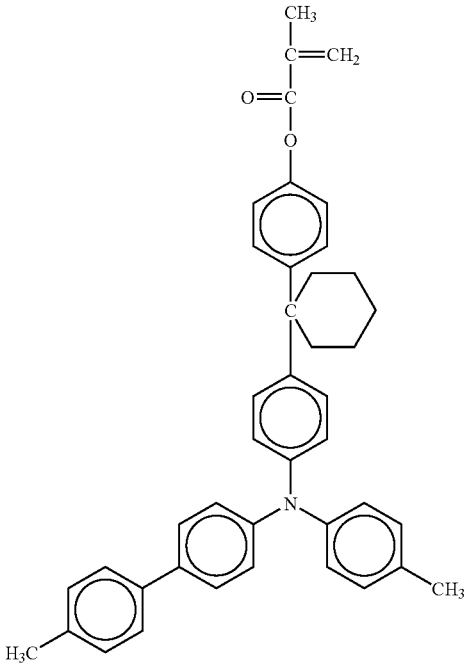
No. 93
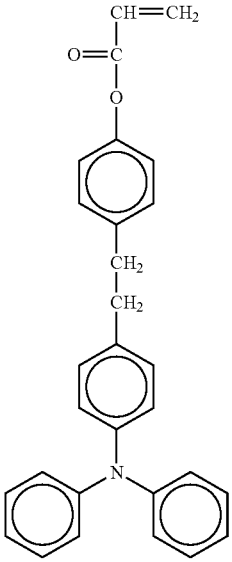
-continued
No. 94
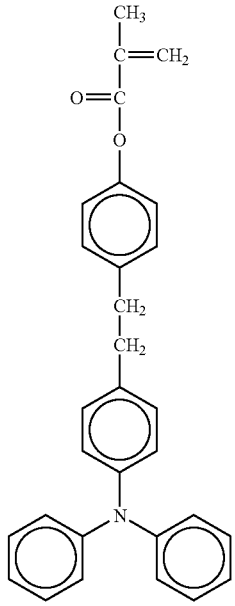
No. 95
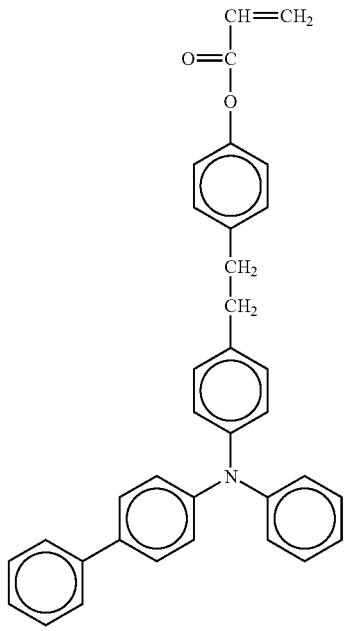

-continued
No. 96
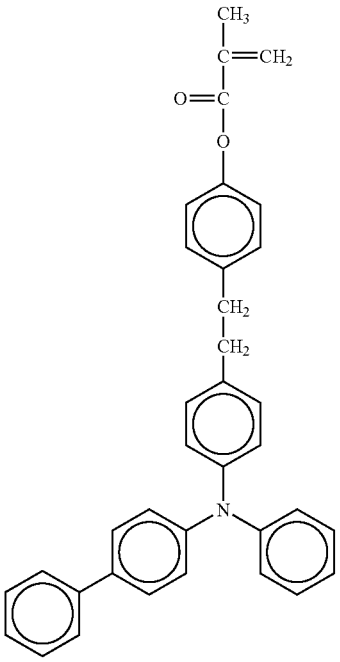
-continued
No. 98
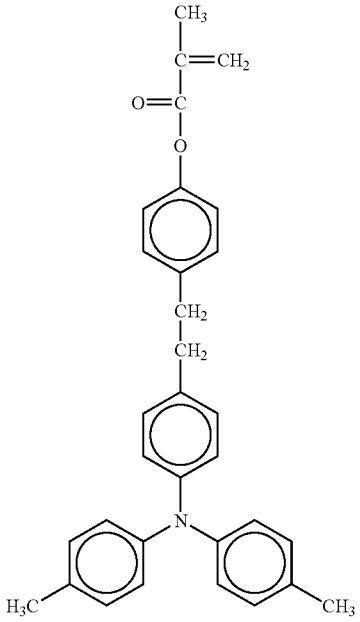
No. 97
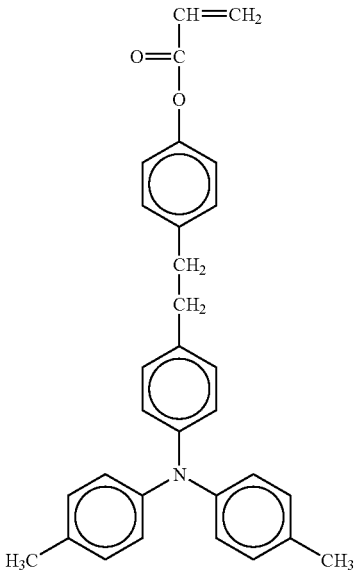
No. 99
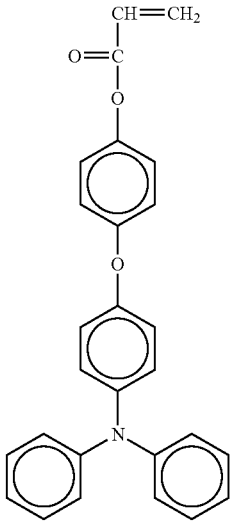

-continued
No. 100
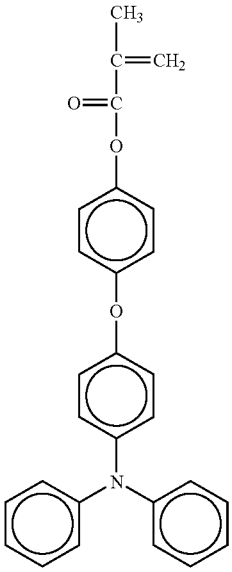
No. 101
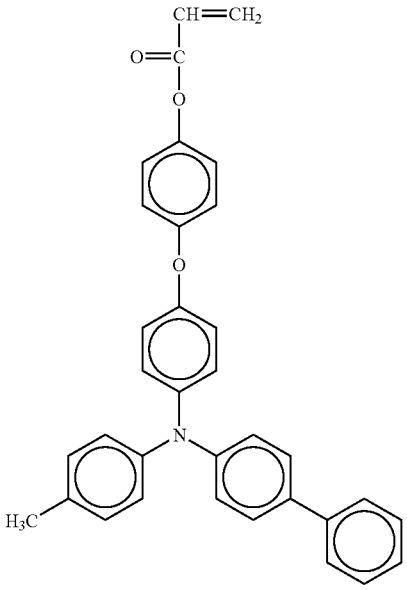
-continued
No. 102
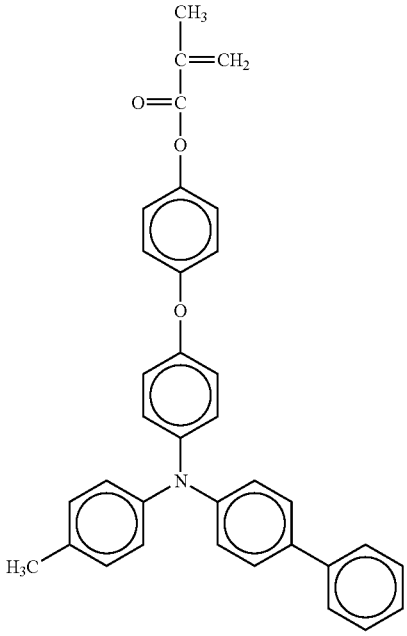
No. 103
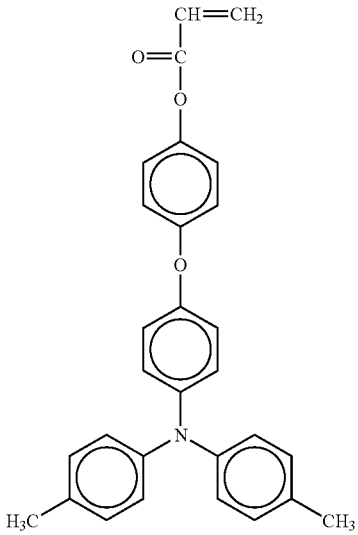

-continued
No. 104
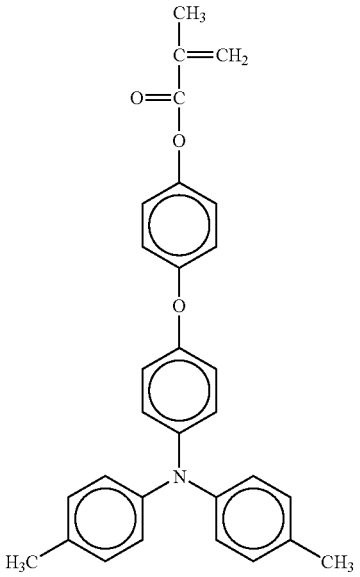
No. 105
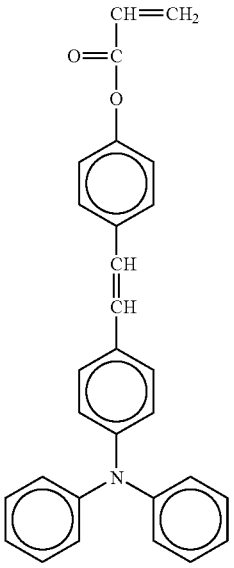
-continued
No. 106
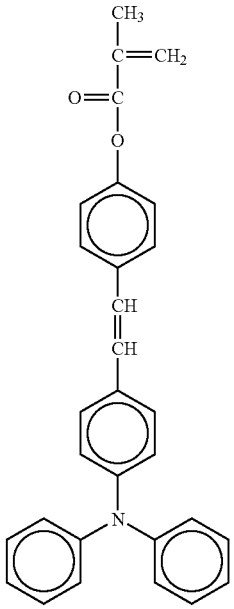
No. 107
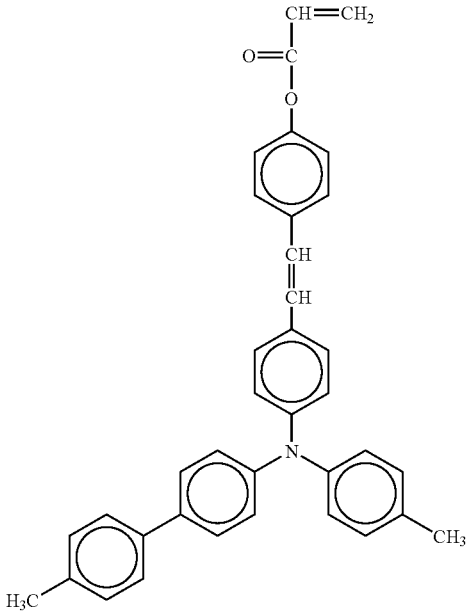

-continued
No. 108
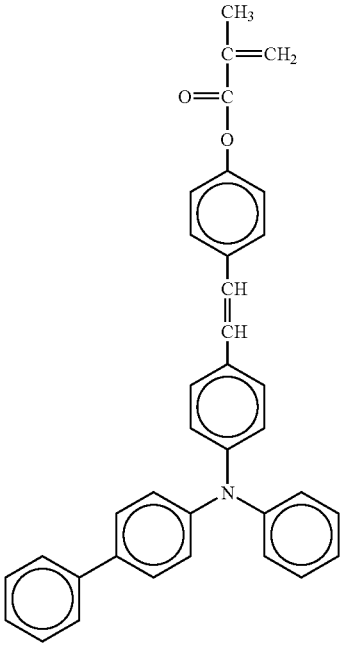
No. 109
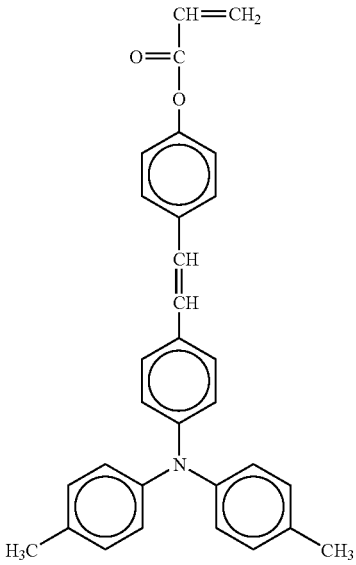
-continued
No. 110
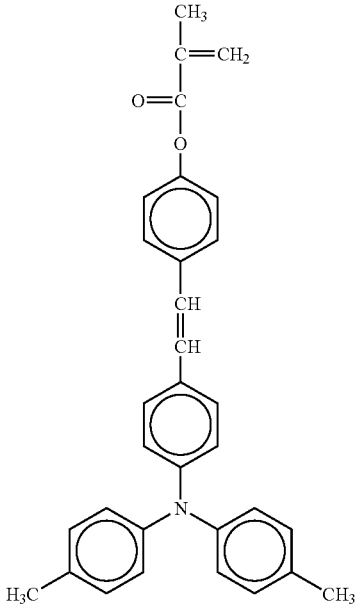
No. 111
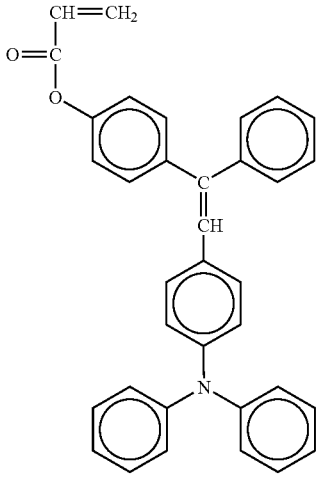
No. 112
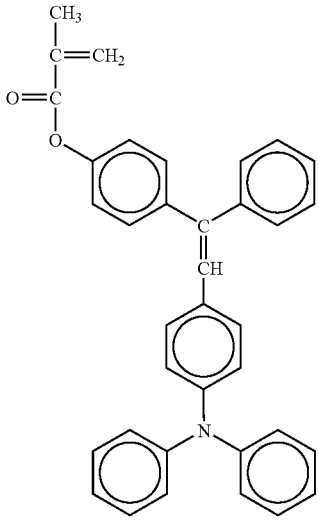

-continued
No. 113
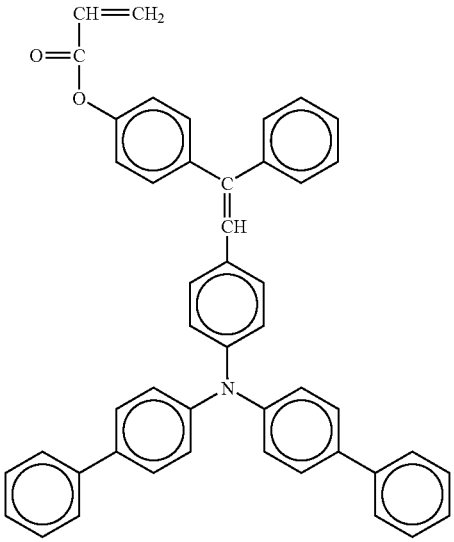
No. 114
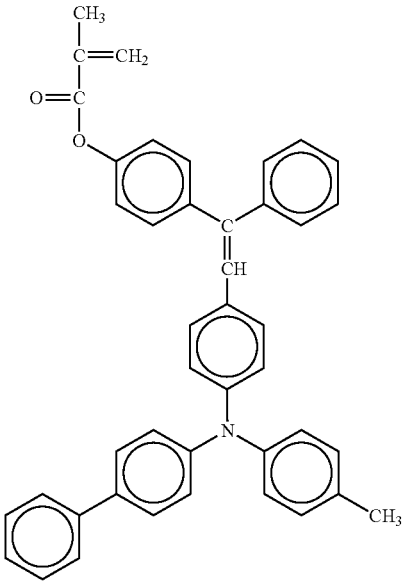
No. 115
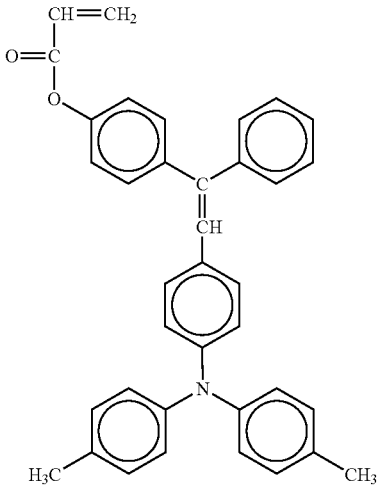
-continued
No. 116
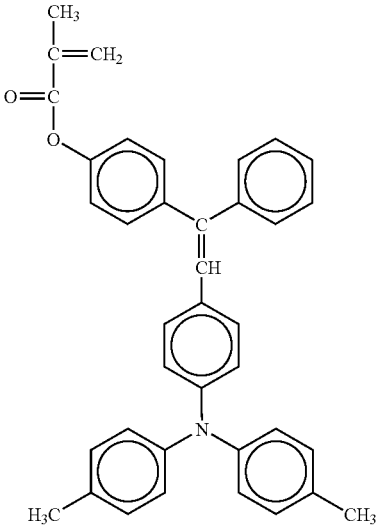
No. 117
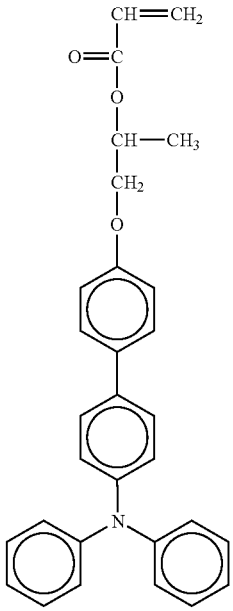

-continued
No. 118
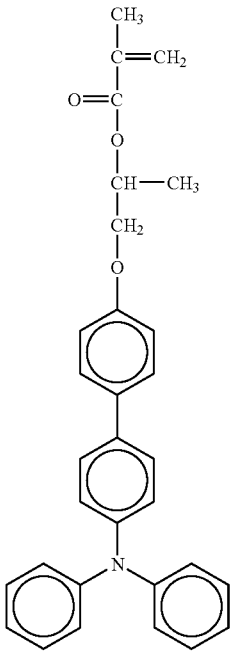
No. 119
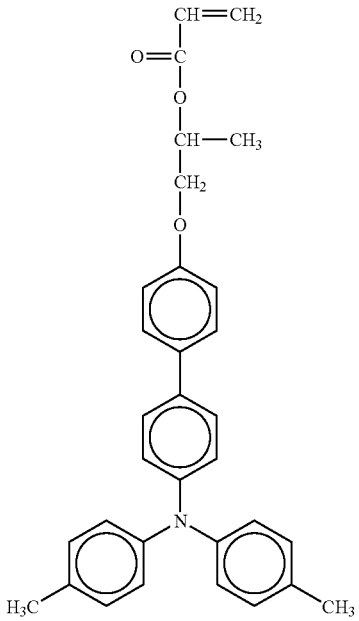
-continued
No. 120
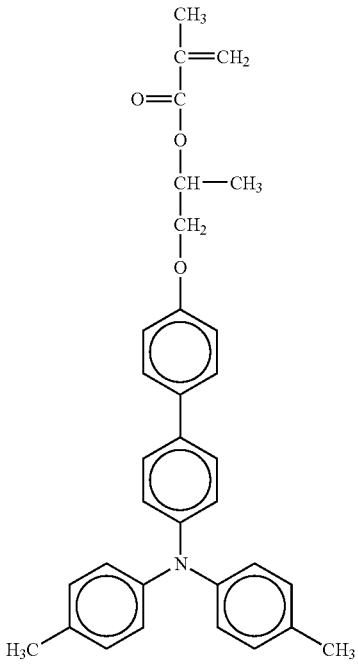
No. 121
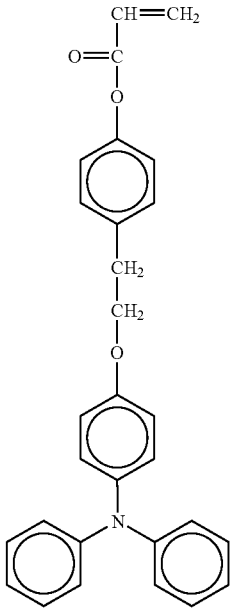

-continued
No. 122
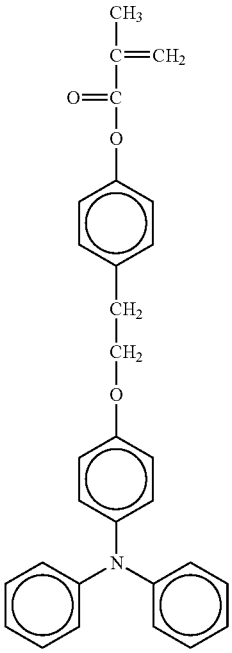
-continued
No. 124
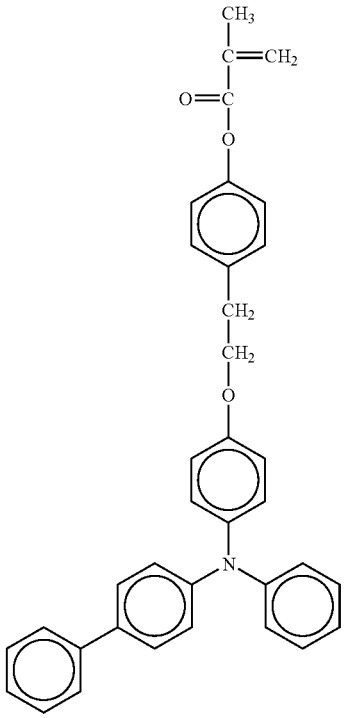
No. 123
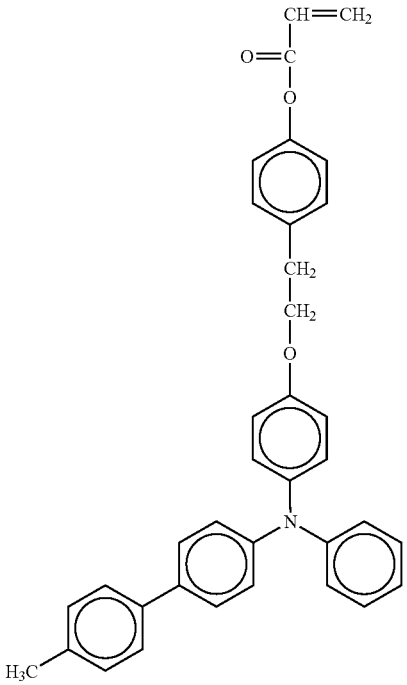
No. 125
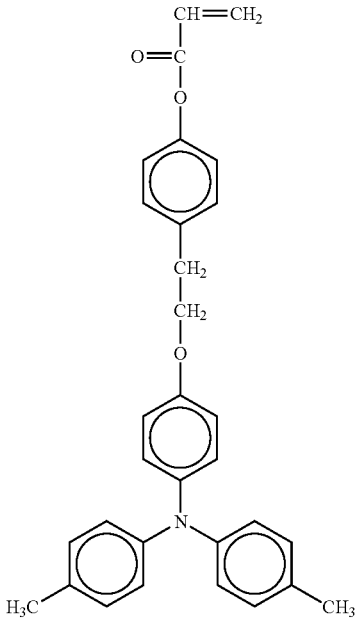

-continued
No. 126
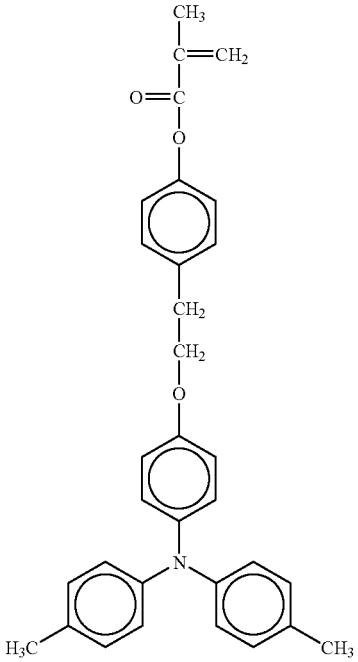
-continued
No. 128
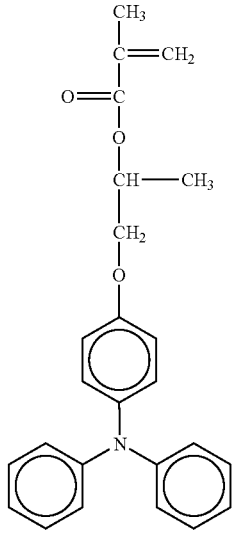
No. 127
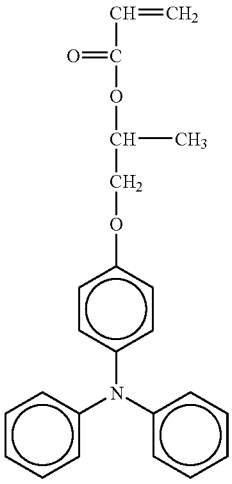
No. 129
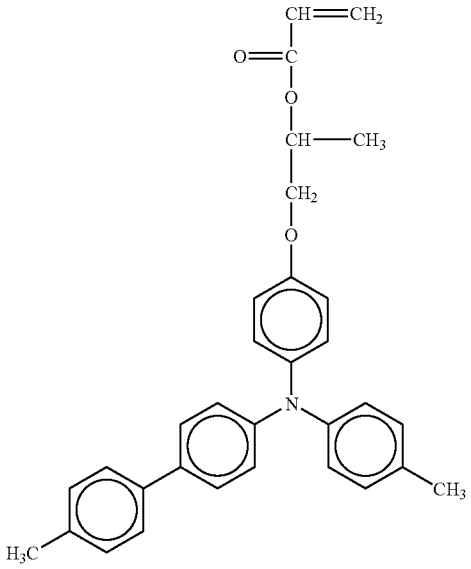

-continued
No. 130
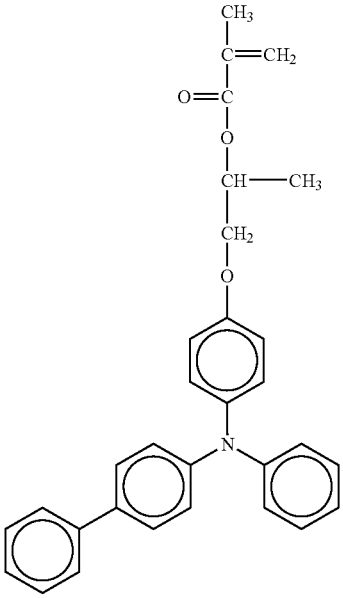
No. 131
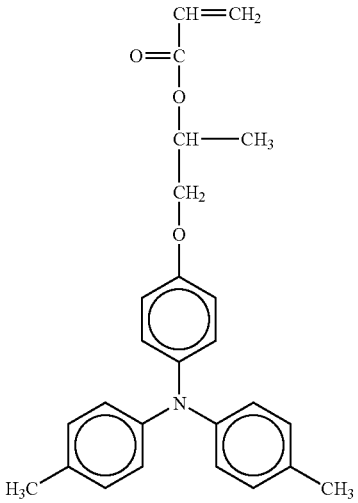
No. 132
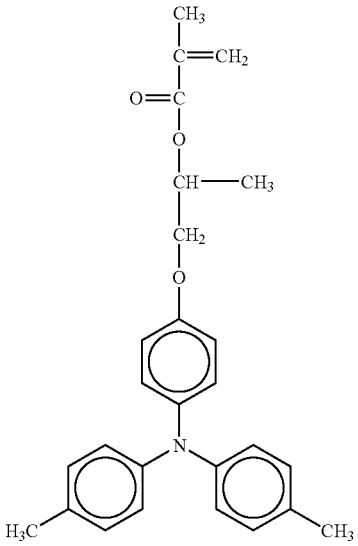
-continued
No. 133
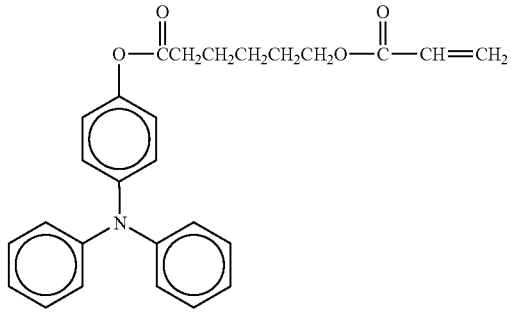
No. 134
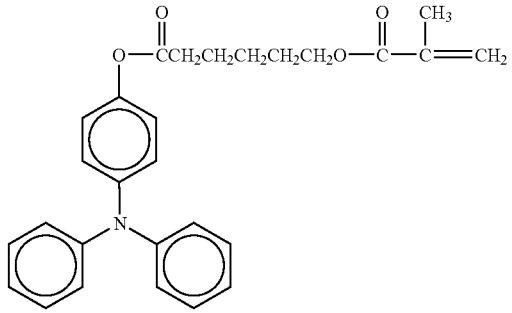
No. 135
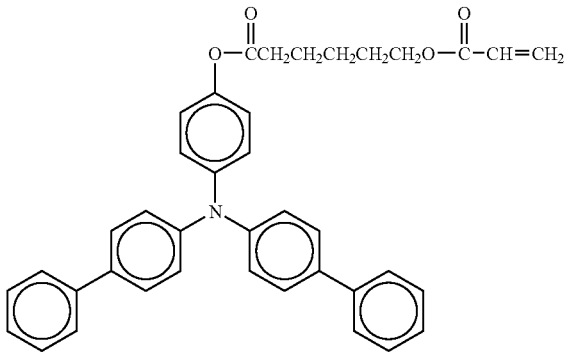
No. 136
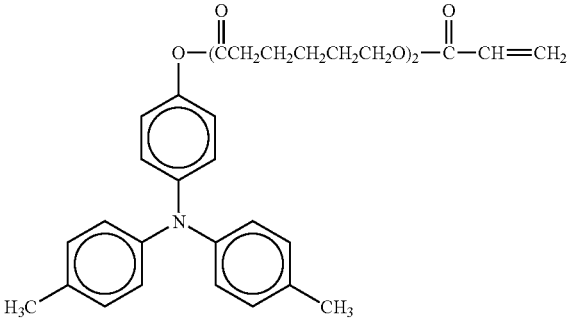

-continued
No. 137
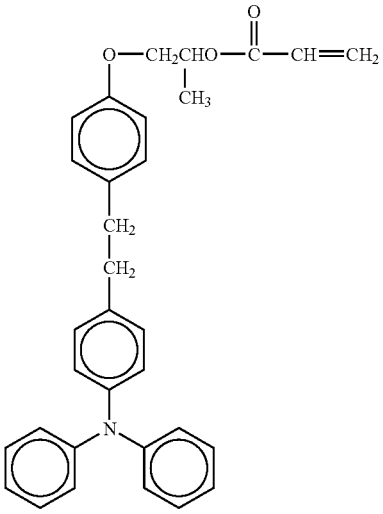
No. 138
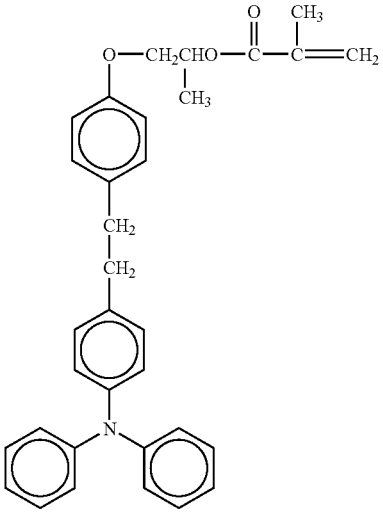
No. 139
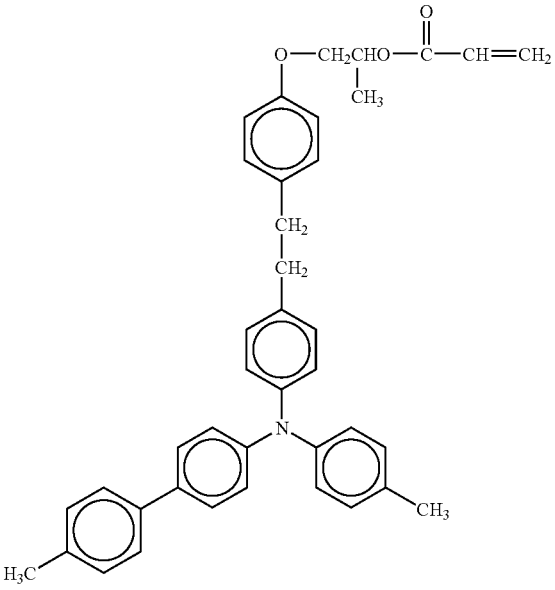
-continued
No. 140
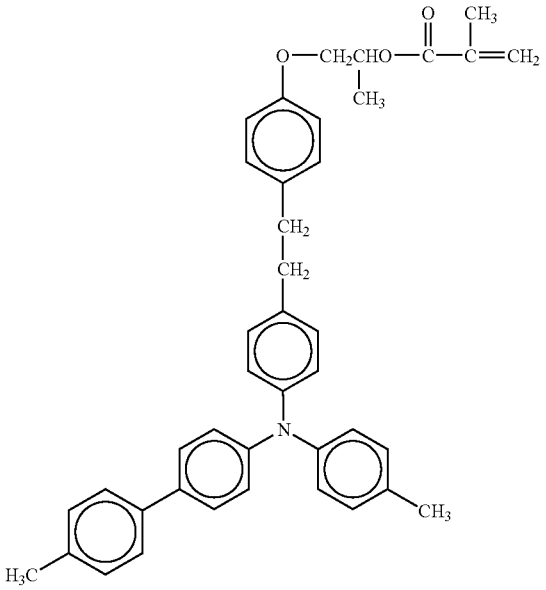
No. 141
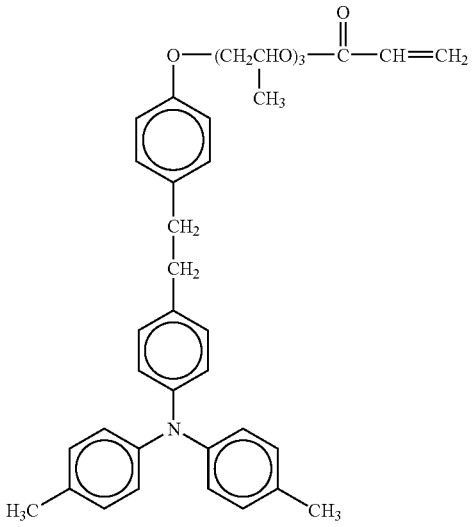

-continued
No. 142
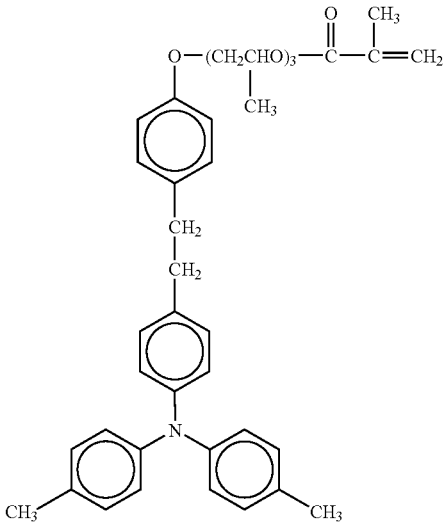
No. 143
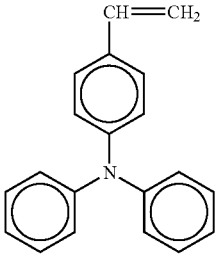
No. 144
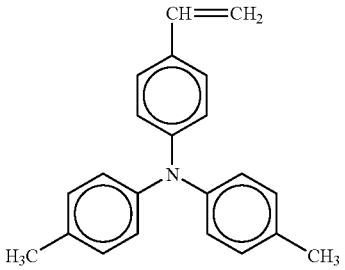
No. 145
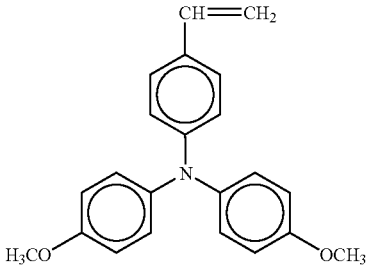
-continued
No. 146
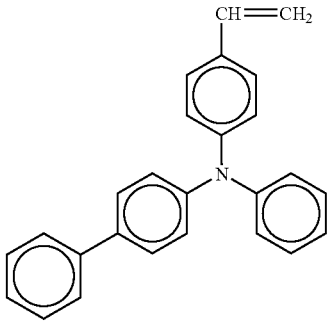
No. 147
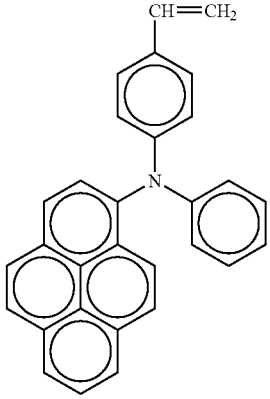
No. 148
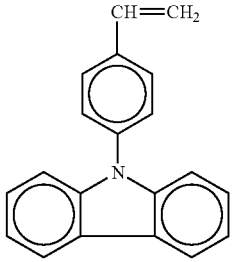
No. 149
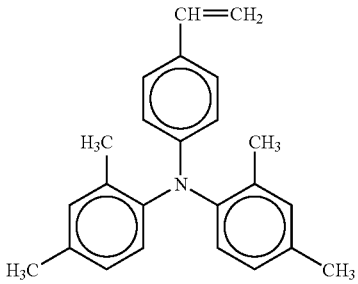
No. 150
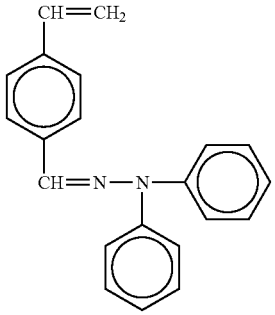

-continued
No. 151
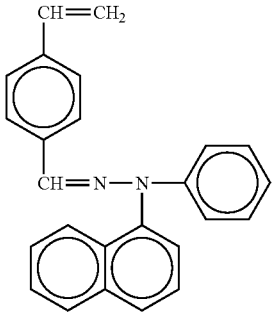
No. 152
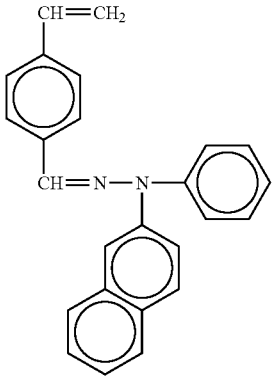
No. 153
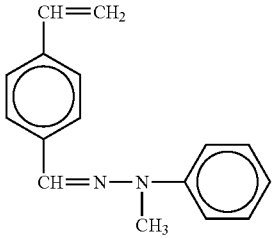
No. 154
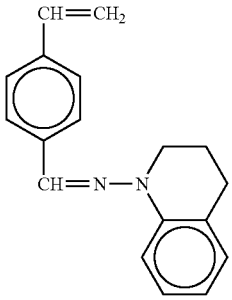
No. 155
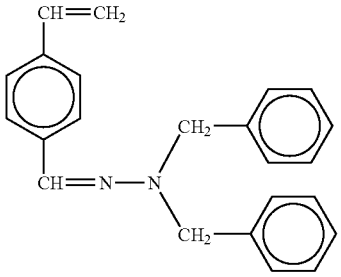
-continued
No. 156
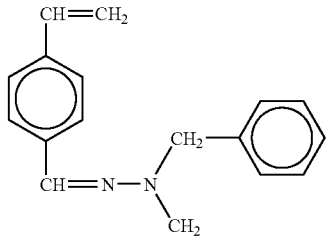
No. 157
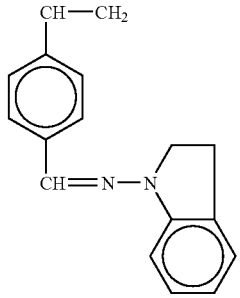
No. 158
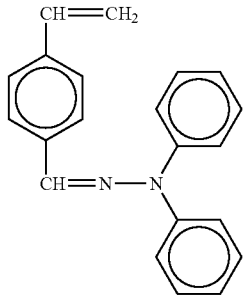
No. 159
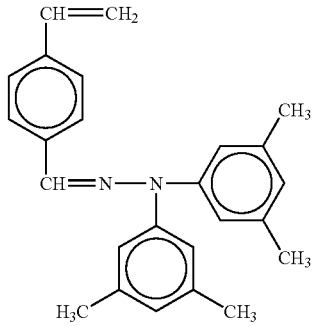
No. 160
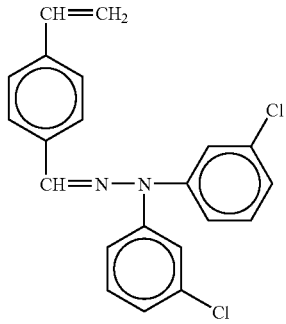
The radical polymerizable monofunctional monomers are used for imparting a charge transport property to the resultant protective layer. The added amount of the radical polymerizable monofunctional monomers is preferably from 20 to 80% by weight, and more preferably from 30 to 70% by weight, based on the total weight of the protective layer. When the added amount is less than 20% by weight, good charge transport property cannot be imparted to the resultant polymer, and thereby the electric properties (such as photosensitivity and residual potential) of the resultant photoreceptor deteriorate. In contrast, when the added amount is greater than 80% by weight, the crosslinking density of the resultant protective layer decreases, and thereby the abrasion resistance of the resultant photoreceptor deteriorates. From this point of view, the added amount of the monofunctional monomers is from 30 to 70% by weight.

The crosslinked protective layer is typically prepared by reacting (crosslinking) at least a radical polymerizable tri- or poly-functional monomer and a radical polymerizable monofunctional monomer. However, in order to reduce the viscosity of the coating liquid, to relax the stress of the protective layer, and to reduce the surface energy and friction coefficient of the protective layer, known radical polymerizable mono- or di-functional monomers and radical polymerizable oligomers having no charge transport structure can be used in combination therewith.

Specific examples of the radical polymerizable monofunctional monomers having no charge transport structure include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isostearyl acrylate, stearyl acrylate, styrene, etc.

Specific examples of the radical polymerizable difunctional monomers having no charge transport structure include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacryalte, neopentylglycol diacrylate, bisphenol A-ethyleneoxy-modified diacrylate, bisphenol F-ethyleneoxy-modified diacrylate, neopentylglycol diacryalte, etc.

Specific examples of the mono- or di-functional monomers for use in imparting a function such as low surface energy and/or low friction coefficient to the crosslinked protective layer include fluorine-containing monomers such as octafluoropentyl acrylate, 2-perfluorooctylethyl acrylate, 2-perfluorooctylethyl methacrylate, and 2-perfluoroisononylethyl acrylate; and vinyl monomers, acrylates and methacrylates having a polysiloxane group such as siloxane units having a repeat number of from 20 to 70 which are described in Japanese Patent Publications Nos. 05-60503 and 06-45770 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl).

Specific examples of the radical polymerizable oligomers include epoxyacryalte oligomers, urethane acrylate oligomers, polyester acrylate oligomers, etc.

The added amount of such mono- and di-functional monomers is preferably not greater than 50 parts by weight, and more preferably not greater than 30 parts by weight, per 100 parts by weight of the tri- or poly-functional monomers used. When the added amount is greater than 100 parts by weight of the tri- or poly-functional monomers used, the crosslinking density decreases, and thereby the abrasion resistance of the resultant protective layer deteriorates.

In addition, in order to efficiently crosslink the protective layer, a polymerization initiator can be added to the protective layer coating liquid. Suitable polymerization initiators include heat polymerization initiators and photo polymerization initiators. The polymerization initiators can be used alone or in combination.

Specific examples of the heat polymerization initiators include peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide, t-butylhydroperoxide, cumenehydroperoxide, lauroyl peroxide, and 2,2-bis(4,4-di-t-butylperoxycyclohexy)propane; and azo type initiators such as azobisisobutyronitrile, azobiscyclohexanecarbonitrile, azobisbutyric acid methyl ester, hydrochloric acid salt of azobisisobutylamidine, and 4,4'-azobis-cyanovaleric acid.

Specific examples of the photopolymerization initiators include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acrylated benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, etc. Photopolymerization accelerators can be used alone or in combination with the above-mentioned photopolymerization initiators. Specific examples of the photopolymerization accelerators include triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, etc.

The added amount of the polymerization initiators is preferably from 0.5 to 40 parts by weight, and more preferably from 1 to 20 parts by weight, per 100 parts by weight of the total weight of the radical polymerizable monomers used.

In order to relax the stress of the crosslinked protective layer and to improve the adhesion of the protective layer to the CTL, the protective layer coating liquid may include additives such as plasticizers, leveling agent, and low molecular weight charge transport materials having no radical polymerizability. Specific examples of the plasticizers include known plasticizers for use in general resins, such as dibutyl phthalate, and dioctyl phthalate. The added amount of the plasticizers in the protective layer coating liquid is preferably not greater than 20% by weight, and more preferably not greater than 10% by weight, based on the total solid components included in the coating liquid. Specific examples of the leveling agents include silicone oils (such as dimethylsilicone oils, and methylphenylsilicone oils), and polymers and oligomers having a perfluoroalkyl group in their side chains. The added amount of the leveling agents is preferably not greater than 3% by weight based on the total solid components included in the coating liquid.

The crosslinked protective layer is typically prepared by coating a coating liquid including a radical polymerizable tri- or poly-functional monomer and a radical polymerizable monofunctional monomer on the CTL and then crosslinking the coated layer. When the monomers are liquid, it may be possible to dissolve other components in the monomers, resulting in preparation of the protective layer coating liquid. The coating liquid can optionally include a solvent in order to dissolve the other components and/or to reduce the viscosity of the coating liquid. Specific examples of the solvents include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; etc. These solvents can be used alone or in combination. The added amount of the solvents is determined depending on the solubility of the solid components, the coating method used, and the target thickness of the protective layer. Coating methods such as dip coating methods, spray coating methods, bead coating methods, and ring coating methods can be used for forming the protective layer.

After coating a protective layer coating liquid, energy such as heat energy, photo energy and radiation energy is applied to the coated layer to crosslink the layer. Specific examples of the method for applying heat energy are as follows:

(1) applying heated gas (such as air and nitrogen gas) thereto;

(2) contacting a heated material thereto; and (3) irradiating the coated layer with light or electromagnetic waves from the coated layer side or the opposite side.

The temperature at which the coated protective layer is heated is preferably from 100 to 170° C. When the temperature is too low, the crosslinking speed becomes too slow, and thereby a problem in that the coated layer is not sufficiently crosslinked is caused. When the temperature is too high, the crosslinking reaction is unevenly performed, and thereby a problem in that the resultant protective layer has a large strain or includes non-reacted functional groups is caused. In order to uniformly perform the crosslinking reaction, a method in which at first the coated layer is heated at a relatively low temperature (not higher than about 100° C.), followed by heating at a relatively high temperature (not lower than about 170° C. is preferably used. Specific examples of the light source for use in photo-crosslinking the coated layer include ultraviolet light emitting devices such as high pressure mercury lamps and metal halide lamps. In addition, visible light emitting lamps can also be used if the radical polymerizable monomers and the photopolymerization initiators used have absorption in a visible region. The illuminance intensity is preferably from 50 to 1000 mW/cm$^2$. When the illuminance intensity is too low, it takes a long time until the coated layer is crosslinked. In contrast, when the illuminance intensity is too high, a problem in that the crosslinking reaction is unevenly performed, thereby forming wrinkles in the resultant protective layer, or the layer includes non-reacted reaction groups therein is caused. In addition, a problem in that due to rapid crosslinking, the resultant protective layer causes cracks or peeling occurs. Specific examples of the radiation energy applying methods include methods using electron beams. Among these methods, the methods using heat or light are preferably used because the reaction speed is high and the energy applying devices have a simple structure.

The thickness of the crosslinked protective layer is preferably from 1 to 10 μm, and more preferably from 2 to 8 μm. When the crosslinked protective layer is greater than 8 μm, the above-mentioned cracking and peeling problems occurs. When the thickness is not greater than 8 μm, the margin for the cracking and peeling problems can be increased. Therefore, a relatively large amount of energy can be applied to the coated layer, and thereby crosslinking density can be further increased. In addition, flexibility in choosing materials for imparting good abrasion resistance to the protective layer and flexibility in setting crosslinking conditions can be enhanced. In general, radical polymerization reaction is obstructed by oxygen included in the air, namely, crosslinking is not well performed in the surface portion (from 0 to about 1 μm in the thickness direction) of the coated layer due to oxygen in the air, resulting information of unevenly-crosslinked layer. Therefore, if the crosslinked protective layer is too thin (i.e., the thickness of the protective layer is less than about 1 μm), the layer has poor abrasion resistance. Further, when the protective layer coating liquid is coated directly on a CTL, the components included in the CTL tends to be dissolved in the coated liquid, resulting in migration of the components into the protective layer. In this case, if the protective layer is too thin, the components are migrated into the entire protective layer, resulting in occurrence of a problem in that crosslinking cannot be well performed or the crosslinking density is low. Thus, the thickness of the protective layer is preferably not less than 1 μm so that the protective layer has good abrasion resistance and scratch resistance. However, if the entire protective layer is abraded, the CTL located below the protective layer is abraded more easily than the protective layer. In this case, problems in that the photosensitivity of the photoreceptor seriously changes and uneven half tone images are produced occur. In order that the resultant photoreceptor can produce high quality images for a long period of time, the crosslinked protective layer preferably has a thickness not less than 2 μm.

When the crosslinked protective layer, which is formed as an outermost layer of a photoreceptor having a CGL, and CTL, is insoluble in organic solvents, the resultant photoreceptor has dramatically improved abrasion resistance and scratch resistance. The solvent resistance of a protective layer can be checked by the following method:

(1) dropping a solvent, which can well dissolve polymers, such as tetrahydrofuran and dichloromethane, on the surface of the protective layer;

(2) naturally drying the solvent;

(3) the surface of the protective layer is visually observed to determine whether the condition of the surface portion is changed.

If the protective layer has poor solvent resistance, the following phenomena are observed:

(1) the surface portion is recessed while the edge thereof is projected;

(2) the charge transport material in the protective layer is crystallized, and thereby the surface portion is clouded; or (3) the surface portion is at first swelled, and then wrinkled.

If the protective layer has good solvent resistance, the above-mentioned phenomena are not observed.

In order to prepare a crosslinked protective layer having good resistance to organic solvents, the key points are as follows.

(1) to optimize the formula of the protective layer coating liquid, i.e., to optimize the content of each of the components included in the liquid;

(2) to choose a proper solvent for diluting the protective layer coating liquid, while properly controlling the solid content of the coating liquid;

(3) to use a proper method for coating the protective layer coating liquid;

(4) to crosslink the coated layer under proper crosslinking conditions; and (5) to form a CTL which located below the protective layer and is hardly insoluble in the solvent included in the protective layer coating liquid.

It is preferable to use one or more of these techniques.

The protective layer coating liquid can include additives such as binder resins having no radical polymerizable group, antioxidants and plasticizers other than the radical polymerizable tri- or poly-functional monomers having no charge transport structure and radical polymerizable monofunctional monomers having a charge transport structure. Since the added amount of these additives is too large, the crosslinking density decreases and the protective layer causes a phase separation problem in that the crosslinked polymer is separated from the additives, and thereby the resultant protective layer becomes soluble in organic solvents. Therefore, the added amount of the additives is preferably not greater than 20% by weight based on the total weight of the solid components included in the protective layer coating liquid. In addition, in order not to decrease the crosslinking density, the total added amount of the mono- or di-functional monomers, reactive oligomers and reactive polymers in the protective layer coating liquid is preferably not greater than 20% by weight based on the weight of the radical polymerizable tri- or poly-functional monomers. In particular, when the added amount of the di- or poly-functional monomers having a charge transport structure is too large, units having a bulky structure are incorporated in the protective layer while the units are connected with plural chains of the protective layer, thereby generating strain in the protective layer, resulting in formation of aggregates of micro crosslinked materials in the protective layer. Such a protective layer is soluble in organic solvents. The added amount of a radical polymerizable di- or poly-functional monomer having a charge transport structure is determined depending on the species of the monomer used, but is generally not greater than 10% by weight based on the weight of the radical polymerizable monofunctional monomer having a charge transport structure included in the protective layer.

When an organic solvent having a low evaporating speed is used for the protective layer coating liquid, problems which occur are that the solvent remaining in the coated layer adversely affects crosslinking of the protective layer; and a large amount of the components included in the CTL is migrated into the protective layer, resulting in deterioration of crosslinking density or formation of an unevenly crosslinked protective layer (i.e., the crosslinked protective layer becomes soluble in organic solvents). Therefore, it is preferable to use solvents such as tetrahydrofuran, mixture solvents of tetrahydrofuran and methanol, ethyl acetate, methyl ethyl ketone, and ethyl cellosolve. It is preferable that one or more proper solvents are chosen among the solvents in consideration of the coating method used. When the solid content of the protective layer coating liquid is too low, similar problems occur. The upper limit of the solid content is determined depending on the target thickness of the protective layer and the target viscosity of the protective layer coating liquid, which is determined depending on the coating method used, but in general, the solid content of the protective layer coating liquid is preferably from 10 to 50% by weight. Suitable coating methods for use in preparing the crosslinked protective layer include methods in which the weight of the solvent included in the coated layer is as low as possible, and the time during which the solvent in the coated layer contacts the CTL on which the coating liquid is coated is as short as possible. Specific examples of such coating methods include spray coating methods and ring coating methods in which the weight of the coated layer is controlled so as to be light. In addition, in order to control the amount of the components of the CTL migrating into the protective layer so as to be as small as possible, it is preferable to use a charge transport polymer for the CTL and/or to form an intermediate layer, which is hardly soluble in the solvent used for the protective layer coating liquid, between the CTL and the protective layer. When the heating or irradiating energy is low in the crosslinking process, the coated layer is not completely crosslinked. In this case, the resultant layer becomes soluble in organic solvents. In contrast, when the energy is too high, uneven crosslinking is performed, resulting in an increase of non-crosslinked portions or portions at which the radical is terminated, or formation of aggregates of micro crosslinked materials. In this case, the resultant protective layer is soluble in organic solvents. In order to make a protective layer insoluble inorganic solvents, the crosslinking conditions are preferably as follows:

Heat Crosslinking Conditions
Temperature: 100 to 170° C.
Heating time: 10 minutes to 3 hours UV Light Crosslinking Conditions
Illuminance intensity: 50 to 1000 mW/cm$^2$
Irradiation time: 5 seconds to 5 minutes
Temperature of coated material: 50° C. or less In order to make a protective layer insoluble in organic solvents in a case where an acrylate monomer having three acryloyloxy group and a triarylamine compound having one acryloyloxy group are used for the protective layer coating liquid, the weight ratio (A/T) of the acrylate monomer (A) to the triarylamine compound (T) is preferably 7/3 to 3/7. The added amount of a polymerization initiator is preferably from 3 to 20% by weight based on the total weight of the acrylate monomer (A) and the triarylamine compound (T). In addition, a proper solvent is preferably added to the coating liquid. Provided that the CTL, on which the protective layer coating liquid is coated, is formed of a triarylamine compound (serving as a CTM) and a polycarbonate resin (serving as a binder resin), and the protective layer coating liquid is coated by a spray coating method, the solvent of the protective layer coating liquid is preferably selected from tetrahydrofuran, 2-butanone, and ethyl acetate. The added amount of the solvent is preferably from 300 to 1000 parts by weight per 100 parts by weight of the acrylate monomer (A).

After the protective layer coating liquid is prepared, the coating liquid is coated by a spray coating method on a peripheral surface of a drum, which includes, for example, an aluminum cylinder and an undercoat layer, a CGL and a CTL which are formed on the aluminum cylinder. Then the coated layer is naturally dried, followed by drying for a short period of time (from 1 to 10 minutes) at a relatively low temperature (from 25 to 80° C.). Then the dried layer is heated or exposed to UV light to be crosslinked.

When crosslinking is performed using UV light, metal halide lamps are preferably used. In this case, the illuminance intensity of UV light is preferably from 50 mW/cm$^2$ to 1000 mW/cm$^2$. Provided that plural UV lamps emitting UV light of 200 mW/cm$^2$ are used, it is preferable that plural lamps uniformly irradiate the coated layer with UV light along the peripheral surface of the coated drum for about 30 seconds. In this case, the temperature of the drum is controlled so as not to exceed 50° C. When heat crosslinking is performed, the temperature is preferably from 100 to 170° C., and the heating device is preferably an oven with an air blower. When the heating temperature is 150° C., the heating time is preferably from 20 minutes to 3 hours.

It is preferable that after the crosslinking operation, the thus prepared photoreceptor is heated for a time of from 10 minutes to 30 minutes at a temperature of from 100 to 150° C. to remove the solvent remaining in the protective layer. Thus, a photoreceptor (i.e., an image bearer) of the present invention is prepared.

In addition, protective layers in which an amorphous carbon layer or an amorphous SiC layer is formed by a vacuum thin film forming method such as sputtering can also be used for the photoreceptor for use in the present invention.

When a protective layer is formed as an outermost layer of the photoreceptor, there is a case where the discharging light hardly reaches the photosensitive layer if the protective layer greatly absorbs the discharging light, resulting in an increase of residual potential and deterioration of the protective layer. Therefore, the protective layer preferably has a transmittance of not less than 30%, more preferably not less than 50% and even more preferably not less than 85% against the discharging light used.

As mentioned above, by using a charge transport polymer for the CTL and/or forming a protective layer as an outermost layer, the durability of the photoreceptor can be improved. In addition, when such a photoreceptor is used for the below-mentioned tandem type full color image forming apparatus, a new effect can be produced.

In the photoreceptor for use in the present invention, the following antioxidants can be added to the protective layer, CTL, CGL, charge blocking layer, moiré preventing layer, etc., to improve the stability to withstand environmental conditions (particularly, to avoid deterioration of sensitivity and increase of residual potential).

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)-benzene, tetrakis-[methylene-3-(3',5'-di-t-butyl-4'-hydroxyphenyl)-propionate]methane, bis[3,3'-bis(4'-hydroxy-3'-t-butylphenyl)butyric acid]glycol ester, tocopherol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-Containing Compounds triphenylphosphine, tri(nonylphenyl)phosphine, tri(di-nonylphenyl)phosphine, tricresylphosphine, tri(2,4-dibutylphenoxy)phosphine and the like.

These compounds have been used as antioxidants for rubbers, resins and oils and fats, and commercially available. The content of the antioxidants in a layer is from 0.01 to 10% by weight based on the total weight of the layer.

When full color images are formed, color images of various patterns are produced. In this case, all the portions of the photoreceptor are subjected to image forming processes such as imagewise irradiating and developing. In contrast, there are original documents having a fixed color image (such as stamp of approval). Stamp of approval is typically located on an edge portion of a document, and the color thereof is limited. When such images are formed on a photoreceptor, a specific portion of a photoreceptor is mainly used for image formation. In this case, the portion is deteriorated faster than the other portions of the photoreceptor. If a photoreceptor having insufficient durability (i.e., insufficient physical, chemical and mechanical durability) is used therefor, an image problem tends to be caused. However, the photoreceptor for use in the present invention has good durability, and therefore such an image problem is hardly caused.

Electrostatic Latent Image Former

After the image bearer (i.e., the photoreceptor) is charged with a charger, a light irradiator irradiates the charged photoreceptor with imagewise light to form an electrostatic latent image on the photoreceptor, wherein the charger and the light irradiator serve as an electrostatic latent image former.

The electrostatic latent image former typically includes a charger configured to uniformly charge the photoreceptor and a light irradiator.

The charger for use in the image forming apparatus of the present invention is not particularly limited, and known chargers can be used. Specific examples thereof include contact chargers (e.g., conductive or semi-conductive rollers, brushes, films, and rubber blades); short-range chargers which a charging member charges a photoreceptor with a gap on the order of 100 μm; non-contact chargers such as chargers utilizing corona discharging (e.g., corotrons and scorotrons); etc. The strength of the electric field formed on a photoreceptor by a charger is preferably from 20 to 60 V/μm and more preferably from 30 to 50 V/μm. In this regard, the greater the electric field strength, the better dot reproducibility the resultant image has. However, when the electric field strength is greater than 50 V/μm, problems in that the photoreceptor causes dielectric breakdown and carrier particles are adhered to an electrostatic latent image occur.

The electric field strength (E) is represented by the following equation.

$$E(\text{V}/\mu\text{m})=SV/G$$

wherein SV represents the potential (V) of a non-lighted portion of a photoreceptor at a developing position; and G represents the thickness of the photosensitive layer of the photoreceptor, which includes at least a CGL and a CTL.

Image irradiation is performed by irradiating the charged photoreceptor with imagewise light using a light irradiator. Known light irradiators can be used and a proper light irradiator is chosen and used for the image forming apparatus for which the toner of the present invention is used. Specific examples thereof include optical systems for use in reading images in copiers; optical systems using rod lens arrays; optical systems using laser; and optical systems using a liquid crystal shutter. It is possible to irradiate the photoreceptor from the backside of the photoreceptor.

Specific examples of the light sources for use in the light irradiator include light emitting diodes (LEDs), laser diodes (LDs) and electroluminescence devices (ELs)

The resolution of an electrostatic latent image (and a toner image) depends on the resolution of the image writing light. Namely, the higher the resolution of the image writing light, the better the resolution of the resultant electrostatic latent image. However, when the resolution of the image writing light is high, it takes a long time to write an image. When only one light source is used for image writing, the image processing speed (i.e., the speed of the image bearer) depends on the image writing speed. Therefore, when only one light source is used for image writing, the upper limit of the resolution is about 1200 dpi (dots per inch) and preferably 2400 dpi. When plural light sources (n pieces) are used, the upper limit of the resolution is 1200 (or 2400) dpi×n. Among these light sources, LEDs and LDs are preferably used.

By using a light source emitting light with a wavelength less than 450 nm, high resolution images can be formed. Therefore, such a light source is preferably used for the image forming apparatus of the present invention. In order to emit laser light with such a short wavelength, a technique in that the wavelength of laser light is reduced to one half using a second harmonic generation (SHG) technique or a technique using a wide gap semiconductor is used. In recent years, laser diodes emitting light with a wavelength of from 400 to 410 nm have been developed, and optical devices using such a LD have been developed. These devices can be preferably used for the image forming apparatus of the present invention. From the viewpoint of the materials constituting the CTL and protective layer, the lower limit of the wavelength of the light used for image writing is about 350 nm. It is expected the limit will be lowered by developing new materials and new laser.

Image Developer

The electrostatic latent image formed on the photoreceptor is developed with a image developer using a developer including a toner, and a toner image is formed on the photoreceptor. In this regard, a nega-posi developing method is typically used. Therefore a toner having the same polarity as that of the charges formed on the photoreceptor is used. Both one-component developers including only a toner, and two-component developers including a toner and a carrier can be used for the image forming apparatus of the present invention.

Transferer

The transferer transfers the toner image onto a receiving material. The transfer method is classified into a direct transfer method in which the toner image is directly transferred to a receiving material; and an indirect transfer method in which the toner image is transferred to an intermediate transfer medium (primary transfer) and then transferred to a receiving material (secondary transfer). Both the transfer methods can be used for the image forming apparatus of the present invention. When high resolution images are produced, the direct transfer method is preferably used.

When a toner image is transferred, the photoreceptor is typically charged with a transfer charger which is included in the transferring device. The transferer is not limited thereto, and known transferers such as transfer belts and rollers can also be used.

Suitable transferers (primary and secondary transferers) of the image forming apparatus of the present invention include transferers which charge toner images so as to be easily transferred to a receiving material. Specific examples of the transferers include corona-charge transferers, transfer belts, transfer rollers, pressure transfer rollers, adhesion transferers, etc. The transferer may be one or more. The receiving material is not particularly limited, and known receiving materials such as papers and films can be used.

Suitable transfer chargers include transfer belt chargers and transfer roller chargers. In this regard, in view of the amount of ozone generated, contact type transfer belt chargers and transfer roller chargers are preferably used. Both constant voltage type charging methods and constant current type charging methods can be used in the present invention, but constant current type charging methods are preferably used because constant transfer charges can be applied and thereby charging can be stably performed.

As mentioned above, the quantity of charges passing through the photoreceptor in one image formation cycle largely changes depending on the residual potential of the photoreceptor after the transfer process. Namely, the higher residual potential a photoreceptor has, the faster the photoreceptor deteriorates.

In this regard, the charge quantity means the quantity of charges passing in the thickness direction of the photoreceptor. Specifically, the photoreceptor is (negatively) charged with a main charger so as to have a predetermined potential. Then imagewise light irradiation is performed on the charged photoreceptor. In this case, the lighted portion of the photoreceptor generates photo-carriers, and thereby the charges on the surface of the photoreceptor are decayed. In this case, a current corresponding to the quantity of the generated carriers flows in the thickness direction of the photoreceptor. In contrast, a non-lighted portion of the photoreceptor is fed to the discharging position after the developing and transferring processes (and optionally a cleaning process). If the potential of the non-lighted portion is near the potential thereof just after the charging process, charges whose quantity is almost the same as that of charges passing through the photoreceptor in the imagewise light irradiation process pass through the photoreceptor in the discharging process In general, images to be produced have a small image area proportion, and therefore almost all charges pass through the photoreceptor in the discharging process in one image formation cycle. Provided that the image area proportion is 10%, 90% of the current flown in the discharging process.

The electrostatic properties of a photoreceptor are largely influenced by the charges passing through the photoreceptor if the materials constituting the photoreceptor are deteriorated by the charges. Specifically, the residual potential of the photoreceptor increases depending on the quantity of the charges passing through the photoreceptor. If the residual potential increases, a problem in that the image density of the resultant toner image decreases occurs when a nega-posi developing method is used. Therefore, in order to prolong the life of a photoreceptor, the quantity of charges passing through the photoreceptor has to be reduced.

There is a proposal such that image forming is performed without performing a discharging process. In this case, it is impossible to uniformly charge all the portions of the photoreceptor (which results in formation of a ghost image) unless a high power charger is used.

In order to reduce the quantity of charges passing through a photoreceptor, it is preferable to discharge the charges on the photoreceptor without using light. Accordingly, it is effective to reduce the potential of a non-lighted portion of the photoreceptor by controlling the transfer bias. Specifically, it is preferable to reduce the potential of a non-lighted portion of the photoreceptor to about (−)100V (preferably 0V) before the discharging process. In this case, the quantity of charges passing through the photoreceptor can be reduced. It is more preferable to charge the photoreceptor so as to have a potential with a polarity opposite to that of charges formed on the photoreceptor in the main charging process because photocarriers are not generated in this case. However, in this case problems in that the toner image is scattered and the photoreceptor cannot be charged so as to have the predetermined potential unless a high power charger is used as the main charger occur. Therefore, the potential of the photoreceptor is preferably not greater than 100V after the transferring process.

Fixer

When plural color images are transferred to form a multicolor (or full color) image, the fixing operation can be performed on each color image or on overlaid color images.

Known fixers can be used for the image forming apparatus of the present invention. Among the fixers, heat/pressure fixing devices including a combination of a heat roller and a pressure roller or a combination of a heat roller, a pressure roller and an endless belt are preferably used. The temperature of the heating member is preferably from 80 to 200° C. The fixer is not limited thereto, and known light fixers can also be used.

Discharger

The discharger for use in the image forming apparatus of the present invention is not particularly limited, and known devices such as laser diodes, electroluminescence devices can be used as long as the devices can emit light with a wavelength of less than 500 nm, preferably less than 480 nm and more preferably less than 450 nm.

Specifically, for example, the following devices can be used.

(1) laser diodes and electroluminescence devices emitting light having a wavelength of less than 500 nm; and (2) combinations of a light source (such as fluorescent lamps, tungsten lamps, halogen lamps, mercury lamps, sodium lamps, and xenon lamps) and an optical filter capable of selectively obtaining light having a wavelength of less than 500 nm (such as sharp-cut filters, band pass filters, near-infrared cutting filters, dichroic filters, interference filters, and color temperature converting filters).

In order to obtain laser light with such a short wavelength, techniques in that the wavelength of laser light is reduced to one half using a second harmonic generation (SHG) technique and a non-linear optical material (disclosed in Japanese Laid-Open Patent Publications Nos. 09-275242, 09-189930 and 05-313033), or techniques using a wide gap semiconductor can be used. The first-mentioned techniques have advantages in that GaAs laser diodes and YAG lasers, which have been technically established and have a high power, can be used and thereby a high power discharger having a long life can be provided. The second-mentioned techniques have an advantage in that the discharger can be miniaturized. In this case, laser diodes using ZnSe based semiconductors (disclosed in Japanese Laid-Open Patent Publications Nos. 07-321409 and 06-334272), or GaN based semiconductors (disclosed in Japanese Laid-Open Patent Publications Nos. 08-88441, and 07-335975) can be used. In recent years, GaN based laser diodes emitting light with a wavelength of from 405 nm have been developed, and optical devices using such a LD have been developed. These devices can be used for the discharger of the image forming apparatus of the present invention.

In addition, LED lamps using the above-mentioned materials are commercialized. These lamps can also be used for the discharger.

At the present time, the lower limit of the wavelength of the discharging light is about 350 nm. This is because CTMs for use in the protective layer and the CTL typically have a low transmittance against light with a wavelength less than about 350 nm. This is because CTMs having a triarylamine structure have absorption at a wavelength range of from 300 to 350 nm. If a CTM having absorption at a shorter wavelength is developed, the limit can be further lowered.

Others

The image forming apparatus of the present invention can include a cleaner removing toner particles remaining on the surface of the photoreceptor even after the transfer process. The cleaner is not particularly limited, and known cleaners such as magnetic brush cleaners, electrostatic brush cleaners, magnetic roller cleaners, blade cleaners, brush cleaners and web cleaners can be used.

The image forming apparatus of the present invention can include a toner recycler feeding the toner particles collected by the cleaner to the image developer. The toner recycler is not particularly limited, and known powder feeders can be used therefor.

The image forming apparatus of the present invention can include a controller controlling the processes mentioned above. Any known controllers such as sequencers and computers can be used therefor.

The image forming apparatus of the present invention will be explained referring to drawings.

Figure 11:
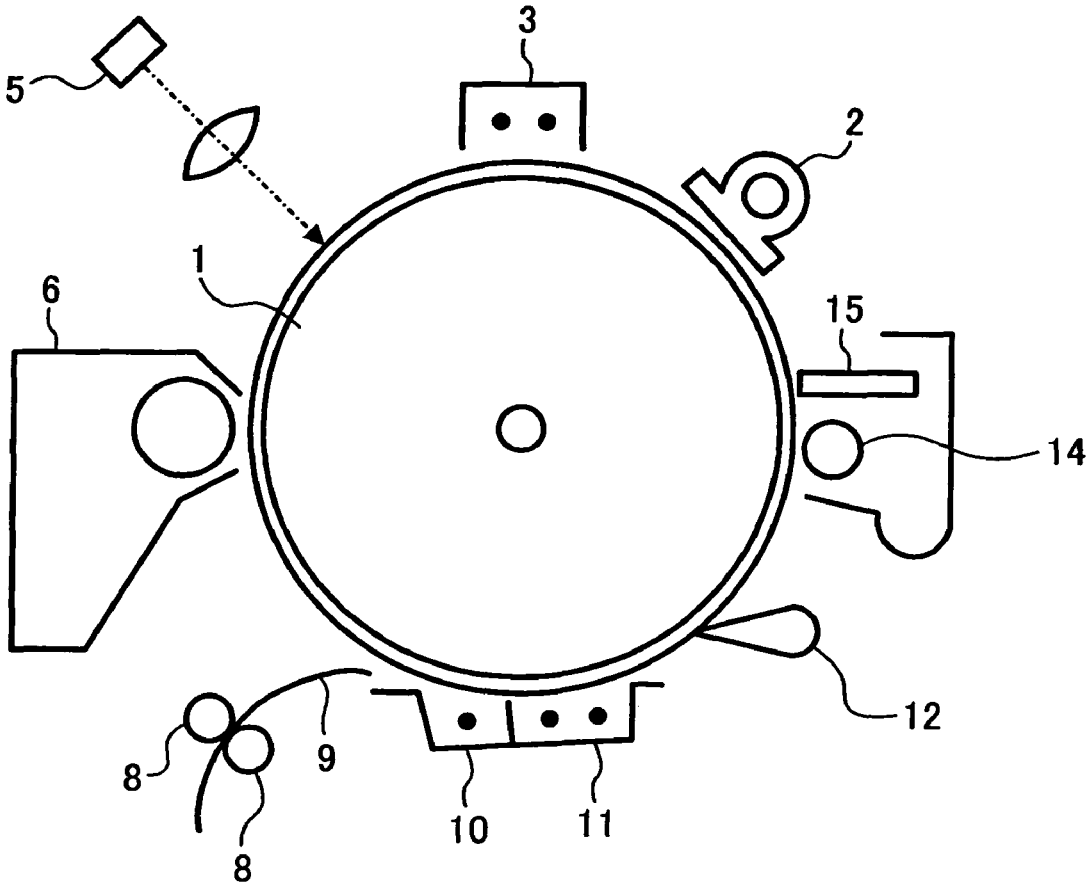
FIG. 11 is a schematic view illustrating an embodiment of the image forming apparatus of the present invention.

FIG. 11 is a schematic view illustrating an embodiment of the image forming apparatus. The image forming apparatus includes a photoreceptor 1 which includes at least an electroconductive substrate, a CGL including an organic CGM and located overlying the substrate and a CTL located overlying the CGL. Although a photoreceptor 1 is depicted as having a drum-form, the shape is not limited thereto and sheet-form and endless belt-form photoreceptors can also be used.

Around the photoreceptor 1, a discharging lamp 2 discharging the charges remaining on the photoreceptor 1, a charger 3 charging the photoreceptor 1, a light irradiator 5 irradiating the photoreceptor 1 with imagewise light to form an electrostatic latent image on the photoreceptor 1, an image developer 6 developing the latent image with a toner to form a toner image on the photoreceptor 1, and a cleaner including a fur brush 14 and a cleaning blade 15 cleaning the surface of the photoreceptor 1 are arranged while contacting or being set closely to the photoreceptor 1. The toner image formed on the photoreceptor 1 is transferred on a receiving paper 9 fed by a pair of registration rollers 8 at a transferer (i.e., a pair of a transfer charger 10 and a separating charger 11). The receiving paper 9 having the toner image thereon is separated from the photoreceptor 1 by a separating pick 12.

As the charger 3, wire chargers and roller chargers are preferably used. When high speed charging is needed, scorotron chargers are preferably used. Roller chargers are preferably used for compact image forming apparatuses and tandem type image forming apparatuses because the amount of acidic gases such as NOx and SOx and ozone generated by charging is small. The strength of the electric field formed on the photoreceptor by the charger is preferably not less than 20 V/μm. In this regard, the greater the electric field strength, the better dot reproducibility the resultant image has. However, when the electric field strength is too high, problems in that the photoreceptor causes dielectric breakdown and carrier particles are adhered to an electrostatic latent image occur. Therefore, the electric field strength is preferably not greater than 60 V/μm and more preferably not greater than 50 V/μm.

Suitable light sources for use in the light irradiator include light emitting diodes (LEDs), laser diodes (LDs) and electroluminescence devices (ELs), which are high intensity light sources and which can form latent images with a resolution not less than 600 dpi. The resolution of an electrostatic latent image (and a toner image) depends on the resolution of the image writing light. Namely, the higher the resolution of the image writing light, the better the resolution of the resultant electrostatic latent image. However, when the resolution of the image writing light is high, it takes a long time to write an image. When only one light source is used for image writing, the image processing speed (i.e., the speed of the image bearer) depends on the image writing speed. Therefore, when only one light source is used for image writing, the upper limit of the resolution is about 1200 dpi (dots per inch) and preferably 2400 dpi. When plural light sources (n pieces) are used, the upper limit of the resolution is 1200 (or 2400) dpi×n.

Among these light sources, LEDs and LDs are preferably used because of having high illuminance. By using a light source emitting light with a wavelength of less than 450 nm, high resolution images can be formed.

The image developer 6 includes at least one developing sleeve. The developing device develops an electrostatic latent image formed on the photoreceptor with a developer including a toner, using a nega-posi developing method. The current digital image forming apparatus uses a nega-posi developing method in which a toner is adhered to a lighted portion because the image area proportion of original images is low and therefore it is preferable for the light irradiating device to irradiate the image portion of a photoreceptor with light in view of the life of the light irradiator. With respect to the developer, both one-component developers including only a toner, and two-component developers including a toner and a carrier can be used for the image forming apparatus of the present invention.

With respect to the transfer charger 10, transfer belts and transfer rollers can also be used therefor. Particularly, contact transfer belts and transfer rollers are preferably used because the amount of ozone generated during the transferring process is small. Both constant voltage type charging methods and constant current type charging methods can be used in the present invention, but constant current type charging methods are preferably used because constant transfer charges can be applied and thereby charging can be stably performed. In the transferring process, it is preferable to control the current flowing in the photoreceptor through the transfer member in the transferring process when a voltage is applied from a power source to the transferer.

The transfer current is flown due to application of charges to remove the toner, which is electrostatically adhered to the photoreceptor, from the photoreceptor and transfer the toner to a receiving material. In order to prevent occurrence of a transfer problem in that a part of a toner image is not transferred, the transfer current is increased. However, when a nega-posi developing method is used, a voltage having a polarity opposite to that of the charge formed on the photoreceptor is applied in the transferring process, and thereby the photoreceptor suffers a serious electrostatic fatigue. In the transferring process, the higher the transfer current, the better the transfer efficiency of a toner image, but a discharging phenomenon occurs between the photoreceptor and the receiving material if the current is greater than a threshold, resulting in formation of scattered toner images. Therefore, the transfer current is preferably controlled so as not to exceed the threshold current. The threshold current changes depending on the factors such as distance between the photoreceptor and the receiving material, and materials constituting the photoreceptor and the receiving material, but is generally about 200 μA to prevent occurrence of a discharging phenomenon.

The transfer method is classified into a direct transfer method in which the toner image is directly transferred to a receiving material; and an indirect transfer method in which the toner image is transferred to an intermediate transfer medium (primary transfer) and then transferred to a receiving material (secondary transfer). Both the transfer methods can be used for the image forming apparatus of the present invention.

As mentioned above, it is preferable to control the transfer current to decrease the potential of a non-lighted portion of the photoreceptor, which results in decrease of quantity of charges passing through the photoreceptor in one image forming cycle.

Suitable light sources for use in the discharger 2 include light sources capable of emitting light with a wavelength of less than 500 nm, preferably less than 480 nm and more preferably less than 450 nm. Known light sources such as laser diodes (LDs) and electroluminescence devices (LEDs) can be used therefor.

Specifically, for example, the following devices can be used.

(1) laser diodes and electroluminescence devices emitting light having a wavelength of less than 500 nm; and (2) combinations of a light source (such as fluorescent lamps, tungsten lamps, halogen lamps, mercury lamps, sodium lamps, and xenon lamps) and an optical filter capable of selectively obtaining light having a wavelength of less than 500 nm (such as sharp-cut filters, band pass filters, near-infrared cutting filters, dichroic filters, interference filters, and color temperature converting filters).

The lower limit of the light used for discharging is from about 300 nm to about 350 nm, which depends on the transmittance of the CTL and the protective layer against the discharging light.

In FIG. 11, the cleaner uses a fur brush and a cleaning blade, but cleaning may be performed only by a cleaning brush. Known brushes such as fur brushes and mag-fur brushes can be used for the cleaning brush.

Figure 12:
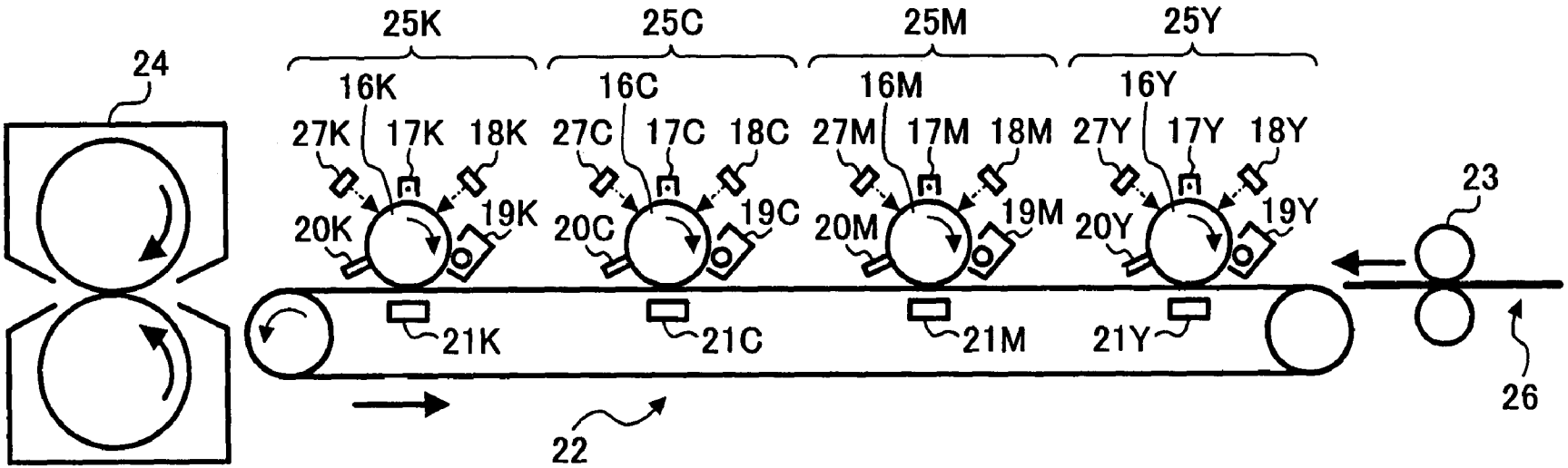
FIG. 12 is a schematic view illustrating another embodiment (a tandem-type full color image forming apparatus) of the image forming apparatus of the present invention.

FIG. 12 is a schematic view illustrating another embodiment of the image forming apparatus (i.e., a tandem type image forming apparatus) of the present invention. In FIG. 12, the tandem type image forming apparatus has a yellow image forming unit 25Y, a magenta image forming unit 25M, a cyan image forming unit 25C, and a black image forming unit 25K. Drum photoreceptors 16Y, 16M, 16C and 16K, which are the photoreceptors mentioned above, each including at least an organic CGM in the CGL, and at least one of charge transport materials having the formulae (I) to (IV) in the CTL, rotate in the direction indicated by respective arrows. Around the photoreceptors 16Y, 16M, 16C and 16K, chargers 17Y, 17M, 17C and 17K, light irradiators 18Y, 18M, 18C and 18K, developing devices 19Y, 19M, 19C and 19K, cleaners 20Y, 20M, 20C and 20K and discharging devices 27Y, 27M, 27C and 27K are arranged respectively in this order in the clockwise direction. As the chargers, the above-mentioned chargers which can uniformly charge the surfaces of the photoreceptors are preferably used. The light irradiators 18 irradiate the surfaces of the respective photoreceptors with laser light beams at points between the chargers and the image developers to form electrostatic latent images on the respective photoreceptors. The four image forming units 25 are arranged along a transfer belt 22. The transfer belt 22 contacts the respective photoreceptors 16 at image transfer points located between the respective image developers and the respective cleaners to receive color images formed on the photoreceptors. At the backsides of the image transfer points of the transfer belt 22, transfer brushes 21Y, 21M, 21C and 21K are arranged to apply a transfer bias to the transfer belt 22. The image forming units have substantially the same configuration except that the color of the toner is different from each other.

The image forming process will be explained referring to FIG. 12.

At first, in each of the image forming units 25, the photoreceptor 16 is charged with the charger 17 which rotates in the direction indicated by the arrow. Then the light irradiator 18 irradiates the photoreceptors 16 with an imagewise laser beam to form an electrostatic latent image on each photoreceptor, which typically has a resolution of not less than 1200 dpi (and preferably not less than 2400 dpi).

Then the electrostatic latent image formed on the photoreceptor is developed with the developing device 19 using a yellow, a magenta, a cyan or a black toner to form different color toner images on the respective photoreceptors. The thus prepared color toner images are transferred onto a receiving material 26, which has been fed to a pair of registration rollers 23 from a paper tray and which is timely fed to the transfer belt 22 by the registration rollers 23.

Each of the toner images on the photoreceptors is transferred onto the receiving material 26 at the contact point (i.e., the transfer position) of the photoreceptor 16 and the receiving material 26.

The toner image on each photoreceptor is transferred onto the receiving material 26 due to an electric field which is formed due to the difference between the transfer bias voltage applied to the transfer members 21Y, 21M, 21C and 21K and the potential of the respective photoreceptors 16. After passing through the four transfer positions, the receiving material 26 having the color toner images thereon is then transported to a fixer 24 so that the color toner images are fixed to the receiving material 26. Then the receiving material 26 is discharged from the main body of the image forming apparatus. Toner particles, which remain on the photoreceptors even after the transfer process, are collected by the respective cleaners 20Y, 20M, 20C and 20K.

Then the discharging devices 27 irradiate the respective photoreceptor 16 with light having a wavelength of less than 500 nm. Thus, the photoreceptors 16 are ready for the next image forming operation.

In the image forming apparatus, the image forming units 25Y, 25M, 25C and 25K are arranged in this order in the paper feeding direction, but the order is not limited thereto. In addition, when a black color image is produced, the operation of the photoreceptors 16Y, 16M and 16C other than the photoreceptor 16K may be stopped.

As mentioned above, it is preferable for the photoreceptors 16 to have a potential of not higher than 100V (i.e., −100V when the photoreceptor is negatively charged by a main charger). More preferably, the photoreceptor is charged so as to have a potential of not lower than +100V in the transferring process when the photoreceptor is negatively charged by a main charger (i.e., 100V with a polarity opposite to that of the charge formed on the photoreceptor). In this case, occurrence of the residual potential increasing problem can be well prevented.

The above-mentioned image forming unit may be fixedly set in an image forming apparatus such as copiers, facsimiles and printers. However, the image forming unit may be set therein as a process cartridge. The process cartridge means an image forming unit which includes at least the photoreceptor mentioned above and one or more of the charging device, light irradiating device, a developing device, a transferring device, a cleaning device and a discharging device.

Figure 13:
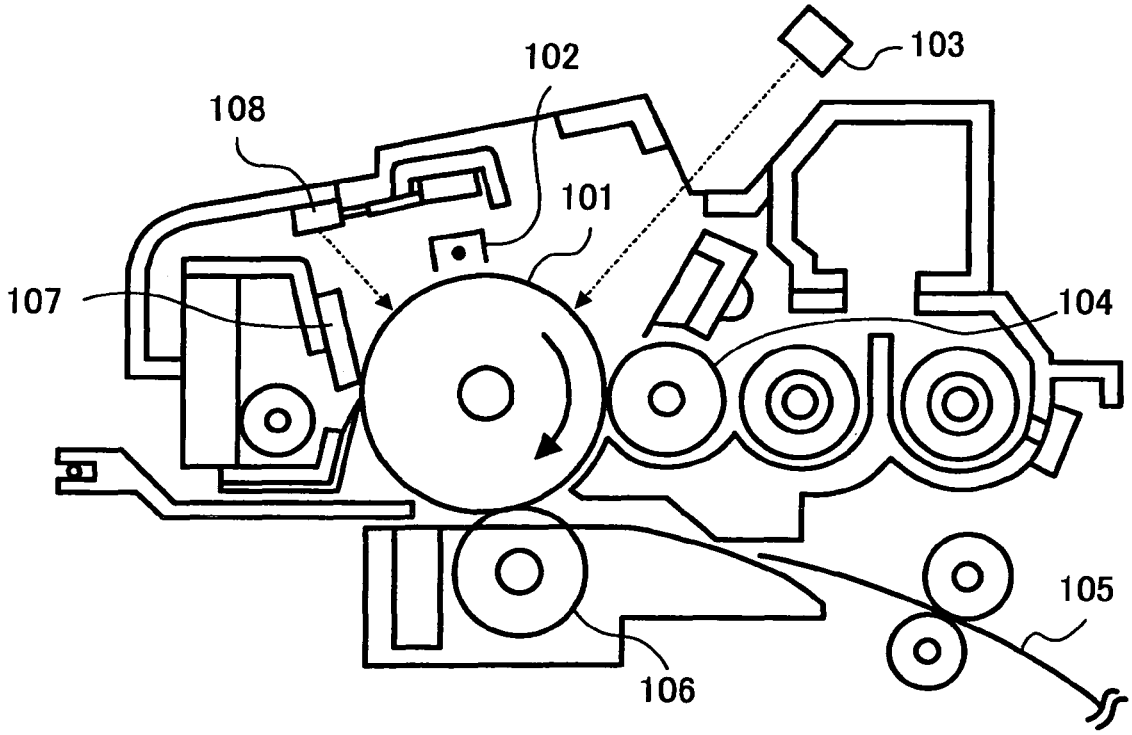
FIG. 13 is a schematic view illustrating a process cartridge for use in the image forming apparatus of the present invention.

FIG. 13 is a schematic view illustrating an embodiment of the process cartridge of the present invention. In FIG. 13, the process cartridge includes a photoreceptor 101 which is the photoreceptor mentioned above, including at least an organic CGM in the CGL, and at least one of charge transport materials having the formulae (I) to (IV) in the CTL, a charger 102 configured to charge the photoreceptor 101, a light irradiating device 103 configured to irradiate the photoreceptor 101 with imagewise light to form an electrostatic latent image on the photoreceptor, a developing device including a developing sleeve 104 configured to develop the latent image with a toner, an image transfer device 106 configured to transfer the toner image onto a receiving paper 105, a cleaning device 107 configured to clean the surface of the photoreceptor 101, and a discharging device 108 including a light source emitting light with a wavelength of less than 500 nm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, methods of synthesizing the azo pigments and titanylphthalocyanine crystals for use in the present invention will be explained. The azo pigments were prepared according to the methods disclosed in Japanese Patent Publication No. 60-29109 and Japanese Patent No. 3026645. The titanylphthalocyanine crystals were prepared according to the methods disclosed in Japanese Laid-Open Patent Publications Nos. 2001-19871 and 2004-83859.

Synthesis of Titanylphthalocyanine Crystal

Synthesis Example 1

A titanylphthalocyanine crystal was prepared by the method disclosed in Synthesis Example 1 of Japanese Laid-Open Patent Publications Nos. 2001-19871. Specifically, at first 29.2 g of 1,3-diiminoisoindoline and 200 ml of sulfolane were mixed. Then 20.4 g of titanium tetrabutoxide was dropped into the mixture under a nitrogen gas flow. The mixture was then heated to 180° C. and a reaction was performed for 5 hours at a temperature of from 170 to 180° C. while agitating. After the reaction, the reaction product was cooled, followed by filtering. The thus prepared wet cake was washed with chloroform until the cake colored blue. Then the cake was washed several times with methanol, followed by washing several times with hot water heated to 80° C. and drying. Thus, a crude titanylphthalocyanine was prepared. One part of the thus prepared crude titanylphthalocyanine was dropped into 20 parts of concentrated sulfuric acid to be dissolved therein. The solution was dropped into 100 parts of ice water while stirred, to precipitate a titanylphthalocyanine pigment. The pigment was obtained by filtering. The pigment was washed with ion-exchange water having a pH of 7.0 and a specific conductivity of 1.0 μS/cm until the filtrate became neutral. In this case, the pH and specific conductivity of the filtrate was 6.8 and 2.6 μS/cm. Thus, an aqueous paste of a titanylphthalocyanine pigment was obtained. Forty (40) grams of the thus prepared aqueous paste of the titanylphthalocyanine pigment, which has a solid content of 15% by weight, was added to 200 g of tetrahydrofuran (THF) and the mixture was stirred for about 4 hours. The weight ratio of the titanylphthalocyanine pigment to the crystal changing solvent (i.e., THF) was 1/33. Then the mixture was filtered and the wet cake was dried to prepare a titanylphthalocyanine powder (Pigment 1). The materials used therefor do not include a halogenated compound.

Figure 14:
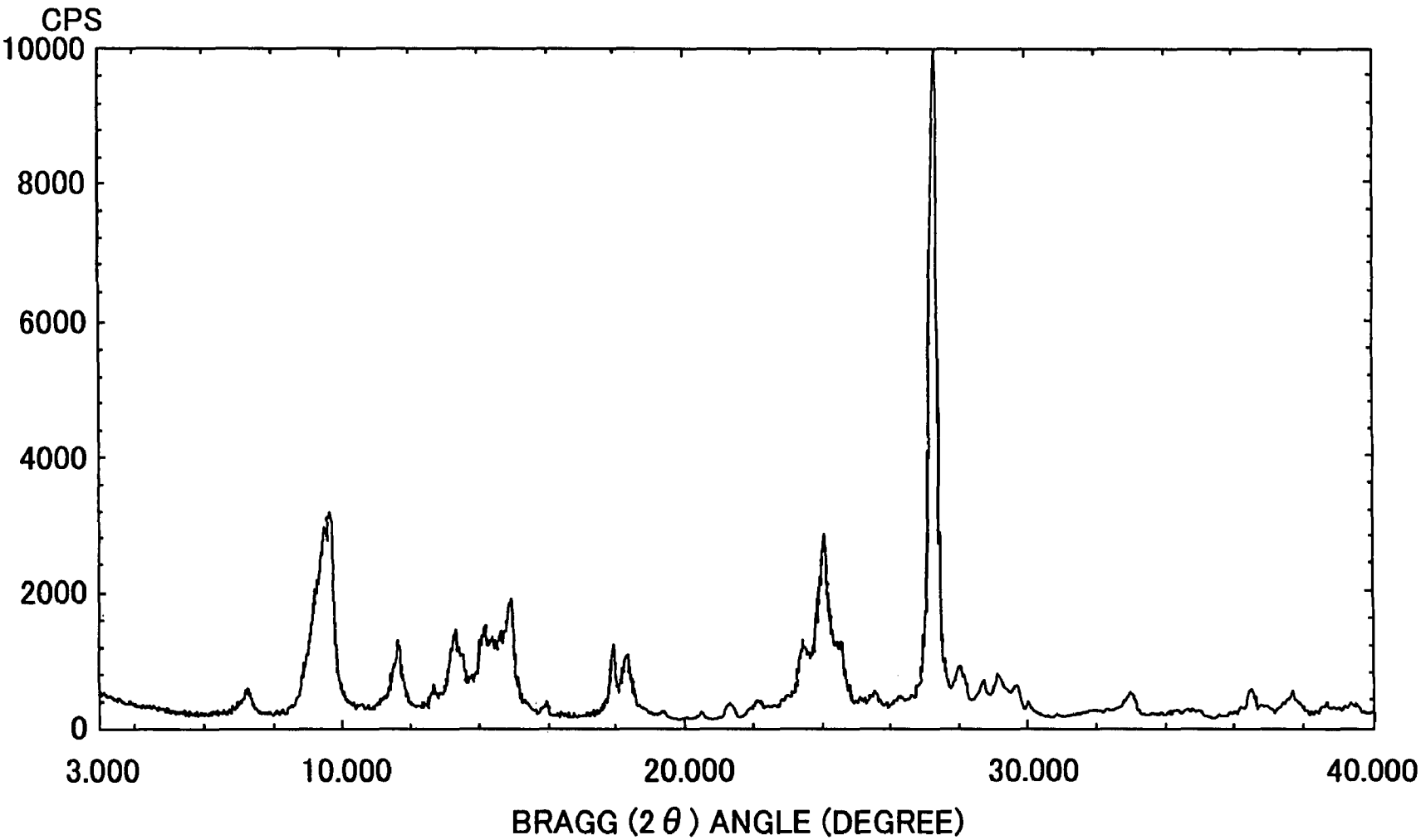
FIG. 14 is the X-ray diffraction spectrum of the titanylphthalocyanine crystal prepared in Synthesis Example 1.

When the thus prepared titanylphthalocyanine powder was subjected to the X-ray diffraction analysis under the following conditions, it was confirmed that the titanylphthalocyanine powder has an X-ray diffraction spectrum such that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° and at an angle of 26.3. The X-ray diffraction spectrum thereof is illustrated in FIG. 14.

Figure 15:
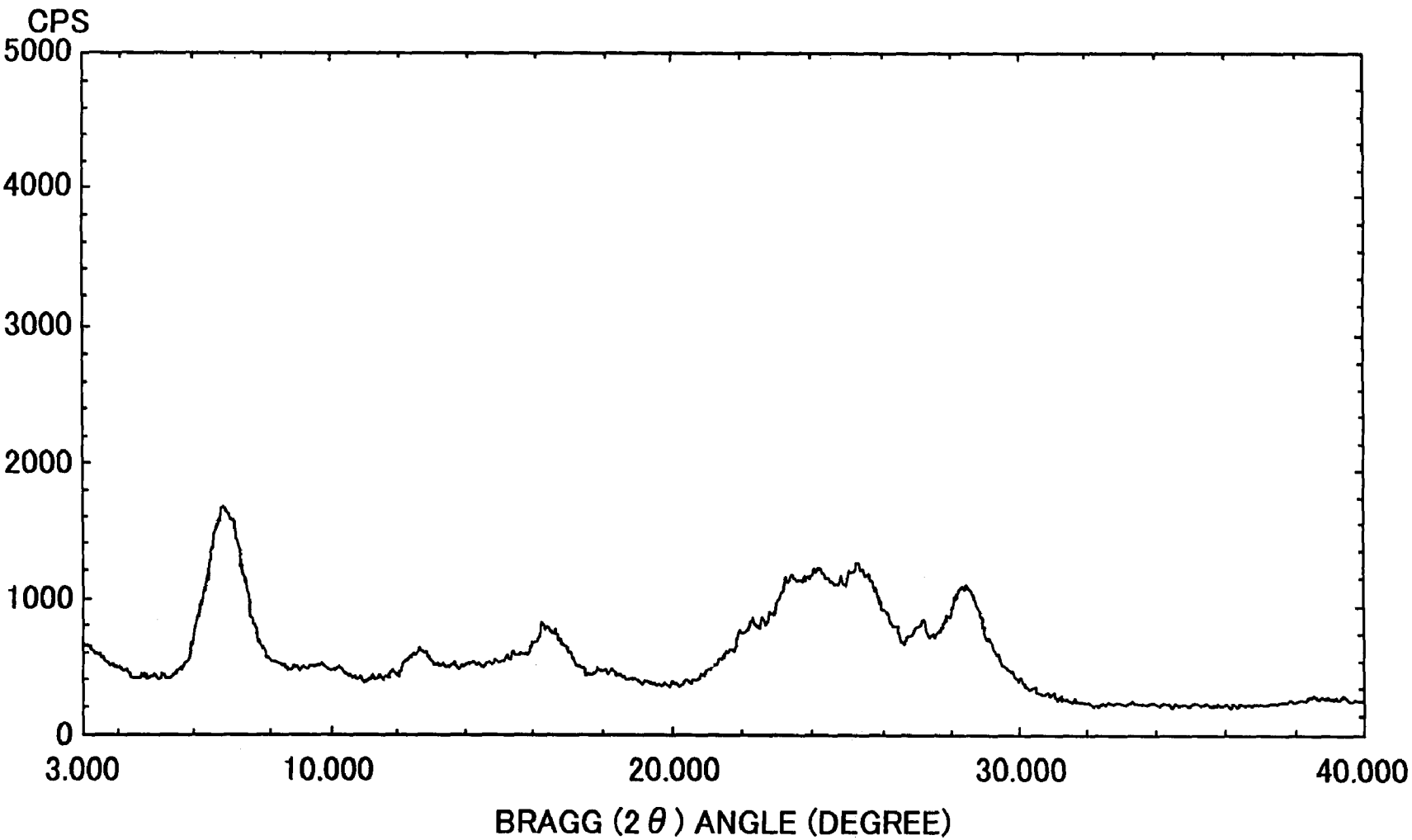
FIG. 15 is the X-ray diffraction spectrum of the titanylphthalocyanine pigment obtained by drying the wet paste prepared in Synthesis Example 1.
Figure 16:
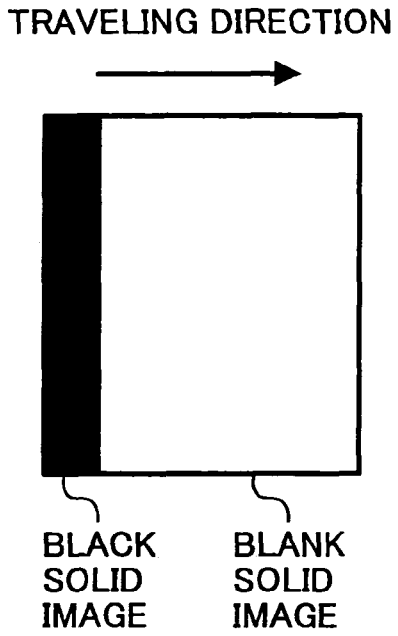
FIG. 16 is a test chart used in Example 7.

In addition, a part of the aqueous paste prepared above was dried at 80° C. for 2 days under a reduced pressure of 5 mmHg, to prepare a titanylphthalocyanine pigment, which has a low crystallinity. The X-ray diffraction spectrum of the titanylphthalocyanine pigment is illustrated in FIG. 15.

X-Ray Diffraction Spectrum Measuring Conditions

X-ray tube: Cu
X-ray used: Cu—$K_\alpha$ having a wavelength of 1.542 Å
Voltage: 50 kV
Current: 30 mA
Scanning speed: 2°/min
Scanning range: 30 to 400
Time constant: 2 seconds Synthesis Example 2

A titanylphthalocyanine crystal was prepared by the method disclosed in Example 1 of Japanese Laid-Open Patent Publications Nos. 2004-83859.

Specifically, 60 parts of the thus prepared aqueous paste of the titanylphthalocyanine pigment prepared in Synthesis Example 1 was added to 400 g of tetrahydrofuran (THF) and the mixture was strongly agitated with a HOMOMIXER (MARK IIf from Kenis Ltd.) at a revolution of 2,000 rpm until the color of the paste was changed from navy blue to light blue. The color was changed after the agitation was performed for about 20 minutes. In this regard, the ratio of the titanylphthalocyanine pigment to the crystal change solvent (THF) is 44. The dispersion was then filtered under a reduced pressure. The thus obtained cake on the filter was washed with tetrahydrofuran to prepare a wet cake of a titanylphthalocyanine crystal. The crystal was dried for 2 days at 70° C. under a reduced pressure of 5 mmHg. Thus, 8.5 parts of a titanylphthalocyanine crystal (Pigment 2) was prepared. No halogen-containing raw material was used for synthesizing the phthalocyanine crystal. The solid content of the wet cake was 15% by weight, and the weight ratio (S/C) of the solvent (S) used for crystal change to the wet cake (C) was 44.

A part of the aqueous paste of the titanylphthalocyanine pigment prepared above in Synthesis Example 1, which had not been subjected to a crystal change treatment, was diluted with ion-exchange water such that the resultant dispersion has a solid content of 1% by weight. The dispersion was placed on a 150-mesh copper net covered with a continuous collodion membrane and a conductive carbon layer. The titanylphthalocyanine pigment was observed with a transmission electron microscope (H-9000NAR from Hitachi Ltd., hereinafter referred to as a TEM) of 75,000 power magnification to measure the average particle size of the titanylphthalocyanine pigment. The average particle diameter thereof was determined as follows.

The image of particles of the titanylphthalocyanine pigment in the TEM was photographed. Among the particles (needle form particles) of the titanylphthalocyanine pigment in the photograph, 30 particles were randomly selected to measure the lengths of the particles in the long axis direction of the particles. The lengths were arithmetically averaged to determine the average particle diameter of the titanylphthalocyanine pigment. As a result, it was confirmed that the titanylphthalocyanine pigment in the aqueous paste prepared in Synthesis Example 5 has an average primary particle diameter of 0.06 μm.

Similarly, each of the phthalocyanine crystals prepared in Synthesis Examples 1 and 2, which had been subjected to the crystal change treatment but was not filtered, was diluted with tetrahydrofuran such that the resultant dispersion has a solid content of 1% by weight. The average particle diameters of Pigments 1 and 2 were determined by the method mentioned above. The results are shown in Table 5. In this regard, the form of the crystals was not uniform and includes triangle forms, quadrangular forms, etc. Therefore, the maximum lengths of the diagonal lines of the particles were arithmetically averaged.

TABLE 5

| Phthalocyanine crystal | Average particle diameter (μm) | Note |
|---|---|---|
| Crystal 5 (Syn. Ex. 5) | 0.31 | Coarse particles having a particle diameter of from 0.3 to 0.4 μm are included. |
| Crystal 6 (Syn. Ex. 6) | 0.12 | The particle diameters of the crystal are almost uniform. |

Pigment 2 was also subjected to the X-ray diffraction spectrum mentioned above. As a result, it was confirmed that the X-ray diffraction spectrum thereof is the same as that of Pigment 1.

Dispersion Preparation Example 1

| Formula of dispersion | |
|---|---|
| Titanylphthalocyanine (Pigment 1) | 15 |
| Polyvinyl butyral (BX-1 from Sekisui Chemical Co., Ltd.) | 10 |
| 2-butanone | 280 |

At first, the polyvinyl butyral resin was dissolved in the solvent. The solution was mixed with phthalocyanine crystal and the mixture was subjected to a dispersion treatment for 30 minutes using a bead mill which includes PSZ balls having a diameter of 0.5 mm and which is rotated at a revolution of 1200 rpm to prepare a dispersion 1.

Dispersion Preparation Example 2

The procedure for preparation of dispersion 1 was repeated to prepare a dispersion 2 except for replacing the Pigment 1 with the Pigment 2

Dispersion Preparation Example 3

The procedure for preparation of dispersion 1 was repeated to prepare a dispersion 3 except for being filtered with a cotton wind cartridge filter (TCW-1-CS from Advantech Co., Ltd.) having an effective pore diameter of 1 μm under pressure using a pump.

Dispersion Preparation Example 4

The procedure for preparation of dispersion 3 was repeated to prepare a dispersion 4 except for being filtered with a cotton wind cartridge filter (TCW-3-CS from Advantech Co., Ltd.) having an effective pore diameter of 3 μm under pressure using a pump.

Dispersion Preparation Example 5

| Formula of dispersion | |
|---|---|
| Azo pigment having the following formula | 5 |
| Polyvinyl butyral (BX-1 from Sekisui Chemical Co., Ltd.) | 2 |
| Cyclohexanone | 250 |
| 2-butanone | 100 |

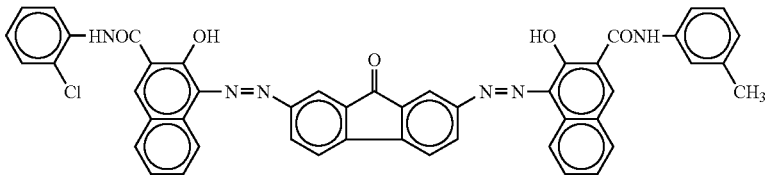

At first, the polyvinyl butyral resin was dissolved in the solvents. The solution was mixed with the azo pigment and the mixture was subjected to a dispersion treatment for 7 days using a ball mill which includes PSZ balls having a diameter of 10 mm and which is rotated at a revolution of 85 rpm to prepare a dispersion 5.

Dispersion Preparation Example 6

The procedure for preparation of dispersion 5 in Dispersion Preparation Example 5 was repeated to prepare a dispersion 6 except for replacing the azo pigment with an azo pigment having the following formula.

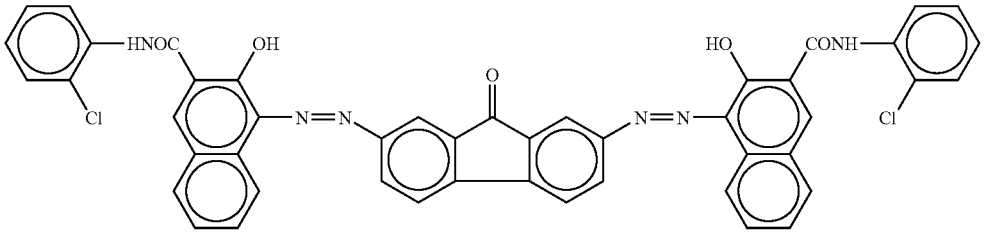

The particle diameter distributions of the thus prepared dispersions 1 to 6 were measured with a particle diameter measuring instrument (CAPA-700 from Horiba Ltd.). The results are shown in Table 6.

TABLE 6

| Dispersion | Average particle diameter (μm) | Standard deviation of particle diameter (μm) |
|---|---|---|
| Dispersion 1 | 0.29 | 0.18 |
| Dispersion 2 | 0.19 | 0.13 |
| Dispersion 3 | 0.22 | 0.16 |
| Dispersion 4 | 0.24 | 0.17 |
| Dispersion 5 | 0.26 | 0.18 |
| Dispersion 6 | 0.27 | 0.17 |

Photoreceptor Preparation Example 1

On an aluminum drum of JIS 1050, the following intermediate layer coating liquid, CGL coating liquid, and CTL coating liquid were coated and dried one by one to prepare a multi-layered photoreceptor (Photoreceptor 1) having an intermediate transfer layer having a thickness of 3.5 μm, a CGL having a thickness of 0.5 μm, and a CTL having a thickness of 25 μm.

| Formula of intermediate layer coating liquid | |
|---|---|
| Titanium oxide (CR-EL from Ishihara Sangyo Kaisha Ltd., average particle diameter of 0.25 μm) | 112 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-Butanone | 260 |

Formula of CGL Coating Liquid

Dispersion 1 prepared above was used as the CGL coating liquid.

| Formula of CTL coating liquid | |
|---|---|
| Polycarbonate (TS2050 from Teijin Chemicals Ltd.) | 10 |
| CTM having the following formula | 7 |

-continued

| Formula of CTL coating liquid | |
|---|---|
| 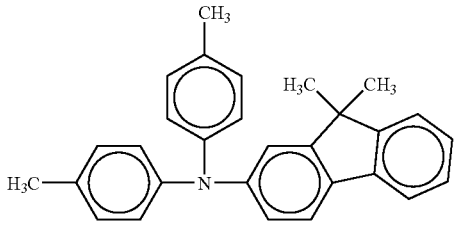 | |
| Methylene chloride | 80 |

Example 1

Photoreceptor 1 prepared above was set in an image forming apparatus having a structure illustrated in FIG. 11, and a running test in which 30,000 copies of an original character image with image area proportion of 6% are continuously produced was performed under the following conditions.

Light irradiator: Irradiator having a light source including a laser diode emitting light of 780 nm, and a polygon mirror used Charger: Scorotron charger Transferer: Transfer belt Discharger: Discharging lamp including a LED (from Rohm Co., Ltd.) which emits light with a wavelength of 428 nm and a half width of 65 nm.

Potential of charged photoreceptor: −900 V (potential of non-lighted portion)

Developing method: Nega-posi developing method

Developing bias: −650 V

Potential of non-lighted portion of photoreceptor after discharging process: −100 V Evaluation Method The potentials of a lighted portion and a non-lighted portion of the photoreceptor were measured at the beginning of the running test and after the running test. Specifically, the photoreceptor was charged so as to have a potential of −900 V, and then the light irradiator irradiates the charged photoreceptor to form a solid electrostatic latent image. Then the potential of the lighted portion ($V_L$) and a non-lighted portion ($V_D$) were measured with a potential meter set in the developing position illustrated in FIG. 11. The evaluation results are shown in Table 7.

Example 2

The procedure for the running test and the evaluation in Example 1 was repeated except for replacing the discharging lamp with a discharging lamp including a LED (from Seiwa Electric Mfg. Co., Ltd.) which emits light with a wavelength of 472 nm and a half width of 15 nm. In this regard, the light intensity of the discharging lamp was controlled so that the potential of the non-lighted portion of the photoreceptor after the discharging process is the same as that in Example 1. The evaluation results are shown in Table 7.

Comparative Example 1

The procedure for the running test and the evaluation in Example 1 was repeated except for replacing the discharging lamp with a discharging lamp including a LED (from Seiwa Electric Mfg. Co., Ltd.) which emits light with a wavelength of 502 nm and a half width of 15 nm. In this regard, the light intensity of the discharging lamp was controlled so that the potential of the non-lighted portion of the photoreceptor after the discharging process is the same as that in Example 1. The evaluation results are shown in Table 7.

Comparative Example 2

The procedure for the running test and the evaluation in Example 1 was repeated except for replacing the discharging lamp with a discharging lamp including a LED (from Rohm Co., Ltd.) which emits light with a wavelength of 591 nm and a half width of 15 nm. In this regard, the light intensity of the discharging lamp was controlled so that the potential of the non-lighted portion of the photoreceptor after the discharging process is the same as that in Example 1. The evaluation results are shown in Table 7.

Comparative Example 3

The procedure for the running test and the evaluation in Example 1 was repeated except for replacing the discharging lamp with a discharging lamp including a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 1. The evaluation results are shown in Table 7.

Comparative Example 4

The procedure for the running test and the evaluation in Example 1 was repeated except for replacing the discharging lamp with a fluorescent lamp which emits light having a spectrum as illustrated in FIG. 1. In this regard, the light intensity of the discharging lamp was controlled so that the potential of the non-lighted portion of the photoreceptor after the discharging process is the same as that in Example 1. The evaluation results are shown in Table 7.

Comparative Example 5

The procedure for the running test and the evaluation in Example 1 was repeated except for replacing the discharging lamp with two discharging lamps including a LED (from Rohm Co., Ltd.) which emits light with a wavelength of 428 nm and a half width of 65 nm, and a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 1. The evaluation results are shown in Table 7.

TABLE 7

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 1 | 428 | 900 | 130 | 900 | 145 |
| Ex. 2 | 472 | 900 | 130 | 900 | 155 |
| Comp. Ex. 1 | 502 | 900 | 130 | 900 | 185 |
| Comp. Ex. 2 | 591 | 900 | 130 | 900 | 190 |
| Comp. Ex. 3 | 630 | 900 | 130 | 900 | 195 |
| Comp. Ex. 4 | White light | 900 | 130 | 900 | 180 |
| Comp. Ex. 5 | 428, 630 | 900 | 130 | 900 | 185 |

λ: The wavelength of the discharging light emitted by the discharging lamp.
$V_D$: Potential of non-lighted portion.
$V_L$: Potential of lighted portion.

It is clear from Table 7 that when the wavelength of the discharging light is less than 500 nm (Examples 1 and 2), increase in potential ($V_L$) of the lighted portion is lower than that in the cases where the wavelength of the discharging light is not less than 500 nm (Comparative Examples 1-3). In particular, when the wavelength of the discharging light is less than 450 nm (i.e., Example 1), increase in potential ($V_L$) of the lighted portion is lower than that in the case where the wavelength of the discharging light is from 450 nm to 500 nm (i.e., Example 2).

In addition, it is also found that when discharging light having a wide wavelength range and including light with a relatively long wavelength is used (i.e., Comparative Example 4), such an effect as produced in Examples 1 and 2 cannot be produced. Further, it is found that when a combination of two light sources emitting light with different wavelengths is used (Comparative Example 5), the effect of the light with a relatively short wavelength is reduced.

Photoreceptor Preparation Example 2

The procedure for preparation of photoreceptor 1 in Photoreceptor Preparation Example 1 was repeated to prepare a photoreceptor 2 except for replacing the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |
| 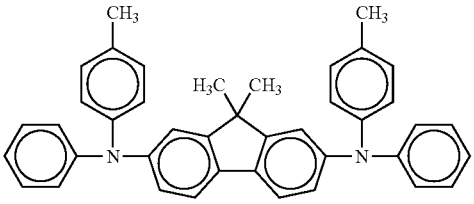 | |
| Methylene chloride | 80 |

Example 3

The procedure for the running test and the evaluation in Example 1 was repeated except for replacing the photoreceptor 1 with the photoreceptor 2. The evaluation results are shown in Table 8.

Example 4

The procedure for the running test and the evaluation in Example 2 was repeated except for replacing the photoreceptor 1 with the photoreceptor 2. The evaluation results are shown in Table 8.

Comparative Example 6

The procedure for the running test and the evaluation in Comparative Example 1 was repeated except for replacing the photoreceptor 1 with the photoreceptor 2. The evaluation results are shown in Table 8.

Comparative Example 7

The procedure for the running test and the evaluation in Comparative Example 2 was repeated except for replacing the photoreceptor 1 with the photoreceptor 2. The evaluation results are shown in Table 8.

Comparative Example 8

The procedure for the running test and the evaluation in Comparative Example 3 was repeated except for replacing the photoreceptor 1 with the photoreceptor 2. The evaluation results are shown in Table 8.

Comparative Example 9

The procedure for the running test and the evaluation in Comparative Example 4 was repeated except for replacing the photoreceptor 1 with the photoreceptor 2. The evaluation results are shown in Table 8.

Comparative Example 10

The procedure for the running test and the evaluation in Comparative Example 5 was repeated except for replacing the photoreceptor 1 with the photoreceptor 2. The evaluation results are shown in Table 8.

TABLE 8

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 3 | 428 | 900 | 140 | 900 | 160 |
| Ex. 4 | 472 | 900 | 140 | 900 | 170 |
| Comp. Ex. 6 | 502 | 900 | 140 | 900 | 200 |
| Comp. Ex. 7 | 591 | 900 | 140 | 900 | 205 |
| Comp. Ex. 8 | 630 | 900 | 140 | 900 | 210 |
| Comp. Ex. 9 | White light | 900 | 140 | 900 | 195 |
| Comp. Ex. 10 | 428, 630 | 900 | 140 | 900 | 200 |

It is clear from Table 8 that when the wavelength of the discharging light is less than 500 nm (Examples 3 and 4), increase in potential ($V_L$) of the lighted portion is lower than that in the cases where the wavelength of the discharging light is not less than 500 nm (Comparative Examples 6-8). In particular, when the wavelength of the discharging light is less than 450 nm (i.e., Example 3), increase in potential ($V_L$) of the lighted portion is lower than that in the case where the wavelength of the discharging light is from 450 nm to 500 nm (i.e., Example 4).

In addition, it is also found that when discharging light having a wide wavelength range and including light with a relatively long wavelength is used (i.e., Comparative Example 9), such an effect as produced in Examples 3 and 4 cannot be produced. Further, it is found that when a combination of two light sources emitting light with different wavelengths is used (Comparative Example 10), the effect of the light with a relatively short wavelength is reduced.

Photoreceptor Preparation Example 3

The procedure for preparation of photoreceptor 1 in Photoreceptor Preparation Example 1 was repeated to prepare photoreceptor 3 except for replacing the CGL coating liquid (dispersion 1) with the dispersion 2.

Example 5

The procedure for the running test and the evaluation in Example 1 was repeated except for replacing the photoreceptor 1 with the photoreceptor 3. The evaluation results are shown in Table 9.

Example 6

The procedure for the running test and the evaluation in Example 2 was repeated except for replacing the photoreceptor 1 with the photoreceptor 3. The evaluation results are shown in Table 9.

Comparative Example 11

The procedure for the running test and the evaluation in Comparative Example 1 was repeated except for replacing the photoreceptor 1 with the photoreceptor 3. The evaluation results are shown in Table 9.

Comparative Example 12

The procedure for the running test and the evaluation in Comparative Example 2 was repeated except for replacing the photoreceptor 1 with the photoreceptor 3. The evaluation results are shown in Table 9.

Comparative Example 13

The procedure for the running test and the evaluation in Comparative Example 3 was repeated except for replacing the photoreceptor 1 with the photoreceptor 3. The evaluation results are shown in Table 9.

Comparative Example 14

The procedure for the running test and the evaluation in Comparative Example 4 was repeated except for replacing the photoreceptor 1 with the photoreceptor 3. The evaluation results are shown in Table 9.

Comparative Example 15

The procedure for the running test and the evaluation in Comparative Example 5 was repeated except for replacing the photoreceptor 1 with the photoreceptor 3. The evaluation results are shown in Table 9.

TABLE 9

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 5 | 428 | 900 | 120 | 900 | 135 |
| Ex. 6 | 472 | 900 | 120 | 900 | 145 |
| Comp. Ex. 11 | 502 | 900 | 120 | 900 | 175 |
| Comp. Ex. 12 | 591 | 900 | 120 | 900 | 180 |
| Comp. Ex. 13 | 630 | 900 | 120 | 900 | 185 |
| Comp. Ex. 14 | White light | 900 | 120 | 900 | 170 |

TABLE 9-continued

| | λ | At beginning of running test | | After running test | |
|---|---|---|---|---|---|
| | (nm) | $V_D$ (−V) | $V_L$ (−V) | $V_D$ (−V) | $V_L$ (−V) |
| Comp. Ex. 15 | 428, 630 | 900 | 120 | 900 | 175 |

It is clear from Table 9 that when the wavelength of the discharging light is less than 500 nm (Examples 5 and 6), increase in potential ($V_L$) of the lighted portion is lower than that in the cases where the wavelength of the discharging light is not less than 500 nm (Comparative Examples 11-13). In particular, when the wavelength of the discharging light is less than 450 nm (i.e., Example 5), increase in potential ($V_L$) of the lighted portion is lower than that in the case where the wavelength of the discharging light is from 450 nm to 500 nm (i.e., Example 6). In addition, it is also found that when discharging light having a wide wavelength range and including light with a relatively long wavelength is used (i.e., Comparative Example 14), such an effect as produced in Examples 5 and 6 cannot be produced. Further, it is found that when a combination of two light sources emitting light with different wavelengths is used (Comparative Example 15), the effect of the light with a relatively short wavelength is reduced.

Photoreceptor Preparation Example 4

The procedure for preparation of photoreceptor 1 in Photoreceptor Preparation Example 1 was repeated to prepare photoreceptor 4 except for replacing the CGL coating liquid (dispersion 1) with the dispersion 3.

Photoreceptor Preparation Example 5

The procedure for preparation of photoreceptor 1 in Photoreceptor Preparation Example 1 was repeated to prepare photoreceptor 5 except for replacing the CGL coating liquid (dispersion 1) with the dispersion 4.

Example 7

The procedure for the running test and the evaluation in Example 1 was repeated except for replacing the photoreceptor 1 with the photoreceptor 4. In addition, after the running test, a copy of a white solid image was produced and observed to determine whether the white solid image has background fouling (i.e., whether the white solid image is soiled with toner particles). The evaluation results are shown in Table 10 together with those of Examples 1 and 5.

Example 8

The procedure for the running test and the evaluation in Example 1 was repeated except for replacing the photoreceptor 1 with the photoreceptor 5. In addition, after the running test, a copy of a white solid image was produced and observed to determine whether the white solid image has background fouling (i.e., whether the white solid image is soiled with toner particles). The evaluation results are shown in Table 10.

The level of background fouling is classified into the following four grades while considering the number and size of black spots formed on the white solid image.

TABLE 10

| | At beginning of running test | | After running test | | Background |
|---|---|---|---|---|---|
| | $V_D$ (−V) | $V_L$ (−V) | $V_D$ (−V) | $V_L$ (−V) | fouling |
| Ex. 1 | 900 | 130 | 900 | 145 | Δ-○ |
| Ex. 5 | 900 | 120 | 900 | 135 | ◎ |
| Ex. 7 | 900 | 120 | 900 | 135 | ◎ |
| Ex. 8 | 900 | 120 | 900 | 140 | ○ |

◎: Excellent
○: Good
Δ: Acceptable
X: Bad

It is clear from Table 10 that when the average particle diameter of the CGM dispersed in the CGL coating liquid is less than 0.25 μm (Examples 5, 7 and 8), the initial potential of a lighted portion ($V_L$) can be reduced and in addition occurrence of background fouling can be prevented without increasing the potential of a lighted portion even after long repeated use.

Photoreceptor Preparation Example 6

The procedure for preparation of photoreceptor 1 in Photoreceptor Preparation Example 1 was repeated to prepare a photoreceptor 6 except for changing the thickness of the CTL to 22 μm and coating and drying a protective layer coating liquid having the following formula to form a protective layer having a thickness of 3 μm on the CTL.

| Formula of protective layer coating liquid | |
|---|---|
| Polycarbonate (TS2050 from Teijin Chemicals Ltd.) | 10 |
| CTM having the following formula | 7 |

-continued

| Formula of protective layer coating liquid | |
|---|---|

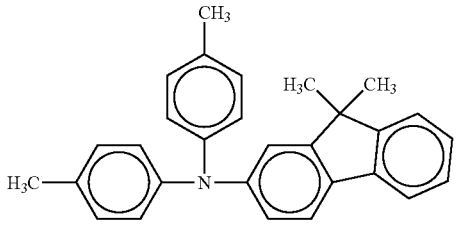

| | |
|---|---|
| Particulate alumina (resistivity of 2.5 × $10^{12}$ Ω · cm, average primary particle diameter of 0.4 μm) | 4 |
| Cyclohexanone | 500 |
| Tetrahydrofuran | 150 |

Photoreceptor Preparation Example 7

The procedure for preparation of photoreceptor 6 in Photoreceptor Preparation Example 6 was repeated to prepare a photoreceptor 7 except for replacing the particulate alumina with 4 parts of a particulate titanium oxide having a resistivity of $1.5\times10^{10}$ Ω·cm, and an average primary particle diameter of 0.5 μm.

Photoreceptor Preparation Example 8

The procedure for preparation of photoreceptor 6 in Photoreceptor Preparation Example 6 was repeated to prepare a photoreceptor 8 except for replacing the particulate alumina with 4 parts of a particulate tin oxide-antimony oxide having a resistivity of $1\times10^{6}$ Ω·cm, and an average primary particle diameter of 0.4 μm.

Photoreceptor Preparation Example 9

The procedure for preparation of photoreceptor 6 in Photoreceptor Preparation Example 6 was repeated to prepare a photoreceptor 9 except for replacing the protective layer coating liquid with a protective layer coating liquid having the following formula.

| Formula of protective layer coating liquid | |
|---|---|
| Charge transport polymer having the following formula (weight average molecular weight of about 140,000) | 17 |

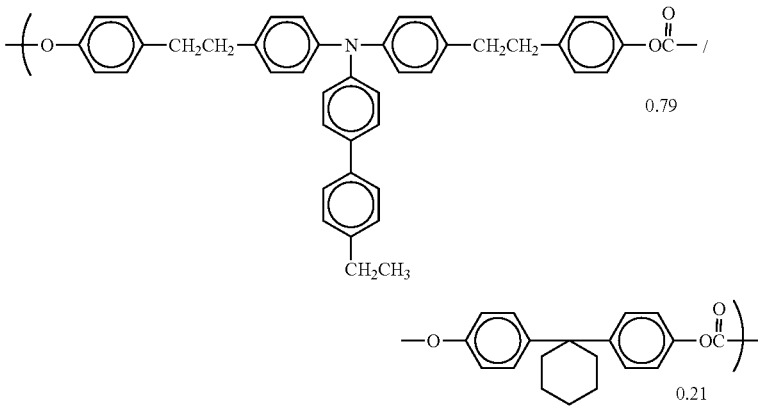

-continued

| Formula of protective layer coating liquid | |
|---|---|
| Particulate alumina (resistivity of $2.5 \times 10^{12}$ Ω · cm, average primary particle diameter of 0.4 μm) | 4 |
| Cyclohexanone | 500 |
| Tetrahydrofuran | 150 |

Photoreceptor Preparation Example 10

The procedure for preparation of photoreceptor 6 in Photoreceptor Preparation Example 6 was repeated to prepare a photoreceptor 10 except for replacing the protective layer coating liquid with a protective layer coating liquid having the following formula.

| Formula of protective layer coating liquid | |
|---|---|
| Methyltrimethoxysilane | 100 |
| 3% acetic acid | 20 |
| CTM having the following formula | 35 |

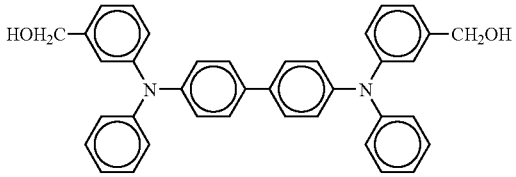

| | |
|---|---|
| Antioxidant (SANOL LS2626 from Sankyo Lifetech Co., Ltd.) | 1 |
| Crosslinking agent (dibutyltin acetate) | 1 |
| 2-Propanol | 200 |

Photoreceptor Preparation Example 11

The procedure for preparation of photoreceptor 6 in Photoreceptor Preparation Example 6 was repeated to prepare a photoreceptor 11 except for replacing the protective layer coating liquid with a protective layer coating liquid having the following formula.

| Formula of protective layer coating liquid | |
|---|---|
| Methyltrimethoxysilane | 100 |
| 3% acetic acid | 20 |
| CTM having the following formula | 35 |

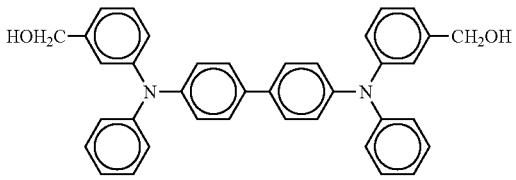

| | |
|---|---|
| Particulate alumina (resistivity of $2.5 \times 10^{12}$ Ω · cm, average primary particle diameter of 0.4 μm) | 15 |
| Antioxidant (SANOL LS2626 from Sankyo Lifetech Co., Ltd.) | 1 |

-continued

| Formula of protective layer coating liquid | |
|---|---|
| Polycarboxylic acid (BYK P104 from Byk Chemie) | 0.4 |
| Crosslinking agent (dibutyltin acetate) | 1 |
| 2-Propanol | 200 |

Photoreceptor Preparation Example 12

The procedure for preparation of photoreceptor 6 in Photoreceptor Preparation Example 6 was repeated to prepare a photoreceptor 12 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropane triacrylate, KAYARAD TMPTA from Nippon Kayaku Co., Ltd., having a molecular weight (M) of 296, three functional groups (F) and ratio (M/F) of 99) | 10 |
| Monofunctional radical polymerizable monomer having charge transport structure and the following formula (i.e., compound No. 54 mentioned above) | 10 |
| Photopolymerization initiator (1-hydroxycycolhexyl-phenyl-ketone, IRGACURE 184 from Ciba Specialty Chemicals) | 1 |

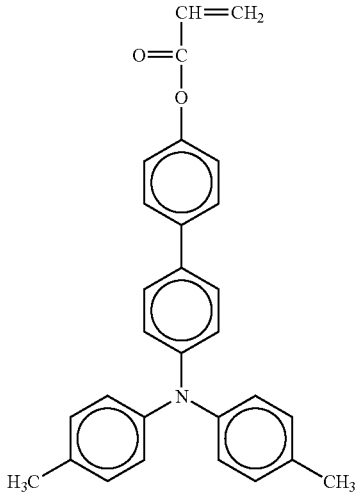

| | |
|---|---|
| Tetrahydrofuran | 100 |

The protective layer coating liquid was coated by a spray coating method and the coated liquid was naturally dried for 20 minutes. Then the coated layer was subjected to a photocrosslinking treatment using a metal halide lamp with a power of 160 W/cm to be crosslinked. The crosslinking conditions are as follows.

Light intensity: 500 mW/cm$^2$

Irradiation time: 60 seconds

Photoreceptor Preparation Example 13

The procedure for preparation of photoreceptor 12 in Photoreceptor Preparation Example 12 was repeated to prepare a photoreceptor 13 except for replacing the tri- or poly-functional radical polymerizable monomer with 10 parts of a trifunctional radical polymerizable monomer having no charge transport structure, pentaerythritol tetraacrylate (SR-295 from Sartomer Company Inc., having molecular weight (M) of 352, four functional groups (F) and ratio (M/F) of 88).

Photoreceptor Preparation Example 14

The procedure for preparation of photoreceptor 12 in Photoreceptor Preparation Example 12 was repeated to prepare a photoreceptor 14 except for replacing the tri- or poly-functional radical polymerizable monomer with 10 parts of a bifunctional radical polymerizable monomer having no charge transport structure, 1,6-hexanediol diacrylate (Wako Pure Chemical Industries Ltd., having molecular weight (M) of 226, two functional groups (F) and ratio (MIF) of 113).

Photoreceptor Preparation Example 15

The procedure for preparation of photoreceptor 12 in Photoreceptor Preparation Example 12 was repeated to prepare a photoreceptor 15 except for replacing the tri- or poly-functional radical polymerizable monomer with 10 parts of a hexafunctional radical polymerizable monomer having no charge transport structure, caprolactone-modified dipentaerythritol hexaacrylate (KAYARAD DPCA-120 from Nippon Kayaku Co., Ltd., having molecular weight (M) of 1946, six functional groups (F) and ratio (M/F) of 325).

Photoreceptor Preparation Example 16

The procedure for preparation of photoreceptor 12 in Photoreceptor Preparation Example 12 was repeated to prepare a photoreceptor 16 except for replacing the monofunctional polymerizable monomer having a charge transport structure with 10 parts of a bifunctional radical polymerizable monomer having a charge transport structure, which has the following formula.

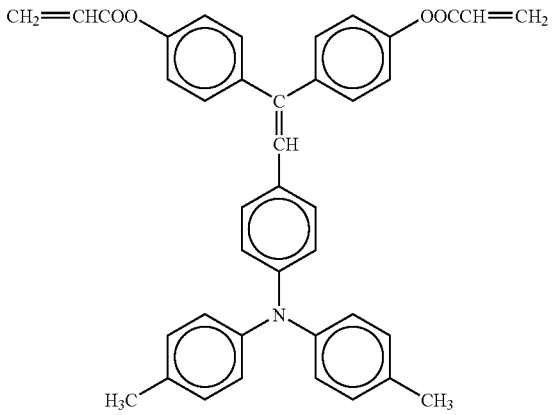

Photoreceptor Preparation Example 17

The procedure for preparation of photoreceptor 12 in Photoreceptor Preparation Example 12 was repeated to prepare a photoreceptor 17 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 6 |
| Monofunctional radical polymerizable monomer having charge transport structure (i.e., compound No. 54 mentioned above) | 14 |

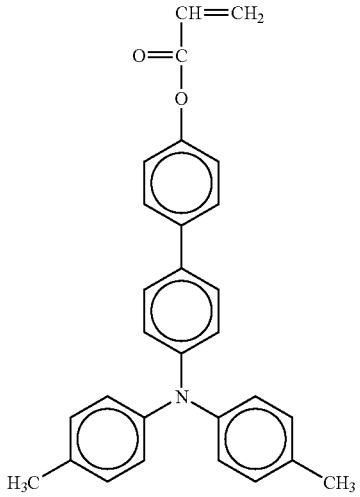

| | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Photoreceptor Preparation Example 18

The procedure for preparation of photoreceptor 12 in Photoreceptor Preparation Example 12 was repeated to prepare a photoreceptor 18 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 14 |

-continued

| Formula of protective layer coating liquid | |
|---|---|
| Monofunctional radical polymerizable monomer having charge transport structure (i.e., compound No. 54 mentioned above) | 6 |

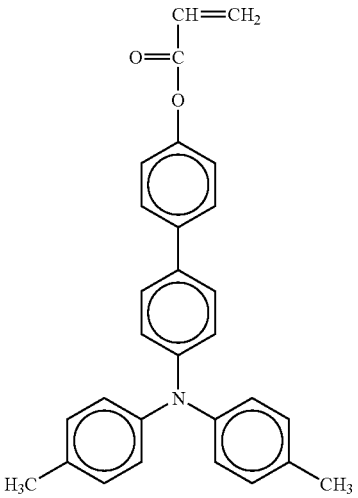

| | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Photoreceptor Preparation Example 19

The procedure for preparation of photoreceptor 12 in Photoreceptor Preparation Example 12 was repeated to prepare a photoreceptor 19 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 2 |
| Monofunctional radical polymerizable monomer having charge transport structure (i.e., compound No. 54 mentioned above) | 18 |

-continued

| Formula of protective layer coating liquid | |
|---|---|
| Photopolymerization initiator | 1 |

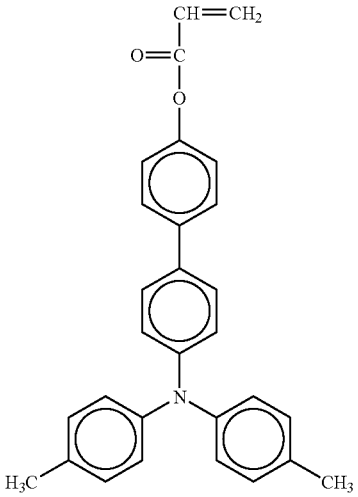

| | |
|---|---|
| (1-hydroxylcycolhexyl-phenyl-ketone, IRGACURE 184 from Ciba Specialty Chemicals) | |
| Tetrahydrofuran | 100 |

Photoreceptor Preparation Example 20

The procedure for preparation of photoreceptor 12 in Photoreceptor Preparation Example 12 was repeated to prepare a photoreceptor 20 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 18 |
| Monofunctional radical polymerizable monomer having charge transport structure (i.e., compound No. 54 mentioned above) | 2 |

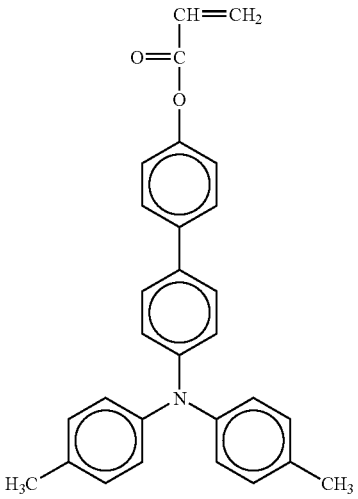

-continued

| Formula of protective layer coating liquid | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Example 9

The procedure for the running test in Example 2 was repeated except for using the photoreceptor 5 and producing 50,000 copies of the original character image. The evaluation items and methods are as follows.

(1) Potential ($V_L$) of Photoreceptor

The potential ($V_L$) of a lighted portion of the photoreceptor was measured at the beginning of the running test and after the running test. The measuring method is the same as that performed in Example 1.

(2) Background Fouling (BF)

After the running test, a white solid image was produced under an environmental condition of 22° C. and 50% RH and observed to determine whether the white solid image has background fouling. The quality is classified into the following four grades.

◎: Excellent

○: Good

Δ: Acceptable

X: Bad (3) Cleanability of Photoreceptor (CL)

After the evaluation of background fouling, 50 copies of an original image illustrated in FIG. 15 were produced under an environmental condition of 10° C. and 15% RH and the white solid image portion of the $50^{th}$ image was visually observed to evaluate the cleanability of the photoreceptor. The cleanability of the photoreceptor is classified into the following four grades.

◎: Excellent (no streak image was observed in the white solid image)

○: Good (one or two slight black streaks were observed in the white solid image)

Δ: Acceptable (three or four slight black streaks were observed in the white solid image)

X: Bad (clear black streaks were observed in the white solid image)

(4) Dot Reproducibility (DOT)

After the evaluation of cleanability, 1,000 copies of the original character image were produced a high temperature and high humidity condition of 30° C. and 90% RH and then an image including one dot images was produced. The one dot images were observed with a microscope with 150 power magnification whether the outline of the one dot images is clear. The dot reproducibility of the photoreceptor is classified into the following four grades.

◎: Excellent

○: Good

Δ: Acceptable

X: Bad (5) Abrasion Loss

The thickness of the photosensitive layer (including the protective layer and the intermediate layer) of each photoreceptor before the running test and after the tests mentioned above in (1) to (4) was measured to determine the thickness difference, i.e., the abrasion loss of the photoreceptor. The thickness of several points of the photoreceptor in the longitudinal direction thereof was measured at intervals of 1 cm except for both the edge portions having a width of 5 cm, and the thickness data were averaged.

The evaluation results are shown in Table 11.

Examples 10 to 24

The procedure for evaluation in Example 9 was repeated except for replacing the photoreceptor 1 with each of the photoreceptors 6 to 20.

The evaluation results are shown in Table 11.

TABLE 11

| | | $V_L$ (−V) | | | | | |
|---|---|---|---|---|---|---|---|
| | No. | Initial potential | After 50,000 copies | BF | CL | DOT | Abrasion Loss (μm) |
| Ex. 9 | 1 | 130 | 155 | Δ | ○ | ◎ | 7.0 |
| Ex. 10 | 6 | 135 | 165 | ◎ | Δ-○ | ○-◎ | 2.0 |
| Ex. 11 | 7 | 140 | 170 | ◎ | Δ-○ | ○ | 1.8 |
| Ex. 12 | 8 | 130 | 160 | ○ | Δ-○ | Δ-○ | 2.0 |
| Ex. 13 | 9 | 140 | 165 | ◎ | Δ-○ | ○ | 1.6 |
| Ex. 14 | 10 | 140 | 165 | ○-◎ | ○ | ○ | 2.5 |
| Ex. 15 | 11 | 145 | 170 | ◎ | Δ-○ | Δ-○ | 1.6 |
| Ex. 16 | 12 | 140 | 165 | ◎ | ◎ | ◎ | 1.4 |
| Ex. 17 | 13 | 140 | 165 | ○ | ◎ | ◎ | 1.2 |
| Ex. 18 | 14 | 140 | 165 | ◎ | Δ-○ | ◎ | 2.6 |
| Ex. 19 | 15 | 140 | 165 | ◎ | ◎ | ◎ | 1.4 |
| Ex. 20 | 16 | 140 | 170 | ◎ | Δ-○ | ◎ | 1.2 |
| Ex. 21 | 17 | 135 | 160 | ○-◎ | ◎ | ◎ | 1.6 |
| Ex. 22 | 18 | 145 | 170 | ◎ | ◎ | ◎ | 1.4 |
| Ex. 23 | 19 | 130 | 155 | ○-◎ | ◎ | ◎ | 1.8 |
| Ex. 24 | 20 | 150 | 170 | ◎ | ◎ | ◎ | 1.4 |

No.: Number of photoreceptor used

It is clear from Table 11 that even when a protective layer is formed, the following knowledge can be obtained.

(1) The residual potential increasing problem can be avoided if light with a wavelength less than 500 nm is used as the discharging light;

(2) The photoreceptors (Examples 10-14) including a protective layer have better abrasion resistance than the photoreceptor (Example 9) including no protective layer;

(3) Among the photoreceptors having a protective layer including a particulate inorganic material (Examples 10-12), the photoreceptors (Examples 11 and 12) having a protective layer including a particulate inorganic material having a resistivity not less than $10^{10}$ Ω·cm have good dot reproducibility even under high temperature and high humidity conditions;

(4) The photoreceptors having a crosslinked protective layer have better abrasion resistance than the photoreceptor having a non-crosslinked protective layer, in particular, the photoreceptors (Examples 16, 17, 19, and 21-24) having a crosslinked protective layer which is prepared using a tri- or poly-functional monomer having no charge transport structure and a monofunctional monomer having a charge transport structure have excellent abrasion resistance; and (5) the photoreceptors (Examples 16, 17, 19, and 21-24) also have excellent cleanability.

Comparative Example 16

The procedure for the running test and the evaluation of the images in Example 19 was repeated except for replacing the laser diode with a laser diode (from Seiwa Electric Mfg. Co., Ltd.) emitting light with a wavelength of 502 nm and a half width of 15 nm. The light intensity was controlled so that the initial potential ($V_L$) of a lighted portion is the same as that in Example 19. The evaluation results are shown in Table 12.

Comparative Example 17

The procedure for the running test and the evaluation of the images in Example 19 was repeated except for replacing the laser diode with a laser diode (from Rohm Co., Ltd.) emitting light with a wavelength of 591 nm and a half width of 15 nm. The light intensity was controlled so that the initial potential ($V_L$) of a lighted portion is the same as that in Example 19. The evaluation results are shown in Table 12.

Comparative Example 18

The procedure for the running test and the evaluation of the images in Example 19 was repeated except for replacing the laser diode with a laser diode (from Rohm Co., Ltd.) emitting light with a wavelength of 630 nm and a half width of 20 nm. The light intensity was controlled so that the initial potential ($V_L$) of a lighted portion is the same as that in Example 19. The evaluation results are shown in Table 12.

Comparative Example 19

The procedure for the running test and the evaluation of the images in Example 19 was repeated except for replacing the laser diode with a fluorescent lamp emitting light having a spectrum illustrated in FIG. 1. The light intensity was controlled so that the initial potential ($V_L$) of a lighted portion is the same as that in Example 19. The evaluation results are shown in Table 12.

TABLE 12

| | Wavelength (λ) of discharging light (nm) | Potential of lighted portion ($V_L$) (−V) At beginning of running test | After running test |
|---|---|---|---|
| Example 19 | 472 | 140 | 165 |
| Comparative Example 16 | 502 | 140 | 195 |
| Comparative Example 17 | 591 | 140 | 200 |
| Comparative Example 18 | 630 | 140 | 210 |
| Comparative Example 19 | White light | 140 | 190 |

It is clear from Table 12 that when the wavelength of the discharging light is less than 500 nm (Example 19), increase in the potential ($V_L$) is smaller than in Comparative Examples 16-18 using discharging light with a wavelength of not less than 500 nm. In addition, when the discharging light has light including components with a relatively long wavelength of not less than 500 nm (Comparative Example 19), the effect as produced in Example 21 cannot be produced.

Example 25

Figure 17:
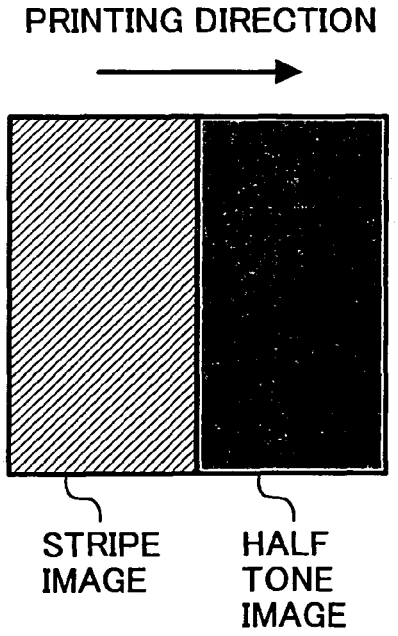
FIG. 17 is a test chart used in Example 23.

The procedure for the running test and evaluation in Example 9 was repeated except for replacing the photoreceptor 1 with the photoreceptor 15; replacing the discharging light with a discharging light, which was obtained from the light emitted by the xenon lamp using a spectroscope, having a wavelength of 450 nm; and further producing a halftone image of a chart shown in FIG. 17 after the running test and evaluation to observe image irregularities thereof. The evaluation results are shown in Table 13.

Example 26

The procedure for the running test and evaluation in Example 25 was repeated except for replacing the discharging light with a discharging light having a wavelength of 400 nm. The evaluation results are shown in Table 13.

Example 27

The procedure for the running test and evaluation in Example 25 was repeated except for replacing the discharging light with a discharging light having a wavelength of 393 nm. The evaluation results are shown in Table 13.

Example 28

The procedure for the running test and evaluation in Example 25 was repeated except for replacing the discharging light with a discharging light having a wavelength of 390 nm. The evaluation results are shown in Table 13.

Example 29

The procedure for the running test and evaluation in Example 25 was repeated except for replacing the discharging light with a discharging light having a wavelength of 385 nm. The evaluation results are shown in Table 13.

TABLE 13

| | Wavelength (λ) of discharging light (nm) | Transmittance of protective layer against discharging light (%) | Potential of lighted portion ($V_L$) (−V) At beginning of running test | After running test |
|---|---|---|---|---|
| Ex. 25 | 450 | 85 | 140 | 165 |
| Ex. 26 | 400 | 73 | 140 | 165 |
| Ex. 27 | 393 | 50 | 140 | 165 |
| Ex. 28 | 390 | 29 | 140 | 170 |
| Ex. 29 | 385 | 9 | 140 | 170 |

It is clear from Table 13 that when the transmittance of the protective layer against the discharging light is less than about 30%, the discharging effect slightly deteriorates.

In addition, it is found that the halftone images of the chart in FIG. 17 produced in Examples 25 to 27 are normal but the halftone images produced in Examples 28 and 29 include a slight ghost image of the stripe image formed on an upper portion of each copy although the quality of the half tone images is still acceptable. The ghost image in the image produced in Example 29 is relatively noticeable compared with that in Example 28.

Thus, it is discovered that even when light with a wavelength of less than 500 nm is used as the discharging light, a minor side effect is produced if the transmittance of the protective layer against the light is less than 30%.

Photoreceptor Preparation Example 21

The procedure for preparation of photoreceptor 1 in Photoreceptor Preparation Example 1 was repeated to prepare a photoreceptor 21 except for replacing the intermediate layer with a combination of a charge blocking layer with a thickness of 1.0 μm and a moiré preventing layer with a thickness of 3.5 μm located on the charge blocking layer, which were formed by coating the respective coating liquids having the following formulae, followed by drying.

| Formula of charge blocking layer coating liquid | |
|---|---|
| N-methoxymethylated nylon (FINE RESIN FR-101 from Namariichi Co., Ltd.) | 4 |
| Methanol | 70 |
| n-butanol | 30 |

| Formula of moiré preventing layer coating liquid | |
|---|---|
| Titanium oxide (CR-EL from Ishihara Sangyo Kaisha, Ltd., average particle diameter of 0.25 μm) | 126 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 1.5/1, and the weight ratio (A/M) of the alkyd resin (A) to the melamine resin (M) is 6/4.

Photoreceptor Preparation Example 22

The procedure for preparation of photoreceptor 21 in Photoreceptor Preparation Example 21 was repeated to prepare a photoreceptor 22 except for changing the thickness of the charge blocking layer to 0.3 μm.

Photoreceptor Preparation Example 23

The procedure for preparation of photoreceptor 21 in Photoreceptor Preparation Example 21 was repeated to prepare a photoreceptor 23 except for changing the thickness of the charge blocking layer to 1.8 μm.

Photoreceptor Preparation Example 24

The procedure for preparation of photoreceptor 21 in Photoreceptor Preparation Example 21 was repeated to prepare a photoreceptor 24 except for replacing the charge blocking layer coating liquid with a charge blocking layer coating liquid having the following formula.

| Formula of charge blocking layer coating liquid | |
|---|---|
| Alcohol-soluble nylon (AMILAN CM8000 from Toray Industries Inc.) | 4 |
| Methanol | 70 |
| n-butanol | 30 |

Photoreceptor Preparation Example 25

The procedure for preparation of photoreceptor 21 in Photoreceptor Preparation Example 21 was repeated to prepare a photoreceptor 25 except for replacing the moiré preventing layer coating liquid with a moiré preventing layer coating liquid having the following formula.

| Formula of moiré preventing layer coating liquid | |
|---|---|
| Titanium oxide (CR-EL from Ishihara Sangyo Kaisha, Ltd., average particle diameter of 0.25 μm) | 252 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 3/1, and the weight ratio (A/M) of the alkyd resin (A) to the melamine resin (M) is 6/4.

Photoreceptor Preparation Example 26

The procedure for preparation of photoreceptor 21 in Photoreceptor Preparation Example 21 was repeated to prepare a photoreceptor 26 except for replacing the moiré preventing layer coating liquid with a moiré preventing layer coating liquid having the following formula.

| Formula of moiré preventing layer coating liquid | |
|---|---|
| Titanium oxide (CR-EL from Ishihara Sangyo Kaisha, Ltd., average particle diameter of 0.25 μm) | 84 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 1/1, and the weight ratio (A/M) of the alkyd resin (A) to the melamine resin (M) is 6/4.

Examples 30 to 35

The procedure for the running test and evaluation in Example 13 was repeated except for replacing the photoreceptor 1 with each of photoreceptors 21-26. The evaluation results are shown in Table 14.

TABLE 14

| | No. | $V_L$ (−V) Initial | After 50,000 copies | BF | CL | DOT | Abrasion loss (μm) |
|---|---|---|---|---|---|---|---|
| Ex. 9 | 1 | 130 | 155 | Δ | ○ | ◎ | 7.0 |
| Ex. 30 | 21 | 130 | 160 | ◎ | ○ | ◎ | 7.0 |
| Ex. 31 | 22 | 130 | 155 | ○ | ○ | ◎ | 7.0 |
| Ex. 32 | 23 | 135 | 165 | ◎ | ○ | ◎ | 7.0 |
| Ex. 33 | 24 | 140 | 175 | ◎ | ○ | ◎ | 7.0 |
| Ex. 34 | 25 | 130 | 155 | ○ | ○ | ◎ | 7.0 |
| Ex. 35 | 26 | 140 | 165 | ◎ | ○ | ◎ | 7.0 |

It is clear from Table 14 that the photoreceptors have good resistance to background fouling when using a combination of a charge blocking layer and a moiré preventing layer as the intermediate layer.

Example 36

The procedure for the running test and evaluation in Example 1 was repeated except for replacing the light irradiator with a laser diode emitting light of 407 nm from Nichia Corporation. The evaluation results are shown in Table 15.

In addition, a one-dot image having a diameter of 60 μm was produced to be compared with that of Example 1 with a microscope of 150 magnifications.

TABLE 15

| | λ (nm) | At beginning of running test $V_D$ (−V) | At beginning of running test $V_L$ (−V) | After running test $V_D$ (−V) | After running test $V_L$ (−V) |
|---|---|---|---|---|---|
| Ex. 1 | 428 | 900 | 130 | 900 | 145 |
| Ex. 36 | 407 | 900 | 130 | 900 | 140 |

It is clear from Table 15 that when a short wavelength of the irradiating light of 407 nm (Example 36), increase in potential ($V_L$) of the lighted portion is lower than that in Example 1. Further, the one-dot image had an outline clearer than that of Example 1.

Photoreceptor Preparation Example 27

The procedure for preparation of photoreceptor 1 in Photoreceptor Preparation Example 1 was repeated to prepare photoreceptor 27 except for replacing the CGL coating liquid (dispersion 1) with the dispersion 5 and the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |
| 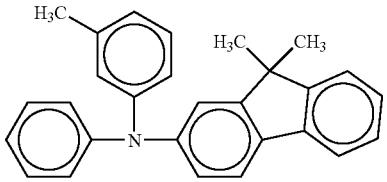 | |
| Methylene chloride | 80 |

Example 37

The procedure for the running test and evaluation in Example 1 was repeated except that photoreceptor 27 was set in a process cartridge having a structure as illustrated in FIG. 13 and four of the process cartridge were set in a full color image forming apparatus having a structure as illustrated in FIG. 12. In addition, after the running test, a copy of an ISO/JIS-SCID N1 portrait image was produced to evaluate the color reproducibility of the photoreceptor. The evaluation results are shown in Table 16.

Example 38

The procedure for the running test and the evaluation in Example 37 was repeated except for replacing the discharging lamp with a discharging lamp including a LED (from Seiwa Electric Mfg. Co., Ltd.) which emits light with a wavelength of 472 nm and a half width of 15 nm. In this regard, the light intensity of the discharging lamp was controlled so that the potential of the non-lighted portion of the photoreceptor after the discharging process is the same as that in Example 37. The evaluation results are shown in Table 16.

Comparative Example 20

The procedure for the running test and the evaluation in Example 37 was repeated except for replacing the discharging lamp with a discharging lamp including a LED (from Seiwa Electric Mfg. Co., Ltd.) which emits light with a wavelength of 502 nm and a half width of 15 nm. In this regard, the light intensity of the discharging lamp was controlled so that the potential of the non-lighted portion of the photoreceptor after the discharging process is the same as that in Example 37. The evaluation results are shown in Table 16.

Comparative Example 21

The procedure for the running test and the evaluation in Example 37 was repeated except for replacing the discharging lamp with a discharging lamp including a LED (from Rohm Co., Ltd.) which emits light with a wavelength of 591 nm and a half width of 15 nm. In this regard, the light intensity of the discharging lamp was controlled so that the potential of the non-lighted portion of the photoreceptor after the discharging process is the same as that in Example 37. The evaluation results are shown in Table 16.

Comparative Example 22

The procedure for the running test and the evaluation in Example 37 was repeated except for replacing the discharging lamp with a discharging lamp including a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 37. The evaluation results are shown in Table 16.

Comparative Example 23

The procedure for the running test and the evaluation in Example 37 was repeated except for replacing the discharging lamp with a fluorescent lamp which emits light having a spectrum as illustrated in FIG. 1. In this regard, the light intensity of the discharging lamp was controlled so that the potential of the non-lighted portion of the photoreceptor after the discharging process is the same as that in Example 37. The evaluation results are shown in Table 16.

Comparative Example 24

The procedure for the running test and the evaluation in Example 37 was repeated except for replacing the discharging lamp with two discharging lamps including a LED (from Rohm Co., Ltd.) which emits light with a wavelength of 428 nm and a half width of 65 nm, and a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 37. The evaluation results are shown in Table 16.

TABLE 16

| | Wavelength (λ) of discharging light (nm) | Potential of lighted portion ($V_L$) (−V) At beginning of running test | After running test |
|---|---|---|---|
| Example 37 | 428 | 60 | 75 |
| Example 38 | 472 | 60 | 80 |
| Comparative Example 20 | 502 | 60 | 105 |
| Comparative Example 21 | 591 | 60 | 110 |
| Comparative Example 22 | 630 | 60 | 115 |
| Comparative Example 23 | White light | 60 | 100 |
| Comparative Example 24 | 428 and 630 | 60 | 105 |

It is clear from Table 16 that when the wavelength of the discharging light is less than 500 nm (Examples 37 and 38), increase in potential ($V_L$) of the lighted portion is lower than that in the cases where the wavelength of the discharging light is not less than 500 nm (Comparative Examples 20-22). In particular, when the wavelength of the discharging light is less than 450 nm (i.e., Example 37), increase in potential ($V_L$) of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 23), such an effect as produced in Examples 37 and 38 cannot be produced. Further, it is found that when a combination of two light sources emitting light with different wavelengths is used (Comparative Example 24), the effect of the light with a relatively short wavelength is reduced.

The image qualities of the color images produced in Examples 37 and 38 were hardly changed before and after the running test. However, the color images produced in Comparative Examples 20-24 after the running test have slightly poor color reproducibility (i.e., the color tones of the color images are changed after the running test).

Photoreceptor Preparation Example 28

The procedure for preparation of photoreceptor 27 in Photoreceptor Preparation Example 27 was repeated to prepare photoreceptor 28 except for replacing the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |

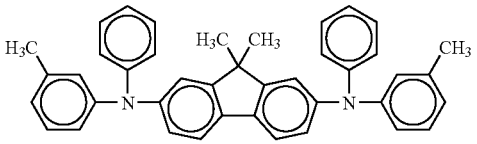

| | |
|---|---|
| Methylene chloride | 80 |

Example 39

The procedure for the running test and the evaluation in Example 37 was repeated except for replacing the photoreceptor 27 with the photoreceptor 28. The evaluation results are shown in Table 17.

Example 40

The procedure for the running test and the evaluation in Example 38 was repeated except for replacing the photoreceptor 27 with the photoreceptor 28. The evaluation results are shown in Table 17.

Comparative Example 25

The procedure for the running test and the evaluation in Comparative Example 20 was repeated except for replacing the photoreceptor 27 with the photoreceptor 28. The evaluation results are shown in Table 17.

Comparative Example 26

The procedure for the running test and the evaluation in Comparative Example 21 was repeated except for replacing the photoreceptor 27 with the photoreceptor 28. The evaluation results are shown in Table 17.

Comparative Example 27

The procedure for the running test and the evaluation in Comparative Example 22 was repeated except for replacing the photoreceptor 27 with the photoreceptor 28. The evaluation results are shown in Table 17.

Comparative Example 28

The procedure for the running test and the evaluation in Comparative Example 23 was repeated except for replacing the photoreceptor 27 with the photoreceptor 28. The evaluation results are shown in Table 17.

Comparative Example 29

The procedure for the running test and the evaluation in Comparative Example 24 was repeated except for replacing the photoreceptor 27 with the photoreceptor 28. The evaluation results are shown in Table 17.

TABLE 17

| | Wavelength (λ) of | Potential of lighted portion ($V_L$) (−V) | |
|---|---|---|---|
| | discharging light (nm) | At beginning of running test | After running test |
| Example 39 | 428 | 70 | 90 |
| Example 40 | 472 | 70 | 95 |
| Comparative Example 25 | 502 | 70 | 120 |
| Comparative Example 26 | 591 | 70 | 125 |
| Comparative Example 27 | 630 | 70 | 130 |
| Comparative Example 28 | White light | 70 | 115 |
| Comparative Example 29 | 428 and 630 | 70 | 120 |

It is clear from Table 17 that when the wavelength of the discharging light is less than 500 nm (Examples 39 and 40), increase in potential ($V_L$) of the lighted portion is lower than that in the cases where the wavelength of the discharging light is not less than 500 nm (Comparative Examples 25-27). In particular, when the wavelength of the discharging light is less than 450 nm (i.e., Example 39), increase in potential ($V_L$) of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 28), such an effect as produced in Examples 39 and 40 cannot be produced. Further, it is found that when a combination of two light sources emitting light with different wavelengths is used (Comparative Example 29), the effect of the light with a relatively short wavelength is reduced.

The image qualities of the color images produced in Examples 39 and 40 were hardly changed before and after the running test. However, the color images produced in Comparative Examples 25-29 after the running test have slightly poor color reproducibility (i.e., the color tones of the color images are changed after the running test).

Photoreceptor Preparation Example 29

The procedure for preparation of photoreceptor 27 in Photoreceptor Preparation Example 27 was repeated to prepare photoreceptor 29 except for replacing the CGL coating liquid (dispersion 5) with the dispersion 6.

Example 41

The procedure for the running test and the evaluation in Example 37 was repeated except for replacing the photoreceptor 27 with the photoreceptor 29. The evaluation results are shown in Table 18.

Example 40

The procedure for the running test and the evaluation in Example 38 was repeated except for replacing the photoreceptor 27 with the photoreceptor 29. The evaluation results are shown in Table 18.

Comparative Example 30

The procedure for the running test and the evaluation in Comparative Example 20 was repeated except for replacing the photoreceptor 27 with the photoreceptor 29. The evaluation results are shown in Table 18.

Comparative Example 31

The procedure for the running test and the evaluation in Comparative Example 21 was repeated except for replacing the photoreceptor 27 with the photoreceptor 29. The evaluation results are shown in Table 18.

Comparative Example 32

The procedure for the running test and the evaluation in Comparative Example 22 was repeated except for replacing the photoreceptor 27 with the photoreceptor 29. The evaluation results are shown in Table 18.

Comparative Example 33

The procedure for the running test and the evaluation in Comparative Example 23 was repeated except for replacing the photoreceptor 27 with the photoreceptor 29. The evaluation results are shown in Table 18.

Comparative Example 34

The procedure for the running test and the evaluation in Comparative Example 24 was repeated except for replacing the photoreceptor 27 with the photoreceptor 29. The evaluation results are shown in Table 18.

TABLE 18

| | Wavelength (λ) of | Potential of lighted portion ($V_L$) (−V) | |
|---|---|---|---|
| | discharging light (nm) | At beginning of running test | After running test |
| Example 41 | 428 | 70 | 85 |
| Example 42 | 472 | 70 | 90 |
| Comparative Example 30 | 502 | 70 | 115 |
| Comparative Example 31 | 591 | 70 | 120 |
| Comparative | 630 | 70 | 125 |

TABLE 18-continued

| | Wavelength (λ) of discharging light (nm) | Potential of lighted portion ($V_L$) (−V) At beginning of running test | After running test |
|---|---|---|---|
| Example 32 | | | |
| Comparative Example 33 | White light | 70 | 110 |
| Comparative Example 34 | 428 and 630 | 70 | 115 |

It is clear from Table 18 that when the wavelength of the discharging light is less than 500 nm (Examples 41 and 42), increase in potential ($V_L$) of the lighted portion is lower than that in the cases where the wavelength of the discharging light is not less than 500 nm (Comparative Examples 30-32). In particular, when the wavelength of the discharging light is less than 450 nm (i.e., Example 41), increase in potential ($V_L$) of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 33), such an effect as produced in Examples 39 and 40 cannot be produced. Further, it is found that when a combination of two light sources emitting light with different wavelengths is used (Comparative Example 34), the effect of the light with a relatively short wavelength is reduced.

The image qualities of the color images produced in Examples 41 and 42 were hardly changed before and after the running test. However, the color images produced in Comparative Examples 30-34 after the running test have slightly poor color reproducibility (i.e., the color tones of the color images are changed after the running test).

In addition, the residual potential ($V_L$) in Example 37 (shown in Table 16) is lower than that in Example 41. This is because the azo dye which is used for the photoreceptor 27 used in Example 41 which includes an asymmetric coupler component enhances the photosensitivity of the photoreceptor.

Example 43

The procedure for the running test and evaluation in Example 37 was repeated except for replacing the light irradiator with a laser diode emitting light of 407 nm from Nichia Corporation. The evaluation results are shown in Table 19.

In addition, a one-dot image having a diameter of 60 μm was produced to be compared with that of Example 37 with a microscope of 150 magnifications.

TABLE 19

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 37 | 428 | 900 | 60 | 900 | 75 |
| Ex. 43 | 407 | 900 | 60 | 900 | 70 |

It is clear from Table 15 that when a short wavelength of the irradiating light of 407 nm (Example 43), increase in potential ($V_L$) of the lighted portion is lower than that in Example 37. Further, the one-dot image had an outline clearer than that of Example 37.

Photoreceptor Preparation Example 30

The procedure for preparation of photoreceptor 1 in Photoreceptor Preparation Example 1 was repeated to prepare a photoreceptor 30 except for replacing the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |
| 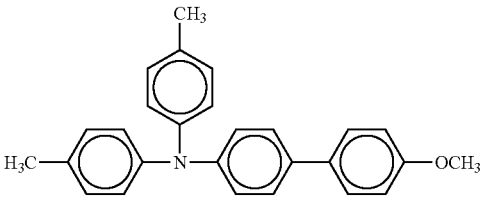 | |
| Methylene chloride | 80 |

Example 44

The procedure for the running test and the evaluation in Example 1 was repeated except for replacing the photoreceptor 1 with the photoreceptor 30. The evaluation results are shown in Table 20.

Example 45

The procedure for the running test and the evaluation in Example 44 was repeated except for replacing the discharging lamp with a discharging lamp including a LED (from Seiwa Electric Mfg. Co., Ltd.) which emits light with a wavelength of 472 nm and a half width of 15 nm. In this regard, the light intensity of the discharging lamp was controlled so that the potential of the non-lighted portion of the photoreceptor after the discharging process is the same as that in Example 44. The evaluation results are shown in Table 20.

Comparative Example 35

The procedure for the running test and the evaluation in Example 44 was repeated except for replacing the discharging lamp with a discharging lamp including a LED (from Seiwa Electric Mfg. Co., Ltd.) which emits light with a wavelength of 502 nm and a half width of 15 nm. In this regard, the light intensity of the discharging lamp was controlled so that the potential of the non-lighted portion of the photoreceptor after the discharging process is the same as that in Example 44. The evaluation results are shown in Table 20.

Comparative Example 36

The procedure for the running test and the evaluation in Example 44 was repeated except for replacing the discharging lamp with a discharging lamp including a LED (from Rohm Co., Ltd.) which emits light with a wavelength of 591 nm and a half width of 15 nm. In this regard, the light intensity of the discharging lamp was controlled so that the potential of the non-lighted portion of the photoreceptor after the discharging process is the same as that in Example 44. The evaluation results are shown in Table 20.

Comparative Example 37

The procedure for the running test and the evaluation in Example 44 was repeated except for replacing the discharging lamp with a discharging lamp including a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 44. The evaluation results are shown in Table 20.

Comparative Example 38

The procedure for the running test and the evaluation in Example 44 was repeated except for replacing the discharging lamp with a fluorescent lamp which emits light having a spectrum as illustrated in FIG. 1. In this regard, the light intensity of the discharging lamp was controlled so that the potential of the non-lighted portion of the photoreceptor after the discharging process is the same as that in Example 44. The evaluation results are shown in Table 20.

Comparative Example 39

The procedure for the running test and the evaluation in Example 44 was repeated except for replacing the discharging lamp with two discharging lamps including a LED (from Rohm Co., Ltd.) which emits light with a wavelength of 428 nm and a half width of 65 nm, and a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 44. The evaluation results are shown in Table 20.

TABLE 20

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 44 | 428 | 900 | 115 | 900 | 125 |
| Ex. 45 | 472 | 900 | 115 | 900 | 135 |
| Comp. Ex. 35 | 502 | 900 | 115 | 900 | 165 |
| Comp. Ex. 36 | 591 | 900 | 115 | 900 | 170 |
| Comp. Ex. 37 | 630 | 900 | 115 | 900 | 175 |
| Comp. Ex. 38 | White light | 900 | 115 | 900 | 160 |
| Comp. Ex. 39 | 428 and 630 | 900 | 115 | 900 | 165 |

It is clear from Table 20 that when the wavelength of the discharging light is less than 500 nm (Examples 44 and 45), increase in potential ($V_L$) of the lighted portion is lower than that in the cases where the wavelength of the discharging light is not less than 500 nm (Comparative Examples 35-37). In particular, when the wavelength of the discharging light is less than 450 nm (i.e., Example 44), increase in potential ($V_L$) Of the lighted portion is lower than that of Example 45 in the case where the wavelength of the discharging light is from 450 nm to 500 nm.

In addition, it is also found that when discharging light having a wide wavelength range and including light with a relatively long wavelength is used (i.e., Comparative Example 38), such an effect as produced in Examples 44 and 45 cannot be produced. Further, it is found that when a combination of two light sources emitting light with different wavelengths is used (Comparative Example 39), the effect of the light with a relatively short wavelength is reduced.

Photoreceptor Preparation Example 31

The procedure for preparation of photoreceptor 30 in Photoreceptor Preparation Example 30 was repeated to prepare photoreceptor 31 except for replacing the CGL coating liquid (dispersion 1) with the dispersion 2.

Example 46

The procedure for the running test and the evaluation in Example 44 was repeated except for replacing the photoreceptor 30 with the photoreceptor 31. The evaluation results are shown in Table 21.

Example 47

The procedure for the running test and the evaluation in Example 45 was repeated except for replacing the photoreceptor 30 with the photoreceptor 31. The evaluation results are shown in Table 2.1.

Comparative Example 40

The procedure for the running test and the evaluation in Comparative Example 35 was repeated except for replacing the photoreceptor 30 with the photoreceptor 31. The evaluation results are shown in Table 21.

Comparative Example 41

The procedure for the running test and the evaluation in Comparative Example 36 was repeated except for replacing the photoreceptor 30 with the photoreceptor 31. The evaluation results are shown in Table 21.

Comparative Example 42

The procedure for the running test and the evaluation in Comparative Example 37 was repeated except for replacing the photoreceptor 30 with the photoreceptor 31. The evaluation results are shown in Table 21.

Comparative Example 43

The procedure for the running test and the evaluation in Comparative Example 38 was repeated except for replacing the photoreceptor 30 with the photoreceptor 31. The evaluation results are shown in Table 21.

Comparative Example 44

The procedure for the running test and the evaluation in Comparative Example 39 was repeated except for replacing the photoreceptor 30 with the photoreceptor 31. The evaluation results are shown in Table 21.

TABLE 21

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 46 | 428 | 900 | 105 | 900 | 115 |
| Ex. 47 | 472 | 900 | 105 | 900 | 125 |
| Comp. Ex. 40 | 502 | 900 | 105 | 900 | 155 |
| Comp. Ex. 41 | 591 | 900 | 105 | 900 | 160 |
| Comp. Ex. 42 | 630 | 900 | 105 | 900 | 165 |
| Comp. Ex. 43 | White light | 900 | 105 | 900 | 150 |
| Comp. Ex. 44 | 428 and 630 | 900 | 105 | 900 | 155 |

It is clear from Table 21 that when the wavelength of the discharging light is less than 500 nm (Examples 46 and 47), increase in potential ($V_L$) of the lighted portion is lower than that in the cases where the wavelength of the discharging light is not less than 500 nm (Comparative Examples 40-42). In particular, when the wavelength of the discharging light is less than 450 nm (i.e., Example 46), increase in potential ($V_L$) of the lighted portion is lower than that of Example 47 in the case where the wavelength of the discharging light is from 450 nm to 500 nm. In addition, it is also found that when discharging light having a wide wavelength range and including light with a relatively long wavelength is used (i.e., Comparative Example 43), such an effect as produced in Examples 46 and 47 cannot be produced. Further, it is found that when a combination of two light sources emitting light with different wavelengths is used (Comparative Example 44), the effect of the light with a relatively short wavelength is reduced.

Photoreceptor Preparation Example 32

The procedure for preparation of photoreceptor 30 in Photoreceptor Preparation Example 30 was repeated to prepare photoreceptor 32 except for replacing the CGL coating liquid (dispersion 1) with the dispersion 3.

Photoreceptor Preparation Example 33

The procedure for preparation of photoreceptor 30 in Photoreceptor Preparation Example 30 was repeated to prepare photoreceptor 33 except for replacing the CGL coating liquid (dispersion 1) with the dispersion 4.

Example 48

The procedure for the running test and the evaluation in Example 44 was repeated except for replacing the photoreceptor 30 with the photoreceptor 32. In addition, after the running test, a copy of a white solid image was produced and observed to determine whether the white solid image has background fouling (i.e., whether the white solid image is soiled with toner particles). The evaluation results are shown in Table 22 together with those of Examples 44 and 46.

Example 49

The procedure for the running test and the evaluation in Example 44 was repeated except for replacing the photoreceptor 30 with the photoreceptor 33. In addition, after the running test, a copy of a white solid image was produced and observed to determine whether the white solid image has background fouling (i.e., whether the white solid image is soiled with toner particles). The evaluation results are shown in Table 22.

The level of background fouling is classified into the following four grades while considering the number and size of black spots formed on the white solid image.

TABLE 22

| | At beginning of running test | | After running test | | Background |
|---|---|---|---|---|---|
| | $V_D$ (−V) | $V_L$ (−V) | $V_D$ (−V) | $V_L$ (−V) | fouling |
| Ex. 44 | 900 | 115 | 900 | 125 | Δ-○ |
| Ex. 46 | 900 | 105 | 900 | 115 | ◎ |
| Ex. 48 | 900 | 105 | 900 | 115 | ◎ |
| Ex. 49 | 900 | 105 | 900 | 120 | ○ |

◎: Excellent
○: Good
Δ: Acceptable
X: Bad

It is clear from Table 22 that when the average particle diameter of the CGM dispersed in the CGL coating liquid is less than 0.25 μm (Examples 46, 48 and 49), the initial potential of a lighted portion ($V_L$) can be reduced and in addition occurrence of background fouling can be prevented without increasing the potential of a lighted portion even after long repeated use.

Photoreceptor Preparation Example 34

The procedure for preparation of photoreceptor 30 in Photoreceptor Preparation Example 30 was repeated to prepare a photoreceptor 34 except for changing the thickness of the CTL to 22 μm and coating and drying a protective layer coating liquid having the following formula to form a protective layer having a thickness of 3 μm on the CTL.

| Formula of protective layer coating liquid | |
|---|---|
| Polycarbonate (TS2050 from Teijin Chemicals Ltd.) | 10 |
| CTM having the following formula | 7 |

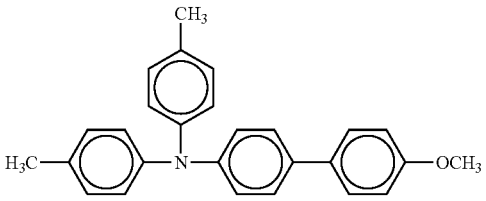

| | |
|---|---|
| Particulate alumina (resistivity of $2.5 \times 10^{12}$ Ω · cm, average primary particle diameter of 0.4 μm) | 4 |
| Cyclohexanone | 500 |
| Tetrahydrofuran | 150 |

Photoreceptor Preparation Example 35

The procedure for preparation of photoreceptor 34 in Photoreceptor Preparation Example 34 was repeated to prepare a photoreceptor 35 except for replacing the particulate alumina with 4 parts of a particulate titanium oxide having a resistivity of $1.5 \times 10^{10}$ Ω·cm, and an average primary particle diameter of 0.5 μm.

Photoreceptor Preparation Example 36

The procedure for preparation of photoreceptor 34 in Photoreceptor Preparation Example 34 was repeated to prepare a photoreceptor 36 except for replacing the particulate alumina with 4 parts of a particulate tin oxide-antimony oxide having a resistivity of $1\times10^6$ Ω·cm, and an average primary particle diameter of 0.4 μm.

Photoreceptor Preparation Example 37

The procedure for preparation of photoreceptor 34 in Photoreceptor Preparation Example 34 was repeated to prepare a photoreceptor 37 except for replacing the protective layer coating liquid with a protective layer coating liquid having the following formula.

| Formula of protective layer coating liquid | |
|---|---|
| Charge transport polymer having the following formula (weight average molecular weight of about 140,000) | 17 |

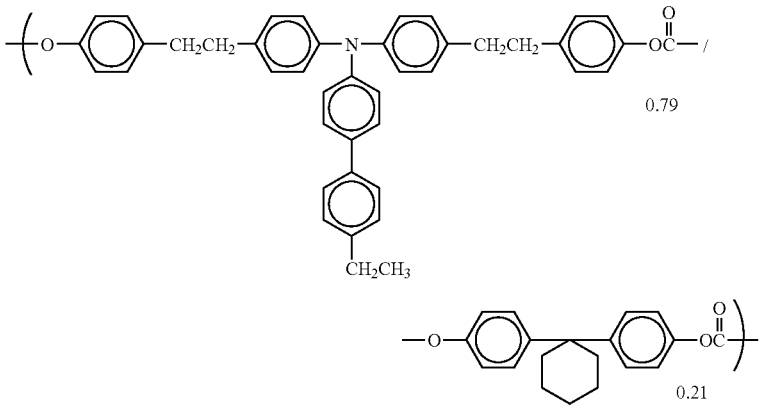

| | |
|---|---|
| Particulate alumina (resistivity of $2.5\times10^{12}$ Ω · cm, average primary particle diameter of 0.4 μm) | 4 |
| Cyclohexanone | 500 |
| Tetrahydrofuran | 150 |

Photoreceptor Preparation Example 38

The procedure for preparation of photoreceptor 34 in Photoreceptor Preparation Example 34 was repeated to prepare a photoreceptor 38 except for replacing the protective layer coating liquid with a protective layer coating liquid having the following formula.

| Formula of protective layer coating liquid | |
|---|---|
| Methyltrimethoxysilane | 100 |
| 3% acetic acid | 20 |
| CTM having the following formula | 35 |

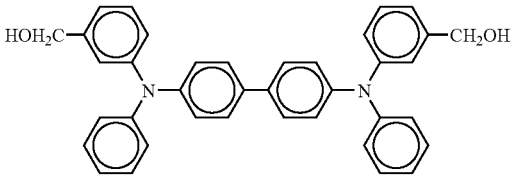

-continued

| Formula of protective layer coating liquid | |
|---|---|
| Antioxidant (SANOL LS2626 from Sankyo Lifetech Co., Ltd.) | 1 |
| Crosslinking agent (dibutyltin acetate) | 1 |
| 2-Propanol | 200 |

Photoreceptor Preparation Example 39

The procedure for preparation of photoreceptor 34 in Photoreceptor Preparation Example 34 was repeated to prepare a photoreceptor 39 except for replacing the protective layer coating liquid with a protective layer coating liquid having the following formula.

| Formula of protective layer coating liquid | |
|---|---|
| Methyltrimethoxysilane | 100 |
| 3% acetic acid | 20 |
| CTM having the following formula | 35 |

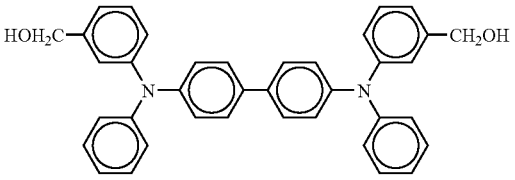

-continued

| Formula of protective layer coating liquid | |
|---|---|
| Particulate alumina (resistivity of $2.5 \times 10^{12}$ Ω · cm, average primary particle diameter of 0.4 μm) | 15 |
| Antioxidant (SANOL LS2626 from Sankyo Lifetech Co., Ltd.) | 1 |
| Polycarboxylic acid (BYK P104 from Byk Chemie) | 0.4 |
| Crosslinking agent (dibutyltin acetate) | 1 |
| 2-Propanol | 200 |

Photoreceptor Preparation Example 40

The procedure for preparation of photoreceptor 34 in Photoreceptor Preparation Example 34 was repeated to prepare a photoreceptor 40 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 10 |
| Monofunctional radical polymerizable monomer having charge transport structure and the following formula (i.e., compound No. 54 mentioned above) | 10 |

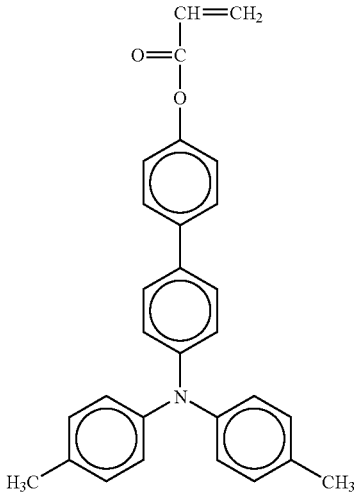

| | |
|---|---|
| Photopolymerization initiator (1-hydroxycyclohexyl-phenyl-ketone, IRGACURE 184 from Ciba Specialty Chemicals) | 1 |
| Tetrahydrofuran | 100 |

The protective layer coating liquid was coated by a spray coating method and the coated liquid was naturally dried for 20 minutes. Then the coated layer was subjected to a photocrosslinking treatment using a metal halide lamp with a power of 160 W/cm to be crosslinked. The crosslinking conditions are as follows.

Light intensity: 500 mW/cm$^2$

Irradiation time: 60 seconds

Photoreceptor Preparation Example 41

The procedure for preparation of photoreceptor 40 in Photoreceptor Preparation Example 40 was repeated to prepare a photoreceptor 41 except for replacing the tri- or poly-functional radical polymerizable monomer with 10 parts of a trifunctional radical polymerizable monomer having no charge transport structure, pentaerythritol tetraacrylate (SR-295 from Sartomer Company Inc., having molecular weight (M) of 352, four functional groups (F) and ratio (M/F) of 88).

Photoreceptor Preparation Example 42

The procedure for preparation of photoreceptor 40 in Photoreceptor Preparation Example 40 was repeated to prepare a photoreceptor 42 except for replacing the tri- or poly-functional radical polymerizable monomer with 10 parts of a bifunctional radical polymerizable monomer having no charge transport structure, 1,6-hexanediol diacrylate (Wako Pure Chemical Industries Ltd., having molecular weight (M) of 226, two functional groups (F) and ratio (M/F) of 113).

Photoreceptor Preparation Example 43

The procedure for preparation of photoreceptor 40 in Photoreceptor Preparation Example 40 was repeated to prepare a photoreceptor 43 except for replacing the tri- or poly-functional radical polymerizable monomer with 10 parts of a hexafunctional radical polymerizable monomer having no charge transport structure, caprolactone-modified dipentaerythritol hexaacrylate (KAYARAD DPCA-120 from Nippon Kayaku Co., Ltd., having molecular weight (M) of 1946, six functional groups (F) and ratio (M/F) of 325).

Photoreceptor Preparation Example 44

The procedure for preparation of photoreceptor 40 in Photoreceptor Preparation Example 40 was repeated to prepare a photoreceptor 44 except for replacing the monofunctional polymerizable monomer having a charge transport structure with 10 parts of a bifunctional radical polymerizable monomer having a charge transport structure, which has the following formula.

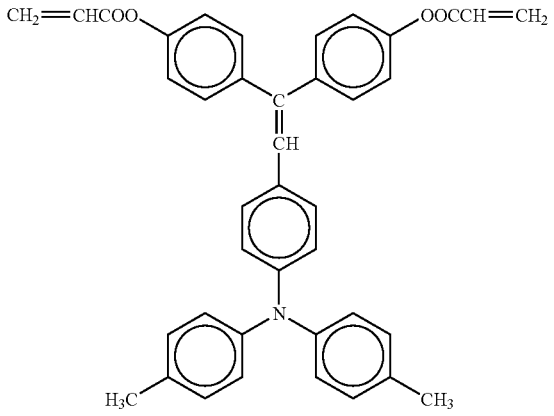

Photoreceptor Preparation Example 45

The procedure for preparation of photoreceptor 40 in Photoreceptor Preparation Example 40 was repeated to prepare a photoreceptor 45 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 6 |
| Monofunctional radical polymerizable monomer having charge transport structure (i.e., compound No. 54 mentioned above) | 14 |

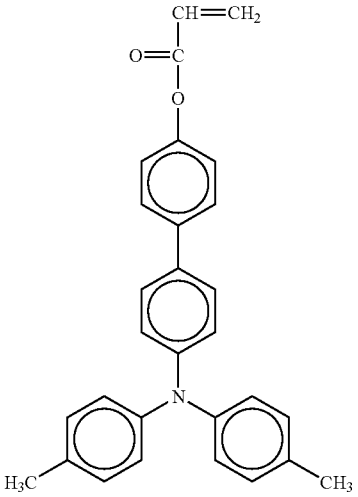

| | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Photoreceptor Preparation Example 46

The procedure for preparation of photoreceptor 40 in Photoreceptor Preparation Example 40 was repeated to prepare a photoreceptor 46 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 14 |

-continued

| Formula of protective layer coating liquid | |
|---|---|
| Monofunctional radical polymerizable monomer having charge transport structure (i.e., compound No. 54 mentioned above) | 6 |

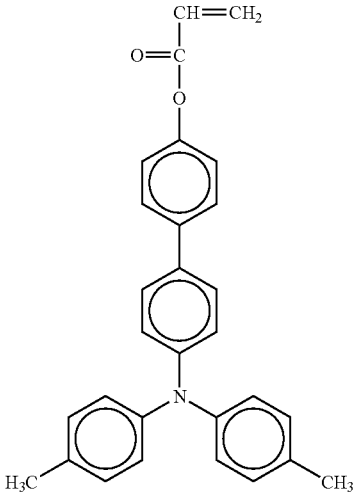

| | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Photoreceptor Preparation Example 47

The procedure for preparation of photoreceptor 40 in Photoreceptor Preparation Example 40 was repeated to prepare a photoreceptor 47 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 2 |
| Monofunctional radical polymerizable monomer having charge transport structure (i.e., compound No. 54 mentioned above) | 18 |

-continued

| Formula of protective layer coating liquid | |
|---|---|
| Photopolymerization initiator | 1 |

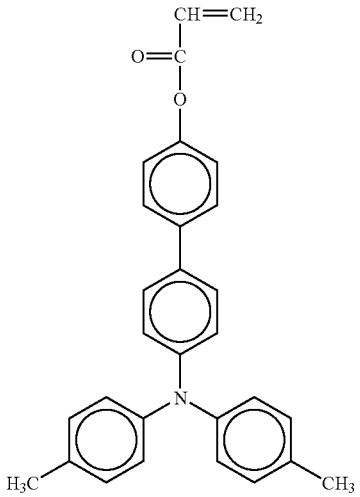

| | |
|---|---|
| (1-hydroxylcycolhexyl-phenyl-ketone, IRGACURE 184 from Ciba Specialty Chemicals) | |
| Tetrahydrofuran | 100 |

Photoreceptor Preparation Example 48

The procedure for preparation of photoreceptor 40 in Photoreceptor Preparation Example 40 was repeated to prepare a photoreceptor 48 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 18 |
| Monofunctional radical polymerizable monomer having charge transport structure (i.e., compound No. 54 mentioned above) | 2 |

-continued

| Formula of protective layer coating liquid | |
|---|---|

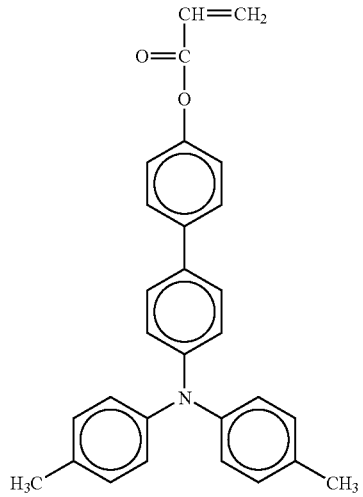

| | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Examples 50 to 65

The procedure for the running test in Example 9 was repeated except for using each of the photoreceptors 30, 34 to 48 and producing 50,000 copies of the original character image. The evaluation results are shown in Table 23.

TABLE 23

| | No. | $V_L$ (−V) Initial potential | After 50,000 copies | BF | CL | DOT | Abrasion Loss (μm) |
|---|---|---|---|---|---|---|---|
| Ex. 50 | 30 | 115 | 130 | Δ | ○ | ◎ | 7.0 |
| Ex. 51 | 34 | 120 | 140 | ◎ | Δ-○ | ○-◎ | 2.0 |
| Ex. 52 | 35 | 125 | 145 | ◎ | Δ-○ | ○ | 1.8 |
| Ex. 53 | 36 | 115 | 135 | ○ | Δ-○ | Δ-○ | 2.0 |
| Ex. 54 | 37 | 125 | 140 | ◎ | Δ-○ | ○ | 1.6 |
| Ex. 55 | 38 | 125 | 140 | ○-◎ | ○ | ○ | 2.5 |
| Ex. 56 | 39 | 130 | 145 | ◎ | Δ-○ | Δ-○ | 1.6 |
| Ex. 57 | 40 | 125 | 140 | ◎ | ◎ | ◎ | 1.4 |
| Ex. 58 | 41 | 125 | 140 | ○ | ◎ | ◎ | 1.2 |
| Ex. 59 | 42 | 125 | 140 | ◎ | Δ-○ | ◎ | 2.6 |
| Ex. 60 | 43 | 125 | 140 | ◎ | ◎ | ◎ | 1.4 |
| Ex. 61 | 44 | 125 | 145 | ◎ | Δ-○ | ◎ | 1.2 |
| Ex. 62 | 45 | 120 | 135 | ○-◎ | ◎ | ◎ | 1.6 |
| Ex. 63 | 46 | 130 | 145 | ◎ | ◎ | ◎ | 1.4 |
| Ex. 64 | 47 | 115 | 130 | ○-◎ | ◎ | ◎ | 1.8 |
| Ex. 65 | 48 | 135 | 145 | ◎ | ◎ | ◎ | 1.4 |

No.: Number of photoreceptor used

It is clear from Table 23 that even when a protective layer is formed, the following knowledge can be obtained.

(1) The residual potential increasing problem can be avoided if light with a wavelength less than 500 nm is used as the discharging light;

(2) The photoreceptors (Examples 51-65) including a protective layer have better abrasion resistance than the photoreceptor (Example 50) including no protective layer;

(3) Among the photoreceptors having a protective layer including a particulate inorganic material (Examples 51-53), the photoreceptors (Examples 51 and 52) having a protective layer including a particulate inorganic material having a resistivity not less than $10^{10}$ Ω·cm have good dot reproducibility even under high temperature and high humidity conditions;

(4) The photoreceptors having a crosslinked protective layer have better abrasion resistance than the photoreceptor having a non-crosslinked protective layer, in particular, the photoreceptors (Examples 57, 58, 60, and 62-65) having a crosslinked protective layer which is prepared using a tri- or poly-functional monomer having no charge transport structure and a monofunctional monomer having a charge transport structure have excellent abrasion resistance; and (5) the photoreceptors (Examples 57, 58, 60, and 62-65) also have excellent cleanability.

Comparative Example 45

The procedure for the running test and the evaluation of the images in Example 60 was repeated except for replacing the laser diode with a laser diode (from Seiwa Electric Mfg. Co., Ltd.) emitting light with a wavelength of 502 nm and a half width of 15 nm. The light intensity was controlled so that the initial potential ($V_L$) of a lighted portion is the same as that in Example 60. The evaluation results are shown in Table 24.

Comparative Example 46

The procedure for the running test and the evaluation of the images in Example 60 was repeated except for replacing the laser diode with a laser diode (from Rohm Co., Ltd.) emitting light with a wavelength of 591 nm and a half width of 15 nm. The light intensity was controlled so that the initial potential ($V_L$) of a lighted portion is the same as that in Example 60. The evaluation results are shown in Table 24.

Comparative Example 47

The procedure for the running test and the evaluation of the images in Example 60 was repeated except for replacing the laser diode with a laser diode (from Rohm Co., Ltd.) emitting light with a wavelength of 630 nm and a half width of 20 nm. The light intensity was controlled so that the initial potential ($V_L$) of a lighted portion is the same as that in Example 60. The evaluation results are shown in Table 24.

Comparative Example 48

The procedure for the running test and the evaluation of the images in Example 60 was repeated except for replacing the laser diode with a fluorescent lamp emitting light having a spectrum illustrated in FIG. 1. The light intensity was controlled so that the initial potential ($V_L$) of a lighted portion is the same as that in Example 60. The evaluation results are shown in Table 24.

TABLE 24

| | Wavelength (λ) of | Potential of lighted portion ($V_L$) (−V) | |
|---|---|---|---|
| | discharging light (nm) | At beginning of running test | After running test |
| Example 60 | 472 | 125 | 140 |
| Comparative | 502 | 125 | 170 |

TABLE 24-continued

| | Wavelength (λ) of | Potential of lighted portion ($V_L$) (−V) | |
|---|---|---|---|
| | discharging light (nm) | At beginning of running test | After running test |
| Example 45 | | | |
| Comparative Example 46 | 591 | 125 | 175 |
| Comparative Example 47 | 630 | 125 | 185 |
| Comparative Example 48 | White light | 125 | 165 |

It is clear from Table 24 that when the wavelength of the discharging light is less than 500 nm (Example 60), increase in the potential ($V_L$) is smaller than in Comparative Examples 45-47 using discharging light with a wavelength of not less than 500 nm. In addition, when the discharging light has light including components with a relatively long wavelength of not less than 500 nm (Comparative Example 48), the effect as produced in Example 21 cannot be produced.

Example 66

The procedure for the running test and the evaluation of the images in Example 25 was repeated except for replacing the photoreceptor 15 with the photoreceptor 43. The evaluation results are shown in Table 25.

Example 67

The procedure for the running test and evaluation in Example 66 was repeated except for replacing the discharging light with a discharging light having a wavelength of 400 nm. The evaluation results are shown in Table 25.

Example 68

The procedure for the running test and evaluation in Example 66 was repeated except for replacing the discharging light with a discharging light having a wavelength of 393 nm. The evaluation results are shown in Table 25.

Example 69

The procedure for the running test and evaluation in Example 66 was repeated except for replacing the discharging light with a discharging light having a wavelength of 390 nm. The evaluation results are shown in Table 25.

Example 70

The procedure for the running test and evaluation in Example 66 was repeated except for replacing the discharging light with a discharging light having a wavelength of 385 nm. The evaluation results are shown in Table 25.

TABLE 25

| | Wavelength (λ) of discharging light (nm) | Transmittance of protective layer against discharging light (%) | Potential of lighted portion ($V_L$) (−V) At beginning of running test | After running test |
|---|---|---|---|---|
| Ex. 66 | 450 | 85 | 125 | 140 |
| Ex. 67 | 400 | 73 | 125 | 140 |
| Ex. 68 | 393 | 50 | 125 | 140 |
| Ex. 69 | 390 | 29 | 125 | 145 |
| Ex. 70 | 385 | 9 | 125 | 145 |

It is clear from Table 25 that when the transmittance of the protective layer against the discharging light is less than about 30%, the discharging effect slightly deteriorates.

In addition, it is found that the halftone images of the chart in FIG. 17 produced in Examples 66 to 68 are normal but the halftone images produced in Examples 69 and 70 include a slight ghost image of the stripe image formed on an upper portion of each copy although the quality of the half tone images is still acceptable. The ghost image in the image produced in Example 70 is relatively noticeable compared with that in Example 69.

Thus, it is discovered that even when light with a wavelength of less than 500 nm is used as the discharging light, a minor side effect is produced if the transmittance of the protective layer against the light is less than 30%.

Photoreceptor Preparation Example 49

The procedure for preparation of photoreceptor 30 in Photoreceptor Preparation Example 30 was repeated to prepare a photoreceptor 49 except for replacing the intermediate layer with a combination of a charge blocking layer with a thickness of 1.0 μm and a moiré preventing layer with a thickness of 3.5 μm located on the charge blocking layer, which were formed by coating the respective coating liquids having the following formulae, followed by drying.

| Formula of charge blocking layer coating liquid | |
|---|---|
| N-methoxymethylated nylon (FINE RESIN FR-101 from Namariichi Co., Ltd.) | 4 |
| Methanol | 70 |
| n-butanol | 30 |

| Formula of moiré preventing layer coating liquid | |
|---|---|
| Titanium oxide (CR-EL from Ishihara Sangyo Kaisha, Ltd., average particle diameter of 0.25 μm) | 126 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 1.5/1, and the weight ratio (A/M) of the alkyd resin (A) to the melamine resin (M) is 6/4.

Photoreceptor Preparation Example 50

The procedure for preparation of photoreceptor 49 in Photoreceptor Preparation Example 49 was repeated to prepare a photoreceptor 50 except for changing the thickness of the charge blocking layer to 0.3 μm.

Photoreceptor Preparation Example 51

The procedure for preparation of photoreceptor 49 in Photoreceptor Preparation Example 49 was repeated to prepare a photoreceptor 51 except for changing the thickness of the charge blocking layer to 1.8 μm.

Photoreceptor Preparation Example 52

The procedure for preparation of photoreceptor 49 in Photoreceptor Preparation Example 49 was repeated to prepare a photoreceptor 52 except for replacing the charge blocking layer coating liquid with a charge blocking layer coating liquid having the following formula.

| Formula of charge blocking layer coating liquid | |
|---|---|
| Alcohol-soluble nylon (AMILAN CM8000 from Toray Industries Inc.) | 4 |
| Methanol | 70 |
| n-butanol | 30 |

Photoreceptor Preparation Example 53

The procedure for preparation of photoreceptor 49 in Photoreceptor Preparation Example 49 was repeated to prepare a photoreceptor 53 except for replacing the moiré preventing layer coating liquid with a moiré preventing layer coating liquid having the following formula.

| Formula of moiré preventing layer coating liquid | |
|---|---|
| Titanium oxide (CR-EL from Ishihara Sangyo Kaisha, Ltd., average particle diameter of 0.25 μm) | 252 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 3/1, and the weight ratio (A/M) of the alkyd resin (A) to the melamine resin (M) is 6/4.

Photoreceptor Preparation Example 54

The procedure for preparation of photoreceptor 49 in Photoreceptor Preparation Example 49 was repeated to prepare a photoreceptor 54 except for replacing the moiré preventing layer coating liquid with a moiré preventing layer coating liquid having the following formula.

| Formula of moiré preventing layer coating liquid | |
|---|---|
| Titanium oxide (CR-EL from Ishihara Sangyo Kaisha, Ltd., average particle diameter of 0.25 μm) | 84 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 1/1, and the weight ratio (A/M) of the alkyd resin (A) to the melamine resin (M) is 6/4.

Examples 71 to 76

The procedure for the running test and evaluation in Example 50 was repeated except for replacing the photoreceptor 30 with each of photoreceptors 49-54. The evaluation results are shown in Table 26.

TABLE 26

| | No. | $V_L$ (−V) Initial | After 50,000 copies | BF | CL | DOT | Abrasion loss (μm) |
|---|---|---|---|---|---|---|---|
| Ex. 50 | 30 | 115 | 130 | Δ | ○ | ◎ | 7.0 |
| Ex. 71 | 49 | 115 | 135 | ◎ | ○ | ◎ | 7.0 |
| Ex. 72 | 50 | 115 | 130 | ○ | ○ | ◎ | 7.0 |
| Ex. 73 | 51 | 120 | 140 | ◎ | ○ | ◎ | 7.0 |
| Ex. 74 | 52 | 125 | 150 | ◎ | ○ | ◎ | 7.0 |
| Ex. 75 | 53 | 115 | 130 | ○ | ○ | ◎ | 7.0 |
| Ex. 76 | 54 | 125 | 140 | ◎ | ○ | ◎ | 7.0 |

It is clear from Table 26 that the photoreceptors have good resistance to background fouling when using a combination of a charge blocking layer and a moiré preventing layer as the intermediate layer.

Example 77

The procedure for the running test and evaluation in Example 44 was repeated except for replacing the light irradiator with a laser diode emitting light of 407 nm from Nichia Corporation. The evaluation results are shown in Table 27.

In addition, a one-dot image having a diameter of 60 μm was produced to be compared with that of Example 44 with a microscope of 150 magnifications.

TABLE 27

| | λ (nm) | At beginning of running test $V_D$ (−V) | At beginning of running test $V_L$ (−V) | After running test $V_D$ (−V) | After running test $V_L$ (−V) |
|---|---|---|---|---|---|
| Ex. 44 | 428 | 900 | 115 | 900 | 125 |
| Ex. 77 | 407 | 900 | 115 | 900 | 120 |

It is clear from Table 27 that when a short wavelength of the irradiating light of 407 nm (Example 77), increase in potential ($V_L$) of the lighted portion is lower than that in Example 44. Further, the one-dot image had an outline clearer than that of Example 44.

Photoreceptor Preparation Example 55

The procedure for preparation of photoreceptor 1 in Photoreceptor Preparation Example 1 was repeated to prepare photoreceptor 55 except for replacing the CGL coating liquid (dispersion 1) with the dispersion 5 and the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |

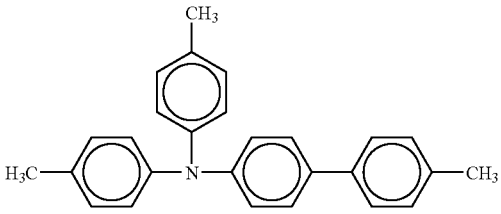

| | |
|---|---|
| Methylene chloride | 80 |

Example 78

The procedure for the running test and evaluation in Example 1 was repeated except that photoreceptor 55 was set in a process cartridge having a structure as illustrated in FIG. 13 and four of the process cartridge were set in a full color image forming apparatus having a structure as illustrated in FIG. 12. In addition, after the running test, a copy of an ISO/JIS-SCID N1 portrait image was produced to evaluate the color reproducibility of the photoreceptor. The evaluation results are shown in Table 28.

Example 79

The procedure for the running test and the evaluation in Example 78 was repeated except for replacing the discharging lamp with a discharging lamp including a LED (from Seiwa Electric Mfg. Co., Ltd.) which emits light with a wavelength of 472 nm and a half width of 15 nm. In this regard, the light intensity of the discharging lamp was controlled so that the potential of the non-lighted portion of the photoreceptor after the discharging process is the same as that in Example 78. The evaluation results are shown in Table 28.

Comparative Example 49

The procedure for the running test and the evaluation in Example 78 was repeated except for replacing the discharging lamp with a discharging lamp including a LED (from Seiwa Electric Mfg. Co., Ltd.) which emits light with a wavelength of 502 nm and a half width of 15 nm. In this regard, the light intensity of the discharging lamp was controlled so that the potential of the non-lighted portion of the photoreceptor after the discharging process is the same as that in Example 78. The evaluation results are shown in Table 28.

Comparative Example 50

The procedure for the running test and the evaluation in Example 78 was repeated except for replacing the discharging lamp with a discharging lamp including a LED (from Rohm Co., Ltd.) which emits light with a wavelength of 591 nm and a half width of 15 nm. In this regard, the light intensity of the discharging lamp was controlled so that the potential of the non-lighted portion of the photoreceptor after the discharging process is the same as that in Example 78. The evaluation results are shown in Table 28.

Comparative Example 51

The procedure for the running test and the evaluation in Example 78 was repeated except for replacing the discharging lamp with a discharging lamp including a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 78. The evaluation results are shown in Table 28.

Comparative Example 52

The procedure for the running test and the evaluation in Example 78 was repeated except for replacing the discharging lamp with a fluorescent lamp which emits light having a spectrum as illustrated in FIG. 1. In this regard, the light intensity of the discharging lamp was controlled so that the potential of the non-lighted portion of the photoreceptor after the discharging process is the same as that in Example 78. The evaluation results are shown in Table 28.

Comparative Example 53

The procedure for the running test and the evaluation in Example 78 was repeated except for replacing the discharging lamp with two discharging lamps including a LED (from Rohm Co., Ltd.) which emits light with a wavelength of 428 nm and a half width of 65 nm, and a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 78. The evaluation results are shown in Table 28.

TABLE 28

| | Wavelength (λ) of | Potential of lighted portion ($V_L$) (−V) | |
|---|---|---|---|
| | discharging light (nm) | At beginning of running test | After running test |
| Example 78 | 428 | 50 | 60 |
| Example 79 | 472 | 50 | 65 |
| Comparative Example 49 | 502 | 50 | 90 |
| Comparative Example 50 | 591 | 50 | 95 |
| Comparative Example 51 | 630 | 50 | 100 |
| Comparative | White light | 50 | 85 |

TABLE 28-continued

| | Wavelength (λ) of | Potential of lighted portion ($V_L$) (−V) | |
|---|---|---|---|
| | discharging light (nm) | At beginning of running test | After running test |
| Example 52 | | | |
| Comparative Example 53 | 428 and 630 | 50 | 90 |

It is clear from Table 28 that when the wavelength of the discharging light is less than 500 nm (Examples 78 and 79), increase in potential ($V_L$) of the lighted portion is lower than that in the cases where the wavelength of the discharging light is not less than 500 nm (Comparative Examples 49-51). In particular, when the wavelength of the discharging light is less than 450 nm (i.e., Example 78), increase in potential ($V_L$) of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 52), such an effect as produced in Examples 78 and 79 cannot be produced. Further, it is found that when a combination of two light sources emitting light with different wavelengths is used (Comparative Example 53), the effect of the light with a relatively short wavelength is reduced.

The image qualities of the color images produced in Examples 78 and 79 were hardly changed before and after the running test. However, the color images produced in Comparative Examples 49-53 after the running test have slightly poor color reproducibility (i.e., the color tones of the color images are changed after the running test).

Photoreceptor Preparation Example 56

The procedure for preparation of photoreceptor 55 in Photoreceptor Preparation Example 55 was repeated to prepare photoreceptor 56 except for replacing the CGL coating liquid (dispersion 5) with the dispersion 6.

Example 80

The procedure for the running test and the evaluation in Example 78 was repeated except for replacing the photoreceptor 55 with the photoreceptor 56. The evaluation results are shown in Table 29.

Example 81

The procedure for the running test and the evaluation in Example 79 was repeated except for replacing the photoreceptor 55 with the photoreceptor 56. The evaluation results are shown in Table 29.

Comparative Example 54

The procedure for the running test and the evaluation in Comparative Example 49 was repeated except for replacing the photoreceptor 55 with the photoreceptor 56. The evaluation results are shown in Table 29.

Comparative Example 55

The procedure for the running test and the evaluation in Comparative Example 50 was repeated except for replacing the photoreceptor 55 with the photoreceptor 56. The evaluation results are shown in Table 29.

Comparative Example 56

The procedure for the running test and the evaluation in Comparative Example 51 was repeated except for replacing the photoreceptor 55 with the photoreceptor 56. The evaluation results are shown in Table 29.

Comparative Example 57

The procedure for the running test and the evaluation in Comparative Example 52 was repeated except for replacing the photoreceptor 55 with the photoreceptor 56. The evaluation results are shown in Table 29.

Comparative Example 58

The procedure for the running test and the evaluation in Comparative Example 53 was repeated except for replacing the photoreceptor 55 with the photoreceptor 56. The evaluation results are shown in Table 29.

TABLE 29

| | Wavelength (λ) of | Potential of lighted portion ($V_L$) (−V) | |
|---|---|---|---|
| | discharging light (nm) | At beginning of running test | After running test |
| Example 80 | 428 | 65 | 75 |
| Example 81 | 472 | 65 | 80 |
| Comparative Example 54 | 502 | 65 | 105 |
| Comparative Example 55 | 591 | 65 | 110 |
| Comparative Example 56 | 630 | 65 | 115 |
| Comparative Example 57 | White light | 65 | 100 |
| Comparative Example 58 | 428 and 630 | 65 | 90 |

It is clear from Table 29 that when the wavelength of the discharging light is less than 500 nm (Examples 80 and 81), increase in potential ($V_L$) of the lighted portion is lower than that in the cases where the wavelength of the discharging light is not less than 500 nm (Comparative Examples 54-56). In particular, when the wavelength of the discharging light is less than 450 nm (i.e., Example 80), increase in potential ($V_L$) of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 57), such an effect as produced in Examples 80 and 81 cannot be produced. Further, it is found that when a combination of two light sources emitting light with different wavelengths is used (Comparative Example 58), the effect of the light with a relatively short wavelength is reduced.

The image qualities of the color images produced in Examples 80 and 81 were hardly changed before and after the running test. However, the color images produced in Comparative Examples 54-58 after the running test have slightly poor color reproducibility (i.e., the color tones of the color images are changed after the running test).

In addition, the residual potential ($V_L$) in Example 78 (shown in Table 28) is lower than that in Example 80. This is because the azo dye which is used for the photoreceptor 55 used in Example 78 which includes an asymmetric coupler component enhances the photosensitivity of the photoreceptor.

Example 82

The procedure for the running test and evaluation in Example 78 was repeated except for replacing the light irradiator with a laser diode emitting light of 407 nm from Nichia Corporation. The evaluation results are shown in Table 30.

In addition, a one-dot image having a diameter of 60 μm was produced to be compared with that of Example 78 with a microscope of 150 magnifications.

TABLE 30

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 78 | 428 | 900 | 50 | 900 | 60 |
| Ex. 82 | 407 | 900 | 50 | 900 | 55 |

It is clear from Table 15 that when a short wavelength of the irradiating light of 407 nm (Example 82), increase in potential ($V_L$) of the lighted portion is lower than that in Example 78. Further, the one-dot image had an outline clearer than that of Example 78.

Photoreceptor Preparation Example 57

The procedure for preparation of photoreceptor 1 in Photoreceptor Preparation Example 1 was repeated to prepare a photoreceptor 57 except for replacing the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |
| 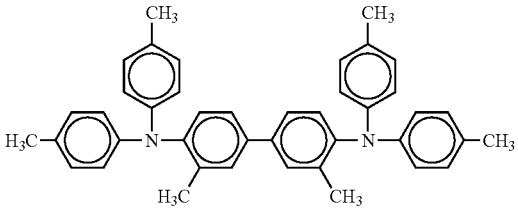 | |
| Methylene chloride | 80 |

Example 83

The procedure for the running test and the evaluation in Example 1 was repeated except for replacing the photoreceptor 1 with the photoreceptor 57. The evaluation results are shown in Table 31.

Example 84

The procedure for the running test and the evaluation in Example 83 was repeated except for replacing the discharging lamp with a discharging lamp including a LED (from Seiwa Electric Mfg. Co., Ltd.) which emits light with a wavelength of 472 nm and a half width of 15 nm. In this regard, the light intensity of the discharging lamp was controlled so that the potential of the non-lighted portion of the photoreceptor after the discharging process is the same as that in Example 83. The evaluation results are shown in Table 31.

Comparative Example 59

The procedure for the running test and the evaluation in Example 83 was repeated except for replacing the discharging lamp with a discharging lamp including a LED (from Seiwa Electric Mfg. Co., Ltd.) which emits light with a wavelength of 502 nm and a half width of 15 nm. In this regard, the light intensity of the discharging lamp was controlled so that the potential of the non-lighted portion of the photoreceptor after the discharging process is the same as that in Example 83. The evaluation results are shown in Table 31.

Comparative Example 60

The procedure for the running test and the evaluation in Example 83 was repeated except for replacing the discharging lamp with a discharging lamp including a LED (from Rohm Co., Ltd.) which emits light with a wavelength of 591 nm and a half width of 15 nm. In this regard, the light intensity of the discharging lamp was controlled so that the potential of the non-lighted portion of the photoreceptor after the discharging process is the same as that in Example 83. The evaluation results are shown in Table 31.

Comparative Example 61

The procedure for the running test and the evaluation in Example 83 was repeated except for replacing the discharging lamp with a discharging lamp including a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 83. The evaluation results are shown in Table 31.

Comparative Example 62

The procedure for the running test and the evaluation in Example 83 was repeated except for replacing the discharging lamp with a fluorescent lamp which emits light having a spectrum as illustrated in FIG. 1. In this regard, the light intensity of the discharging lamp was controlled so that the potential of the non-lighted portion of the photoreceptor after the discharging process is the same as that in Example 83. The evaluation results are shown in Table 31.

Comparative Example 63

The procedure for the running test and the evaluation in Example 83 was repeated except for replacing the discharging lamp with two discharging lamps including a LED (from Rohm Co., Ltd.) which emits light with a wavelength of 428 nm and a half width of 65 nm, and a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 83. The evaluation results are shown in Table 31.

TABLE 31

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 84 | 428 | 900 | 125 | 900 | 135 |
| Ex. 85 | 472 | 900 | 125 | 900 | 145 |
| Comp. Ex. 59 | 502 | 900 | 125 | 900 | 175 |
| Comp. Ex. 60 | 591 | 900 | 125 | 900 | 180 |
| Comp. Ex. 61 | 630 | 900 | 125 | 900 | 185 |
| Comp. Ex. 62 | White light | 900 | 125 | 900 | 170 |
| Comp. Ex. 63 | 428 and 630 | 900 | 125 | 900 | 175 |

It is clear from Table 20 that when the wavelength of the discharging light is less than 500 nm (Examples 84 and 85), increase in potential ($V_L$) of the lighted portion is lower than that in the cases where the wavelength of the discharging light is not less than 500 nm (Comparative Examples 59-61). In particular, when the wavelength of the discharging light is less than 450 nm (i.e., Example 84), increase in potential ($V_L$) of the lighted portion is lower than that of Example 85 in the case where the wavelength of the discharging light is from 450 nm to 500 nm.

In addition, it is also found that when discharging light having a wide wavelength range and including light with a relatively long wavelength is used (i.e., Comparative Example 62), such an effect as produced in Examples 84 and 85 cannot be produced. Further, it is found that when a combination of two light sources emitting light with different wavelengths is used (Comparative Example 63), the effect of the light with a relatively short wavelength is reduced.

Photoreceptor Preparation Example 58

The procedure for preparation of photoreceptor 57 in Photoreceptor Preparation Example 57 was repeated to prepare photoreceptor 58 except for replacing the CGL coating liquid (dispersion 1) with the dispersion 2.

Example 85

The procedure for the running test and the evaluation in Example 83 was repeated except for replacing the photoreceptor 57 with the photoreceptor 58. The evaluation results are shown in Table 32.

Example 86

The procedure for the running test and the evaluation in Example 84 was repeated except for replacing the photoreceptor 57 with the photoreceptor 58. The evaluation results are shown in Table 32.

Comparative Example 64

The procedure for the running test and the evaluation in Comparative Example 59 was repeated except for replacing the photoreceptor 57 with the photoreceptor 58. The evaluation results are shown in Table 32.

Comparative Example 65

The procedure for the running test and the evaluation in Comparative Example 60 was repeated except for replacing the photoreceptor 57 with the photoreceptor 58. The evaluation results are shown in Table 32.

Comparative Example 66

The procedure for the running test and the evaluation in Comparative Example 61 was repeated except for replacing the photoreceptor 57 with the photoreceptor 58. The evaluation results are shown in Table 32.

Comparative Example 67

The procedure for the running test and the evaluation in Comparative Example 62 was repeated except for replacing the photoreceptor 57 with the photoreceptor 58. The evaluation results are shown in Table 32.

Comparative Example 68

The procedure for the running test and the evaluation in Comparative Example 63 was repeated except for replacing the photoreceptor 57 with the photoreceptor 58. The evaluation results are shown in Table 32.

TABLE 32

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 85 | 428 | 900 | 115 | 900 | 125 |
| Ex. 86 | 472 | 900 | 115 | 900 | 135 |
| Comp. Ex. 64 | 502 | 900 | 115 | 900 | 165 |
| Comp. Ex. 65 | 591 | 900 | 115 | 900 | 170 |
| Comp. Ex. 66 | 630 | 900 | 115 | 900 | 175 |
| Comp. Ex. 67 | White light | 900 | 115 | 900 | 160 |
| Comp. Ex. 68 | 428 and 630 | 900 | 115 | 900 | 165 |

It is clear from Table 32 that when the wavelength of the discharging light is less than 500 nm (Examples 85 and 86), increase in potential ($V_L$) of the lighted portion is lower than that in the cases where the wavelength of the discharging light is not less than 500 nm (Comparative Examples 64-66). In particular, when the wavelength of the discharging light is less than 450 nm (i.e., Example 85), increase in potential ($V_L$) of the lighted portion is lower than that of Example 86 in the case where the wavelength of the discharging light is from 450 nm to 500 nm. In addition, it is also found that when discharging light having a wide wavelength range and including light with a relatively long wavelength is used (i.e., Comparative Example 67), such an effect as produced in Examples 85 and 86 cannot be produced. Further, it is found that when a combination of two light sources emitting light with different wavelengths is used (Comparative Example 68), the effect of the light with a relatively short wavelength is reduced.

Photoreceptor Preparation Example 59

The procedure for preparation of photoreceptor 57 in Photoreceptor Preparation Example 57 was repeated to prepare photoreceptor 59 except for replacing the CGL coating liquid (dispersion 1) with the dispersion 3.

Photoreceptor Preparation Example 60

The procedure for preparation of photoreceptor 57 in Photoreceptor Preparation Example 57 was repeated to prepare photoreceptor 60 except for replacing the CGL coating liquid (dispersion 1) with the dispersion 4.

Example 87

The procedure for the running test and the evaluation in Example 83 was repeated except for replacing the photoreceptor 57 with the photoreceptor 59. In addition, after the running test, a copy of a white solid image was produced and observed to determine whether the white solid image has background fouling (i.e., whether the white solid image is soiled with toner particles). The evaluation results are shown in Table 33 together with those of Examples 83 and 85.

Example 88

The procedure for the running test and the evaluation in Example 83 was repeated except for replacing the photoreceptor 57 with the photoreceptor 60. In addition, after the running test, a copy of a white solid image was produced and observed to determine whether the white solid image has background fouling (i.e., whether the white solid image is soiled with toner particles). The evaluation results are shown in Table 33.

The level of background fouling is classified into the following four grades while considering the number and size of black spots formed on the white solid image.

TABLE 33

| | At beginning of running test | | After running test | | Background |
|---|---|---|---|---|---|
| | $V_D$ (−V) | $V_L$ (−V) | $V_D$ (−V) | $V_L$ (−V) | fouling |
| Ex. 83 | 900 | 125 | 900 | 135 | Δ-○ |
| Ex. 85 | 900 | 115 | 900 | 125 | ◎ |
| Ex. 87 | 900 | 115 | 900 | 125 | ◎ |
| Ex. 88 | 900 | 115 | 900 | 130 | ○ |

◎: Excellent

○: Good

Δ: Acceptable

X: Bad

It is clear from Table 33 that when the average particle diameter of the CGM dispersed in the CGL coating liquid is less than 0.25 μm (Examples 85, 87 and 88), the initial potential of a lighted portion ($V_L$) can be reduced and in addition occurrence of background fouling can be prevented without increasing the potential of a lighted portion even after long repeated use.

Photoreceptor Preparation Example 61

The procedure for preparation of photoreceptor 57 in Photoreceptor Preparation Example 57 was repeated to prepare a photoreceptor 61 except for changing the thickness of the CTL to 22 μm and coating and drying a protective layer coating liquid having the following formula to form a protective layer having a thickness of 3 μm on the CTL.

| Formula of protective layer coating liquid | |
|---|---|
| Polycarbonate (TS2050 from Teijin Chemicals Ltd.) | 10 |
| CTM having the following formula | 7 |

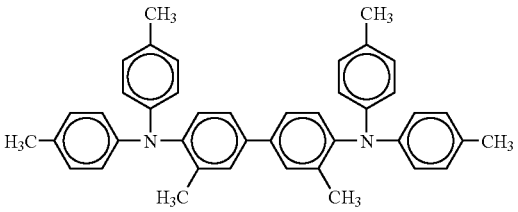

| | |
|---|---|
| Particulate alumina (resistivity of $2.5 \times 10^{12}$ Ω · cm, average primary particle diameter of 0.4 μm) | 4 |
| Cyclohexanone | 500 |
| Tetrahydrofuran | 150 |

Photoreceptor Preparation Example 62

The procedure for preparation of photoreceptor 61 in Photoreceptor Preparation Example 61 was repeated to prepare a photoreceptor 62 except for replacing the particulate alumina with 4 parts of a particulate titanium oxide having a resistivity of $1.5\times10^{10}$ Ω·cm, and an average primary particle diameter of 0.5 μm.

Photoreceptor Preparation Example 63

The procedure for preparation of photoreceptor 61 in Photoreceptor Preparation Example 61 was repeated to prepare a photoreceptor 63 except for replacing the particulate alumina with 4 parts of a particulate tin oxide-antimony oxide having a resistivity of $1\times10^{6}$ Ω·cm, and an average primary particle diameter of 0.4 μm.

Photoreceptor Preparation Example 64

The procedure for preparation of photoreceptor 61 in Photoreceptor Preparation Example 61 was repeated to prepare a photoreceptor 64 except for replacing the protective layer coating liquid with a protective layer coating liquid having the following formula.

| Formula of protective layer coating liquid | |
|---|---|
| Charge transport polymer having the following formula (weight average molecular weight of about 140,000) | 17 |

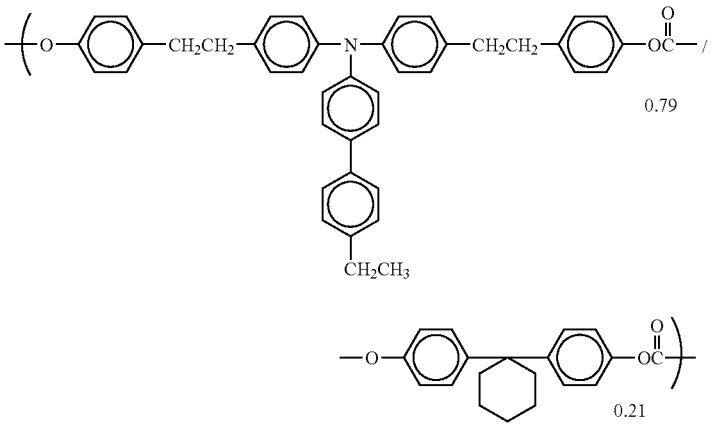

| | |
|---|---|
| Particulate alumina (resistivity of $2.5 \times 10^{12}$ Ω · cm, average primary particle diameter of 0.4 μm) | 4 |
| Cyclohexanone | 500 |
| Tetrahydrofuran | 150 |

Photoreceptor Preparation Example 65

The procedure for preparation of photoreceptor 61 in Photoreceptor Preparation Example 61 was repeated to prepare a photoreceptor 65 except for replacing the protective layer coating liquid with a protective layer coating liquid having the following formula.

| Formula of protective layer coating liquid | |
|---|---|
| Methyltrimethoxysilane | 100 |
| 3% acetic acid | 20 |
| CTM having the following formula | 35 |

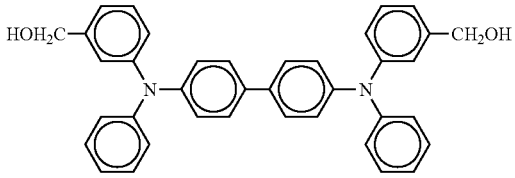

| | |
|---|---|
| Antioxidant (SANOL LS2626 from Sankyo Lifetech Co., Ltd.) | 1 |
| Crosslinking agent (dibutyltin acetate) | 1 |
| 2-Propanol | 200 |

Photoreceptor Preparation Example 66

The procedure for preparation of photoreceptor 61 in Photoreceptor Preparation Example 61 was repeated to prepare a photoreceptor 66 except for replacing the protective layer coating liquid with a protective layer coating liquid having the following formula.

| Formula of protective layer coating liquid | |
|---|---|
| Methyltrimethoxysilane | 100 |
| 3% acetic acid | 20 |
| CTM having the following formula | 35 |

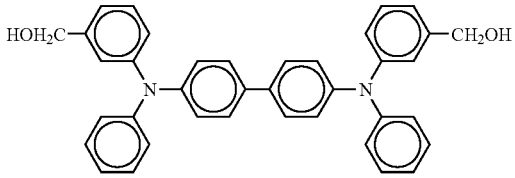

| | |
|---|---|
| Particulate alumina (resistivity of $2.5 \times 10^{12}$ Ω · cm, average primary particle diameter of 0.4 μm) | 15 |
| Antioxidant (SANOL LS2626 from Sankyo Lifetech Co., Ltd.) | 1 |
| Polycarboxylic acid (BYK P104 from Byk Chemie) | 0.4 |
| Crosslinking agent (dibutyltin acetate) | 1 |
| 2-Propanol | 200 |

Photoreceptor Preparation Example 67

The procedure for preparation of photoreceptor 61 in Photoreceptor Preparation Example 61 was repeated to prepare a photoreceptor 67 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 10 |
| Monofunctional radical polymerizable monomer having charge transport structure and the following formula (i.e., compound No. 54 mentioned above) | 10 |

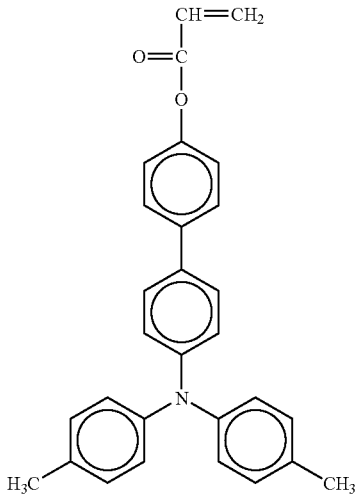

| | |
|---|---|
| Photopolymerization initiator (1-hydroxycycolhexyl-phenyl-ketone, IRGACURE 184 from Ciba Specialty Chemicals) | 1 |
| Tetrahydrofuran | 100 |

The protective layer coating liquid was coated by a spray coating method and the coated liquid was naturally dried for 20 minutes. Then the coated layer was subjected to a photocrosslinking treatment using a metal halide lamp with a power of 160 W/cm to be crosslinked. The crosslinking conditions are as follows.

Light intensity: 500 mW/cm$^2$

Irradiation time: 60 seconds

Photoreceptor Preparation Example 68

The procedure for preparation of photoreceptor 67 in Photoreceptor Preparation Example 67 was repeated to prepare a photoreceptor 68 except for replacing the tri- or poly-functional radical polymerizable monomer with 10 parts of a trifunctional radical polymerizable monomer having no charge transport structure, pentaerythritol tetraacrylate (SR-295 from Sartomer Company Inc., having molecular weight (M) of 352, four functional groups (F) and ratio (M/F) of 88).

Photoreceptor Preparation Example 69

The procedure for preparation of photoreceptor 67 in Photoreceptor Preparation Example 67 was repeated to prepare a photoreceptor 69 except for replacing the tri- or poly-functional radical polymerizable monomer with 10 parts of a bifunctional radical polymerizable monomer having no charge transport structure, 1,6-hexanediol diacrylate (Wako Pure Chemical Industries Ltd., having molecular weight (M) of 226, two functional groups (F) and ratio (M/F) of 113).

Photoreceptor Preparation Example 70

The procedure for preparation of photoreceptor 67 in Photoreceptor Preparation Example 67 was repeated to prepare a photoreceptor 70 except for replacing the tri- or poly-functional radical polymerizable monomer with 10 parts of a hexafunctional radical polymerizable monomer having no charge transport structure, caprolactone-modified dipentaerythritol hexaacrylate (KAYARAD DPCA-120 from Nippon Kayaku Co., Ltd., having molecular weight (M) of 1946, six functional groups (F) and ratio (M/F) of 325).

Photoreceptor Preparation Example 71

The procedure for preparation of photoreceptor 67 in Photoreceptor Preparation Example 67 was repeated to prepare a photoreceptor 71 except for replacing the monofunctional polymerizable monomer having a charge transport structure with 10 parts of a bifunctional radical polymerizable monomer having a charge transport structure, which has the following formula.

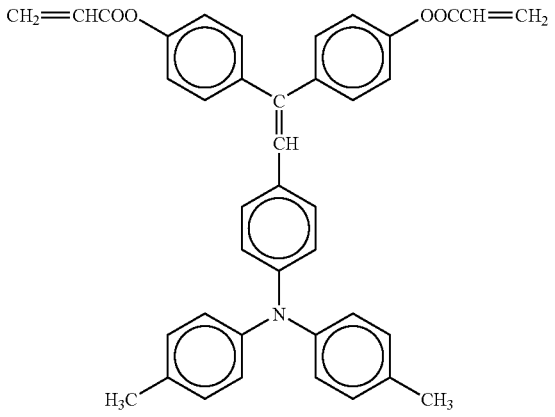

Photoreceptor Preparation Example 72

The procedure for preparation of photoreceptor 67 in Photoreceptor Preparation Example 67 was repeated to prepare a photoreceptor 72 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 6 |

-continued

| Formula of protective layer coating liquid | |
|---|---|
| Monofunctional radical polymerizable monomer having charge transport structure (i.e., compound No. 54 mentioned above) | 14 |

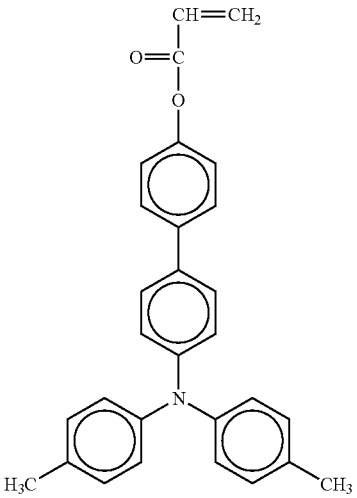

| | |
|---|---|
| Photopolymerization initiator (1-hydroxylcycolhexyl-phenyl-ketone, IRGACURE 184 from Ciba Specialty Chemicals) | 1 |
| Tetrahydrofuran | 100 |

Photoreceptor Preparation Example 73

The procedure for preparation of photoreceptor 67 in Photoreceptor Preparation Example 67 was repeated to prepare a photoreceptor 73 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 14 |
| Monofunctional radical polymerizable monomer having charge transport structure (i.e., compound No. 54 mentioned above) | 6 |

-continued

| Formula of protective layer coating liquid | |
|---|---|
| 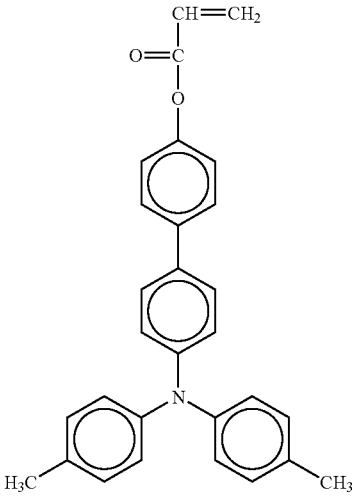 | |
| Photopolymerization initiator (1-hydroxylcycolhexyl-phenyl-ketone, IRGACURE 184 from Ciba Specialty Chemicals) | 1 |
| Tetrahydrofuran | 100 |

Photoreceptor Preparation Example 74

The procedure for preparation of photoreceptor 67 in Photoreceptor Preparation Example 67 was repeated to prepare a photoreceptor 74 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 2 |
| Monofunctional radical polymerizable monomer having charge transport structure (i.e., compound No. 54 mentioned above) | 18 |
| Photopolymerization initiator | 1 |

-continued

| Formula of protective layer coating liquid | |
|---|---|
| 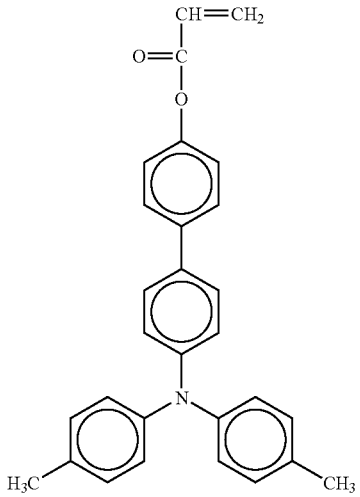 | |
| (1-hydroxylcycolhexyl-phenyl-ketone, IRGACURE 184 from Ciba Specialty Chemicals) | |
| Tetrahydrofuran | 100 |

Photoreceptor Preparation Example 75

The procedure for preparation of photoreceptor 67 in Photoreceptor Preparation Example 67 was repeated to prepare a photoreceptor 75 except for replacing the protective layer coating liquid with a protective layer coating liquid having the following formula.

| Formula of protective layer coating liquid | |
|---|---|
| Tri- or poly-functional radical polymerizable monomer having no charge transport structure (trimethylolpropanetriacrylate, KAYARAD TMPTA from Nippon Kayaku Co., Ltd., having a molecular weight (M) of 296, three functional groups (F) and ratio (M/F) of 99) | 18 |
| Monofunctional radical polymerizable monomer having charge transport structure (i.e., compound No. 54 mentioned above) | 2 |

Examples 89 to 104

The procedure for the running test in Example 9 was repeated except for using each of the photoreceptors 57, 61 to 75 and producing 50,000 copies of the original character image. The evaluation results are shown in Table 34.

TABLE 34

| | No. | $V_L$ (−V) initial potential | $V_L$ (−V) After 50,000 copies | BF | CL | DOT | Abrasion Loss (μm) |
|---|---|---|---|---|---|---|---|
| Ex. 89 | 57 | 125 | 140 | Δ | ○ | ◎ | 7.0 |
| Ex. 90 | 61 | 130 | 150 | ◎ | Δ-○ | ○-◎ | 2.0 |
| Ex. 91 | 62 | 135 | 155 | ◎ | Δ-○ | ○ | 1.8 |

TABLE 34-continued

| | No. | $V_L$ (−V) initial potential | After 50,000 copies | BF | CL | DOT | Abrasion Loss (μm) |
|---|---|---|---|---|---|---|---|
| Ex. 92 | 63 | 125 | 145 | ○ | Δ-○ | Δ-○ | 2.0 |
| Ex. 93 | 64 | 135 | 150 | ◎ | Δ-○ | ○ | 1.6 |
| Ex. 94 | 65 | 135 | 150 | ○-◎ | ○ | ○ | 2.5 |
| Ex. 95 | 66 | 140 | 155 | ◎ | Δ-○ | Δ-○ | 1.6 |
| Ex. 96 | 67 | 135 | 150 | ◎ | ◎ | ◎ | 1.4 |
| Ex. 97 | 68 | 135 | 150 | ○ | ◎ | ◎ | 1.2 |
| Ex. 98 | 69 | 135 | 150 | ◎ | Δ-○ | ◎ | 2.6 |
| Ex. 99 | 70 | 135 | 150 | ◎ | ◎ | ◎ | 1.4 |
| Ex. 100 | 71 | 135 | 155 | ◎ | Δ-○ | ◎ | 1.2 |
| Ex. 101 | 72 | 130 | 145 | ○-◎ | ◎ | ◎ | 1.6 |
| Ex. 102 | 73 | 140 | 155 | ◎ | ◎ | ◎ | 1.4 |
| Ex. 103 | 74 | 125 | 140 | ○-◎ | ◎ | ◎ | 1.8 |
| Ex. 104 | 75 | 145 | 155 | ◎ | ◎ | ◎ | 1.4 |

No.: Number of photoreceptor used

It is clear from Table 34 that even when a protective layer is formed, the following knowledge can be obtained.

(1) The residual potential increasing problem can be avoided if light with a wavelength less than 500 nm is used as the discharging light;

(2) The photoreceptors (Examples 90-104) including a protective layer have better abrasion resistance than the photoreceptor (Example 89) including no protective layer;

(3) Among the photoreceptors having a protective layer including a particulate inorganic material (Examples 90-92), the photoreceptors (Examples 90 and 91) having a protective layer including a particulate inorganic material having a resistivity not less than $10^{10}$ Ω·cm have good dot reproducibility even under high temperature and high humidity conditions;

(4) The photoreceptors having a crosslinked protective layer have better abrasion resistance than the photoreceptor having a non-crosslinked protective layer, in particular, the photoreceptors (Examples 96, 97, 99, and 101-104) having a crosslinked protective layer which is prepared using a tri- or poly-functional monomer having no charge transport structure and a monofunctional monomer having a charge transport structure have excellent abrasion resistance; and (5) the photoreceptors (Examples 96, 97, 99, and 101-104) also have excellent cleanability.

Comparative Example 69

The procedure for the running test and the evaluation of the images in Example 99 was repeated except for replacing the laser diode with a laser diode (from Seiwa Electric Mfg. Co., Ltd.) emitting light with a wavelength of 502 nm and a half width of 15 nm. The light intensity was controlled so that the initial potential ($V_L$) of a lighted portion is the same as that in Example 99. The evaluation results are shown in Table 35.

Comparative Example 70

The procedure for the running test and the evaluation of the images in Example 99 was repeated except for replacing the laser diode with a laser diode (from Rohm Co., Ltd.) emitting light with a wavelength of 591 nm and a half width of 15 nm. The light intensity was controlled so that the initial potential ($V_L$) of a lighted portion is the same as that in Example 99. The evaluation results are shown in Table 35.

Comparative Example 71

The procedure for the running test and the evaluation of the images in Example 99 was repeated except for replacing the laser diode with a laser diode (from Rohm Co., Ltd.) emitting light with a wavelength of 630 nm and a half width of 20 nm. The light intensity was controlled so that the initial potential ($V_L$) of a lighted portion is the same as that in Example 99. The evaluation results are shown in Table 35.

Comparative Example 72

The procedure for the running test and the evaluation of the images in Example 99 was repeated except for replacing the laser diode with a fluorescent lamp emitting light having a spectrum illustrated in FIG. 1. The light intensity was controlled so that the initial potential ($V_L$) of a lighted portion is the same as that in Example 99. The evaluation results are shown in Table 35.

TABLE 35

| | Wavelength (λ) of discharging light (nm) | Potential of lighted portion ($V_L$) (−V) At beginning of running test | After running test |
|---|---|---|---|
| Example 99 | 472 | 135 | 150 |
| Comparative Example 69 | 502 | 135 | 180 |
| Comparative Example 70 | 591 | 135 | 185 |
| Comparative Example 71 | 630 | 135 | 195 |
| Comparative Example 72 | White light | 135 | 175 |

It is clear from Table 35 that when the wavelength of the discharging light is less than 500 nm (Example 99), increase in the potential ($V_L$) is smaller than in Comparative Examples 69-71 using discharging light with a wavelength of not less than 500 nm. In addition, when the discharging light has light including components with a relatively long wavelength of not less than 500 nm (Comparative Example 72), the effect as produced in Example 21 cannot be produced.

Example 105

The procedure for the running test and the evaluation of the images in Example 25 was repeated except for replacing the photoreceptor 15 with the photoreceptor 70. The evaluation results are shown in Table 36.

Example 106

The procedure for the running test and evaluation in Example 105 was repeated except for replacing the discharging light with a discharging light having a wavelength of 400 nm. The evaluation results are shown in Table 36.

Example 107

The procedure for the running test and evaluation in Example 105 was repeated except for replacing the discharging light with a discharging light having a wavelength of 393 nm. The evaluation results are shown in Table 36.

Example 108

The procedure for the running test and evaluation in Example 105 was repeated except for replacing the discharging light with a discharging light having a wavelength of 390 nm. The evaluation results are shown in Table 36.

Example 109

The procedure for the running test and evaluation in Example 105 was repeated except for replacing the discharging light with a discharging light having a wavelength of 385 nm. The evaluation results are shown in Table 36.

TABLE 36

| | Wavelength (λ) of discharging light (nm) | Transmittance of protective layer against discharging light (%) | Potential of lighted portion ($V_L$) (−V) At beginning of running test | After running test |
|---|---|---|---|---|
| Ex. 105 | 450 | 85 | 135 | 150 |
| Ex. 106 | 400 | 73 | 135 | 150 |
| Ex. 107 | 393 | 50 | 135 | 150 |
| Ex. 108 | 390 | 29 | 135 | 155 |
| Ex. 109 | 385 | 9 | 135 | 155 |

It is clear from Table 36 that when the transmittance of the protective layer against the discharging light is less than about 30%, the discharging effect slightly deteriorates.

In addition, it is found that the halftone images of the chart in FIG. 17 produced in Examples 105 to 107 are normal but the halftone images produced in Examples 108 and 109 include a slight ghost image of the stripe image formed on an upper portion of each copy although the quality of the half tone images is still acceptable. The ghost image in the image produced in Example 109 is relatively noticeable compared with that in Example 108.

Thus, it is discovered that even when light with a wavelength of less than 500 nm is used as the discharging light, a minor side effect is produced if the transmittance of the protective layer against the light is less than 30%.

Photoreceptor Preparation Example 76

The procedure for preparation of photoreceptor 57 in Photoreceptor Preparation Example 57 was repeated to prepare a photoreceptor 76 except for replacing the intermediate layer with a combination of a charge blocking layer with a thickness of 1.0 μm and a moiré preventing layer with a thickness of 3.5 μm located on the charge blocking layer, which were formed by coating the respective coating liquids having the following formulae, followed by drying.

| Formula of charge blocking layer coating liquid | |
|---|---|
| N-methoxymethylated nylon (FINE RESIN FR-101 from Namariichi Co., Ltd.) | 4 |
| Methanol | 70 |
| n-butanol | 30 |

| Formula of moiré preventing layer coating liquid | |
|---|---|
| Titanium oxide (CR-EL from Ishihara Sangyo Kaisha, Ltd., average particle diameter of 0.25 μm) | 126 |
| Alkyd resin (BEKKOLITE M6401-50-S from Dainippon Ink & Chemicals, Inc., solid content of 50%) | 33.6 |
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 1.5/1, and the weight ratio (A/M) of the alkyd resin (A) to the melamine resin (M) is 6/4.

Photoreceptor Preparation Example 77

The procedure for preparation of photoreceptor 76 in Photoreceptor Preparation Example 76 was repeated to prepare a photoreceptor 77 except for changing the thickness of the charge blocking layer to 0.3 μm.

Photoreceptor Preparation Example 78

The procedure for preparation of photoreceptor 76 in Photoreceptor Preparation Example 76 was repeated to prepare a photoreceptor 78 except for changing the thickness of the charge blocking layer to 1.8 μm.

Photoreceptor Preparation Example 79

The procedure for preparation of photoreceptor 76 in Photoreceptor Preparation Example 76 was repeated to prepare a photoreceptor 79 except for replacing the charge blocking layer coating liquid with a charge blocking layer coating liquid having the following formula.

| Formula of charge blocking layer coating liquid | |
|---|---|
| Alcohol-soluble nylon (AMILAN CM8000 from Toray Industries Inc.) | 4 |
| Methanol | 70 |
| n-butanol | 30 |

Photoreceptor Preparation Example 80

The procedure for preparation of photoreceptor 76 in Photoreceptor Preparation Example 76 was repeated to prepare a photoreceptor 80 except for replacing the moiré preventing layer coating liquid with a moiré preventing layer coating liquid having the following formula.

| Formula of moiré preventing layer coating liquid | |
|---|---|
| Titanium oxide (CR-EL from Ishihara Sangyo Kaisha, Ltd., average particle diameter of 0.25 μm) | 252 |
| Alkyd resin (BEKKOLITE M6401-50-S from Dainippon Ink & Chemicals, Inc., solid content of 50%) | 33.6 |

-continued

| Formula of moirê preventing layer coating liquid | |
|---|---|
| Melamine resin (SUPER BEKKAMIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 3/1, and the weight ratio (A/M) of the alkyd resin (A) to the melamine resin (M) is 6/4.

Photoreceptor Preparation Example 81

The procedure for preparation of photoreceptor 76 in Photoreceptor Preparation Example 76 was repeated to prepare a photoreceptor 81 except for replacing the moiré preventing layer coating liquid with a moiré preventing layer coating liquid having the following formula.

| Formula of moirê preventing layer coating liquid | |
|---|---|
| Titanium oxide (CR-EL from Ishihara Sangyo Kaisha, Ltd., average particle diameter of 0.25 μm) | 84 |
| Alkyd resin (BEKKOLITE M6401-50-S from Dainippon Ink & Chemicals, Inc., solid content of 50%) | 33.6 |
| Melamine resin (SUPER BEKKANIN L-121-60 from Dainippon Ink & Chemicals, Inc., solid content of 60%) | 18.7 |
| 2-butanone | 100 |

In the moiré preventing layer, the volume ratio (P/R) of the inorganic pigment (P) to the binder resin (R) is 1/1, and the weight ratio (A/M) of the alkyd resin (A) to the melamine resin (M) is 6/4.

Examples 110 to 114

The procedure for the running test and evaluation in Example 89 was repeated except for replacing the photoreceptor 57 with each of photoreceptors 76-81. The evaluation results are shown in Table 37.

TABLE 37

| | | $V_L$ (−V) | | | | | |
|---|---|---|---|---|---|---|---|
| | No. | Initial | After 50,000 copies | BF | CL | DOT | Abrasion Loss (μm) |
| Ex. 89 | 57 | 125 | 140 | Δ | ○ | ◎ | 7.0 |
| Ex. 110 | 76 | 125 | 145 | ◎ | ○ | ◎ | 7.0 |
| Ex. 111 | 77 | 125 | 140 | ○ | ○ | ◎ | 7.0 |
| Ex. 112 | 78 | 130 | 150 | ◎ | ○ | ◎ | 7.0 |
| Ex. 113 | 79 | 135 | 160 | ◎ | ○ | ◎ | 7.0 |
| Ex. 114 | 80 | 125 | 140 | ○ | ○ | ◎ | 7.0 |
| Ex. 115 | 81 | 1135 | 150 | ◎ | ○ | ◎ | 7.0 |

It is clear from Table 37 that the photoreceptors have good resistance to background fouling when using a combination of a charge blocking layer and a moiré preventing layer as the intermediate layer.

Example 115

The procedure for the running test and evaluation in Example 83 was repeated except for replacing the light irradiator with a laser diode emitting light of 407 nm from Nichia Corporation. The evaluation results are shown in Table 38.

In addition, a one-dot image having a diameter of 60 μm was produced to be compared with that of Example 83 with a microscope of 150 magnifications.

TABLE 38

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 83 | 428 | 900 | 115 | 900 | 135 |
| Ex. 115 | 407 | 900 | 115 | 900 | 130 |

It is clear from Table 38 that when a short wavelength of the irradiating light of 407 nm (Example 115), increase in potential ($V_L$) of the lighted portion is lower than that in Example 83. Further, the one-dot image had an outline clearer than that of Example 83.

Photoreceptor Preparation Example 82

The procedure for preparation of photoreceptor 57 in Photoreceptor Preparation Example 57 was repeated to prepare photoreceptor 82 except for replacing the CGL coating liquid (dispersion 1) with the dispersion 5 and the CTL coating liquid with a CTL coating liquid having the following formula.

| Formula of CTL coating liquid | |
|---|---|
| Polycarbonate (TS2050 from Teijin Chemicals Ltd.) | 10 |
| CTM having the following formula | 7 |
| Methylene chloride | 80 |

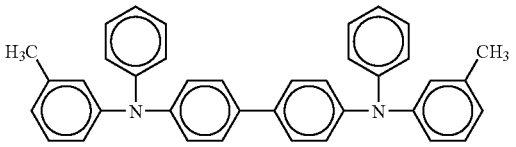

Example 116

The procedure for the running test and evaluation in Example 1 was repeated except that photoreceptor 82 was set in a process cartridge having a structure as illustrated in FIG. 13 and four of the process cartridge were set in a full color image forming apparatus having a structure as illustrated in FIG. 12. In addition, after the running test, a copy of an ISO/JIS-SCID N1 portrait image was produced to evaluate the color reproducibility of the photoreceptor. The evaluation results are shown in Table 39.

Example 117

The procedure for the running test and the evaluation in Example 116 was repeated except for replacing the discharging lamp with a discharging lamp including a LED (from Seiwa Electric Mfg. Co., Ltd.) which emits light with a wavelength of 472 nm and a half width of 15 nm. In this regard, the light intensity of the discharging lamp was controlled so that the potential of the non-lighted portion of the photoreceptor after the discharging process is the same as that in Example 116. The evaluation results are shown in Table 39.

Comparative Example 73

The procedure for the running test and the evaluation in Example 116 was repeated except for replacing the discharging lamp with a discharging lamp including a LED (from Seiwa Electric Mfg. Co., Ltd.) which emits light with a wavelength of 502 nm and a half width of 15 nm. In this regard, the light intensity of the discharging lamp was controlled so that the potential of the non-lighted portion of the photoreceptor after the discharging process is the same as that in Example 116. The evaluation results are shown in Table 39.

Comparative Example 74

The procedure for the running test and the evaluation in Example 116 was repeated except for replacing the discharging lamp with a discharging lamp including a LED (from Rohm Co., Ltd.) which emits light with a wavelength of 591 nm and a half width of 15 nm. In this regard, the light intensity of the discharging lamp was controlled so that the potential of the non-lighted portion of the photoreceptor after the discharging process is the same as that in Example 116. The evaluation results are shown in Table 39.

Comparative Example 75

The procedure for the running test and the evaluation in Example 116 was repeated except for replacing the discharging lamp with a discharging lamp including a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 116. The evaluation results are shown in Table 39.

Comparative Example 76

The procedure for the running test and the evaluation in Example 116 was repeated except for replacing the discharging lamp with a fluorescent lamp which emits light having a spectrum as illustrated in FIG. 1. In this regard, the light intensity of the discharging lamp was controlled so that the potential of the non-lighted portion of the photoreceptor after the discharging process is the same as that in Example 116. The evaluation results are shown in Table 39.

Comparative Example 77

The procedure for the running test and the evaluation in Example 116 was repeated except for replacing the discharging lamp with two discharging lamps including a LED (from Rohm Co., Ltd.) which emits light with a wavelength of 428 nm and a half width of 65 nm, and a LED (from Rohm Co., Ltd.) which emits light with a wavelength of 630 nm and a half width of 20 nm. In this regard, the light intensity of the discharging lamp was controlled so that the potential of the non-lighted portion of the photoreceptor after the discharging process is the same as that in Example 116. The evaluation results are shown in Table 39.

TABLE 39

| | Wavelength (λ) of discharging light (nm) | Potential of lighted portion ($V_L$) (−V) At beginning of running test | After running test |
|---|---|---|---|
| Example 116 | 428 | 55 | 65 |
| Example 117 | 472 | 55 | 70 |
| Comparative Example 73 | 502 | 55 | 95 |
| Comparative Example 74 | 591 | 55 | 100 |
| Comparative Example 75 | 630 | 55 | 105 |
| Comparative Example 76 | White light | 55 | 90 |
| Comparative Example 77 | 428 and 630 | 55 | 95 |

It is clear from Table 39 that when the wavelength of the discharging light is less than 500 nm (Examples 116 and 117), increase in potential ($V_L$) of the lighted portion is lower than that in the cases where the wavelength of the discharging light is not less than 500 nm (Comparative Examples 73-75). In particular, when the wavelength of the discharging light is less than 450 nm (i.e., Example 116), increase in potential ($V_L$) of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 76), such an effect as produced in Examples 116 and 117 cannot be produced. Further, it is found that when a combination of two light sources emitting light with different wavelengths is used (Comparative Example 77), the effect of the light with a relatively short wavelength is reduced.

The image qualities of the color images produced in Examples 116 and 117 were hardly changed before and after the running test. However, the color images produced in Comparative Examples 73-77 after the running test have slightly poor color reproducibility (i.e., the color tones of the color images are changed after the running test).

Photoreceptor Preparation Example 83

The procedure for preparation of photoreceptor 82 in Photoreceptor Preparation Example 82 was repeated to prepare photoreceptor 83 except for replacing the CGL coating liquid (dispersion 5) with the dispersion 6.

Example 118

The procedure for the running test and the evaluation in Example 116 was repeated except for replacing the photoreceptor 82 with the photoreceptor 83. The evaluation results are shown in Table 40.

Example 119

The procedure for the running test and the evaluation in Example 117 was repeated except for replacing the photoreceptor 82 with the photoreceptor 83. The evaluation results are shown in Table 40.

Comparative Example 78

The procedure for the running test and the evaluation in Comparative Example 73 was repeated except for replacing the photoreceptor 82 with the photoreceptor 83. The evaluation results are shown in Table 40.

Comparative Example 79

The procedure for the running test and the evaluation in Comparative Example 74 was repeated except for replacing the photoreceptor 82 with the photoreceptor 83. The evaluation results are shown in Table 40.

Comparative Example 80

The procedure for the running test and the evaluation in Comparative Example 75 was repeated except for replacing the photoreceptor 82 with the photoreceptor 83. The evaluation results are shown in Table 40.

Comparative Example 81

The procedure for the running test and the evaluation in Comparative Example 76 was repeated except for replacing the photoreceptor 82 with the photoreceptor 83. The evaluation results are shown in Table 40.

Comparative Example 82

The procedure for the running test and the evaluation in Comparative Example 77 was repeated except for replacing the photoreceptor 82 with the photoreceptor 83. The evaluation results are shown in Table 40.

TABLE 40

| | Wavelength (λ) of discharging light (nm) | Potential of lighted portion ($V_L$) (−V) At beginning of running test | After running test |
|---|---|---|---|
| Example 118 | 428 | 70 | 80 |
| Example 119 | 472 | 70 | 85 |
| Comparative Example 78 | 502 | 70 | 110 |
| Comparative Example 79 | 591 | 70 | 115 |
| Comparative Example 80 | 630 | 70 | 120 |
| Comparative Example 81 | White light | 70 | 105 |
| Comparative Example 82 | 428 and 630 | 70 | 95 |

It is clear from Table 40 that when the wavelength of the discharging light is less than 500 nm (Examples 118 and 119), increase in potential ($V_L$) of the lighted portion is lower than that in the cases where the wavelength of the discharging light is not less than 500 nm (Comparative Examples 78-80). In particular, when the wavelength of the discharging light is less than 450 nm (i.e., Example 118), increase in potential ($V_L$) Of the lighted portion is lower than that in the case where the wavelength of the discharging light is from 450 nm to 500 nm.

In addition, it is also found that when discharging light having a wide wavelength range and including light with a relatively long wavelength is used (i.e., Comparative Example 81), such an effect as produced in Examples 118 and 119 cannot be produced. Further, it is found that when a combination of two light sources emitting light with different wavelengths is used (Comparative Example 82), the effect of the light with a relatively short wavelength is reduced.

The image qualities of the color images produced in Examples 118 and 119 were hardly changed before and after the running test. However, the color images produced in Comparative Examples 78-82 after the running test have slightly poor color reproducibility (i.e., the color tones of the color images are changed after the running test).

In addition, the residual potential ($V_L$) in Example 116 (shown in Table 39) is lower than that in Example 118. This is because the azo dye which is used for the photoreceptor 82 used in Example 116 which includes an asymmetric coupler component enhances the photosensitivity of the photoreceptor.

Example 120

The procedure for the running test and evaluation in Example 116 was repeated except for replacing the light irradiator with a laser diode emitting light of 407 nm from Nichia Corporation. The evaluation results are shown in Table 41.

In addition, a one-dot image having a diameter of 60 μm was produced to be compared with that of Example 116 with a microscope of 150 magnifications.

TABLE 41

| | λ | At beginning of running test | | After running test | |
|---|---|---|---|---|---|
| | (nm) | $V_D$ (−V) | $V_L$ (−V) | $V_D$ (−V) | $V_L$ (−V) |
| Ex. 116 | 428 | 900 | 50 | 900 | 60 |
| Ex. 120 | 407 | 900 | 50 | 900 | 55 |

It is clear from Table 41 that when a short wavelength of the irradiating light of 407 nm (Example 120), increase in potential ($V_L$) of the lighted portion is lower than that in Example 116. Further, the one-dot image had an outline clearer than that of Example 116.

This application claims priority and contains subject matter related to Japanese Patent Applications Nos. 2005-215640, 2005-188047 and 2005-184380, filed on Jul. 26, 2005, Jun. 28, 2005 and Jun. 24, 2005 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an electrostatic latent image bearer configured to bear an electrostatic latent image;

an electrostatic latent image former having a laser diode to form the electrostatic latent image on a surface of the image bearer, wherein the laser diode has a wavelength of 780 nm;

an image developer configured to develop the electrostatic latent image with a developer comprising a toner to form a toner image on the surface of the image bearer;

a transferer configured to transfer the toner image onto a receiving material;

a fixer configured to fix the toner image to the receiving material; and a discharger having an LED as a discharging light to discharge charges remaining on the image bearer, wherein the LED has a peak wavelength of less than 500 nm, wherein the electrostatic latent image bearer comprises:

a substrate; and a photosensitive layer located overlying the substrate, which comprises a charge generation layer comprising an organic charge generation material, and a charge transport layer comprising at least one of charge transport materials having the following formulae (I) to (IV):

(I)

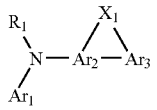

wherein each of $Ar_1$, $Ar_2$ and $Ar_3$ represents an aromatic ring group optionally having a substituent; $R_1$ represents an alkyl group optionally having a substituent, an aralkyl group optionally having a substituent, a vinyl group optionally having a substituent or an aromatic ring group optionally having a substituent; $X_1$ represents a bivalent organic group; and $Ar_1$ and $R_1$ optionally form a ring in combination, (II)

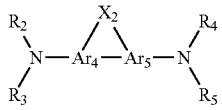

wherein each of $Ar_4$ and $Ar_5$ represents an aromatic ring group optionally having a substituent; each of $R_2$, $R_3$, $R_4$ and $R_5$ represents an alkyl group optionally having a substituent, an aralkyl group optionally having a substituent, a vinyl group optionally having a substituent or an aromatic ring group optionally having a substituent, provided that at least two of them are aromatic ring groups each optionally having a substituent; $X_2$ represents a bivalent organic group; and $R_2$ and $R_3$, and $R_4$ and $R_5$ optionally form a ring in combination, (III)

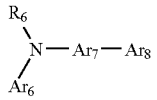

wherein each of $Ar_6$, $Ar_7$ and $Ar_8$ represents an aromatic ring group optionally having a substituent; $R_6$ represents an alkyl group optionally having a substituent, an aralkyl group optionally having a substituent, a vinyl group optionally having a substituent or an aromatic ring group optionally having a substituent; $X_1$ represents a bivalent organic group; and $Ar_6$ and $R_6$ optionally form a ring in combination, and (IV)

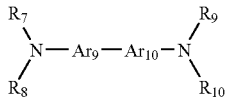

wherein each of $Ar_9$ and $Ar_{10}$ represents an aromatic ring group optionally having a substituent; each of $R_7$, $R_8$, $R_9$ and $R_{10}$ represents an alkyl group optionally having a substituent, an aralkyl group optionally having a substituent, a vinyl group optionally having a substituent or an aromatic ring group optionally having a substituent, provided that at least two of them are aromatic ring groups each optionally having a substituent; and $R_7$ and $R_8$, and $R_9$ and $R_{10}$ optionally form a ring in combination.

2. The image forming apparatus of claim 1, wherein the organic charge generation material is an azo pigment having the following formula (V):

(V)

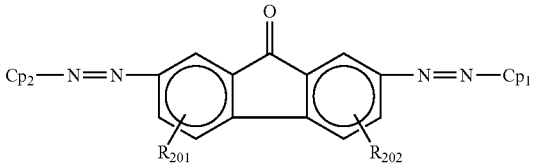

wherein $Cp_1$ and $Cp_2$ represent coupler residues, which may be the same or different from each other having the following formula (VI):

(VI)

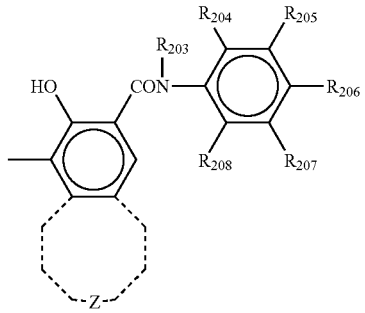

wherein $R_{203}$ represents an alkyl group or an aryl group; $R_{204}$, $R_{205}$, $R_{206}$, $R_{207}$ and $R_{208}$ independently represent a halogen atom, a nitro group, a cyano group, a fluorine atom, a chlorine atom, an iodine atom, an alkyl group, a methyl group, an ethyl group, an alkoxy group, an ethoxy group, a dialkylamino group and a hydroxyl group; Z represents atoms which are required to form a substituted or an unsubstituted aromatic carbon ring, or a substituted or an unsubstituted aromatic; and $R_{201}$ and $R_{202}$ independently represent a hydrogen atom, a halogen atom, an alkyl group, an alkoxy group and a cyano group.

3. The image forming apparatus of claim 2, wherein $Cp_1$ and $Cp_2$ are different from each other.

4. The image forming apparatus of claim 1, wherein the organic charge generation material is a titanylphthalocyanine crystal having an X-ray diffraction spectrum of CuKα such that a maximum peak is observed at a Bragg (2θ) angle of 27.2±0.2°, a lowest angle peak at an angle of 7.3±0.2°, and a main peak at each of Bragg (2θ) angles of 9.4±0.2°, 9.6±0.2°, and 24.0±0.2°, wherein no peak is observed between the peaks of 7.3°±0.2° and 9.4°±0.2° and at an angle of 26.3±0.2°.

5. The image forming apparatus of claim 1, wherein the photosensitive layer further comprises a protective layer overlying the charge transport layer.

6. The image forming apparatus of claim 5, wherein the transmittance of the discharging light through the protective layer is not less than 30%.

7. The image forming apparatus of claim 5, wherein the protective layer comprises at least one of an inorganic pigment and a metal oxide, both having a resistivity not less than $10^{10}$ Ω·cm.

8. The image forming apparatus of claim 5, wherein the protective layer comprises a crosslinked polymer having a unit obtained from a radical polymerizable monomer having at least three functional groups and no charge transport structure, and a unit obtained from a monofunctional radical polymerizable monomer having a charge transport structure.

9. The image forming apparatus of claim 8, wherein the unit obtained from a monofunctional radical polymerizable monomer having a charge transport structure is at least one of compounds having the following formula (VII) or (VIII):

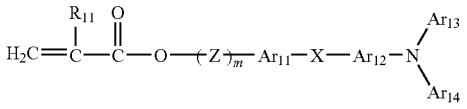

(VIII)

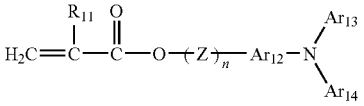

wherein $R_{11}$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR_{12}$ group (wherein $R_{12}$ represents a hydrogen atom, a substituted or unsubstituted alkyl group, a substituted or unsubstituted aralkyl group and a substituted or unsubstituted aryl group), a halogenated carbonyl group or a —$CONR_{13}R_{14}$ (wherein each of $R_{13}$ and $R_{14}$ represents a hydrogen atom, a substituted or unsubstituted alkyl group, a substituted or unsubstituted aralkyl group and a substituted or unsubstituted aryl group); each of $Ar_{11}$ and $Ar_{12}$ represents a substituted or unsubstituted arylene group; each of $Ar_{13}$ and $Ar_{14}$ represents a substituted or unsubstituted arylene group; X represents a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxycarbonyl group; each of m and n is 0 or an integer of from 1 to 3.

10. The image forming apparatus of claim 8, wherein the unit obtained from a monofunctional radical polymerizable monomer having a charge transport structure is at least one of compounds having the following formula (IX):

(IX)

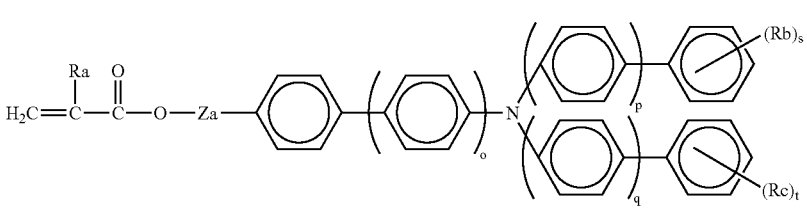

wherein each of o, p and q is 0 or 1; Ra represents a hydrogen atom, or a methyl group; each of Rb and Rc represents an alkyl group having from 1 to 6 carbon atoms, wherein each of Rb and Rc can include plural groups which are the same as or different from each other; each of and t is 0, 1, 2 or 3; and Za represents a methylene group, an ethylene group or a group having one of the following formulae:

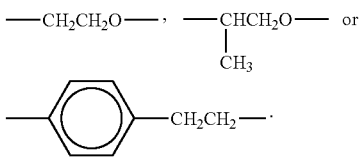

11. The image forming apparatus of claim 8, wherein the crosslinked polymer is crosslinked with heat or light.

12. The image forming apparatus of claim 1, wherein the electrostatic latent image bearer further comprises an intermediate layer between the substrate and the charge generation layer, wherein the intermediate layer includes a charge blocking layer and a moire preventing layer.

13. The image forming apparatus of claim 12, wherein the charge blocking layer includes an insulating material and has a thickness of less than 2.0 μm and not less than 0.3 μm.

14. The image forming apparatus of claim 12, wherein the moire preventing layer includes an inorganic pigment and a binder resin, wherein a volume ratio of the inorganic pigment to the binder resin is from 1/1 to 3/1.

15. The image forming apparatus according to claim 1, further comprising a plurality of image forming units each including the electrostatic latent image bearer, the electrostatic latent image former, the image developer, the transferer and the discharger.

16. The image forming apparatus of claim 1, further comprising a process cartridge which comprises:

the electrostatic latent image bearer; and at least one of the image developer, the discharger and a cleaner configured to clean the surface of the electrostatic latent image bearer, wherein the process cartridge is detachably from the image forming apparatus.

17. The image forming apparatus of claim 1, wherein the photosensitive layer further comprises a charge transport layer overlaying the charge generation layer.

18. The image forming apparatus of claim 1, wherein the LED of the discharger has a peak wavelength of 428 to 472 nm.

* * * * *